US012108853B2

(12) United States Patent
Nichols et al.

(10) Patent No.: US 12,108,853 B2
(45) Date of Patent: Oct. 8, 2024

(54) LUGGAGE SYSTEM

(71) Applicant: YETI Coolers, LLC, Austin, TX (US)

(72) Inventors: Steve Charles Nichols, Austin, TX (US); Andy Bondhus, Austin, TX (US); Michael Christopher Cieszko, Austin, TX (US); Nicholas James Lombardi, Austin, TX (US); Dustin Bullock, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 138 days.

(21) Appl. No.: 16/839,311

(22) Filed: Apr. 3, 2020

(65) Prior Publication Data

US 2020/0229568 A1 Jul. 23, 2020

Related U.S. Application Data

(63) Continuation-in-part of application No. 16/735,013, filed on Jan. 6, 2020, now Pat. No. 11,517,086.
(Continued)

(51) Int. Cl.
*A45C 13/10* (2006.01)
*A45C 5/03* (2006.01)
(Continued)

(52) U.S. Cl.
CPC ..... *A45C 13/1084* (2013.01); *A45C 5/03* (2013.01); *A45C 5/14* (2013.01); *A45C 13/005* (2013.01);
(Continued)

(58) Field of Classification Search
CPC ..... A45C 13/1084; A45C 7/0031; A45C 2013/267; A45C 13/005; A45C 13/262; A45C 2005/037
(Continued)

(56) References Cited

U.S. PATENT DOCUMENTS 674,820 A 5/1901 Wilhite
1,008,041 A 11/1911 Leonard
(Continued)

FOREIGN PATENT DOCUMENTS

BE 1013040 A3 8/2001
BE 1016429 A3 10/2006
(Continued)

OTHER PUBLICATIONS

Jul. 6, 2020—(WO) International Search Report & Written Opinion—PCT/US2020/012404.
(Continued)

*Primary Examiner* — Don M Anderson
*Assistant Examiner* — Jessica Kavini Tamil
(74) *Attorney, Agent, or Firm* — Banner & Witcoff, Ltd.

(57) ABSTRACT

A suitcase having a base and a lid where the lid may be rotatable about a hinge from a closed configuration to an open configuration and may be secured, via one or more latching assemblies is disclosed. The lid may comprise an upper shell, and the base may comprise a lower shell. The upper shell and the lower shell may be seamlessly formed to create a water resistant and/or waterproof suitcase. The suitcase may have an extendable trolley handle assembly that is externally attached to the base of the suitcase using a plurality of mounting clips. The trolley handle assembly may comprise a pair of extrusion assemblies that are connected to the base of the suitcase and connected to each other by a grip. The suitcase may also have a removably secured interior liner.

21 Claims, 56 Drawing Sheets

Related U.S. Application Data

(60) Provisional application No. 62/830,203, filed on Apr. 5, 2019, provisional application No. 62/788,886, filed on Jan. 6, 2019, provisional application No. 62/788,888, filed on Jan. 6, 2019.

(51) Int. Cl.
*A45C 5/14* (2006.01)
*A45C 13/00* (2006.01)
*A45C 13/26* (2006.01)

(52) U.S. Cl.
CPC ..... *A45C 13/262* (2013.01); *A45C 2005/037* (2013.01); *A45C 2013/267* (2013.01)

(58) Field of Classification Search
USPC ..... 190/115
See application file for complete search history.

(56) References Cited

U.S. PATENT DOCUMENTS 1,056,648 A 3/1913 Earley
2,028,339 A 1/1936 Levine et al.
2,101,337 A 12/1937 Komenak
2,109,928 A 3/1938 Passalaqua
2,183,121 A 12/1939 Levine
2,439,660 A 4/1948 Keil
2,455,069 A 11/1948 Launder
2,472,491 A 6/1949 Quinton
2,510,643 A 6/1950 Long
2,565,939 A 8/1951 Wriston
2,574,089 A 11/1951 Cochran
2,577,951 A 12/1951 Cortsen
2,581,417 A 1/1952 Jones
2,604,961 A 7/1952 Device
2,647,653 A 8/1953 Dube
2,717,093 A 9/1955 Mautner
2,747,732 A 5/1956 Fischer
2,803,956 A 8/1957 Womer
2,874,401 A 2/1959 Kotkins
2,912,080 A 11/1959 Ikelheimer
2,931,205 A 4/1960 Schmitz
2,936,189 A 5/1960 Pearson
3,009,193 A 11/1961 Lifton
3,057,636 A 10/1962 D'Ettorre
3,141,680 A 7/1964 McCord
3,191,244 A 6/1965 Burke
3,202,310 A 8/1965 Tibbets
3,225,983 A 12/1965 Majka
3,250,558 A 5/1966 McClintock
3,259,412 A 7/1966 Wheeler
3,416,701 A 12/1968 Kramer et al.
3,432,025 A 3/1969 Luhe
3,464,579 A 9/1969 Asenbauer
3,519,298 A 7/1970 Gley
3,565,305 A 2/1971 Belokin, Jr.
3,642,168 A 2/1972 Wiley, Jr. et al.
3,656,650 A 4/1972 Frater
3,661,410 A 5/1972 Larson et al.
3,688,942 A 9/1972 Mitchell et al.
3,690,708 A 9/1972 Worley et al.
3,741,433 A 6/1973 Bentley et al.
3,831,224 A 8/1974 MacMaster et al.
3,847,423 A 11/1974 Gley
3,861,504 A 1/1975 McGraw
3,882,914 A 5/1975 Strutz
3,886,625 A 6/1975 Rollband
3,902,628 A 9/1975 Schurman
3,915,362 A 10/1975 Hart
3,917,038 A 11/1975 Foge et al.
3,933,269 A 1/1976 Mastrovito
3,955,656 A 5/1976 Kashinski
3,987,829 A 10/1976 Leone
3,991,921 A 11/1976 Hirsch
4,094,392 A 6/1978 Gregg et al.
4,095,711 A 6/1978 Conley
4,116,479 A 9/1978 Poe
4,143,442 A 3/1979 Harlang
4,153,178 A 5/1979 Weavers
4,184,705 A 1/1980 Little
D256,630 S 9/1980 Maney
D257,218 S 10/1980 Eriksson
4,249,760 A 2/1981 Conley
4,254,850 A 3/1981 Knowles
4,273,223 A 6/1981 Tomlinson
4,343,412 A 8/1982 Wilcox et al.
4,351,165 A 9/1982 Gottsegen et al.
4,446,705 A 5/1984 Loucks
4,465,189 A 8/1984 Molzan
4,476,988 A 10/1984 Tanner
4,509,622 A 4/1985 Morszeck
4,515,421 A 5/1985 Steffes
4,516,686 A 5/1985 Chaussepied
4,522,312 A 6/1985 Rathgeber et al.
4,523,692 A 6/1985 Lemkin
4,550,813 A 11/1985 Browning
4,561,526 A 12/1985 Winter et al.
4,573,202 A 2/1986 Lee
4,575,109 A 3/1986 Cowdery
D283,666 S 5/1986 Holzkopf
4,592,482 A 6/1986 Seager
4,615,464 A 10/1986 Byrns
4,662,188 A 5/1987 Hullihan
4,673,207 A 6/1987 Reynolds et al.
D290,908 S 7/1987 Thomas
4,706,344 A 11/1987 Tanaka et al.
4,707,011 A 11/1987 McKim, Jr.
4,712,657 A 12/1987 Myers et al.
4,746,008 A 5/1988 Heverly et al.
4,768,815 A 9/1988 Harmon
4,775,072 A 10/1988 Lundblade et al.
4,792,024 A 12/1988 Morton et al.
4,802,344 A 2/1989 Livingston et al.
4,805,272 A 2/1989 Yamaguchi
4,826,060 A 5/1989 Hollingsworth
4,858,444 A 8/1989 Scott
4,873,841 A 10/1989 Bradshaw et al.
4,899,904 A 2/1990 Dooley et al.
4,904,007 A 2/1990 Woodruff
4,917,261 A 4/1990 Borst
4,928,800 A 5/1990 Green et al.
4,930,649 A 6/1990 Moser
4,975,073 A 12/1990 Weisman
4,982,863 A 1/1991 Skillius
5,011,013 A 4/1991 Meisner et al.
5,011,020 A 4/1991 Stevens et al.
5,014,830 A 5/1991 Seynhaeve
5,024,471 A 6/1991 Kahl et al.
5,040,834 A 8/1991 Kahl et al.
5,044,513 A 9/1991 Van Berne
5,062,557 A 11/1991 Mahvi et al.
5,075,925 A 12/1991 Maloney
5,080,250 A 1/1992 Dickinson et al.
5,096,030 A 3/1992 Espinosa et al.
5,101,541 A 4/1992 Watanabe
5,105,920 A 4/1992 Grebenstein
5,111,920 A 5/1992 Castelli et al.
D327,427 S 6/1992 McCooey
5,117,952 A 6/1992 Suh
D328,186 S 7/1992 Hanke
5,139,294 A 8/1992 Ward et al.
D329,135 S 9/1992 Embree
5,153,561 A 10/1992 Johnson
5,165,583 A 11/1992 Kouwenberg
5,167,433 A 12/1992 Ryan
5,169,018 A 12/1992 Fiore
D333,775 S 3/1993 Krape
D334,870 S 4/1993 Griffin
D335,030 S 4/1993 Alfonso
5,205,413 A 4/1993 Cautereels et al.
5,213,381 A 5/1993 Anderson
5,216,905 A 6/1993 Sersch et al.
5,235,830 A 8/1993 Benge
D340,167 S 10/1993 Kahl

(56) References Cited

U.S. PATENT DOCUMENTS

D342,609 S 12/1993 Brightbill
5,269,157 A 12/1993 Ciminelli et al.
5,282,706 A 2/1994 Anthony et al.
5,295,369 A 3/1994 Garcia
D347,114 S 5/1994 Tengvall
5,313,817 A 5/1994 Meinders
D347,971 S 6/1994 Krugman
D348,343 S 6/1994 Lang-Ree et al.
5,319,937 A 6/1994 Fritsch et al.
5,322,178 A 6/1994 Foos
5,335,451 A 8/1994 Druzynski
D351,533 S 10/1994 Lynam, Jr.
D351,726 S 10/1994 Lin
5,353,946 A 10/1994 Behrend
5,358,082 A 10/1994 Armstrong, IV
D353,265 S 12/1994 Newby, Sr.
5,373,708 A 12/1994 Dumoulin, Jr.
D355,568 S 2/1995 Paulin et al.
5,390,811 A 2/1995 Ogino et al.
5,398,807 A 3/1995 Plath
5,402,557 A 4/1995 Dalen
D358,765 S 5/1995 Dickinson et al.
5,419,432 A 5/1995 Ingram
5,423,644 A 6/1995 First, Sr.
5,427,308 A 6/1995 Swift et al.
D359,836 S 7/1995 Shuler
5,431,263 A 7/1995 Nordstrom
5,435,256 A 7/1995 Svehaug
D361,664 S 8/1995 Brown
D361,888 S 9/1995 Kahl et al.
5,454,477 A 10/1995 Bomhorst et al.
D364,426 S 11/1995 Bucaccio
5,465,985 A 11/1995 Devan et al.
5,474,162 A 12/1995 Shyr et al.
5,478,097 A 12/1995 Forma
D367,360 S 2/1996 Wolff
D368,161 S 3/1996 Miller
D369,342 S 4/1996 Williams
D369,695 S 5/1996 Imotani
5,518,139 A 5/1996 Trower et al.
5,519,919 A 5/1996 Lee
D370,619 S 6/1996 Hall et al.
D371,051 S 6/1996 Melk
D371,052 S 6/1996 Melk
5,524,737 A 6/1996 Wang
5,526,953 A 6/1996 Chieng
D371,724 S 7/1996 Melk
D371,942 S 7/1996 Lippincott et al.
5,533,231 A 7/1996 Bai
D373,514 S 9/1996 Melk
D373,515 S 9/1996 Melk
D374,772 S 10/1996 Hotaling et al.
5,564,805 A 10/1996 Dickinson
5,568,848 A 10/1996 Liang
5,570,915 A 11/1996 Asadurian
5,575,362 A 11/1996 Franklin et al.
5,590,891 A 1/1997 Kazmark, Jr.
5,603,545 A 2/1997 Benson et al.
5,620,212 A 4/1997 Bourne et al.
5,620,213 A 4/1997 Ellis
5,626,373 A 5/1997 Chambers et al.
5,630,630 A 5/1997 Price et al.
D380,369 S 7/1997 Antonucci
D381,512 S 7/1997 Green
D381,562 S 7/1997 Westcott
D381,871 S 8/1997 Melk
D382,114 S 8/1997 Dickinson et al.
D383,306 S 9/1997 Pennoyer
D383,603 S 9/1997 Pedlar
5,662,223 A 9/1997 Sylegård
5,683,097 A 11/1997 Fenton et al.
5,688,001 A 11/1997 Klein et al.
D387,249 S 12/1997 Mogil
D387,558 S 12/1997 Mann et al.
D387,626 S 12/1997 Melk
5,704,158 A 1/1998 Whiteaker
5,718,350 A 2/1998 Williams
D392,510 S 3/1998 Perez
5,727,844 A 3/1998 O'Quinn et al.
5,732,987 A 3/1998 Wright et al.
5,755,311 A 5/1998 Younessian et al.
5,762,242 A 6/1998 Yost
5,762,411 A 6/1998 Yemini
5,769,194 A 6/1998 Chang
5,797,488 A 8/1998 Yemini
5,797,617 A * 8/1998 Lin ..... B62B 1/125 280/37
5,803,472 A 9/1998 Lien
5,813,503 A 9/1998 Chang
5,816,185 A 10/1998 Ruthrford
5,823,550 A 10/1998 Bennett et al.
5,826,718 A 10/1998 Ahern, Jr. et al.
5,826,770 A 10/1998 Chuang
5,829,558 A * 11/1998 Cheng ..... A45C 13/262 190/39
5,839,553 A 11/1998 Dorsam
5,860,281 A 1/1999 Coffee et al.
5,865,281 A 2/1999 Wang
5,875,948 A 3/1999 Sadler
5,876,048 A * 3/1999 Lee ..... A45C 13/262 190/115
5,887,745 A 3/1999 Wood
5,896,962 A 4/1999 Smith et al.
5,901,571 A 5/1999 Whaley
5,904,269 A 5/1999 Wolff
D410,387 S 6/1999 Jacques
5,924,303 A 7/1999 Hodosh
5,933,929 A 8/1999 Kawakami et al.
5,934,716 A 8/1999 Koveal et al.
5,940,940 A 8/1999 Tanikoshi et al.
5,950,368 A 9/1999 Bradford
5,956,805 A 9/1999 Huang
5,957,321 A 9/1999 Jones
D414,673 S 10/1999 Dickinson et al.
5,971,218 A 10/1999 Le
5,975,334 A 11/1999 Mayo
5,984,064 A 11/1999 Byington
5,984,326 A 11/1999 Abraham et al.
5,984,382 A 11/1999 Bourne et al.
5,988,658 A 11/1999 Ritchie et al.
6,015,072 A 1/2000 Young
D419,767 S 2/2000 Richardson et al.
D419,768 S 2/2000 Richardson et al.
D420,221 S 2/2000 Williams et al.
6,039,205 A 3/2000 Flink
6,047,976 A 4/2000 Wang
6,050,373 A 4/2000 Wonka et al.
D425,301 S 5/2000 Sagol
6,070,888 A * 6/2000 Wang ..... A45C 13/385 280/37
6,079,083 A 6/2000 Akashi
6,079,754 A 6/2000 Alexy
D427,767 S 7/2000 Young
D427,882 S 7/2000 Wytcherley et al.
D428,254 S 7/2000 Alexander-Katz
D428,698 S 8/2000 Cheng
D429,606 S 8/2000 Israel et al.
D429,966 S 8/2000 Israel et al.
6,105,767 A 8/2000 Vasudeva
6,129,231 A 10/2000 Hsiao et al.
6,135,253 A 10/2000 Weissman et al.
6,152,501 A 11/2000 Magi et al.
D435,780 S 1/2001 Tieu
6,167,994 B1 1/2001 Kuo et al.
6,170,122 B1 1/2001 Kuo
6,176,499 B1 1/2001 Conrado et al.
6,176,559 B1 1/2001 Tiramani et al.
6,179,176 B1 1/2001 Saggese et al.
D440,118 S 4/2001 Claffy et al.
D441,954 S 5/2001 Parker
6,224,258 B1 5/2001 Dodson
6,234,287 B1 5/2001 Pfeiffer
6,244,064 B1 6/2001 Powell et al.
6,244,066 B1 6/2001 LaRose

(56) References Cited

U.S. PATENT DOCUMENTS 6,244,458 B1 6/2001 Frysinger et al.
6,247,203 B1 6/2001 Kuo
6,247,328 B1 6/2001 Mogil
6,260,240 B1 7/2001 Akashi et al.
6,279,971 B1 8/2001 Dessenberger, Jr.
6,289,554 B1 9/2001 Wang
6,289,684 B1 9/2001 Guidry, II et al.
D449,163 S 10/2001 Dahlen et al.
6,305,185 B1 10/2001 Sloan
D451,278 S 12/2001 Cooper
D451,765 S 12/2001 Israel et al.
6,338,586 B1 * 1/2002 Kuo ..... A45C 13/262 190/115
6,343,815 B1 2/2002 Poe
D454,292 S 3/2002 Plummer et al.
6,353,978 B1 3/2002 Kawahara et al.
6,357,080 B1 3/2002 Tsai
6,360,400 B1 3/2002 Chang
6,363,739 B1 4/2002 Hodosh et al.
6,367,602 B1 4/2002 Chang
6,371,320 B2 4/2002 Sagol
6,371,346 B1 4/2002 Sharma
6,375,237 B1 4/2002 Koenig
D457,724 S 5/2002 Och
D457,725 S 5/2002 Parsons
6,389,645 B1 5/2002 Polidoro
6,398,272 B1 6/2002 Plummer et al.
6,401,308 B1 6/2002 Kawahara
6,422,386 B1 7/2002 Wiese et al.
6,427,475 B1 8/2002 DeFelice et al.
6,427,501 B2 8/2002 Ramsauer
D462,519 S 9/2002 Gaydos et al.
6,446,382 B1 9/2002 Cloutier et al.
6,446,988 B1 9/2002 Kho
D464,485 S 10/2002 Sward et al.
6,467,779 B1 10/2002 Mills
6,478,463 B2 11/2002 Snider
6,481,239 B2 11/2002 Hodosh et al.
D466,439 S 12/2002 Wagner et al.
D467,424 S 12/2002 Hardigg et al.
D467,425 S 12/2002 Hardigg et al.
D467,426 S 12/2002 Hardigg et al.
6,497,311 B2 12/2002 Tiramani et al.
6,497,438 B1 12/2002 Holub et al.
6,499,574 B1 12/2002 Anthony
6,502,677 B1 1/2003 Tiramani et al.
6,508,389 B1 1/2003 Ripoyla et al.
6,520,514 B2 2/2003 Clegg
D471,711 S 3/2003 Addison
6,527,309 B1 3/2003 Gaydos et al.
6,532,624 B1 3/2003 Yang
D472,431 S 4/2003 Spence, Jr.
6,543,096 B2 4/2003 Settelmayer et al.
6,547,218 B2 4/2003 Andy
6,547,289 B1 4/2003 Greenheck et al.
6,550,592 B1 4/2003 Godshaw et al.
6,554,327 B1 4/2003 Riley
D474,649 S 5/2003 Spence, Jr.
6,574,983 B2 6/2003 Smith et al.
6,585,090 B2 7/2003 Harvey
D477,916 S 8/2003 Nykoluk
D478,782 S 8/2003 Li
6,612,411 B2 9/2003 Nykoluk et al.
6,619,448 B1 * 9/2003 Wang ..... A45C 13/262 190/115
D481,293 S 10/2003 Ayrest
6,637,077 B2 10/2003 Doty
6,637,562 B2 10/2003 Ph
D482,593 S 11/2003 Wolf
6,640,397 B1 11/2003 Gipson
6,646,864 B2 11/2003 Richardson
D484,004 S 12/2003 Lee
6,658,903 B1 12/2003 McShane et al.
6,679,358 B2 1/2004 Be
6,679,359 B2 1/2004 Pfeiffer
6,691,451 B1 2/2004 Keenan
D487,348 S 3/2004 Fenton et al.
6,698,608 B2 3/2004 Parker et al.
6,718,559 B1 4/2004 Davidson
D489,531 S 5/2004 Oh
D489,595 S 5/2004 Gleichauf et al.
6,736,265 B2 5/2004 Kipper et al.
D490,980 S 6/2004 Concari
D491,797 S 6/2004 Eriksson
D492,184 S 6/2004 Parker et al.
6,755,448 B2 6/2004 Jackson et al.
D493,286 S 7/2004 Concari
6,757,942 B2 7/2004 Matsui et al.
6,761,366 B1 7/2004 Klemmensen et al.
6,779,681 B2 8/2004 Doerfler et al.
6,789,692 B2 9/2004 Prezelin
6,793,096 B1 9/2004 Seok
D497,480 S 10/2004 Drew et al.
D498,053 S 11/2004 Nordstrom et al.
D498,054 S 11/2004 Moon
6,821,019 B2 11/2004 Mogil
D500,598 S 1/2005 Ramos
6,877,189 B2 4/2005 Simonson et al.
6,883,208 B1 4/2005 Huang
D505,011 S 5/2005 Einav
6,895,789 B2 5/2005 Masseth, Jr. et al.
D508,376 S 8/2005 Bhavnani
6,929,145 B2 8/2005 Shepler
6,955,381 B2 10/2005 Parker et al.
6,981,780 B2 1/2006 Einav
6,983,946 B2 1/2006 Sullivan et al.
D515,362 S 2/2006 Chan
D517,947 S 3/2006 Hollingworth et al.
7,017,740 B2 3/2006 Itzkovitch
7,028,730 B2 4/2006 Pace et al.
D520,237 S 5/2006 Cheng
7,040,115 B1 5/2006 Lopez et al.
D522,751 S 6/2006 Irwin et al.
D522,811 S 6/2006 Martinez et al.
D523,242 S 6/2006 Hardigg et al.
D523,634 S 6/2006 Dost et al.
7,066,311 B2 6/2006 O'Shea
D525,714 S 7/2006 Jeda
7,082,641 B1 8/2006 Jung et al.
7,093,699 B2 8/2006 Yu
D528,800 S 9/2006 Liu et al.
D530,095 S 10/2006 Herzberg
7,162,890 B2 1/2007 Mogil et al.
D537,251 S 2/2007 Musgrove
7,171,731 B1 2/2007 Borcherding
D539,543 S 4/2007 Wu
D540,540 S 4/2007 Szyf et al.
D540,651 S 4/2007 Wolf, V
D540,652 S 4/2007 Wolf, V
D544,211 S 6/2007 Herzberg
7,237,660 B2 7/2007 Wu
7,246,704 B2 7/2007 Brunson et al.
7,246,718 B2 7/2007 Einav et al.
D552,352 S 10/2007 Lin
D553,857 S 10/2007 Pendergraph et al.
7,284,393 B1 10/2007 Macmillan
7,284,763 B1 10/2007 King
D555,902 S 11/2007 Pendergraph et al.
7,296,434 B2 11/2007 Scroggs
7,306,243 B2 12/2007 Van Horn et al.
7,309,106 B2 12/2007 Stallman
D562,646 S 2/2008 Lown et al.
7,334,680 B2 2/2008 Cunningham et al.
7,334,802 B2 2/2008 Kaplan
D563,101 S 3/2008 Kuchler
7,344,028 B2 3/2008 Hanson
D566,479 S 4/2008 Kabalin
7,367,451 B2 5/2008 Pendergraph et al.
7,370,891 B1 5/2008 Schmitt et al.
D570,601 S 6/2008 Drew et al.
D570,603 S 6/2008 Wu et al.
7,387,350 B2 6/2008 Killinger et al.
D572,577 S 7/2008 Hatton
7,397,674 B2 7/2008 Schlack

(56) References Cited

U.S. PATENT DOCUMENTS

| | | | |
|---|---|---|---|
| D574,150 | S | 8/2008 | Ross |
| D574,667 | S | 8/2008 | Grabijas, III et al. |
| D575,059 | S | 8/2008 | Cappiello et al. |
| 7,415,794 | B1 | 8/2008 | Thompson |
| 7,418,311 | B1 | 8/2008 | Lagassey et al. |
| D578,758 | S | 10/2008 | Stevens et al. |
| D579,202 | S | 10/2008 | Grenier et al. |
| 7,434,410 | B2 | 10/2008 | Ford |
| 7,441,641 | B2 | 10/2008 | Beakey |
| D581,161 | S | 11/2008 | Tong |
| D582,678 | S | 12/2008 | Rekuc et al. |
| 7,458,481 | B2 | 12/2008 | Yuen |
| 7,461,871 | B2 | 12/2008 | Vauchel |
| 7,475,782 | B2 | 1/2009 | Lombardi |
| D587,902 | S | 3/2009 | Yoneno |
| 7,503,439 | B2 | 3/2009 | O'Shea et al. |
| D590,694 | S | 4/2009 | Stuckey |
| 7,516,520 | B2 | 4/2009 | Kelaher et al. |
| 7,516,842 | B2 | 4/2009 | Gu |
| D591,511 | S | 5/2009 | Wu |
| 7,530,405 | B2 | 5/2009 | Kollath et al. |
| 7,533,782 | B2 | 5/2009 | Parker et al. |
| 7,540,364 | B2 | 6/2009 | Sanderson |
| 7,549,652 | B2 | 6/2009 | Wu |
| D596,400 | S | 7/2009 | Chu et al. |
| D597,652 | S | 8/2009 | Tang |
| 7,568,739 | B2 | 8/2009 | Lee |
| 7,571,915 | B1 | 8/2009 | Simmons |
| D600,912 | S | 9/2009 | Brunner |
| 7,581,656 | B2 | 9/2009 | Gnepper et al. |
| D601,801 | S | 10/2009 | Perez |
| D602,252 | S | 10/2009 | Ehret |
| 7,604,290 | B1 | 10/2009 | Giordano |
| 7,607,540 | B2 | 10/2009 | Ballard |
| D603,165 | S | 11/2009 | Losiewicz |
| D605,896 | S | 12/2009 | Zalewski et al. |
| D607,697 | S | 1/2010 | Whitlock et al. |
| D608,159 | S | 1/2010 | Whitlock et al. |
| D608,601 | S | 1/2010 | Whitlock et al. |
| D610,349 | S | 2/2010 | Ehret |
| 7,658,269 | B2 | 2/2010 | Wu |
| 7,669,436 | B2 | 3/2010 | Mogil et al. |
| 7,688,584 | B1 | 3/2010 | Becklin |
| D613,560 | S | 4/2010 | Robichaud et al. |
| D614,404 | S | 4/2010 | Brunner |
| 7,703,588 | B2 | 4/2010 | Chiang |
| 7,722,204 | B1 | 5/2010 | Sandberg |
| D617,561 | S | 6/2010 | Salerno-Tortora |
| 7,735,261 | B2 | 6/2010 | Sellati |
| D618,966 | S | 7/2010 | Koehler et al. |
| D619,423 | S | 7/2010 | Koehler et al. |
| D619,854 | S | 7/2010 | Koehler et al. |
| D619,855 | S | 7/2010 | Koehler et al. |
| 7,748,232 | B2 | 7/2010 | Kang |
| D624,315 | S | 9/2010 | Amatrudo |
| 7,806,287 | B2 | 10/2010 | Rouns |
| D626,451 | S | 11/2010 | Helwig et al. |
| D627,162 | S | 11/2010 | Weng |
| D627,199 | S | 11/2010 | Pruchnicki |
| 7,837,053 | B2 | 11/2010 | Arnett et al. |
| 7,841,207 | B2 | 11/2010 | Mogil et al. |
| D629,200 | S | 12/2010 | Turella-Yuan et al. |
| 7,854,321 | B2 | 12/2010 | Twig et al. |
| D630,435 | S | 1/2011 | Brunner |
| D630,851 | S | 1/2011 | Landau et al. |
| 7,861,552 | B1 | 1/2011 | Hughes |
| 7,861,834 | B2 | 1/2011 | Gorga et al. |
| 7,874,047 | B2 | 1/2011 | Breeden |
| 7,874,408 | B2 | 1/2011 | Suppancig |
| D633,300 | S | 3/2011 | Fair |
| D634,545 | S | 3/2011 | Fair |
| 7,909,148 | B1 | 3/2011 | Miller et al. |
| D635,366 | S | 4/2011 | Luburic |
| D636,292 | S | 4/2011 | Brown |
| 7,922,052 | B2 | 4/2011 | Podschus |
| D637,811 | S | 5/2011 | Hong |
| 7,937,884 | B1 | 5/2011 | Naylor et al. |
| 7,959,194 | B2 | 6/2011 | Mahoney |
| D640,869 | S | 7/2011 | Katz et al. |
| D642,379 | S | 8/2011 | Buller |
| D643,624 | S | 8/2011 | Hong |
| D643,629 | S | 8/2011 | Sofy et al. |
| 7,997,591 | B2 | 8/2011 | Arthur |
| D644,434 | S | 9/2011 | Miles et al. |
| D644,435 | S | 9/2011 | Weng |
| 8,016,153 | B2 | 9/2011 | Boenig et al. |
| D646,528 | S | 10/2011 | Stallman et al. |
| 8,037,983 | B2 | 10/2011 | Leung |
| D648,538 | S | 11/2011 | Reinhart et al. |
| D649,786 | S | 12/2011 | Lipfert et al. |
| D650,585 | S | 12/2011 | Jamison et al. |
| D651,860 | S | 1/2012 | Nie |
| D652,216 | S | 1/2012 | Fair |
| 8,091,731 | B2 | 1/2012 | Kidd et al. |
| 8,096,152 | B2 | 1/2012 | Wagh et al. |
| 8,096,442 | B2 | 1/2012 | Ramundi |
| 8,099,836 | B2 | 1/2012 | Breeden et al. |
| D654,694 | S | 2/2012 | Wu |
| 8,141,211 | B2 | 3/2012 | Weyer et al. |
| D659,395 | S | 5/2012 | Sijmons |
| D660,000 | S | 5/2012 | Peterson et al. |
| 8,167,166 | B2 | 5/2012 | Kidd et al. |
| 8,176,749 | B2 | 5/2012 | LaMere et al. |
| 8,191,747 | B2 | 6/2012 | Pruchnicki |
| 8,210,353 | B2 | 7/2012 | Epicureo |
| 8,214,972 | B2 | 7/2012 | Lai |
| D664,891 | S | 8/2012 | Takeda |
| D665,166 | S | 8/2012 | Khalifa et al. |
| D666,002 | S | 8/2012 | Lai |
| 8,245,868 | B2 | 8/2012 | Keda et al. |
| 8,251,113 | B2 | 8/2012 | Baxter |
| 8,251,245 | B2 | 8/2012 | DiPietro et al. |
| D666,831 | S | 9/2012 | Kinskey et al. |
| D666,832 | S | 9/2012 | Kinskey et al. |
| D667,697 | S | 9/2012 | Shah |
| 8,256,156 | B1 | 9/2012 | Burgoyne, Jr. |
| D668,049 | S | 10/2012 | Buller |
| 8,286,828 | B2 | 10/2012 | Schafer |
| 8,287,009 | B2 | 10/2012 | Dane et al. |
| 8,292,119 | B2 | 10/2012 | Kenneally |
| 8,297,464 | B2 | 10/2012 | Grenier et al. |
| D670,502 | S | 11/2012 | Wu |
| D673,024 | S | 12/2012 | Caffin et al. |
| 8,328,247 | B2 | 12/2012 | Tonelli |
| 8,336,708 | B2 | 12/2012 | Potterfield et al. |
| D674,192 | S | 1/2013 | Li |
| 8,342,580 | B2 | 1/2013 | Cowie et al. |
| 8,378,323 | B1 | 2/2013 | Spann et al. |
| 8,382,171 | B2 | 2/2013 | Williams |
| D677,896 | S | 3/2013 | Wu |
| D678,749 | S | 3/2013 | Tung |
| D678,750 | S | 3/2013 | Tung |
| 8,424,930 | B2 | 4/2013 | Matsubara et al. |
| 8,430,284 | B2 | 4/2013 | Broadbent et al. |
| D681,337 | S | 5/2013 | Wu |
| 8,459,058 | B2 | 6/2013 | Mogil |
| 8,459,422 | B1 | 6/2013 | Efron |
| 8,459,487 | B2 | 6/2013 | Sharma et al. |
| 8,459,495 | B2 | 6/2013 | Koenig et al. |
| D685,186 | S | 7/2013 | Massaud |
| 8,474,098 | B1 | 7/2013 | Yang |
| 8,484,813 | B2 | 7/2013 | Taniguchi et al. |
| 8,490,413 | B2 | 7/2013 | Blackway et al. |
| 8,496,133 | B2 | 7/2013 | Mizukoshi et al. |
| D688,589 | S | 8/2013 | Hung et al. |
| 8,505,729 | B2 | 8/2013 | Sosnovsky et al. |
| 8,517,211 | B2 | 8/2013 | Brown et al. |
| D688,920 | S | 9/2013 | Manley et al. |
| D690,939 | S | 10/2013 | Lintz et al. |
| D691,808 | S | 10/2013 | Wu |
| 8,544,648 | B2 | 10/2013 | Cleveland et al. |
| 8,561,264 | B2 | 10/2013 | Hasegawa et al. |
| 8,561,269 | B2 | 10/2013 | LeCompte et al. |
| 8,567,631 | B2 | 10/2013 | Brunner |

(56) References Cited

U.S. PATENT DOCUMENTS 8,567,796 B2 10/2013 Bar-Erez et al.
D692,657 S 11/2013 Hyma et al.
8,572,821 B2 11/2013 Hasegawa
8,573,399 B2 11/2013 Ulmer et al.
8,590,704 B2 11/2013 Koenig et al.
8,590,724 B2 11/2013 Kreidler et al.
8,596,485 B2 12/2013 Lindsay
8,596,487 B1 12/2013 Su
8,601,838 B2 12/2013 Hansen et al.
8,616,600 B2 12/2013 Owen
D697,717 S 1/2014 Santy
8,622,235 B2 1/2014 Suchecki
8,627,972 B2 1/2014 Thomas
D699,100 S 2/2014 Moreau et al.
D699,438 S 2/2014 Mathieu et al.
8,640,937 B2 2/2014 Pruchnicki
8,677,661 B2 3/2014 Michels et al.
8,678,227 B2 3/2014 Patstone
D701,697 S 4/2014 Sabbag et al.
D703,435 S 4/2014 Wile et al.
8,683,660 B2 4/2014 Hasegawa et al.
8,689,396 B2 4/2014 Wolfe et al.
8,708,351 B2 * 4/2014 Kinskey ..... B25H 3/022 280/47.131
D704,935 S 5/2014 Lintz et al.
8,714,568 B2 5/2014 Allam et al.
8,740,010 B1 6/2014 Page
8,757,642 B2 6/2014 Arthur et al.
8,757,643 B2 6/2014 Arthur et al.
8,757,696 B2 6/2014 Schneider
D709,336 S 7/2014 Liebenthal
D709,696 S 7/2014 Wu
D709,697 S 7/2014 Brunner
8,763,848 B2 7/2014 Carey
8,763,851 B2 7/2014 Jiang et al.
8,770,426 B2 7/2014 Arnett et al.
8,777,045 B2 7/2014 Mitchell et al.
D710,099 S 8/2014 Horovitz et al.
D710,610 S 8/2014 Sijmons et al.
D710,614 S 8/2014 Meersschaert
D711,104 S 8/2014 Lai
D711,646 S 8/2014 Ke
D711,647 S 8/2014 Chen
D711,648 S 8/2014 Chen
D711,649 S 8/2014 Chen
D712,143 S 9/2014 Chehebar
D714,056 S 9/2014 Weng
D714,057 S 9/2014 Hou
D714,064 S 9/2014 Kim
8,844,749 B2 9/2014 Manahan et al.
8,844,950 B2 9/2014 Greene et al.
8,850,666 B2 10/2014 Hasegawa et al.
8,851,282 B2 10/2014 Brunner
8,851,289 B2 10/2014 Shi
8,857,654 B2 10/2014 Mogil et al.
8,863,975 B2 10/2014 McCanless
8,864,185 B2 10/2014 Do
8,864,189 B2 10/2014 Fournie et al.
D717,152 S 11/2014 Weinerman et al.
D718,051 S 11/2014 Frahm et al.
8,875,877 B2 11/2014 Cottle et al.
8,875,888 B2 11/2014 Koenig et al.
8,875,934 B2 11/2014 Deka
8,881,930 B2 11/2014 Banik
8,887,515 B2 11/2014 Patstone
D718,936 S 12/2014 Sanz et al.
D719,351 S 12/2014 Hailwood
8,905,412 B2 12/2014 Fux
8,910,788 B2 12/2014 Roach et al.
8,910,819 B2 12/2014 Seiders
8,919,596 B2 12/2014 Carino
D720,536 S 1/2015 Hsu
D720,599 S 1/2015 Weinerman et al.
D720,928 S 1/2015 Roncato
8,925,752 B2 1/2015 Smith
D722,771 S 2/2015 Wu
D722,860 S 2/2015 Linares
8,944,476 B1 2/2015 Henderson
8,960,430 B2 2/2015 Roach et al.
8,960,735 B2 2/2015 Michael et al.
D723,806 S 3/2015 Salmon
D724,323 S 3/2015 Wang
8,979,100 B2 3/2015 Bensman et al.
8,979,101 B2 3/2015 Primiano
8,979,144 B2 3/2015 Paugh et al.
8,985,326 B2 3/2015 Halsne et al.
8,985,385 B2 3/2015 Parker et al.
D725,907 S 4/2015 Yu
D727,620 S 4/2015 Tonelli
9,004,274 B2 4/2015 Thornberg
9,004,548 B2 4/2015 Joret et al.
D728,933 S 5/2015 Sanz et al.
D730,050 S 5/2015 Hogan et al.
9,027,751 B2 5/2015 Lee
D730,716 S 6/2015 Weinerman et al.
D731,250 S 6/2015 Butler et al.
D732,348 S 6/2015 Seiders et al.
D732,349 S 6/2015 Seiders et al.
D732,350 S 6/2015 Seiders et al.
D732,823 S 6/2015 Baron
D732,899 S 6/2015 Seiders et al.
D732,923 S 6/2015 Rechberg et al.
9,045,264 B2 6/2015 Pils
9,060,577 B2 6/2015 Farrelly et al.
9,067,081 B2 6/2015 Roach et al.
D734,742 S 7/2015 Fujioka
9,079,595 B2 7/2015 Chen et al.
9,085,403 B2 7/2015 Roach et al.
9,101,186 B2 8/2015 Lai
9,108,772 B2 8/2015 Hovatter
9,113,686 B1 8/2015 Bishop
9,114,909 B2 8/2015 Wagner
D738,702 S 9/2015 Linares
9,139,352 B2 9/2015 Seiders et al.
D740,557 S 10/2015 Liao
D740,558 S 10/2015 Liao
D741,064 S 10/2015 Ramos
D741,600 S 10/2015 Della Vecchia
9,163,871 B1 10/2015 Costello
9,169,678 B2 10/2015 Rozema
D743,171 S 11/2015 Reinhart
9,187,210 B2 11/2015 Zhu et al.
9,193,060 B2 11/2015 Ben-Gigi
D744,750 S 12/2015 Sabbag et al.
9,198,492 B2 12/2015 Chehebar
9,199,370 B2 12/2015 Crull
9,199,657 B2 12/2015 Martin
9,204,699 B2 12/2015 Pickens et al.
9,205,551 B2 12/2015 Green et al.
9,211,040 B2 12/2015 Lane
9,215,918 B2 12/2015 Kao et al.
D747,639 S 1/2016 Linares
D747,950 S 1/2016 Jacobsen et al.
D747,951 S 1/2016 Jacobsen et al.
9,233,465 B2 1/2016 Lai
D748,452 S 2/2016 Jacobsen et al.
9,248,566 B2 2/2016 Horiyama et al.
9,254,901 B2 2/2016 Gill
9,259,090 B1 2/2016 Cronin
9,259,593 B2 2/2016 Roach et al.
9,259,828 B2 2/2016 Bermes
9,266,462 B2 2/2016 Miller
D750,953 S 3/2016 Jacobsen et al.
D752,344 S 3/2016 Green
9,272,820 B2 3/2016 Cowie
9,278,704 B2 3/2016 Cates
9,290,297 B2 3/2016 Overath
D752,862 S 4/2016 Riddiford et al.
9,307,840 B2 4/2016 Restrepo et al.
9,322,192 B2 4/2016 Burd
D755,518 S 5/2016 Sijmons
9,327,887 B2 5/2016 Farentinos et al.
9,340,224 B2 5/2016 Yoder et al.
9,341,003 B2 5/2016 Ely et al.

(56) References Cited

U.S. PATENT DOCUMENTS

| | | | |
|---|---|---|---|
| 9,341,403 | B2 | 5/2016 | Conrad et al. |
| 9,346,616 | B2 | 5/2016 | Foster |
| 9,351,550 | B2 | 5/2016 | Arthur et al. |
| D759,971 | S | 6/2016 | Riddiford et al. |
| 9,359,798 | B2 | 6/2016 | Greenwood et al. |
| 9,376,050 | B1 | 6/2016 | Gill |
| 9,387,963 | B2 | 7/2016 | McBroom et al. |
| 9,393,684 | B2 | 7/2016 | Christopher et al. |
| D762,471 | S | 8/2016 | Green et al. |
| D762,977 | S | 8/2016 | Xu |
| 9,408,449 | B1 | 8/2016 | Tsai |
| 9,415,787 | B2 | 8/2016 | Mericle |
| 9,427,058 | B2 | 8/2016 | Boglione |
| D765,397 | S | 9/2016 | Reinhart |
| D765,406 | S | 9/2016 | Faibish |
| D765,407 | S | 9/2016 | Reinhart |
| D765,408 | S | 9/2016 | Reinhart |
| D765,409 | S | 9/2016 | Reinhart |
| D765,410 | S | 9/2016 | Reinhart |
| D765,411 | S | 9/2016 | Reinhart |
| D765,973 | S | 9/2016 | Tonelli et al. |
| D767,277 | S | 9/2016 | Faibish |
| 9,435,578 | B2 | 9/2016 | Calderon et al. |
| 9,443,366 | B2 | 9/2016 | Rayner |
| D768,464 | S | 10/2016 | Hatton |
| D768,985 | S | 10/2016 | Morszeck |
| 9,468,277 | B2 | 10/2016 | King |
| D770,179 | S | 11/2016 | Menirom |
| D771,381 | S | 11/2016 | Sosnovsky et al. |
| D772,577 | S | 11/2016 | Muchin et al. |
| D773,821 | S | 12/2016 | Reinhart |
| D773,901 | S | 12/2016 | Marret |
| 9,511,491 | B2 | 12/2016 | Brunner |
| D776,429 | S | 1/2017 | Zagorski et al. |
| D776,932 | S | 1/2017 | Reinhart |
| D776,934 | S | 1/2017 | Braendle |
| D777,441 | S | 1/2017 | Li |
| D777,530 | S | 1/2017 | Marret |
| D778,054 | S | 2/2017 | Li |
| D778,707 | S | 2/2017 | Tonelli |
| D779,201 | S | 2/2017 | Beilman et al. |
| 9,566,704 | B1 | 2/2017 | Stoikos et al. |
| 9,567,784 | B2 | 2/2017 | Defrance et al. |
| D780,523 | S | 3/2017 | Jacobsen |
| D780,524 | S | 3/2017 | Jacobsen |
| D780,525 | S | 3/2017 | Jacobsen |
| D784,017 | S | 4/2017 | Hsieh |
| 9,622,547 | B2 | 4/2017 | Seader |
| D785,937 | S | 5/2017 | Morszeck |
| D786,561 | S | 5/2017 | Seiders et al. |
| 9,637,294 | B2 | 5/2017 | Kinskey |
| 9,655,418 | B2 | 5/2017 | Chien et al. |
| D788,460 | S | 6/2017 | Morszeck |
| D788,461 | S | 6/2017 | Tonelli |
| D789,690 | S | 6/2017 | Foley et al. |
| D789,766 | S | 6/2017 | Todd, Jr. et al. |
| 9,669,986 | B1 | 6/2017 | Evans |
| D791,477 | S | 7/2017 | Liu |
| D792,094 | S | 7/2017 | Stoikos et al. |
| D792,105 | S | 7/2017 | Reinhart |
| D792,708 | S | 7/2017 | Tazawa |
| D793,089 | S | 8/2017 | Jackson |
| D796,199 | S | 9/2017 | Law |
| D796,838 | S | 9/2017 | Sijmons et al. |
| D797,518 | S | 9/2017 | Pavia, III |
| 9,770,084 | B1 | 9/2017 | Shiekh |
| D802,924 | S | 11/2017 | Mahanavanont |
| 9,809,376 | B2 | 11/2017 | Mitchell et al. |
| D804,174 | S | 12/2017 | Morszeck |
| D804,818 | S | 12/2017 | Sadler |
| D804,819 | S | 12/2017 | Faibish et al. |
| D805,772 | S | 12/2017 | Oshima |
| D805,851 | S | 12/2017 | Sullivan et al. |
| 9,839,272 | B2 | 12/2017 | Licciardino |
| 9,848,681 | B1 | 12/2017 | Chen |
| 9,849,901 | B2 | 12/2017 | Jackman |
| D806,483 | S | 1/2018 | Stanford et al. |
| D807,123 | S | 1/2018 | Carey et al. |
| D807,124 | S | 1/2018 | Carey et al. |
| D808,164 | S | 1/2018 | Summers |
| D808,653 | S | 1/2018 | Rayeski et al. |
| D808,655 | S | 1/2018 | Seiders et al. |
| D808,730 | S | 1/2018 | Sullivan et al. |
| 9,876,522 | B2 | 1/2018 | Huang et al. |
| 9,878,841 | B2 | 1/2018 | Holderness et al. |
| D809,293 | S | 2/2018 | Virassamy et al. |
| D809,295 | S | 2/2018 | Ehret |
| D810,432 | S | 2/2018 | Ballou et al. |
| D810,433 | S | 2/2018 | Ballou et al. |
| D810,434 | S | 2/2018 | Xu |
| D811,084 | S | 2/2018 | Ballou et al. |
| D811,090 | S | 2/2018 | Karl |
| 9,883,724 | B2 | 2/2018 | Woode |
| 9,894,971 | B2 | 2/2018 | Scicluna et al. |
| 9,901,153 | B2 | 2/2018 | Nash |
| D811,742 | S | 3/2018 | Ballou et al. |
| D811,744 | S | 3/2018 | Ballou et al. |
| D812,909 | S | 3/2018 | Morszeck |
| 9,913,518 | B2 | 3/2018 | Su |
| D814,187 | S | 4/2018 | Caglar |
| D815,831 | S | 4/2018 | Tonelli |
| D815,919 | S | 4/2018 | DeFrancia |
| D816,337 | S | 5/2018 | Cheng |
| D816,492 | S | 5/2018 | Reinhart |
| D817,722 | S | 5/2018 | Bradley |
| D818,712 | S | 5/2018 | Fleming et al. |
| 9,968,170 | B2 | 5/2018 | Morszeck |
| D819,331 | S | 6/2018 | Ballou et al. |
| D820,049 | S | 6/2018 | Ahlstrom et al. |
| 9,999,284 | B1 | 6/2018 | Tan |
| D821,824 | S | 7/2018 | Rane et al. |
| D821,825 | S | 7/2018 | Sullivan et al. |
| D823,064 | S | 7/2018 | Eichinger et al. |
| D823,065 | S | 7/2018 | Eichinger et al. |
| D824,168 | S | 7/2018 | Morszeck |
| 10,028,561 | B2 | 7/2018 | Vecellio |
| D824,674 | S | 8/2018 | Seiders et al. |
| D824,731 | S | 8/2018 | Sullivan et al. |
| 10,058,151 | B2 | 8/2018 | Morszeck |
| D827,304 | S | 9/2018 | Tao |
| D828,028 | S | 9/2018 | Seiders et al. |
| D828,029 | S | 9/2018 | Seiders et al. |
| D828,108 | S | 9/2018 | Bowling |
| D828,112 | S | 9/2018 | Furneaux et al. |
| D829,244 | S | 9/2018 | Sullivan et al. |
| 10,080,412 | B2 | 9/2018 | Hartmann et al. |
| D830,132 | S | 10/2018 | Sullivan et al. |
| D830,133 | S | 10/2018 | Sullivan et al. |
| D830,134 | S | 10/2018 | Sullivan et al. |
| 10,086,745 | B2 | 10/2018 | Gill |
| 10,088,144 | B1 | 10/2018 | Sandberg |
| D832,653 | S | 11/2018 | Waskow et al. |
| 10,124,742 | B2 | 11/2018 | Martinez et al. |
| 10,138,048 | B2 | 11/2018 | Mitchell et al. |
| D834,819 | S | 12/2018 | Burek et al. |
| D835,470 | S | 12/2018 | Seiders et al. |
| D835,472 | S | 12/2018 | Seiders et al. |
| D835,473 | S | 12/2018 | Jacobsen |
| D835,946 | S | 12/2018 | Seiders et al. |
| 10,143,282 | B2 | 12/2018 | Seiders et al. |
| 10,159,312 | B2 | 12/2018 | Ito |
| 10,160,471 | B2 | 12/2018 | Yahav et al. |
| D836,993 | S | 1/2019 | Meda et al. |
| D836,996 | S | 1/2019 | Jacobsen |
| D836,997 | S | 1/2019 | Jacobsen |
| D836,998 | S | 1/2019 | Jacobsen |
| D836,999 | S | 1/2019 | Jacobsen |
| D837,001 | S | 1/2019 | Jacobsen |
| D837,515 | S | 1/2019 | Shpitzer |
| D837,611 | S | 1/2019 | Lane et al. |
| D838,208 | S | 1/2019 | Hirabayashi et al. |
| D838,983 | S | 1/2019 | Seiders et al. |
| D838,984 | S | 1/2019 | Seiders et al. |
| D839,094 | S | 1/2019 | Giraud et al. |

(56) References Cited

U.S. PATENT DOCUMENTS

| | | | |
|---|---|---|---|
| D839,682 | S | 2/2019 | Jacobsen |
| D840,150 | S | 2/2019 | Seiders et al. |
| D840,194 | S | 2/2019 | Furneaux et al. |
| D842,048 | S | 3/2019 | Wells |
| D843,114 | S | 3/2019 | Sanz |
| 10,219,601 | B2 | 3/2019 | Selvi |
| D844,325 | S | 4/2019 | Nelson |
| D844,386 | S | 4/2019 | Ahlstrom et al. |
| 10,272,934 | B2 | 4/2019 | DeFrancia |
| D848,219 | S | 5/2019 | Munie et al. |
| D848,220 | S | 5/2019 | Munie et al. |
| D848,221 | S | 5/2019 | Munie et al. |
| D848,222 | S | 5/2019 | Munie et al. |
| D848,223 | S | 5/2019 | Munie et al. |
| D848,744 | S | 5/2019 | Axelbaum |
| D848,798 | S | 5/2019 | Munie et al. |
| D849,486 | S | 5/2019 | Munie et al. |
| 10,292,473 | B2 | 5/2019 | Meersschaert |
| D850,796 | S | 6/2019 | Ricca |
| D851,401 | S | 6/2019 | Zhang |
| 10,314,377 | B2 | 6/2019 | Stephens |
| D852,504 | S | 7/2019 | Ben-David |
| D853,729 | S | 7/2019 | Axelbaum |
| D854,826 | S | 7/2019 | Tonelli |
| 10,334,935 | B2 | 7/2019 | Chung |
| 10,350,746 | B2 | 7/2019 | Martinez et al. |
| 10,351,330 | B2 | 7/2019 | Smith et al. |
| 10,357,874 | B2 | 7/2019 | Engvall et al. |
| D857,386 | S | 8/2019 | Shpitzer |
| 10,376,031 | B1 | 8/2019 | Majhess |
| 10,378,569 | B2 | 8/2019 | Jensen et al. |
| D858,986 | S | 9/2019 | Shalgi |
| D859,842 | S | 9/2019 | Frank |
| D860,789 | S | 9/2019 | Rayeski et al. |
| 10,399,748 | B2 | 9/2019 | Reinhart |
| 10,401,075 | B2 | 9/2019 | Bond |
| D861,535 | S | 10/2019 | Venables |
| 10,443,918 | B2 | 10/2019 | Li et al. |
| D869,160 | S | 12/2019 | Seiders et al. |
| D869,244 | S | 12/2019 | Ellison et al. |
| D869,848 | S | 12/2019 | Wu |
| D871,767 | S | 1/2020 | Harrison |
| D872,478 | S | 1/2020 | Seiders et al. |
| D872,485 | S | 1/2020 | Seiders et al. |
| D873,020 | S | 1/2020 | Seiders et al. |
| D873,024 | S | 1/2020 | Usui |
| D874,139 | S | 2/2020 | Rubio et al. |
| D874,140 | S | 2/2020 | Rubio et al. |
| D874,141 | S | 2/2020 | Rubio et al. |
| 10,568,395 | B2 | 2/2020 | Hayashi |
| 10,568,400 | B2 | 2/2020 | Shechter et al. |
| D876,833 | S | 3/2020 | Brunner et al. |
| D876,835 | S | 3/2020 | Libman et al. |
| D878,054 | S | 3/2020 | Reinhart et al. |
| D878,929 | S | 3/2020 | Rubio et al. |
| 10,595,608 | B2 | 3/2020 | Korey et al. |
| D881,569 | S | 4/2020 | Rubio et al. |
| D881,578 | S | 4/2020 | Prommel et al. |
| D882,266 | S | 4/2020 | Prommel et al. |
| D882,267 | S | 4/2020 | Prommel et al. |
| D887,789 | S | 6/2020 | Seiders et al. |
| D893,876 | S | 8/2020 | Van Fossen |
| D898,357 | S | 10/2020 | Chagnon et al. |
| D899,083 | S | 10/2020 | Rubio et al. |
| D899,869 | S | 10/2020 | Bullock et al. |
| D904,129 | S | 12/2020 | Astle |
| D909,062 | S | 2/2021 | Qian et al. |
| D912,983 | S | 3/2021 | Newson |
| D915,069 | S | 4/2021 | Tonelli |
| D920,668 | S | 6/2021 | Bonnough et al. |
| D925,911 | S | 7/2021 | Sun |
| D927,851 | S | 8/2021 | Chasseriaux et al. |
| D942,218 | S | 2/2022 | Astle |
| D946,894 | S | 3/2022 | Seiders et al. |
| D948,292 | S | 4/2022 | Peng |
| D977,833 | S | 2/2023 | Yang |
| D981,714 | S | 3/2023 | Tonelli |
| 2002/0024189 | A1 | 2/2002 | Chen |
| 2002/0038745 | A1 | 4/2002 | Lamming |
| 2002/0074332 | A1 | 6/2002 | Sagol |
| 2002/0148694 | A1 | 10/2002 | Tong |
| 2002/0162841 | A1 | 11/2002 | Shamir et al. |
| 2002/0185871 | A1 | 12/2002 | Straka |
| 2002/0195827 | A1 | 12/2002 | Jackson et al. |
| 2003/0019705 | A1 | 1/2003 | Lau |
| 2003/0038007 | A1 | 2/2003 | Han |
| 2003/0038142 | A1 | 2/2003 | Gee |
| 2003/0106821 | A1 | 6/2003 | Bar-Erez |
| 2003/0111476 | A1 | 6/2003 | Serio |
| 2003/0136702 | A1 | 7/2003 | Redzisz et al. |
| 2004/0007604 | A1 | 1/2004 | Plzak |
| 2004/0016854 | A1 | 1/2004 | Hart |
| 2004/0025306 | A1 | 2/2004 | Coffey |
| 2004/0040967 | A1 | 3/2004 | Eiskant et al. |
| 2004/0163910 | A1 | 8/2004 | Lee |
| 2004/0178208 | A1 | 9/2004 | Leba et al. |
| 2004/0238543 | A1 | 12/2004 | Askew |
| 2004/0246695 | A1 | 12/2004 | Schlack |
| 2004/0262319 | A1 | 12/2004 | Fisher |
| 2005/0023096 | A1 | 2/2005 | Tiramani |
| 2005/0099019 | A1 | 5/2005 | Hall et al. |
| 2005/0103813 | A1 | 5/2005 | Edwards |
| 2005/0109776 | A1 | 5/2005 | Camp |
| 2005/0139741 | A1 | 6/2005 | Yuen |
| 2005/0150892 | A1 | 7/2005 | Miller |
| 2005/0180835 | A1 | 8/2005 | Schneider |
| 2005/0183914 | A1 | 8/2005 | Lin |
| 2005/0199628 | A1 | 9/2005 | Van Handel et al. |
| 2005/0217071 | A1 | 10/2005 | Shinner |
| 2005/0258610 | A1 | 11/2005 | Stone et al. |
| 2005/0279123 | A1 | 12/2005 | Maldonado et al. |
| 2006/0011641 | A1 | 1/2006 | Sanderson |
| 2006/0017293 | A1 | 1/2006 | Tonelli |
| 2006/0037178 | A1 | 2/2006 | Sulhoff |
| 2006/0037824 | A1 | 2/2006 | Park et al. |
| 2006/0042897 | A1 | 3/2006 | Sanderson |
| 2006/0049640 | A1 | 3/2006 | Lee |
| 2006/0180422 | A1 | 8/2006 | Lin |
| 2006/0196218 | A1 | 9/2006 | Mogil et al. |
| 2006/0213736 | A1 | 9/2006 | Godshaw |
| 2006/0213941 | A1 | 9/2006 | Sweeney |
| 2006/0225981 | A1 | 10/2006 | Lin |
| 2006/0249412 | A1 | 11/2006 | Hernandez et al. |
| 2006/0249522 | A1 | 11/2006 | Ringo |
| 2006/0276768 | A1 | 12/2006 | Miller et al. |
| 2007/0039957 | A1 | 2/2007 | Shulz et al. |
| 2007/0101754 | A1 | 5/2007 | Maldonado |
| 2007/0158157 | A1 | 7/2007 | Krulik et al. |
| 2007/0175898 | A1 | 8/2007 | Craft et al. |
| 2007/0235452 | A1 | 10/2007 | Killinger et al. |
| 2007/0261977 | A1 | 11/2007 | Sakai |
| 2008/0001373 | A1 | 1/2008 | Vaughn |
| 2008/0029528 | A1 | 2/2008 | Mireault |
| 2008/0042460 | A1 | 2/2008 | Fuchs |
| 2008/0067095 | A1 | 3/2008 | Mueller |
| 2008/0067206 | A1 | 3/2008 | Kuhn |
| 2008/0078637 | A1 | 4/2008 | Su |
| 2008/0078682 | A1 | 4/2008 | Clark et al. |
| 2008/0110892 | A1 | 5/2008 | House |
| 2008/0116215 | A1 | 5/2008 | Chuang |
| 2008/0128428 | A1 | 6/2008 | Beckerman |
| 2008/0156858 | A1 | 7/2008 | Perry et al. |
| 2008/0170388 | A1 | 7/2008 | Greil |
| 2008/0190940 | A1 | 8/2008 | Scott |
| 2008/0196650 | A1 | 8/2008 | Fernung |
| 2008/0230339 | A1 | 9/2008 | Pereira |
| 2008/0245095 | A1 | 10/2008 | Schlipman et al. |
| 2008/0257775 | A1 | 10/2008 | Randolph |
| 2008/0264946 | A1 | 10/2008 | Moschella et al. |
| 2009/0009039 | A1 | 1/2009 | Mayes, Jr. |
| 2009/0014974 | A1 | 1/2009 | VanVorst et al. |
| 2009/0033110 | A1 | 2/2009 | Fragale |
| 2009/0049859 | A1 | 2/2009 | Moon |
| 2009/0078593 | A1 | 3/2009 | Patstone |

(56) References Cited

U.S. PATENT DOCUMENTS

2009/0080809 A1 3/2009 Pham et al.
2009/0101460 A1 4/2009 Justham et al.
2009/0114646 A1 5/2009 Whalen
2009/0114653 A1 5/2009 Schenker
2009/0120126 A1 5/2009 Mew
2009/0158770 A1 6/2009 Cohrs et al.
2009/0173744 A1 7/2009 Hassell
2009/0194541 A1 8/2009 Mayo
2009/0277905 A1 11/2009 Gillan
2010/0001013 A1 1/2010 Sommerfeld
2010/0072215 A1 3/2010 Coon
2010/0078451 A1 4/2010 Mount
2010/0108556 A1 5/2010 Claffy
2010/0133132 A1 6/2010 Allan
2010/0200784 A1 8/2010 Turner
2010/0258576 A1 10/2010 Marquez
2010/0275642 A1 11/2010 Klettner
2011/0016911 A1 1/2011 Mosby
2011/0064332 A1 3/2011 Piazza et al.
2011/0114526 A1 5/2011 Neumann et al.
2011/0119986 A1 5/2011 Sellers
2011/0121002 A1 5/2011 Stiller
2011/0127264 A1 6/2011 Whalen
2011/0132046 A1 6/2011 Tonelli
2011/0181008 A1 7/2011 Bensman et al.
2011/0182532 A1 7/2011 Baltus
2011/0186396 A1 8/2011 Sheikh
2011/0186398 A1 8/2011 Sheikh
2011/0197625 A1 8/2011 Urban et al.
2011/0203328 A1 8/2011 Vilkomirski et al.
2011/0220531 A1 9/2011 Meether et al.
2011/0226003 A1 9/2011 Chaney et al.
2011/0226785 A1 9/2011 Sakell
2012/0024896 A1 2/2012 Scobey et al.
2012/0103740 A1 5/2012 Moussatche et al.
2012/0104012 A1 5/2012 Cowie et al.
2012/0168444 A1 7/2012 Shitrit et al.
2012/0193353 A1 8/2012 Cronin et al.
2012/0247897 A1 10/2012 Sheikh
2012/0267208 A1 10/2012 D'Angelo
2012/0273506 A1 11/2012 Adams et al.
2012/0286489 A1 11/2012 Bartholomew
2012/0312708 A1 12/2012 Roehm et al.
2013/0068579 A1 3/2013 Mathieu et al.
2013/0140120 A1 6/2013 Rasmussen
2013/0168196 A1 7/2013 Stanley
2013/0175130 A1 7/2013 Liang
2013/0175276 A1 7/2013 Gleichauf et al.
2013/0248390 A1 9/2013 Roehm et al.
2013/0284619 A1 10/2013 Daley
2013/0292220 A1 11/2013 Kerley
2013/0292221 A1 11/2013 Ryan et al.
2013/0307214 A1 11/2013 Groller et al.
2013/0313058 A1 11/2013 Yoshida
2014/0027454 A1 1/2014 Banik
2014/0062042 A1 3/2014 Wagner et al.
2014/0069832 A1 3/2014 Roehm
2014/0130310 A1 5/2014 Roth
2014/0137370 A1 5/2014 Lo et al.
2014/0138384 A1 5/2014 O'Brien
2014/0151388 A1 6/2014 Culeron et al.
2014/0158028 A1 6/2014 Adams
2014/0166516 A1 6/2014 Martinez et al.
2014/0197059 A1 7/2014 Evans et al.
2014/0251864 A1 9/2014 Voeller
2014/0252010 A1 9/2014 Miller
2014/0265197 A1 9/2014 Russell et al.
2014/0271095 A1 9/2014 Umans et al.
2014/0284158 A1 9/2014 Reid
2014/0284243 A1 9/2014 Tucker
2014/0311361 A1 10/2014 Wangler
2014/0311844 A1 10/2014 Meersschaert et al.
2014/0319147 A1 10/2014 Horovitz et al.
2015/0021132 A1* 1/2015 Sijmons ..... A45C 13/1084 190/120
2015/0027835 A1 1/2015 Moon
2015/0034515 A1 2/2015 Monyak et al.
2015/0069962 A1 3/2015 Dietzel et al.
2015/0089903 A1 4/2015 Carey
2015/0090551 A1 4/2015 Sikka
2015/0114024 A1 4/2015 Grepper
2015/0129569 A1 5/2015 Miller
2015/0144448 A1 5/2015 Chen
2015/0150347 A1 6/2015 Scicluna
2015/0150348 A1 6/2015 Wax
2015/0175338 A1 6/2015 Culp et al.
2015/0189963 A1 7/2015 Lai et al.
2015/0190920 A1 7/2015 Karlsson et al.
2015/0208779 A1 7/2015 Tong
2015/0209226 A1 7/2015 Priebe et al.
2015/0233630 A1 8/2015 Bond
2015/0292840 A1 10/2015 Tobin
2015/0296945 A1 10/2015 Douglas
2015/0296948 A1 10/2015 Kung
2015/0315532 A1 11/2015 Bergbohm et al.
2015/0352709 A1 12/2015 Diamond
2015/0352711 A1 12/2015 Brunner
2015/0375558 A1 12/2015 Ben-Or
2015/0375918 A1 12/2015 Holderness et al.
2016/0023837 A1 1/2016 Furneaux et al.
2016/0046417 A1 2/2016 Kromer
2016/0052682 A1 2/2016 Gunnerson et al.
2016/0083186 A1 3/2016 Wright
2016/0084454 A1 3/2016 Svitak, Sr. et al.
2016/0091239 A1 3/2016 Beland
2016/0135563 A1 5/2016 Truong
2016/0138809 A1 5/2016 Colucci et al.
2016/0150862 A1 6/2016 Tonelli
2016/0166024 A1 6/2016 Lai
2016/0183651 A1 6/2016 Tonelli
2016/0244209 A1 8/2016 Hain
2016/0251124 A1 9/2016 Arnold et al.
2016/0279840 A1 9/2016 French et al.
2016/0286912 A1 10/2016 Morszeck
2017/0079398 A1 3/2017 Reh et al.
2017/0082342 A1 3/2017 Weinberg et al.
2017/0108260 A1 4/2017 Ansted et al.
2017/0127782 A1 5/2017 Korey et al.
2017/0127783 A1 5/2017 Korey et al.
2017/0165829 A1 6/2017 Damberg
2017/0173781 A1 6/2017 Damberg
2017/0196332 A1 7/2017 Tong
2017/0215537 A1 8/2017 Yu
2017/0290400 A1 10/2017 Thomas
2017/0347765 A1 12/2017 Jackson et al.
2018/0035774 A1 2/2018 Pelatti
2018/0035775 A1 2/2018 Haimoff
2018/0037394 A1 2/2018 Seiders et al.
2018/0078008 A1 3/2018 Sturm
2018/0087819 A1 3/2018 Triska et al.
2018/0087955 A1 3/2018 Lu
2018/0141718 A1 5/2018 Ahlstrom et al.
2018/0186547 A1 7/2018 Morine et al.
2018/0194533 A1 7/2018 Bramwell
2018/0325230 A1 11/2018 Morszeck
2018/0335241 A1 11/2018 Li et al.
2018/0339820 A1 11/2018 Reinhart et al.
2018/0354687 A1 12/2018 Seiders et al.
2019/0008254 A1 1/2019 Newson
2019/0092530 A1 3/2019 Seiders et al.
2019/0170422 A1 6/2019 Dexter
2019/0234671 A1 8/2019 Stanford et al.
2019/0256119 A1 8/2019 Brilhante et al.
2019/0271433 A1 9/2019 Tonelli
2020/0037719 A1 2/2020 Jaworski et al.
2020/0039056 A1 2/2020 Damberg
2020/0060400 A1 2/2020 Glaser
2020/0061802 A1 2/2020 Samsel et al.
2020/0062454 A1 2/2020 Duong et al.
2020/0086905 A1 3/2020 Yao et al.
2020/0196725 A1* 6/2020 Tonelli ..... A45C 13/26
2020/0214407 A1 7/2020 Nichols et al.

(56) References Cited

U.S. PATENT DOCUMENTS

| | | | |
|---|---|---|---|
| 2020/0216224 | A1 | 7/2020 | Nichols et al. |
| 2020/0217576 | A1 | 7/2020 | Guan et al. |

FOREIGN PATENT DOCUMENTS

| | | | |
|---|---|---|---|
| BR | 202015031355 | U2 | 6/2017 |
| CA | 60997 | A | 8/1898 |
| CA | 72336 | A | 7/1901 |
| CA | 72337 | A | 7/1901 |
| CA | 72338 | A | 7/1901 |
| CA | 73327 | A | 10/1901 |
| CA | 77273 | A | 9/1902 |
| CA | 81456 | A | 6/1903 |
| CA | 152411 | A | 12/1913 |
| CA | 175930 | A | 3/1917 |
| CA | 175939 | A | 3/1917 |
| CA | 2624994 | A1 | 5/2000 |
| CA | 89737 | A | 6/2000 |
| CA | 2483772 | A1 | 4/2005 |
| CA | 2633223 | A1 | 12/2009 |
| CA | 2635328 | A1 | 12/2009 |
| CA | 2782668 | A1 | 12/2013 |
| CH | 365631 | A | 11/1962 |
| CN | 2073459 | U | 3/1991 |
| CN | 2132145 | Y | 5/1993 |
| CN | 1112819 | A | 12/1995 |
| CN | 2515999 | Y | 10/2002 |
| CN | 2549792 | Y | 5/2003 |
| CN | 1457237 | A | 11/2003 |
| CN | 1502279 | A | 6/2004 |
| CN | 2664452 | Y | 12/2004 |
| CN | 3498732 | | 1/2006 |
| CN | 3498735 | | 1/2006 |
| CN | 2813823 | Y | 9/2006 |
| CN | 300690540 | | 9/2007 |
| CN | 300690541 | | 9/2007 |
| CN | 201076126 | Y | 6/2008 |
| CN | 300854008 | | 12/2008 |
| CN | 300856959 | | 12/2008 |
| CN | 300918117 | | 5/2009 |
| CN | 301150817 | | 3/2010 |
| CN | 301189065 | | 5/2010 |
| CN | 201691232 | U | 1/2011 |
| CN | 301548656 | | 5/2011 |
| CN | 301620134 | | 7/2011 |
| CN | 201919912 | U | 8/2011 |
| CN | 201938601 | U | 8/2011 |
| CN | 201630123602 | | 8/2011 |
| CN | 301711528 | | 11/2011 |
| CN | 301808188 | | 1/2012 |
| CN | 301950501 | | 6/2012 |
| CN | 102626271 | A | 8/2012 |
| CN | 202396674 | U | 8/2012 |
| CN | 102805467 | A | 12/2012 |
| CN | 202722894 | U | 2/2013 |
| CN | 102948946 | A | 3/2013 |
| CN | 202760445 | U | 3/2013 |
| CN | 302365993 | | 3/2013 |
| CN | 202874104 | U | 4/2013 |
| CN | 302425923 | | 5/2013 |
| CN | 302448361 | | 6/2013 |
| CN | 203182247 | U | 9/2013 |
| CN | 203283617 | U | 11/2013 |
| CN | 302631183 | | 11/2013 |
| CN | 203439475 | U | 2/2014 |
| CN | 203524042 | U | 4/2014 |
| CN | 302811286 | | 5/2014 |
| CN | 302868078 | | 7/2014 |
| CN | 203789329 | U | 8/2014 |
| CN | 203814784 | U | 9/2014 |
| CN | 204032607 | U | 12/2014 |
| CN | 104433073 | A | 3/2015 |
| CN | 204245396 | U | 4/2015 |
| CN | 303154464 | | 4/2015 |
| CN | 303186110 | | 4/2015 |
| CN | 303221245 | | 5/2015 |
| CN | 204409860 | U | 6/2015 |
| CN | 303228513 | | 6/2015 |
| CN | 303228514 | | 6/2015 |
| CN | 303242426 | | 6/2015 |
| CN | 303251869 | | 6/2015 |
| CN | 303324038 | | 8/2015 |
| CN | 303333672 | | 8/2015 |
| CN | 201530103483 | | 8/2015 |
| CN | 303381343 | | 9/2015 |
| CN | 303390870 | | 9/2015 |
| CN | 303499903 | | 12/2015 |
| CN | 303514839 | | 12/2015 |
| CN | 303546215 | | 1/2016 |
| CN | 201530438676 | | 2/2016 |
| CN | 201530438792 | | 2/2016 |
| CN | 105473462 | A | 4/2016 |
| CN | 303630971 | | 4/2016 |
| CN | 303680031 | | 5/2016 |
| CN | 303680054 | | 5/2016 |
| CN | 303687108 | | 6/2016 |
| CN | 205521292 | U | 8/2016 |
| CN | 303783877 | | 8/2016 |
| CN | 303799176 | | 8/2016 |
| CN | 303904119 | | 11/2016 |
| CN | 303918135 | | 11/2016 |
| CN | 205831341 | U | 12/2016 |
| CN | 303973165 | | 12/2016 |
| CN | 303982382 | | 12/2016 |
| CN | 303982387 | | 12/2016 |
| CN | 304000494 | | 1/2017 |
| CN | 304036742 | | 2/2017 |
| CN | 304036750 | | 2/2017 |
| CN | 304050612 | | 2/2017 |
| CN | 304068469 | | 3/2017 |
| CN | 304076890 | | 3/2017 |
| CN | 106551485 | A | 4/2017 |
| CN | 304172638 | | 6/2017 |
| CN | 107125891 | A | 9/2017 |
| CN | 107173938 | A | 9/2017 |
| CN | 107307551 | A | 11/2017 |
| CN | 107467837 | A | 12/2017 |
| CN | 206702967 | U | 12/2017 |
| CN | 304411331 | | 12/2017 |
| CN | 304411334 | | 12/2017 |
| CN | 304411336 | | 12/2017 |
| CN | 304411337 | | 12/2017 |
| CN | 304411389 | | 12/2017 |
| CN | 304417314 | | 12/2017 |
| CN | 304423206 | | 12/2017 |
| CN | 304423258 | | 12/2017 |
| CN | 304423259 | | 12/2017 |
| CN | 304423260 | | 12/2017 |
| CN | 304423317 | | 12/2017 |
| CN | 206880270 | U | 1/2018 |
| CN | 304461798 | | 1/2018 |
| CN | 107668874 | A | 2/2018 |
| CN | 304532315 | | 3/2018 |
| CN | 304532317 | | 3/2018 |
| CN | 304532318 | | 3/2018 |
| CN | 304532319 | | 3/2018 |
| CN | 304539046 | | 3/2018 |
| CN | 304555895 | | 3/2018 |
| CN | 304562598 | | 4/2018 |
| CN | 304569073 | | 4/2018 |
| CN | 304569074 | | 4/2018 |
| CN | 108078109 | A | 5/2018 |
| CN | 304645055 | | 5/2018 |
| CN | 207428627 | U | 6/2018 |
| CN | 304653754 | | 6/2018 |
| CN | 304660325 | | 6/2018 |
| CN | 304660327 | | 6/2018 |
| CN | 304660329 | | 6/2018 |
| CN | 304660332 | | 6/2018 |
| CN | 304692146 | | 6/2018 |
| CN | 304701684 | | 6/2018 |
| CN | 108337874 | A | 7/2018 |
| CN | 304749390 | | 7/2018 |
| CN | 304764980 | | 8/2018 |

(56) References Cited

FOREIGN PATENT DOCUMENTS

| | | | | |
|---|---|---|---|---|
| CN | 108495572 | A | 9/2018 | |
| CN | 108497660 | A | 9/2018 | |
| CN | 304823694 | | 9/2018 | |
| CN | B04823685 | | 9/2018 | |
| CN | 108608804 | A | 10/2018 | |
| CN | 207949211 | U | 10/2018 | |
| CN | 304836888 | | 10/2018 | |
| CN | 304854893 | | 10/2018 | |
| CN | 304862165 | | 10/2018 | |
| CN | 304862166 | | 10/2018 | |
| CN | 108783799 | A | 11/2018 | |
| CN | 108835813 | A | 11/2018 | |
| CN | 108835814 | A | 11/2018 | |
| CN | 304877452 | | 11/2018 | |
| CN | 304900938 | | 11/2018 | |
| CN | 108945792 | A | 12/2018 | |
| CN | 109043770 | A | 12/2018 | |
| CN | 208192442 | U | 12/2018 | |
| CN | 208192487 | U | 12/2018 | |
| CN | 304970790 | | 1/2019 | |
| CN | 304995265 | | 1/2019 | |
| CN | 305641119 | | 1/2019 | |
| CN | 109303399 | A | 2/2019 | |
| CN | 305019548 | | 2/2019 | |
| CN | 109431028 | A | 3/2019 | |
| CN | 109497673 | A | 3/2019 | |
| CN | 208581902 | U | 3/2019 | |
| CN | 305050777 | | 3/2019 | |
| CN | 305078423 | | 3/2019 | |
| CN | 305078424 | | 3/2019 | |
| CN | 305111950 | | 4/2019 | |
| CN | 305181543 | | 5/2019 | |
| CN | 305181544 | | 5/2019 | |
| CN | 305184266 | | 5/2019 | |
| CN | 305184268 | | 5/2019 | |
| CN | 305191726 | | 6/2019 | |
| CN | 305219344 | | 6/2019 | |
| CN | 305242412 | | 7/2019 | |
| CN | 305242413 | | 7/2019 | |
| CN | 305283238 | | 8/2019 | |
| CN | 209403814 | U | 9/2019 | |
| CN | 305344781 | | 9/2019 | |
| CN | 305347993 | | 9/2019 | |
| CN | 305359134 | | 9/2019 | |
| CN | 305359135 | | 9/2019 | |
| CN | 209528183 | U | 10/2019 | |
| CN | 305398498 | | 10/2019 | |
| CN | 209563672 | U | 11/2019 | |
| CN | 209628893 | U | 11/2019 | |
| CN | 305424085 | | 11/2019 | |
| CN | 305424089 | | 11/2019 | |
| CN | 305437133 | | 11/2019 | |
| CN | 305437134 | | 11/2019 | |
| CN | 305437137 | | 11/2019 | |
| CN | 110605939 | A | 12/2019 | |
| CN | 209719155 | U | 12/2019 | |
| CN | 209719159 | U | 12/2019 | |
| CN | 209732871 | U | 12/2019 | |
| CN | 209788810 | U | 12/2019 | |
| CN | 305476163 | | 12/2019 | |
| CN | 305488622 | | 12/2019 | |
| CN | 305499080 | | 12/2019 | |
| CN | 305506675 | | 12/2019 | |
| CN | 305518862 | | 12/2019 | |
| CN | 209931762 | U | 1/2020 | |
| CN | 209965461 | U | 1/2020 | |
| CN | 305527333 | | 1/2020 | |
| CN | 305533439 | | 1/2020 | |
| CN | 305533533 | | 1/2020 | |
| CN | 305533534 | | 1/2020 | |
| CN | 305533538 | | 1/2020 | |
| CN | 305533539 | | 1/2020 | |
| CN | 305540311 | | 1/2020 | |
| CN | 305547763 | | 1/2020 | |
| CN | 305547764 | | 1/2020 | |
| CN | 305547961 | | 1/2020 | |
| CN | 305556652 | | 1/2020 | |
| CN | 305563596 | | 1/2020 | |
| CN | 305571758 | | 1/2020 | |
| CN | 305571764 | | 1/2020 | |
| CN | 305577923 | | 1/2020 | |
| CN | 305577960 | | 1/2020 | |
| CN | 305578103 | | 1/2020 | |
| CN | 210076793 | U | 2/2020 | |
| CN | 210114130 | U | 2/2020 | |
| CN | 305584094 | | 2/2020 | |
| CN | 305584095 | | 2/2020 | |
| CN | 305584098 | | 2/2020 | |
| CN | 305605578 | | 2/2020 | |
| CN | 305614805 | | 2/2020 | |
| CN | 305621592 | | 2/2020 | |
| CN | 305621593 | | 2/2020 | |
| CN | 305629332 | | 2/2020 | |
| CN | 305635594 | | 3/2020 | |
| CN | 305636583 | | 3/2020 | |
| CN | 305639489 | | 3/2020 | |
| CN | 305642338 | | 3/2020 | |
| CN | 305642339 | | 3/2020 | |
| CN | 305642418 | | 3/2020 | |
| CN | 305657621 | | 3/2020 | |
| CN | 305748162 | | 5/2020 | |
| CN | 305873337 | | 6/2020 | |
| DE | 74708 | C | 4/1894 | |
| DE | 2020368 | A1 | 11/1971 | |
| DE | 7502524 | U | 9/1975 | |
| DE | 2939826 | A1 | 4/1980 | |
| DE | 3344410 | A1 | 6/1985 | |
| DE | 8620597 | U1 | 9/1986 | |
| DE | 9012845 | U1 | 10/1990 | |
| DE | 4042245 | A1 | 7/1991 | |
| DE | 9105033 | U1 | 3/1992 | |
| DE | 4418429 | A1 * | 12/1994 | ..... A45C 13/262 |
| DE | 9408707 | U1 | 9/1995 | |
| DE | 29516306 | U1 | 2/1997 | |
| DE | 29815666 | U1 | 11/1998 | |
| DE | 19755532 | A1 | 6/1999 | |
| DE | 20312950 | U1 | 10/2003 | |
| DE | 20313077 | U1 | 1/2004 | |
| DE | 202004007996 | U1 | 7/2004 | |
| DE | 202004012191 | U1 | 12/2004 | |
| DE | 202004015475 | U1 | 1/2005 | |
| DE | 202004016959 | U1 | 2/2005 | |
| DE | 202005006105 | U1 | 6/2005 | |
| DE | 202005014773 | U1 | 11/2005 | |
| DE | 202006001888 | U1 | 4/2006 | |
| DE | 402010002800-0008 | | 6/2010 | |
| DE | 402010002800-0001 | | 7/2010 | |
| DE | 402010002800-0002 | | 7/2010 | |
| DE | 402010002800-0003 | | 7/2010 | |
| DE | 402010002800-0004 | | 7/2010 | |
| DE | 402010002800-0007 | | 7/2010 | |
| DE | 402010002800-0009 | | 7/2010 | |
| DE | 402010002800-0010 | | 7/2010 | |
| DE | 402010002800-0011 | | 7/2010 | |
| DE | 402010002800-0012 | | 7/2010 | |
| DE | 202012006671 | U1 | 8/2012 | |
| DE | 102012025617 | A1 | 10/2013 | |
| DE | 102013004590 | A1 | 9/2014 | |
| DE | 102013114520 | A1 | 6/2015 | |
| DE | 202016004315 | U1 | 8/2016 | |
| DE | 102015217545 | | 12/2016 | |
| DE | 202015106823 | U1 | 3/2017 | |
| DE | 102017122609 | A1 | 3/2019 | |
| EM | 000134804-0001 | | 6/2004 | |
| EM | 001606468-0001 | | 9/2009 | |
| EM | 001606468-0002 | | 9/2009 | |
| EM | 001682428-0001 | | 4/2010 | |
| EM | 001682428-0002 | | 4/2010 | |
| EM | 001682428-0003 | | 4/2010 | |
| EM | 001682428-0004 | | 4/2010 | |
| EM | 001682428-0005 | | 4/2010 | |
| EM | 001682428-0006 | | 4/2010 | |
| EM | 001781865-0001 | | 12/2010 | |
| EM | 001781865-0006 | | 12/2010 | |

(56) References Cited

FOREIGN PATENT DOCUMENTS

| | | | |
|---|---|---|---|
| EM | 001781865-0007 | | 12/2010 |
| EM | 001781865-0008 | | 12/2010 |
| EM | 001781899-0006 | | 2/2011 |
| EM | 001781899-0009 | | 2/2011 |
| EM | 002215897-0001 | | 8/2013 |
| EM | 002277574-0001 | | 8/2013 |
| EM | 002277574-0002 | | 8/2013 |
| EM | 002325209-0001 | | 11/2013 |
| EM | 002325209-0002 | | 11/2013 |
| EM | 002569467-0001 | | 11/2014 |
| EM | 002569467-0002 | | 11/2014 |
| EM | 002569467-0003 | | 11/2014 |
| EM | 002569467-0004 | | 11/2014 |
| EM | 002576728-0013 | | 11/2014 |
| EM | 002646935-0001 | | 3/2015 |
| EM | 002978569-0001 | | 2/2016 |
| EM | 003261668-0002 | | 7/2016 |
| EM | 003743905-0006 | | 2/2017 |
| EM | 004100048-0001 | | 9/2017 |
| EM | 004100048-0002 | | 9/2017 |
| EM | 004385409-0001 | | 10/2017 |
| EM | 004168789-0001 | | 11/2017 |
| EM | 004662039-0002 | | 3/2018 |
| EM | 004662039-0003 | | 3/2018 |
| EM | 005609583-0001 | | 8/2018 |
| EM | 005625977-0006 | | 9/2018 |
| EM | 005500311-0002 | | 10/2018 |
| EM | 005500311-0003 | | 10/2018 |
| EM | 005804747-0001 | | 10/2018 |
| EM | 005804762-0001 | | 10/2018 |
| EM | 005804770-0001 | | 10/2018 |
| EM | 005805140-0001 | | 10/2018 |
| EM | 005805199-0001 | | 10/2018 |
| EM | 006453072-0001 | | 5/2019 |
| EM | 006618583-0001 | | 10/2019 |
| EM | 006618583-0002 | | 10/2019 |
| EM | 006618583-0003 | | 10/2019 |
| EM | 006618583-0004 | | 10/2019 |
| EM | 007064233-0002 | | 11/2019 |
| EM | 007145461-0012 | | 11/2019 |
| EM | 007449095-0001 | | 1/2020 |
| EM | 007576806-0001 | | 2/2020 |
| EM | 007719141-0001 | | 3/2020 |
| EP | 0069419 | A1 | 1/1983 |
| EP | 0530067 | | 3/1993 |
| EP | 0587451 | A1 | 3/1994 |
| EP | 0221215 | B1 | 6/1995 |
| EP | 0670791 | A1 | 9/1995 |
| EP | 1000865 | A1 | 5/2000 |
| EP | 1059239 | A1 | 12/2000 |
| EP | 1080656 | A1 | 3/2001 |
| EP | 1442845 | A1 | 8/2004 |
| EP | 1475008 | A1 | 11/2004 |
| EP | 1880948 | A2 | 1/2008 |
| EP | 1921009 | A1 | 5/2008 |
| EP | 2024218 | A2 | 2/2009 |
| EP | 2107982 | A1 | 10/2009 |
| EP | 2236428 | A1 | 10/2010 |
| EP | 2330939 | A1 | 6/2011 |
| EP | 2344000 | A1 | 7/2011 |
| EP | 2387906 | A1 | 11/2011 |
| EP | 2412493 | A2 | 2/2012 |
| EP | 2441340 | A1 | 4/2012 |
| EP | 2522248 | A1 | 11/2012 |
| EP | 2543481 | A1 | 1/2013 |
| EP | 2745727 | | 6/2014 |
| EP | 2826394 | A1 | 1/2015 |
| EP | 2829484 | A1 | 1/2015 |
| EP | 2829485 | A1 | 1/2015 |
| EP | 2904926 | | 8/2015 |
| EP | 3013176 | | 5/2016 |
| EP | 3027078 | A1 | 6/2016 |
| EP | 3073852 | | 10/2016 |
| EP | 3216363 | A1 | 9/2017 |
| EP | 3351130 | | 7/2018 |
| EP | 3403521 | A1 | 11/2018 |
| EP | 3549480 | A1 | 10/2019 |
| EP | 3581059 | | 12/2019 |
| EP | 3402720 | B1 | 12/2020 |
| FR | 1198768 | A | 12/1959 |
| FR | 2179844 | A1 | 11/1973 |
| FR | 2223248 | A1 | 10/1974 |
| FR | 2638950 | A1 | 5/1990 |
| FR | 2689100 | A1 | 10/1993 |
| FR | 2711044 | A1 | 4/1995 |
| FR | 2712257 | A1 | 5/1995 |
| FR | 2809690 | A1 | 12/2001 |
| FR | 2870692 | A1 | 12/2005 |
| FR | 2912997 | A1 | 8/2008 |
| GB | 854540 | A | 11/1960 |
| GB | 1041392 | A | 9/1966 |
| GB | 2023550 | A | 1/1980 |
| GB | 2023551 | A | 1/1980 |
| GB | 2032814 | A | 5/1980 |
| GB | 2047073 | A | 11/1980 |
| GB | 2023549 | A | 9/1992 |
| GB | 2278874 | A | 12/1994 |
| GB | 2291042 | A | 1/1996 |
| GB | 2045135 | A | 2/1996 |
| GB | 2308803 | A | 7/1997 |
| GB | 2289713 | B | 12/1997 |
| GB | 2421713 | A | 7/2006 |
| GB | 2438189 | A | 11/2007 |
| GB | 2459111 | A | 10/2009 |
| GB | 4036176 | | 7/2014 |
| GB | 4037039 | | 10/2014 |
| GB | 9005804-0001 | | 10/2018 |
| GB | 9006576138-0004 | | 6/2019 |
| GB | 90066075520006 | | 7/2019 |
| GB | 2575671 | A | 1/2020 |
| ID | D0000002662-0001 | | 1/2003 |
| IL | 55179 | A | 7/1981 |
| IN | 302115731 | | 10/2012 |
| IN | 266778 | | 5/2015 |
| IN | 266779-0001 | | 5/2015 |
| IN | 276720 | | 2/2016 |
| IN | 108741519 | A | 11/2018 |
| JP | 64628827 | Y1 | 10/1971 |
| JP | S57-150175 | U | 9/1982 |
| JP | S60-164570 | A | 8/1985 |
| JP | H03-066374 | U | 6/1991 |
| JP | H0574275 | A | 3/1993 |
| JP | H07-102842 | A | 4/1995 |
| JP | H08-093298 | A | 4/1996 |
| JP | 2569734 | B2 | 1/1997 |
| JP | 2976179 | B2 | 11/1999 |
| JP | H11309011 | A | 11/1999 |
| JP | 2001-107621 | A | 4/2001 |
| JP | 3177720 | B2 | 6/2001 |
| JP | 3191248 | B2 | 7/2001 |
| JP | 3197227 | B2 | 8/2001 |
| JP | 2001-262907 | A | 9/2001 |
| JP | 3211023 | B2 | 9/2001 |
| JP | D1121506 | | 9/2001 |
| JP | 3225244 | B2 | 11/2001 |
| JP | D2001-10753 | | 6/2002 |
| JP | D1193948 | | 1/2004 |
| JP | 2004136941 | A | 5/2004 |
| JP | 2006122067 | A | 5/2006 |
| JP | D1312168 | | 10/2007 |
| JP | D2007-16058 | | 5/2008 |
| JP | D2007-16059 | | 5/2008 |
| JP | D1338388 | | 8/2008 |
| JP | D1382214 | | 3/2010 |
| JP | D1382215 | | 3/2010 |
| JP | D1397219 | | 9/2010 |
| JP | D1397346 | | 9/2010 |
| JP | D1408819 | | 3/2011 |
| JP | D1408988 | | 3/2011 |
| JP | 2014184051 | A | 10/2014 |
| JP | 3208907 | U | 2/2017 |
| JP | 6206200 | B2 | 10/2017 |
| JP | 6226662 | B2 | 11/2017 |
| JP | 2019119506 | A | 7/2019 |

(56) References Cited

FOREIGN PATENT DOCUMENTS

| | | | |
|---|---|---|---|
| JP | 1671282 | S | 11/2020 |
| KR | 100395931 | B1 | 8/2003 |
| KR | 3020030024985 | | 9/2003 |
| KR | 200362331 | Y1 | 9/2004 |
| KR | 20070101643 | A | 10/2007 |
| KR | 20070103598 | A | 10/2007 |
| KR | 3020070008850 | | 12/2007 |
| KR | 300492699.0000 | | 5/2008 |
| KR | 20090074289 | A | 7/2009 |
| KR | 100921297 | B1 | 10/2009 |
| KR | 101267451 | B1 | 5/2013 |
| KR | 300740505.0000 | | 4/2014 |
| KR | 300831147.0000 | | 12/2015 |
| KR | 300887228.0000 | | 12/2016 |
| KR | 300908948.0000 | | 6/2017 |
| KR | 300908949.0000 | | 6/2017 |
| KR | 300915252.0000 | | 7/2017 |
| KR | 20180037090 | A | 4/2018 |
| KR | 300968949.0000 | | 8/2018 |
| KR | 300982867.0000 | | 11/2018 |
| KR | 300983257.0000 | | 12/2018 |
| KR | 300990244.0000 | | 1/2019 |
| KR | 300990253.0000 | | 1/2019 |
| KR | 300996066.0000 | | 3/2019 |
| KR | 102054504 | B1 | 12/2019 |
| KR | 301037245.0000 | | 12/2019 |
| KR | 301037251.0000 | | 12/2019 |
| KR | 301050842.0000 | | 3/2020 |
| KR | 301541440002 | | 4/2020 |
| NL | 7504291 | A | 10/1975 |
| NL | 8903105 | A | 7/1991 |
| NL | 1032860 | C1 | 11/2006 |
| RU | 00100422 | U1 | 12/2010 |
| TR | 201708307-0001 | | 2/2018 |
| TW | M310869 | U | 5/2007 |
| WO | 9400034 | A1 | 1/1994 |
| WO | D032061-005 | | 4/1995 |
| WO | D035637-003 | | 2/1996 |
| WO | D036648-008 | | 6/1996 |
| WO | 9631140 | A1 | 10/1996 |
| WO | 9748613 | A1 | 12/1997 |
| WO | 0041937 | A1 | 7/2000 |
| WO | 0168477 | A1 | 9/2001 |
| WO | 02064445 | A1 | 8/2002 |
| WO | 03041529 | A1 | 5/2003 |
| WO | 04076291 | A2 | 9/2004 |
| WO | 06037302 | A1 | 4/2006 |
| WO | 08001029 | A1 | 1/2008 |
| WO | 2008034603 | A1 | 3/2008 |
| WO | 09028960 | A1 | 3/2009 |
| WO | 1135559 | A1 | 3/2011 |
| WO | 11135559 | A1 | 11/2011 |
| WO | 12000497 | A1 | 1/2012 |
| WO | 2012029119 | A1 | 3/2012 |
| WO | D078390-004 | | 11/2012 |
| WO | 13014670 | A1 | 1/2013 |
| WO | D080557-001 | | 4/2013 |
| WO | 2013126851 | A1 | 8/2013 |
| WO | 14131214 | A1 | 9/2014 |
| WO | 14193073 | A1 | 12/2014 |
| WO | 2015040526 | | 3/2015 |
| WO | 15087357 | A1 | 6/2015 |
| WO | 16072912 | A1 | 5/2016 |
| WO | 16091570 | A1 | 6/2016 |
| WO | 2017034992 | A1 | 3/2017 |
| WO | 17088278 | A1 | 6/2017 |
| WO | 17091899 | A1 | 6/2017 |
| WO | 17192694 | A1 | 11/2017 |
| WO | 2017191628 | A1 | 11/2017 |
| WO | 2018012675 | A1 | 1/2018 |
| WO | 2018086193 | A1 | 5/2018 |
| WO | 18169478 | A1 | 9/2018 |
| WO | 2019238228 | A1 | 12/2019 |
| WO | 2020030766 | A1 | 2/2020 |

OTHER PUBLICATIONS

Apr. 7, 2021—(CN) First Office Action—App. No. 202030815015.X.

www.amazon.com; website visited Oct. 6, 21; Pelican 1510 Case with Foam; Date First Available Oct. 2, 2001; https://www.amazon.com/Pelican-1510-Case-Foam-Black/dp/B0002SKHIK/ref=sr_1_123?dchild=1&keywords=wheeled+tool+box+for+flying&qid=16%E2%80%A6 (Year: 2001).

Halliburton Pursuit Aluminum Continental Carry-on Case, Site visited on Oct. 6, 2021; website captured on May 20, 2020 via wayback: https://web.archive.org/web/20200520103816/https://zerohalliburton.com/collections/luggage (Year: 2020).

2020 Dec. 2020—(CN) First Office Action—App. No. 201880036572.1.

Oct. 7, 2020—(WO) ISR & WO—PCT/US2020/026655.

amazon.com, "Pelican 015100-0050-110 Protector Carry-On Case Black w/TrekPak Insert: Camera & Photo," visited Oct. 16, 2019 and revisited Jan. 6, 2020 at https://www.amazon.com/Pelican-1510TP-Carry-TrekPak-Divider/dp/B01E4E1BFK/ref=sr_1_48?crid=3CJLVWN9DJ62R&keywords=carry+on+organizer+insert&qid=1571270299&sprefix=carry+on+organizer%2Caps%2C143&sr=8-48.

amazon.com, "Samsonite F'Lite GT 31" Hardside Wheeled Luggage (Vivid Blue)," visited Dec. 16, 2019 and revisited Jan. 7, 2020 at <https://www.amazon.com/Samsonite-Flite-Spinner-Black-Size/dp/B01LTG2XVC?th=1> Samsonite F'Lite GT 31" Hardside Wheeled Luggage (Vivid Blue).

alibaba.com, "Removable Spinner Wheels for Suitcase Replacement Suitcase Luggage," visited Dec. 16, 2019 and revisited Jan. 7, 2020 at https://www.alibaba.com/product-detail/Removable-Spinner-Wheels-For-Suitcase-Replacement_605641600.

amazon.com, "Lockable Tackle Box Fishing Waterproof Fly Fishing Box Double Sided Ice Fishing Tackle Case Box Storage Waterproof: 360 Degree Rubber Gasket, Durable Plastic Construction Double Sided Triangle-Cut For," visited Dec. 16, 2019 and revisited Jan. 7, 2020 at <https://www.amazon.com/Lockable-Tackle-Fishing-Waterproof-Storage/dp/B07MFF6S6N>.

yankodesign.com, "Vacuum Packed Suitcase," visited Dec. 16, 2019 and revisited Jan. 7, 2020 at <https://www.yankodesign.com/2011/11/28/vacuum-packed-suitcase/>.

alibaba.com, "Portable Luggage Wheels for Luggage Trolley Bags & Suitcase," visited Dec. 16, 2019 and revisited Jan. 7, 2020 at https://www.alibaba.com/product-detail/Portable-Luggage-Wheels-for-luggage-Trolley_1854722793.html.

Pelican Elite 50 Quart Cooler, available Nov. 9, 2016, [online], [site visited Mar. 31, 2018]. Available from internet, <URL: https://www.amazon.com/Pelican-Elite-Quart-Cooler-White/product-reviews/B01G7KG5PA/ref=cm_cr_getr_d_paging_btm_5?ie=UTF8&reviewerType=all_reviews&sortBy=recent&pageNumber=5 (Year:2016).

Pelican Storm Waterproof Case, available Jul. 27, 2009, [online], [site visited Mar. 31, 2018]. Available from internet, <URL: https://www.amazon.com/dp/B002JB07D8?aaxitk=EqSpVoa9QpKAGqst7rmxMA&pd_rd_i=B002JB07D8&pf_rd_m=ATVPDKIKX0DER&pf (Year: 2009).

Outdoor Products Small Watertight Dry Box, Blue, available May 31, 2016, [online], [site visited Mar. 31, 2018]. Available from internet, <URL: https://www.walmart.com/ip/Outdoor-Products-Small-Watertight-Dry-Box-Blue/26674162 (Year: 2016).

Sep. 20, 2018—(WO) International Search Report and Written Opinion—App. PCT/US2018/037100.

yeti.com, Images of Loadout Bucket Web Page visited on Mar. 17, 2020, at https://www.yeti.com/en_US/buckets/loadout-5-gallon-bucket/YLOB5.html?dwvar_YLOB5_color=white&cgid=buckets#start=1 <https://www.yeti.com/en_US/buckets/loadout-5-gallon-bucket/YLOB5.html?dwvar_YLOB5_color=white&cgid=buckets>.

northerntool.com, "Dewalt 28in. Wheeled Toolbox, Model# DWST28100," visited on Apr. 6, 2020 at https://www.northerntool.com/shop/tools/product_200726534_200726534.

(56) References Cited

OTHER PUBLICATIONS walmart.com, "Sterilite 151L Black Wheeled Industrial Tote," visited on Apr. 6, 2020 at https://www.walmart.ca/en/ip/sterilite-1511-black-wheeled-industrial-tote/6000195957310.
globalindustrial.com, "Contico UK3725-4 Rolling Pro Tuff Work Box," visited on Apr. 6, 2020 at https://www.globalindustrial.com/p/tools/tool-storage/Jo-Site/rolling-pro-tuff-work-box?infoParam.campaignId=T9F.
amazon.com, "Grey: Akro-Mils 33105 Akro-Grid Slotted Divider Plastic Tote Box," visited on Apr. 6, 2020 at https://www.amazon.in/Grey-Akro-Mils-Akro-Grid-Slotted-Divider/dp/B004C044VU.
globalindustrial.com, "Global Industrial™ Plastic Dividable Grid Container," visited on Apr. 6, 2020 at https://www.globalindustrial.com/p/storage/bins-totes-containers/dividable-grid/grid-wall-bin-stackable-1.
globalindustrial.com, "Straight Wall Container Solid," visited on Apr. 6, 2020 at https://www.globalindustrial.com/p/storage/bins-totes-containers/stacking-containers/straight-wall-container-12x7-2-5x5.
Oct. 18, 2021—(WO) International Search Report & Written Opinion—PCT/US21/023632.
Aug. 13, 2020—(WO) Partial International Search—PCT/US2020/026655.
May 12, 2020—(WO) Partial International Search—PCT/US2020/012404.
Mar. 29, 2022—(CN) First Office Action—Appl. No. 202080008216.6.
Jan. 28, 2022—(JP) Office Action—App. No. 2019566933.
9to5toys.com, Site visited Dec. 28, 21, "Review, Pelican's Impressive Elite Luggage is built like a tank, but is it worth the price tag?" Published by Justin Kahn on May 29, 2016, https://9to5toys.com/2016/05/29/review-pelicans-impressive-elite-luggage-is-built-like-a-tank-but-is-it-worth-the-price-tag/ (Year: 2016).
Amazon.ca, Site visited Dec. 27, 2021, Trolley Box Suitcase by Yadsheng, First available Sep. 23, 2019, https://www.amazon.ca/Suitcase-Universal-Portable-Hardshell-Business/dp/B07Y7R8RN1 (Year: 2019).
Amazon.ca, Site visited Dec. 27, 2021, Bamboo Wolf Hardside Suitcase, First available May 29, 2020, https://www.amazon.ca/Aluminum-Hardside-Suitcase-Business-Travelling/dp/B085M1CB6J (Year: 2020).
Amazon.ca, Site visited Dec. 28, 2021 , Rimowa Suitcase, First available Jan. 25, 2017, https://www.amazon.ca/Rimowa-Classic-Luggage-Multiwheel-Suitcase/dp/B01N6NEIIX (Year: 2017).
Amazon.ca, Site visited Dec. 28, 2021 , Travelking Spinner Suitcase, First available May 4, 2017, https://www.amazon.ca/Multi-size-Aluminum-Luggage-Suitcase-TravelKing/dp/B06Y53X785 (Year: 2017).
Amazon.ca, Site visited Dec. 28, 2021 , LEVEL8 Gibraltar Suitcase, First available Jan. 24, 2019, https://www.amazon.ca/dp/B07MX224X5 (Year: 2019).
Amazon.ca, Site visited Dec. 28, 2021, Samsonite Centric, First available Sep. 20, 2017, https://www.amazon.ca/Samsonite-Ce 1ntric-Hardside-Expandable-Luggage/dp/B074VJYRZN (Year: 2017).
Whereintheworldisnina.com, Site visited Dec. 28, 21, "Choosing the Best Hard Shell Luggage for your Trip" by Nina Ragusa published on Apr. 29, 2019 Features the Maxlite, Timberland, and Level8 luggage cases with compression straps, https://whereintheworldisnina.com/best-hard-shell-luggage/ (Year: 2019).
Nytimes.com, Site visited Dec. 28, 21, "Are Away Carry-Ons Worth the Hype" by Kit Dillon published on May 19, 2020 Features the Muji Carry-on with compression strap, https://www.nytimes.com/wirecutter/reviews/are-away-carry-ons-worth-the-hype/ (Year: 2020).
Amazon.ca, Site visited Dec. 28, 2021, Bamboo Wolf Hard Shell Luggage, First available May 29, 2020, https://www.amazon.ca/Aluminum-Magnesium-Hardside-Suitcase-Zipperless-Business/dp/B085M1CB6J (Year: 2020).
Apr. 19, 2022—(JP) Office Action—App. No. 2021-012889.
Jun. 28, 2022—(JP) Office Action—App. No. 2021539546.
Jul. 6, 2022—(AU) Examination Report No. 1—App. No. 2020204740.
May 13, 2022—(CN) Office Action—App. No. 202210270032.8.
Jul. 13, 2022—(CN) First Office Action—App. No. 202080025625.7.
Jun. 3, 2022—(WO) International Search Report and Written Opinion—PCT/US2022/063684.
Sep. 2, 2022—(CN) Second Office Action—App. No. 202080008216.6.
Nordstrom.com, Rimowa Original Cabin 22-Inch Wheeled Carry-On, Oldest review dated Apr. 14, 2019, https://www.nordstrom.com/s/ rimowa-original-cabin-22-inch-wheeled-carry-on/5102644 (Year: 2019).
Youtube.com, Site visited Sep. 28, 2022, "Carl Friedrik 'The Carry-On' First Look," published by Bo Ismono on Jun. 21, 2020 features the Carl Friedrik carry on, https://youtu.be/XYCU00WAIO4 (Year: 2020).
Amazon.com, site visited Sep. 29, 2022, SureSeal by FireKing Waterproof Fireproof Safe Chest, first available Aug. 10, 2012, https://www.amazon.com/dp/B008VXQ72I (Year: 2012).
phphotovideo.com, site visited Sep. 29, 2022, Nanuk 935 Wheeled Hard Utility Case, oldest review dated Jul. 1, 2014, https://www.bhphotovideo.com/c/product/1504694-REG/nanuk_935_6005_935_waterproof_hard_case.html (Year: 2014).
Amazon.ca, Site visited Sep. 28, 2022, Delsey Titanium Spinner Luggage, First available Oct. 27, 2014, https://www.amazon.ca/Delsey-Luggage-Titanium-Spinner-Trolley/dp/B00MQFOQTM?th=1 (Year: 2014).
Amazon.ca, Site visited Sep. 28, 2022, Nanuk Waterproof Hard Case, First available Nov. 13, 2019, https://www.amazon.ca/Nanuk-Waterproof-Hard-Case-Wheels/dp/B07YXLQX4Z (Year: 2019).
Sep. 27, 2022—(JP) Office Action—App. No. 2021-559258.
Dec. 2, 2022—(CA) Office Action—App. No. 3125465.
Oct. 8, 2022—(CN) OA—App No. 202110925931.2.
Newatlas.com, site visited Oct. 18, 2022, "The Survivor—Griffin's military grade iPhone 4 Case" published by Ben Coxworth on Feb. 23, 2011 features the Griffin Technology Survivor Extreme Duty Case, https://newatlas.com/survivor-military-grade-iphone-case/17956/ (Year: 2011).
Amazon.com, site visited Oct. 18, 2022, Ballistic Store Hard Core Case, first available Nov. 19, 2011, https://www.amazon.com/ Ballistic-Built-Screen-Protection-Holster/dp/B0069WKPRQ?th=1 (Year: 2011).
Bhphotovideo.com, Site visited Sep. 28, 2022, Pelican BA22 Elite Carry-On Luggage, Oldest review dated Sep. 23, 2017, https://www.bhphotovideo.com/c/product/1073813-REG/pelican_lg_ba22_gryblk_22_elite_carry_on_luggage. html/reviews (Year: 2017).
Aug. 3, 2022—(EP) Extended Search Report—App. No. 22162500.7.
Aug. 29, 2022—(AU) Examination Report No. 1—App. No. 2020256255.
Feb. 13, 2023—(CN) Office Action—App. No. 202080008216.6.
Jan. 4, 2023—(CA) Office Action—App. No. 3135401.
Feb. 9, 2023—(JP) Office Action—App. No. 2021539546.
Mar. 1, 2023—(AU) Examination Report No. 2—App. No. 2020204740.
Mar. 17, 2023—(CN) Decision of Rejection—App. No. 202080025625.7.
Jul. 22, 2023—(NZ) Examination Report 1—App. No. 780708.
GoBox 60 Gear Case, YETI, [online], [site visited Apr. 18, 2023], Available from internet URL: https://www.yeti.com/cargo/storage/26010000216.html (Year: 2023).
Apr. 28, 2023—(NZ) Examination Report No. 1—App. No. 777933.
May 31, 2023—(AU) Examination Report No. 1—App. No. 2018284207.
May 10, 2023—(MX) Office Action—App. No. MX/a/2019/014178.
Mar. 27, 2023—(MX) Office Action—App. No. MX/f/2021/001747.
Mar. 27, 2023—(MX) Office Action—App. No. MX/f/2021/001748.
May 23, 2023—(CA) Office Action—App. No. 3063924.
Jan. 27, 2024—(CN) First Office Action—App. No. 2022102700328.
Jan. 30, 2024—(NZ) Examination Report 2—App. No. 780708.
Amazon.com, "Top Shelf Custom Injection Molded ABS Saddlebag Organizer Tray, 2014—Current H-D ABS Hard Bags, LFT by Advanced Accessory Concepts LLC," visited Oct. 16, 2019 and

(56) References Cited

OTHER PUBLICATIONS revisited Jan. 6, 2020 at https://www.amazon.com/Custom-Injection-Molded-Saddlebag-Organizer/dp/B01MQWBM40/ref=sr_1_38?keywords=luggage+hard+removable+liner&qid=1571270714&sr=8-38.

Amazon.com, "TCMT Matt Black Chopped Tour Pack Trunk w/Backrest Fits for Hanley Street Road Glide 2014-2020 (Style B) by TCMT," visited Oct. 16, 2019 and revisited Jan. 6, 2020 at https://www.amazon.com/dp/B07HF5B4GZ/ref=sspa_dk_detail_4?psc=1&pd_rd_i=B07HF5B4GZ&pd_rd_w=uELhs&pf_rd_p=45a72588-80f7-4414-9851-786f6c16d42b&pd_rd_wg=znxNS&pf_rd_r=CMA8KMTKC06Z9AWC3AXR&pd_rd_r=bc0dd153-aad3-42a3-97ee-afa879cb28ce&spLa=ZW5jcnlwdGVkUXVhbGlmaWVyPUEyVkdHUzFKRkswRko4JmVuY3J5cHRlZElkPUEwNzA1MDE5MkoxU0U3M0k1MEtENCZlbmNyeXB0ZWRBZElkPUEwNTE4ODQwMk1GV1hXMTAzSzA0WiZ3aWRnZXROYW1lPXNwX2RldGFpbCZhY3Rpb249Y2xpY2tSZWRpcmVjdCZkb05vdExvZ0NsaWNrPXRydWU=.

Amazon.com, "HardBagger Top Shelf Hard Saddlebag Organizer—Right or Left TS100HD by HardBagger," visited Oct. 16, 2019 and revisited Jan. 6, 2020 at https://www.amazon.com/HardBagger-Shelf-Hard-Saddlebag-Organizer/dp/B0041CAJ68/ref=pd_sbs_107_3/137-9152864-6335412?encoding=UTF8&pd_rd_i=B0041CAJ68&pd_rd_r=85c91ba5 e063-4cbd-a422-08e9f9939710&pd_rd_w=TgWdQ&pd_rd_wg=RDGt1&pf_rd_p=52b7592c-2dc9-4ac6-84d4-4bda6360045e&pf_rd_r=FNWTBG4AHKR8D3VF3FNX&psc=1&refRID=FNWTBG4AHKR8D3VF3FNX.

Amazon.com, "Pelican Air 1615 Travel Case—Suitcase Luggage (Blue) by Pelican," visited Oct. 16, 2019 and revisited Jan. 6, 2020 at https://www.amazon.com/Pelican-Air-1615-Travel-Case/dp/B07XGHDK66?ref_=ast_sto_dp.

Lowe's, "CRAFTSMAN 37-in Black Plastic Wheels Lockable Tool Box," https://www.lowes.com/pd/CRAFTSMAN-37-in-Black-Plastic-Wheeled-Lockable-Tool-Box/1000578337.

Home Depot, "Husky 37 in. Rolling Tool Box Utility Cart Black," <https://www.homedepot.com/p/Husky-37-in-Rolling-Tool-Box-Utility-Cart-Black-209261/203668066>.

B&H, "Nanuk 960 Protective Rolling Case with Dividers and Organizer (Black)," https://www.bhphotovideo.com/c/product/1504703-REG/nanuk_960_6001_960_waterproof_hard_case.html.

Toolguyd, "Milwaukee Packout Tool Boxes and Storage System, In Photos," https:/www.google.com/imgres?imgurl=https%3A%2F%2Ftoolguyd.com%2Fblog%2Fwp-content%2Fuploads%2F2017%2F06%2FMilwaukee-Packout-Tool-Storage-Roller-Tool-Cart-Open-Lid-with-Tool-Tote.jpg&imgrefurl=https%3A%2F%2Ftoolguyd.com%2Fmilwaukee-packout-tool-boxes-photo-introduction%2F&tbnid=BjPIghKBhANZGM&vet=12ahUKEwj8ibH3usXpAhX9QTABHQxBCPwQMyhTegUIARCZAw..i&docid=Vg4bvoeFnEtXfM&w=457&h=600&q=tote&20lid%20with%20flexible%20attachment%20of%20items&ved=2ahUKEwj8ibH3usXpAhX9QTABHQxBCPwQMyhTegUIARCZAw#spf.

* cited by examiner

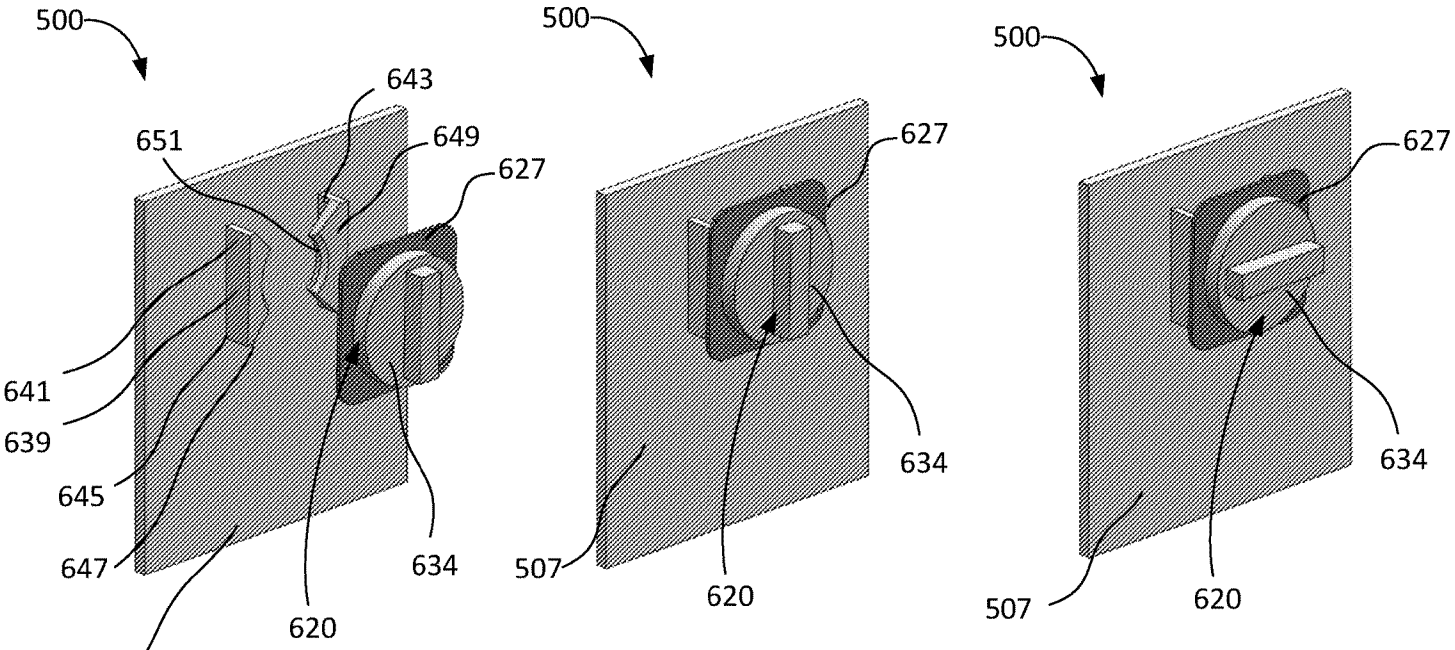
FIG. 43D
FIG. 43C
FIG. 43B
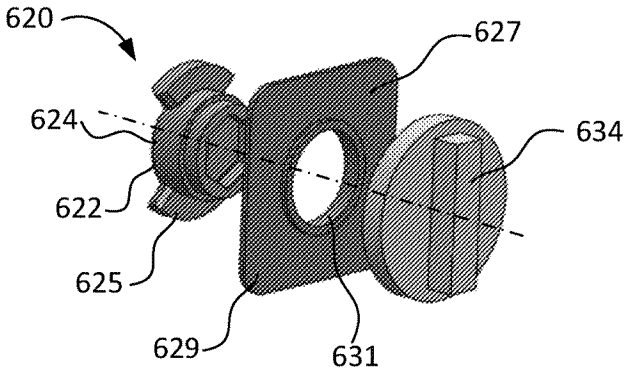
FIG. 43E

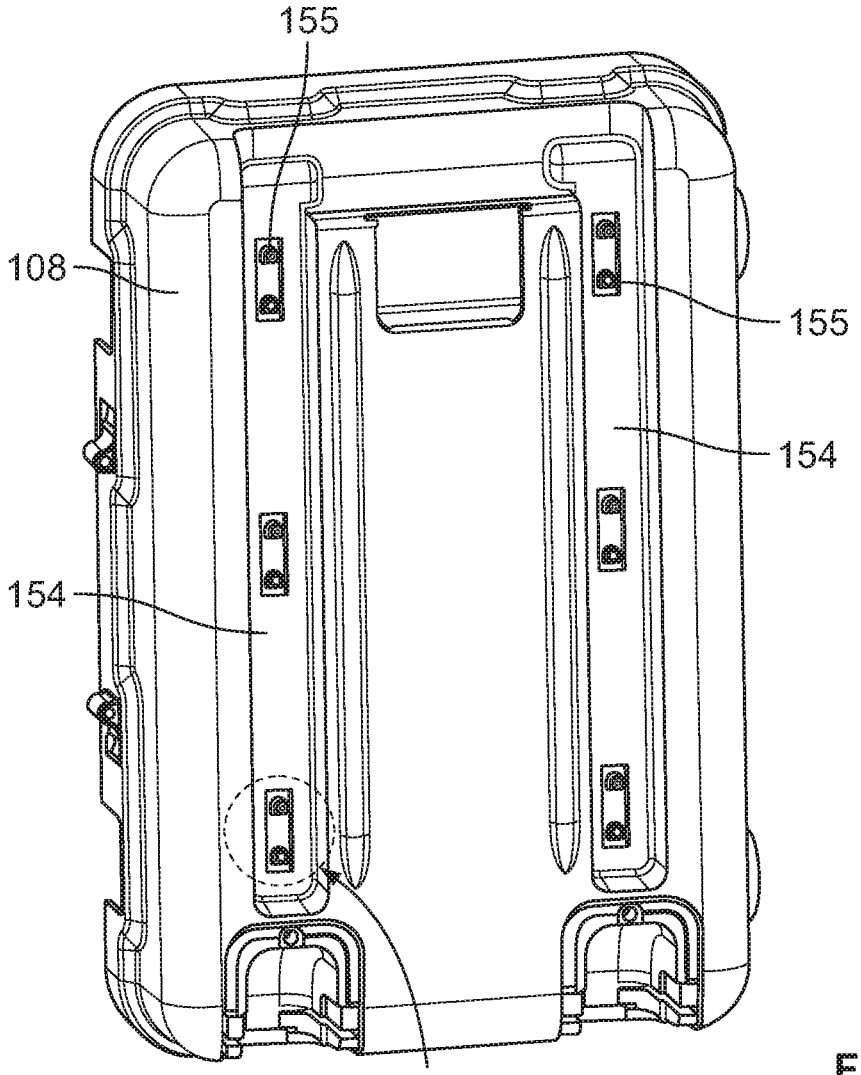
FIG. 57B
FIG. 57A
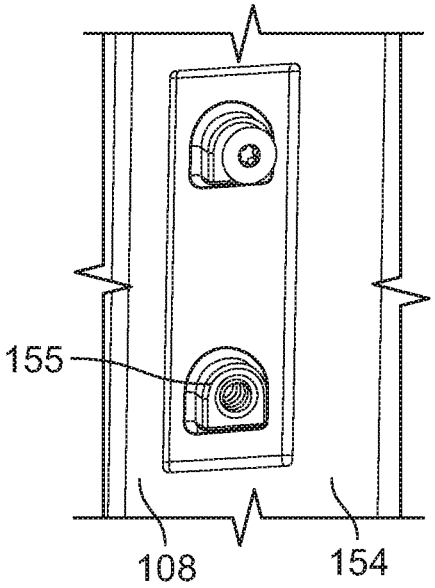
FIG. 57B

LUGGAGE SYSTEM

CROSS-REFERENCE TO RELATED APPLICATIONS

The present application is a continuation-in-part of U.S. patent application Ser. No. 16/735,013 filed on Jan. 6, 2020, which claims priority to U.S. Provisional Patent Application No. 62/788,886 filed on Jan. 6, 2019 and U.S. Provisional Patent Application No. 62/788,888 filed on Jan. 6, 2019. The present application also claims priority to U.S. Provisional Patent Application No. 62/830,203 filed on Apr. 5, 2019. All of the above referenced applications are incorporated by reference in their entirety.

FIELD OF INVENTION

This disclosure relates to luggage and luggage systems.

BACKGROUND

Suitcases may be used for transporting clothing, footwear, and other materials or items.

However, the demands of travel can sometimes cause damage to the suitcase of damage to their contents. Either traveling by airplane or traveling by automobile, a durable and waterproof suitcase may be needed to protect the contents within a suitcase. For ease of movement, a trolley handle gives a user a simple means to pull or push a wheeled suitcase.

BRIEF SUMMARY

Aspects of this disclosure may relate to a suitcase having a base including: a first shell structure having a first side and a second side opposite the first side, where the first shell structure has a first end and a second end opposite the first side and where the first side has a first outward facing surface and a second outward facing surface. The second outward facing surface may be offset a first fixed distance from the first outward facing surface. The first shell structure may have a bottom portion connected to a first end of the first shell structure and configured to support the suitcase on a surface. A first interior void may be defined by the first shell structure and the bottom portion, and a lower latch recess may be located in the second outward facing surface, where the lower latch recess includes a rear surface, a lower surface, and a pair of side surfaces. The suitcase may also include a lid rotatably connected to the base, where the lid includes: a second shell structure having a third side and a fourth side opposite the third side, where the second shell structure includes a third end and a fourth end opposite the third end. The third side may have a third outward facing surface and a fourth outward facing surface, where the fourth outward facing surface may be offset a second fixed distance from the third outward facing surface. The second shell structure may also include a top portion connected to a third end of the second shell structure. A second interior void may be defined by the second shell structure and the top portion; and an upper latch recess located in the second outward facing surface. A latch assembly may be located within the lower latch recess and the upper latch recess, where the lower latch recess and the upper latch recess have a depth that is greater than a thickness of the latch assembly. Additionally, when the suitcase is in a closed configuration, a perimeter of the latch assembly is located within a combined perimeter of the upper latch recess and lower latch recess. The lid may be free of openings that extend through the first outward facing surface into the second interior void. The second outward facing surface may extend along an entire perimeter of the base. The fourth outward facing surface may also extend along an entire perimeter of the lid. The lid is rotatably connected to the base by at least one hinge. A portion of the at least one hinge may be located in an upper hinge recess and a lower hinge recess, where the lower hinge recess is located in the second outward facing surface and the upper hinge recess is located in the fourth outward facing surface.

Still other aspects of this disclosure may relate to a suitcase with a lid connected to a base by at least one hinge, where the at least one hinge comprises at least two linkages, and when the suitcase is in an open configuration, the at least one hinge defines a rotational axis and the rotational axis is located outside of a rear edge of the base and a rear edge of the lid. The base may include a pair of wheel assemblies, where each wheel assembly is attached into a wheel recess formed in the base, and where each wheel assembly includes a wheel housing and a wheel. Each housing may include an outward facing flange surface that is spaced outward a fixed distance from adjacent surfaces of the base around the wheel recess. The bottom portion of the base may also include a tapered region located between the pair of wheel assemblies, where the tapered region forms an angle within a range of 1 degree and 30 degrees when measured from a central portion of the bottom portion to a lower surface of the tapered region. The base may include a second end surface along the second end of the first shell structure, and the lid includes a fourth end surface along the fourth end of the second shell structure, and when the suitcase is in a closed configuration, the second end surface and the fourth end surface are spaced apart from each other. The second end surface may include a sealing rib that protrudes from the second end surface and the fourth end surface may include a channel that receives a gasket, and when the suitcase is in the closed configuration, the rib engages the gasket. The base may include a plurality of ribs that extend from a surface underneath the lower latch recess to an interior surface of the bottom portion, where each rib of the plurality of ribs is spaced apart from each other by a distance within a range of 8 to 10 times a thickness of each rib. A first volume of the first interior void may be within 10 percent of a second volume to the second interior void. Still additional aspects of this disclosure may relate to a suitcase having a base including: a first shell structure having a first side and a second side opposite the first side, where the shell structure has a first end and a second end opposite the first end and where the first side has a first outward facing surface and a second outward facing surface. The second outward facing surface may be offset a first fixed distance from the first outward facing surface. The first shell structure may also include a bottom portion connected to a first end of the first shell structure. A first interior void may be defined by the first shell structure and the bottom portion; and a lower hinge recess may be located in the second outward facing surface. A lid may be rotatably connected to the base, where the lid includes: a second shell structure having a third side and a fourth side opposite the third side, the shell structure having a third end and a fourth end opposite the third end. The third side may have a third outward facing surface and a fourth outward facing surface, where the fourth outward facing surface is offset a second fixed distance from the third outward facing surface. The second shell structure may have a top portion connected to the third end of the shell structure; and a second interior void may be defined by the second shell structure and the top portion. A hinge assembly may be at least partially received within the lower hinge recess, where the lid is rotatably connected to the base by the hinge assembly. The hinge assembly may include at least two linkages. When the suitcase is in an open configuration, the at least one hinge assembly may define a hinge axis where the hinge axis is located outside of a rear edge of the base and a rear edge of the lid. The hinge assembly may be at least partially received in an upper hinge recess, where the upper hinge recess is located within the fourth outward facing surface. In some examples, the hinge assembly includes three hinge assemblies. Each hinge assembly may include a base hinge insert and a lid hinge insert, where the base hinge insert and the lid hinge insert both include a cavity that at least partially receives the at least two linkages. The recess of the base hinge insert has a depth that is greater than a thickness of the at least two hinges. The at least two linkages may include a first linkage and a second linkage, where the first linkage includes a first linkage opening and a second linkage pin. For example, a first linkage pin may extend through the first linkage opening and into the base hinge insert, and where a second linkage pin extends through the second linkage opening and into the lid hinge insert.

Yet additional aspects of this disclosure may relate to a method for forming a suitcase, including: (a) molding a base shell, where the base shell has a plurality of lower latch recesses, a plurality of lower hinge recesses, a base shell structure, and a base interior void; (b) molding a lid shell, where the lid shell has a plurality of upper latch recesses and a plurality of upper hinge recesses, an lid shell structure, and a lid interior void; (c) placing the base shell and the lid shell adjacent each other, wherein the base interior void and the lid interior void are both facing the same direction and wherein the lower hinge recess and the upper hinge recess are facing towards each other; (d) placing a first portion of the hinge assembly into the lower hinge recess; (e) placing a second portion of the hinge assembly into the upper hinge recess; (f) securing the first portion of the hinge assembly to the base using a first mechanical fastener; (g) securing the second portion of the hinge assembly to the lid using a second mechanical fastener; (h) placing a latch assembly into the upper latch recess; and (i) securing the latch assembly to the lid using a third mechanical fastener, where the first mechanical fastener, the second mechanical fastener, and the third mechanical fastener are all oriented generally parallel to each other. The first mechanical fastener may be oriented generally parallel to the third side of the lid shell. The method may also include attaching the wheel assembly into a wheel recess on the base shell using a fourth mechanical fastener, where the fourth mechanical fastener is oriented generally parallel to the first mechanical fastener. In addition, the method may include attaching the portion of the latch assembly to a lid latch mount prior to placing the portion of the latch assembly into the upper latch recess, where the lid latch mount includes a body member and a flange, where the flange extends on outward from the body member and wherein the body member of the lid latch mount is received within the upper latch recess. The method may also include securing the lid latch mount to the lid shell with the third mechanical fastener that extends through an opening in the flange and into a thickened portion of the lid shell.

Other aspects of this disclosure may relate to a suitcase that has a base that includes a first shell structure having a first side and a second side opposite the first side, where the first shell structure having a first end and a second end opposite the first end. A bottom portion may be connected to the first end of the first shell structure and configured to support the suitcase on a surface. A first interior void may be defined by the first shell structure and the bottom portion, and a lower latch recess may be located within the second outward facing surface, where the lower latch recess has a rear surface, a lower surface, and a pair of side surfaces. A lid may be rotatably connected to the base, where the lid includes a second shell structure having a third side and a fourth side opposite the third side. The second shell structure may also have a third end and a fourth end, where a top portion is connected a top portion connected to the third end of the second shell structure; and a second interior void defined by the second shell structure and the top portion. An interior liner may be releasably secured to either the base shell within the first interior void or the lid within the second interior void, where the interior liner includes at least one storage cavity recessed from an upper surface of the liner and includes a liner attachment assembly that releasably engages a base attachment member. The liner attachment assembly may be permanently attached to the interior liner, and the base attachment member may be permanently attached to an interior surface of the suitcase. The liner attachment assembly may include a grip member that is rotated a predetermined amount to move the liner attachment assembly from an unlocked position to a locked position. When the liner attachment assembly is in the unlocked position, the liner is secured to the suitcase and when the liner attachment assembly is in the unlocked position, the liner is allowed to be removed from the suitcase.

Additional aspects may relate to a liner that is releasably secured to a suitcase by a liner attachment assembly, where the liner attachment assembly may include a tail member, a flange member, and the grip member, where the tail member includes a tail body member with a locking projection extending outwardly from the tail body member. The tail body member may have a generally cylindrical shape. In some examples, the locking projection may comprise two locking projections that are arranged opposite each other and where each locking projection may include at least one tapered surface. The flange member may include a flange opening that receives a portion of the tail member, and where the grip member may attach to the portion of the tail member that extends into the flange opening. The liner attachment assembly may be moved to the locked position from the unlocked position by rotating the grip member approximately 90 degrees in a first direction, and the liner attachment assembly is moved to the unlocked position from the locked position by rotating the grip member approximately 90 degrees in a second direction, where the second direction is opposite the first direction. The base attachment member may include a first wall and a second wall where each wall extends away from the interior surface of the base with a first end at the interior surface and a second end opposite the first end. The first wall may include a first base locking projection located at the second end that extends toward the second wall and the second wall may include a second base locking projection located at the second end that extends toward the first wall. When the liner attachment assembly is in the locked position, the locking projection of the liner attachment assembly is at least partially positioned underneath the first base locking projection or the second base locking projection.

Another aspect of this disclosure may relate to a suitcase including a first shell structure having a first side and a second side opposite the first side, where the first shell structure has a first end and a second end opposite the first end and where the first shell structure has a first outward facing surface and a second outward facing surface. The second outward facing surface may be offset a first fixed distance from the first outward facing surface. The first shell structure may also include a bottom portion connected to a first end of the first shell structure. A first interior void may be defined by the first shell structure and the bottom portion; and a lower hinge recess may be located in the second outward facing surface. A lid may be rotatably connected to the base, where the lid includes: a second shell structure having a third side and a fourth side opposite the third side, the shell structure having a third end and a fourth end opposite the third end. The second shell structure may have a third outward facing surface and a fourth outward facing surface, where the fourth outward facing surface is offset a second fixed distance from the third outward facing surface. The second shell structure may have a top portion connected to a third end of the shell structure, and a second interior void may be defined by the second shell structure and the top portion. The suitcase may include an extendable trolley handle, where the trolley handle includes: (a) a pair of nested extrusion assemblies, where each extrusion assembly includes a major extrusion and a minor extrusion, and where the minor extrusion is nested within a central opening of the major extrusion, and slidably engaged with the major extrusion; and (b) a grip connected to the minor extrusion of each of the pair of extrusion assemblies, where the grip includes a release button. The grip may include a release button that when pressed actuates a rack and pinion gear assembly located within the grip to allow the trolley handle to extend. The rack and pinion gear assembly may include a pair of rack gear members, where each rack gear member includes an engaging member that contacts a portion of the release button, a rack gear portion. Each rack gear portion may engage a pinion gear to equalize movement of the rack gear members and where the engaging member has a first angled surface that engages the release button, where the first angled surface includes a compound angle relative to an upper surface of the base member. Each rack gear member may also include a transmitting member at an end opposite the rack gear member, where the transmitting member has a second angled surface that contacts a third angled surface on an activating member, where the activating member disengages a locking mechanism for the trolley handle assembly.

In addition, further aspects of this disclosure may relate to a suitcase that includes an extendable trolley handle assembly that includes: (a) a pair of extrusion assemblies, where each extrusion assembly includes a major extrusion and a minor extrusion, where the minor extrusion is nested within a central opening of the major extrusion, and slidably engaged with the major extrusion and (b) a grip portion connected to the minor extrusion of each of the pair of extrusion assemblies, where the extrusion assembly is at least partially secured to the base by a plurality of mounting clips that are mounted to an outward facing surface of the bottom portion of the base. The plurality of mounting clips may be secured within a recess along the bottom portion of the base and may also be evenly spaced apart within the recess. Each mounting clip may be secured within a pocket located within the recess. Additionally, each mounting clip of the plurality of mounting clips may include a central body with a top end, a bottom end, a front side, a rear side, and an outer spring arm. The major extrusion may have a plurality of receivers, where the outer spring arm of one of the plurality of mounting clips engages a first receiver of the plurality of receivers to secure the major extrusion to the base. The number of receivers may be equal to a number of outer spring arms on each mounting clip. The suitcase may also have a bottom cap attached to the recess that contacts the major extrusion to prevent the major extrusion from moving in a direction toward a plane created by axes of a plurality of wheels. The trolley handle assembly may further comprise a major bushing positioned between the major extrusion and the minor extrusion, where the major bushing includes an upper lip that contacts an end surface of the major extrusion and a central opening that receives the minor extrusion. The upper lip may have a plurality of inward facing grooves.

Still additional aspects of this disclosure may relate to a suitcase with an extendable trolley handle assembly that has (a) a pair of extrusion assemblies, where each extrusion assembly includes a major extrusion and a minor extrusion and (b) a grip portion connected to the minor extrusion of each of the pair of extrusion assemblies, where the grip portion includes a release button for the trolley handle assembly. The minor extrusion may be nested within a central opening of the major extrusion, and slidably engaged with the major extrusion. The release button of the grip portion may actuate a rack and pinion gear assembly located within the grip portion to allow the trolley handle assembly to extend or contract. The rack and pinion gear assembly may include a pair of rack gear members, where each rack gear member includes an engaging member that contacts a portion of the release button, a rack gear portion. Each rack gear portion may engage a pinion gear to equalize movement of the rack gear members. A gasket may be positioned around a perimeter of the release button. One of the extrusion assemblies may be at least partially secured to the base by a plurality of mounting clips that are mounted to an outward facing surface of the bottom portion of the base. The plurality of mounting clips are secured within a recess along the bottom portion of the base.

Another aspect of this disclosure relates to a suitcase with an extendable trolley handle assembly that includes: (a) a pair of extrusion assemblies, where each extrusion assembly includes a major extrusion and a minor extrusion and (b) a grip portion extending between the pair of extrusion assemblies connecting the pair of extrusion assemblies. The minor extrusion may be nested within a central opening of the major extrusion and also slidably engaged with the major extrusion. A first extrusion assembly of the pair of extrusion assemblies may be at least partially secured to the base by a first plurality of mounting clips that are mounted to the base and a second extrusion assembly of the pair of extrusion assemblies is at least partially secured to the base by a second plurality of mounting clips that are mounted to the base. Each mounting clip of the first plurality of mounting clips and the second plurality of mounting clips may include a central body with a top end, a bottom end, a front side, a rear side, and a spring arm. Each pair of extrusion assemblies may further include a tertiary extrusion that is nested within a central opening of the minor extrusion, and slidably engaged with the minor extrusion. The first plurality of mounting clips are attached to the base within a first recess that extends along an outward facing surface of the bottom portion and the second plurality of mounting clips may be attached to the base within a second recess that extends along the outward facing surface of the bottom portion. The first recess may be substantially parallel to the second recess. A first bottom cap may be positioned in the first recess and may also contact the major extrusion of the first extrusion assembly to prevent the major extrusion from moving within the first recess in a direction toward a plane created by axes of a plurality of wheels. The first bottom cap may include an opening in a bottom surface. The first extrusion assembly may further include a major bushing positioned between the major extrusion and the minor extrusion, where the major bushing has an upper lip that contacts an end surface of the major extrusion and a central opening that receives the minor extrusion. Additionally, the upper lip may have a plurality of inward facing grooves.

BRIEF DESCRIPTION OF THE DRAWINGS

The present invention is illustrated by way of example and not limited in the accompanying figures in which like reference numerals indicate similar elements and in which:

FIG. 43B is a perspective partial exploded view of an alternate attachment assembly for an interior liner with the liner removed of the suitcase of FIG. 35 according to one or more aspects described herein.

FIG. 43C is a perspective partial view of the attachment assembly of FIG. 43B according to one or more aspects described herein.

FIG. 43D is a perspective partial view of the attachment assembly of FIG. 43B according to one or more aspects described herein.

FIG. 43E is a perspective exploded view of the liner attachment assembly of FIG. 43B according to one or more aspects described herein.

FIG. 57A is a rear perspective view of the shell of the suitcase of FIG. 1 with the trolley handle removed for clarity according to one or more aspects described herein.

FIG. 57B is an enlarged partial rear perspective view of FIG. 57A according to one or more aspects described herein.

Figure 1:
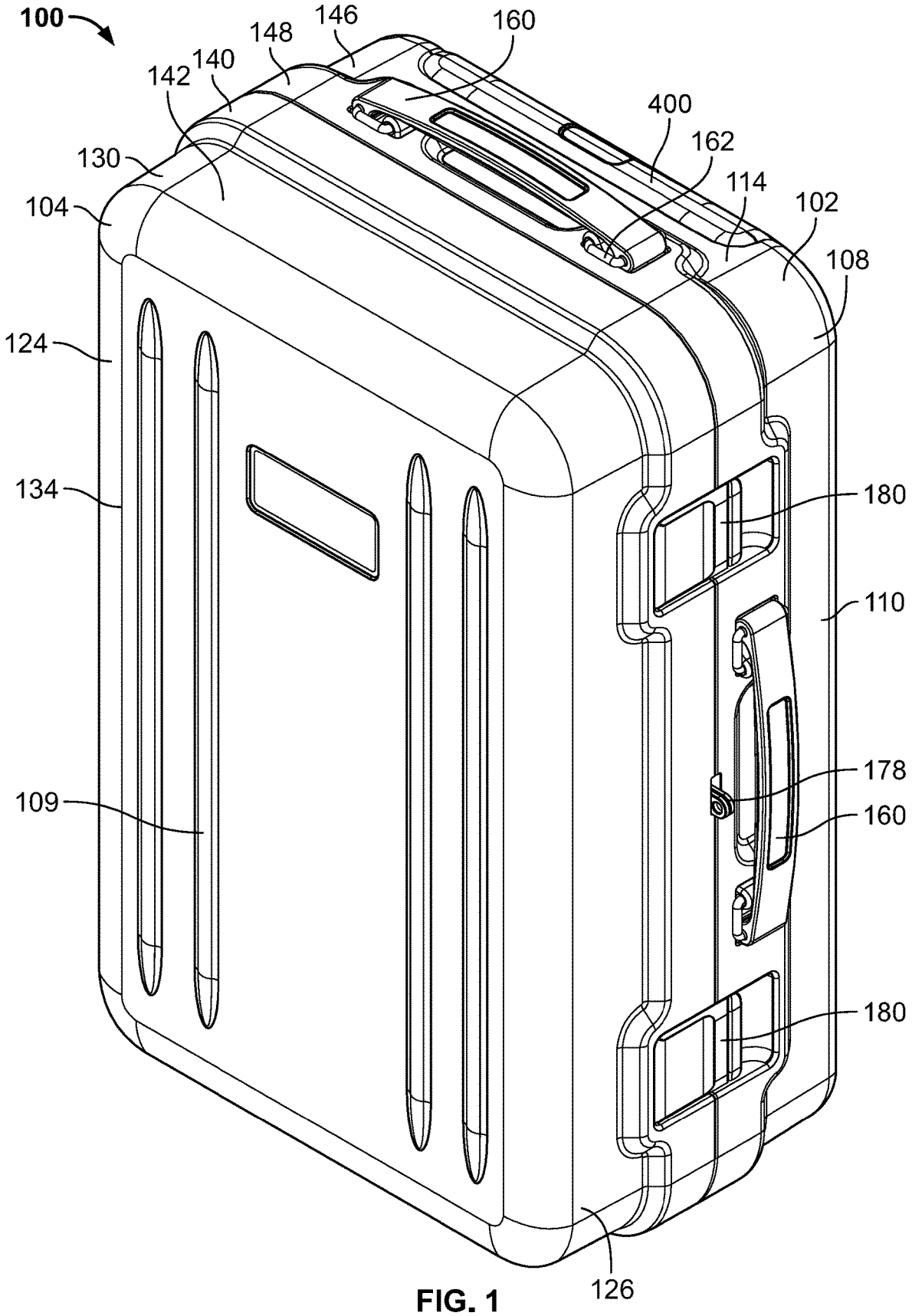
FIG. 1 is a front perspective view of an exemplary suitcase according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

Additionally, the term "plurality," as used herein, indicates any number greater than one, either disjunctively or conjunctively, as necessary, up to an infinite number.

"Generally parallel," as the term is used herein, means that a first line, segment, plane, edge, surface, etc. is approximately (in this instance, within 5%) equidistant from with another line, plane, edge, surface, etc., over at least 50% of the length of the first line, segment, or edge, or over at least 50% of the area of the plane or surface, etc. In some examples, lines, segments, or edges may be considered "generally parallel" if one such a line, segment, or edge is approximately equidistant (±5%) to another respective line, segment, or edge over at least 60%, at least 75%, at least 85%, at least 90%, or even at least 95% of a length of either of the lines, segments, or edges being considered. Additionally, planes or surfaces may be considered "generally parallel" if one plane or surface is approximately equidistant (±5%) to another respective plane or surface over at least 60%, at least 75%, at least 85%, at least 90%, or even at least 95% of a surface area of either of the planes or surfaces being considered.

"Generally perpendicular," as the term is used herein, means that a first line, segment, plane, edge, surface, etc. is approximately (in this instance, within 5%) orthogonal from with another line, plane, edge, surface, etc., over at least 50% of the length of the first line, segment, or edge, or over at least 50% of the area of the plane or surface, etc. In some examples, lines, segments, or edges may be considered "generally perpendicular" if one such a line, segment, or edge is approximately orthogonal (±5%) to another respective line, segment, or edge over at least 60%, at least 75%, at least 85%, at least 90%, or even at least 95% of a length of either of the lines, segments, or edges being considered. Additionally, planes or surfaces may be considered "generally perpendicular" if one plane or surface is approximately orthogonal (±5%) to another respective plane or surface over at least 60%, at least 75%, at least 85%, at least 90%, or even at least 95% of a surface area of either of the planes or surfaces being considered.

In general, aspects of this invention relate to suitcases, or containers, and aspects of the suitcase such as latching assemblies, wheel assemblies, and other sub-assemblies.

According to various aspects and embodiments, the suitcases and latching assemblies described herein may be formed of one or more of a variety of materials, such as metals (including metal alloys), polymers, and composites, and may be formed in one of a variety of configurations, without departing from the scope of the invention. It is understood that the suitcases may contain components made of several different materials. Additionally, the components may be formed by various forming methods. For example, metal components, may be formed by forging, molding, casting, stamping, machining, and/or other known techniques. Additionally, the polymer components may be formed or manufactured by polymer processing techniques, such as various molding and casting techniques and/or other known techniques.

The various figures in this application illustrate examples of suitcases according to this disclosure. When the same reference number appears in more than one drawing, that reference number is used consistently in this specification and the drawings refer to the same or similar parts throughout. The suitcase may be configured to contain, store, carry, etc., items including but not limited to, clothing, footwear, electronics, or any other items. Additionally or alternatively, the suitcase may be configured to store fragile materials without departing from the scope of the disclosure described herein.

FIGS. 1-8 depict views of the suitcase 100. The suitcase 100 may comprise a base 102 and a lid 104 that may be coupled together. For example, the base 102 and the lid 104 may be rotatably coupled together such that the base 102 and the lid 104 are connected by a hinge 106 or a plurality of hinges 106. Both the base 102 and the lid 104 may be a structure that forms a void for containing articles, as will be discussed more fully herein. In some examples, the base 102 and the lid 104 may have a similar volumetric displacement such that the size of the interior void 103 of the base 102 is substantially the same as the size of the interior void 105 of the lid 104, or where the volume of the void of the base 102 may be within 10 percent of the volume of the void of the lid 104. In some embodiments, the volume of suitcase 100 may be approximately 42,000 cubic centimeters, or within a range of 35,000 cubic centimeters and 45,000 cubic centimeters. The base 102 and the lid 104 may be cuboidal or substantially cuboidal in shape. For example, in some embodiments, the suitcase 100 may have a length of approximately 22 inches (55.9 cm), a width of approximately 14 inches (35.6 cm), and a height of 9 inches (22.9 cm). While in other embodiments, the suitcase 100 may have different dimensions. In other examples, the base 102 may be prismoidal or substantially prismoidal (e.g., a pentagonal prism, hexagonal prism, heptagonal prism, or the like) in shape. In still other examples, the base 102 may be substantially cylindrical in shape or may have a substantially trapezoidal cross section. Various other shapes may be used without departing from the invention.

The suitcase 100 may also include a tow pull or extendable trolley handle assembly 400, a plurality of handles 160, a plurality of wheels 168 located on a bottom of the suitcase 100, a plurality of latch assemblies 180, and a pair of retractable padlock loops 178, 179 to allow a padlock to be installed to secure the suitcase 100 during travel. In addition, suitcase 100 may be configured to be water resistant, or waterproof, or not allow substantially any water or moisture to enter the interior of the suitcase 100. As another feature, the exterior of the suitcase 100 may have a contoured shape that may include a plurality of recesses to accommodate the latch assemblies 180, hinges 106, a trolley handle assembly 400, and wheels 168 to minimize their profile and exposure to possible damage from collisions with other objects during travel.

The base 102 may include a lower shell structure 108 having a first side 110, a second side 112 opposite the first side 110, a third side 114 extending between an edge of the first side 110 and an edge of the second side 112, and a fourth side 116 opposite the third side 114. The lower shell 108 may also have a first end 118 and a second end 120 near the opening for the interior void 103 of the base 102. The lower shell 108 may also include a bottom portion 122 connected to a first end 118 of the lower shell structure 108 and configured to support the suitcase 100 on a surface such as a table, the ground, or the like. Similarly, the lid 104 may include a upper shell structure 124 having a first side 126, a second side 128 opposite the first side 126, a third side 130 extending between an edge of the first side 126 and an edge of the second side 128, and a fourth side 132 opposite the third side 130. The upper shell structure 124 may also have a first end 134 and a second end 136 near the opening for the interior void 105 of the lid 104. The upper shell structure 124 may also include a top portion 138 connected to a first end 134 of the upper shell structure 124 and configured to support the suitcase 100 on a surface such as a table, the ground, or the like.

In some examples, both the upper shell 124 and the lower shell 108 may each be formed as a unitary, or single, member such that each shell is seamless. Additionally, the upper shell 124 and the lower shell 108 may be free of any apertures or openings that pierce or extend from an exterior surface into the respective interior voids 103, 105 of the base 102 and lid 104. By having shells 108, 124 that are free of openings extending from the exterior to the interior, the suitcase 100 may advantageously prevent any moisture or water from entering the interior of the suitcase 100. The shells 108, 124 may generally have a thickness within a range of 2 mm and 4 mm, or within 1.5 mm and 6 mm. The shells 108, 124 may also include varying wall thicknesses in localized regions. For example, some areas may be thicker than other regions of the shells 108, 124 to provide attachment locations for the various components. These thicker regions may be arranged to receive mechanical fasteners or other connecting members. As another feature, the shells 108, 124 may include ribs, or rubrails, 109, which may be arranged along an outer or inner surface of the lower shell 108 and the upper shell 124 to increase the stiffness and strength of the shells and also provide extra protection for the shells 108, 124. For example, the ribs 109 may be oriented along the length of the top portion 138 of the upper shell 124 and along the bottom portion 122 of the lower shell 108. In some embodiments, the ribs 109 may be evenly spaced from the first and second sides 126, 128 of the upper shell 124 and may be arranged in pairs of ribs 109.

As discussed above, the upper shell 124 and the lower shell 108 may form the majority of the exterior of the suitcase 100 and each may have a contoured shape that includes a primary surface, a raised surface, and a plurality of recesses, where the recesses may protect the components from collisions or damage. For example, the upper shell 124 may include a raised protruded surface 140 that extends near and/or along the second end 120 around the perimeter of the upper shell 124. The raised surface 140 may be offset a fixed distance from a primary surface 142 of the upper shell. A plurality of upper latch recesses 144 may be at least partially formed within the raised surface 140. Each upper latch recess 144 may have a depth equal to or greater than the thickness of each of the latch assemblies 180 to provide protection from the latch assemblies 180. The upper latch recesses 144 may have a substantially rectangular shape, or alternatively a shape that closely matches the shape of the latch assembly 180. Each latch recess 144 may have receiving features to secure a latch assembly 180 within the recess 144. The receiving features may comprise a pocket on either side of the recess 144 to receive a pin or other mounting hardware for the latch assemblies 180.

Similar to the upper shell 124, the lower shell 108 may include a primary surface 146, a raised protruded surface 148 that extends near and/or along the second end 136 around the perimeter of the lower shell 108. The raised surface 148 may be offset a fixed distance from a primary surface 146 of the upper shell. A plurality of lower latch recesses 150 may be at least partially formed within the raised surface 148. Each lower latch recess 150 may have a depth equal to or greater than the thickness of each of the latch assemblies 180. The lower latch recesses 150 may have a depth that is generally the same as the depth of the upper latch recess 144. The latch recesses 150 may include a latch keeper 182 that extends across the recess 150 and provides an engaging surface for the latch assembly 180 to secure the lower shell 108 to the upper shell 124. Each recess 150 may have a substantially rectangular shape, or alternatively a shape that closely matches the shape of the latch assembly 180. The shape and size of the recesses 144, 150 may be mirror images of each other to and may be aligned to form a larger recess to receive the entire latch assembly 180.

Figure 2:
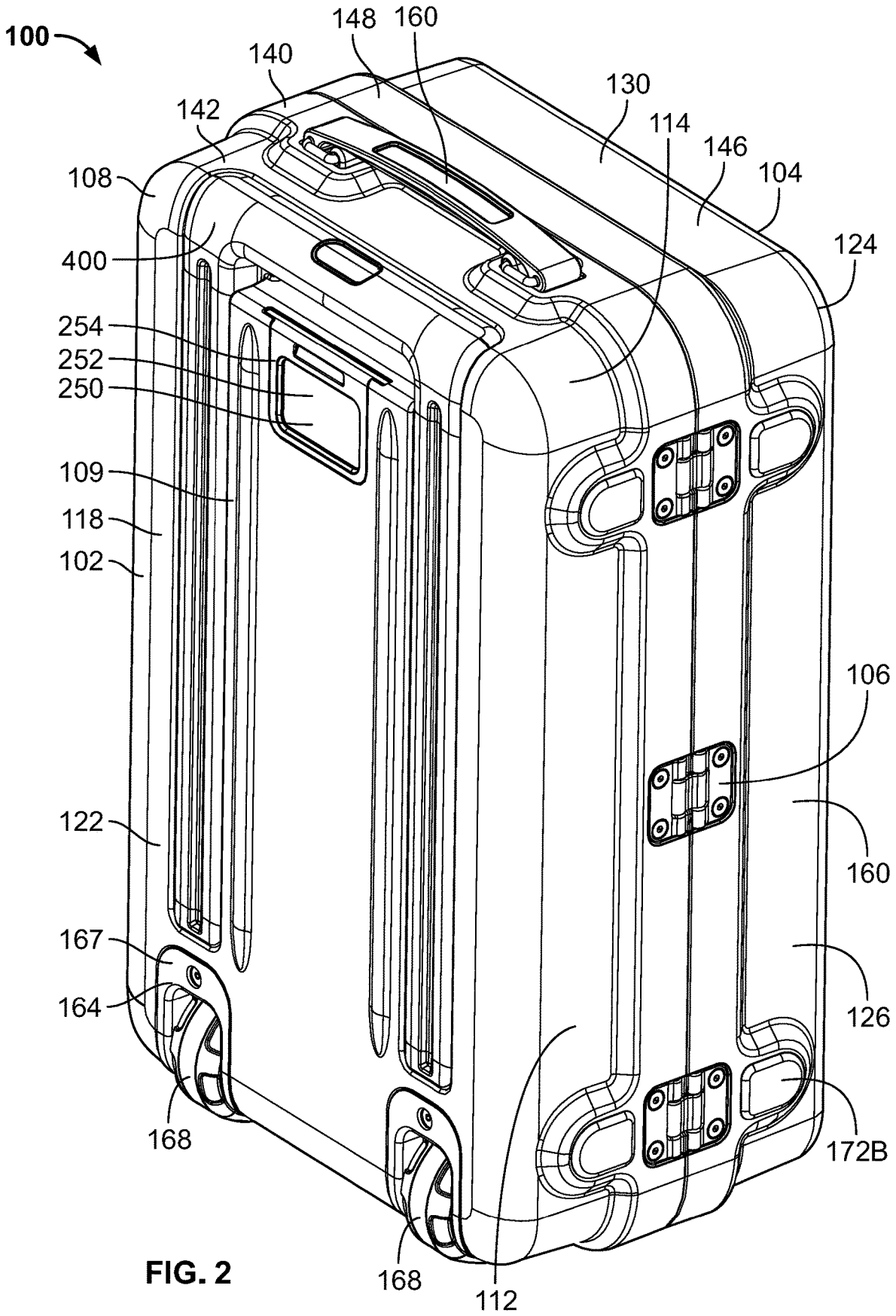
FIG. 2 is a rear perspective view of the suitcase of FIG. 1 according to one or more aspects described herein.
Figure 4:
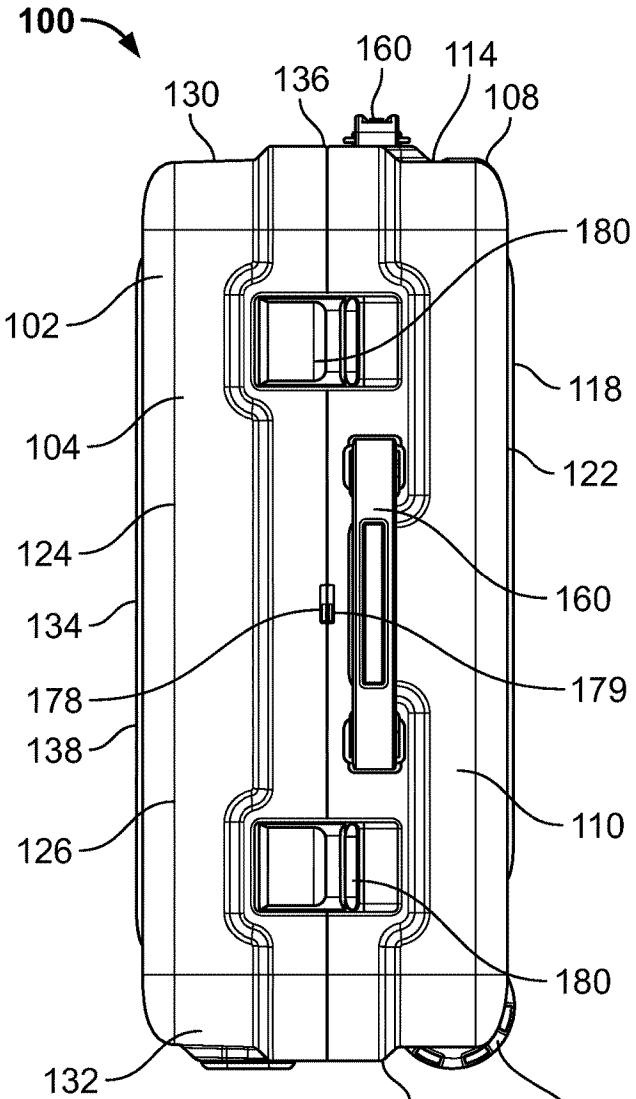
FIG. 4 is a right side view of the suitcase of FIG. 1 according to one or more aspects described herein.
Figure 3:
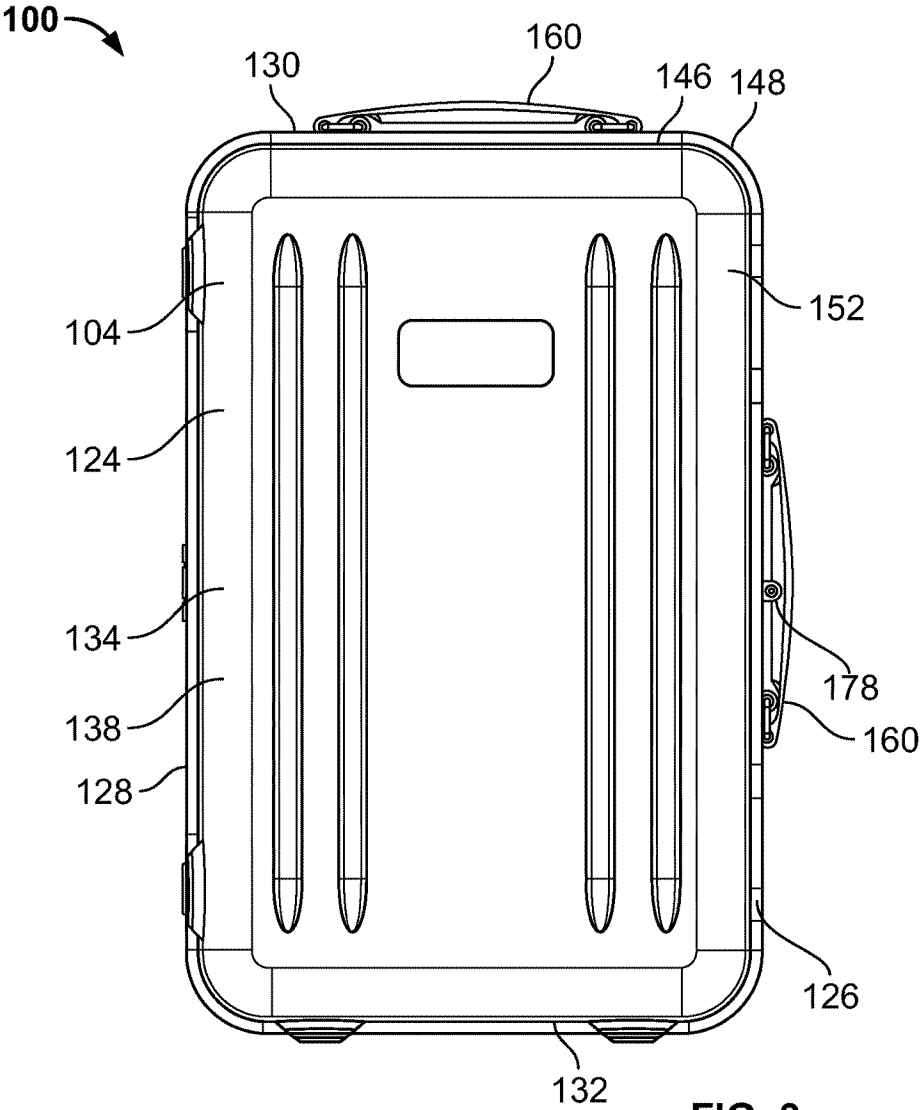
FIG. 3 is a front view of the suitcase of FIG. 1 according to one or more aspects described herein.
Figure 9:
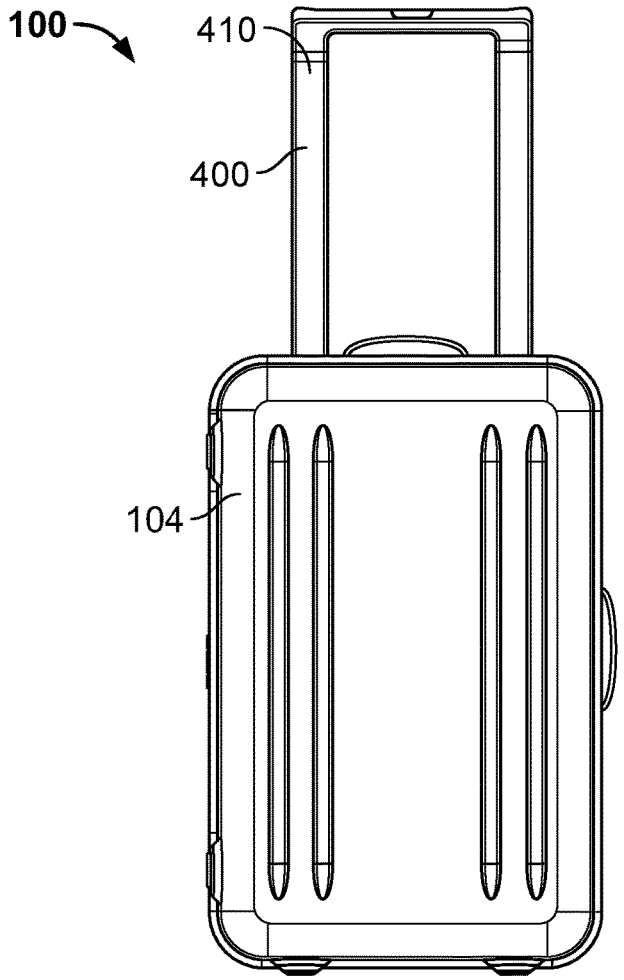
FIG. 9 is a front view of the suitcase of FIG. 1 with the extendable trolley handle in a raised position according to one or more aspects described herein.

The trolley handle assembly 400 may be attached to the lower shell 108 along the exterior of the bottom portion 122. The trolley handle assembly 400 may be formed as a separate member and attached to the lower shell 108. The lower shell 108 may have a tow pull recess or trolley handle recess 154 that is offset from the primary surface 146 on the bottom portion 122 of the lower shell 108. The tow pull recess 154 may be substantially U-shaped as shown in FIG. 2, or may be a pair of symmetrical elongated recesses 154 to receive trolley handle assembly 400. The recess 154 may have a depth that is equal to or greater than the thickness of the extrusions of the trolley handle to adequately protect the trolley handle assembly 400 from impacts. The trolley handle assembly 400 may include an extendable extrusion assembly 410 that slides upward from the top of the suitcase to provide an elevated grip for a user to easily pull the suitcase 100 as shown in FIG. 9.

Figure 10A:
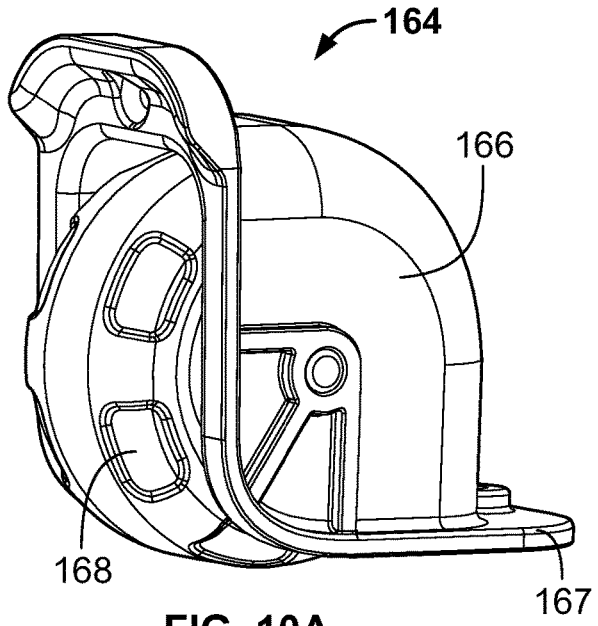
FIG. 10A is a front perspective view of a wheel assembly removed from the suitcase of FIG. 1 according to one or more aspects described herein.
Figure 10B:
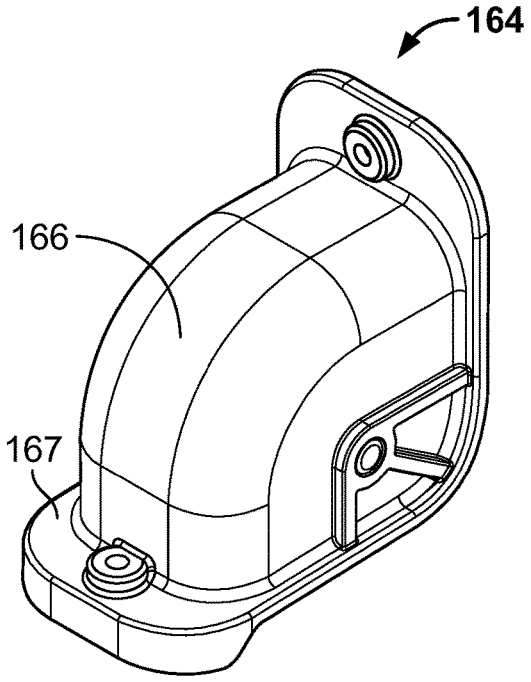
FIG. 10B is a rear perspective view of a wheel assembly removed from the suitcase of FIG. 1 according to one or more aspects described herein.
Figure 11A:
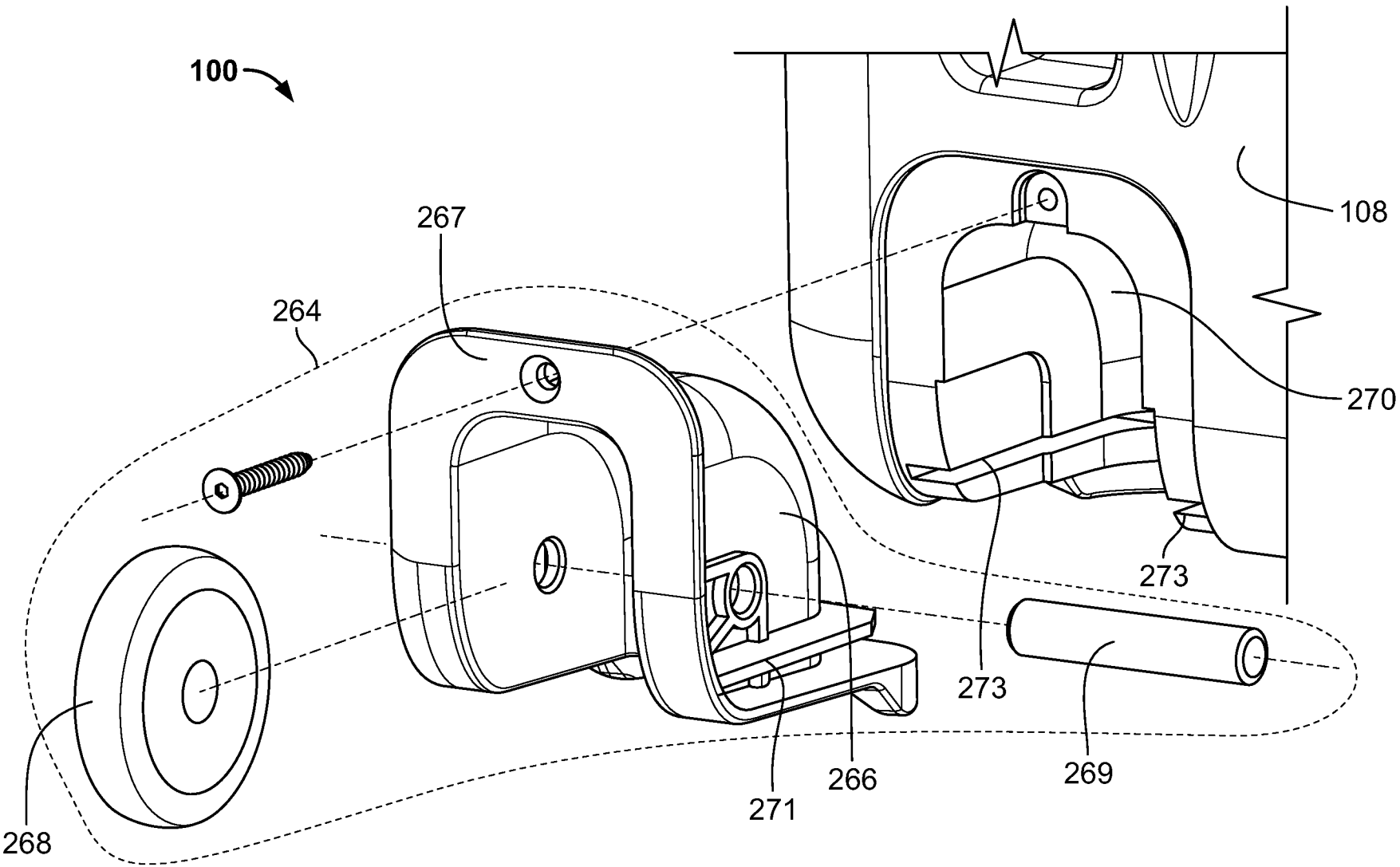
FIG. 11A is an exploded perspective view of an alternate wheel assembly being installed onto the suitcase of FIG. 1 according to one or more aspects described herein.
Figure 11B:
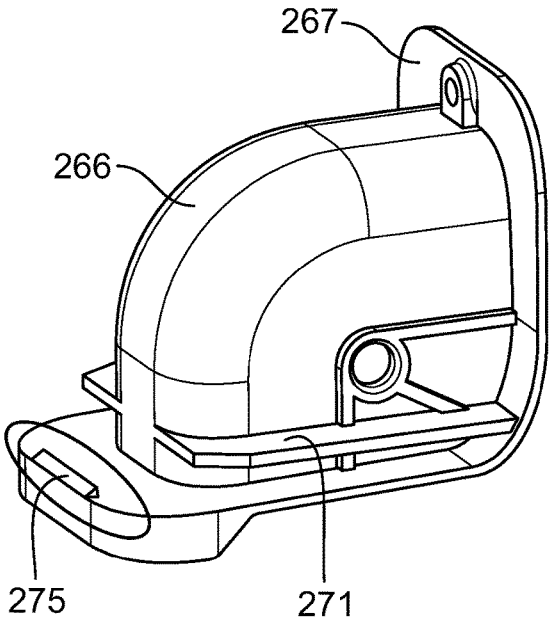
FIG. 11B is a rear perspective view of the housing of the alternate wheel assembly illustrated in FIG. 11A according to one or more aspects described herein.
Figure 11C:
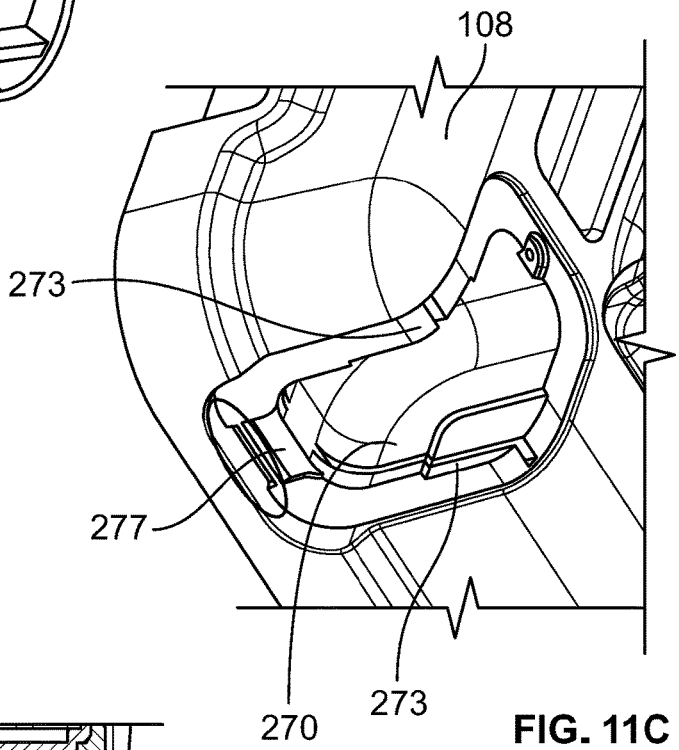
FIG. 11C is an enlarged rear perspective view of the wheel recess in the suitcase to receive the alternate wheel assembly illustrated in FIG. 11A according to one or more aspects described herein.
Figure 11D:
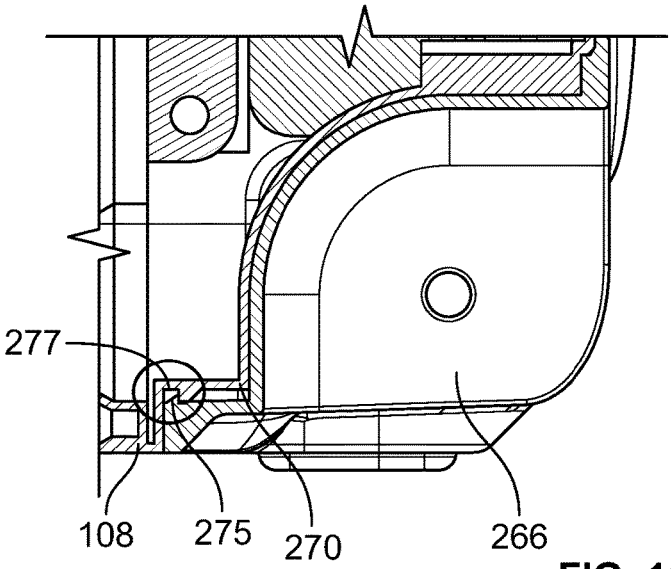
FIG. 11D is a partial cross-sectional view of the alternate wheel assembly illustrated in FIG. 11A installed onto the suitcase of FIG. 1 with some components removed for clarity according to one or more aspects described herein.

Additionally, to allow the user to easily pull the suitcase 100, the bottom of the suitcase may include a plurality of wheel assemblies 164 positioned on the rear and bottom of the suitcase 100. Each wheel assembly 164 may be formed as a separate member, as shown in FIGS. 10A and 10B, and may include a wheel housing 166 having a rounded shape and at least one mounting flange 167 located on at least one end, and a wheel 168 mounted on an axle (not shown) such that the axle is aligned with a center of the rounded shape. The mounting flange 167 may include a mounting hole. The lower shell 108 may include a wheel recess 170 to receive the wheel assembly 164. The wheel assembly 164 may be secured to the wheel recess using at least one mechanical fastener extending through the mounting hole positioned in the mounting flange 167. As shown in the exemplary embodiment, the suitcase 100 may comprise a pair of wheel assemblies 164; however, in other embodiments the suitcase may include more additional wheel assemblies 164. The wheel assemblies 164 may be evenly spaced from the sides of the suitcase 100. The housing 166 may be formed from a polymer material, such as a polyamide (nylon) or similar material, while the wheels 168 may be formed from a polymer material, such as a polyurethane, or similar material.

FIGS. 11A-11D illustrate another option for the wheel assembly 264 that may install onto suitcase 100. Wheel assembly 264 may include a wheel housing 266 that has a rounded shape and a mounting flange 267. The wheel assembly 264 may further include a wheel 268 mounted on axle 269. The housing 266 may further include a pair of horizontally oriented projections 271 positioned along each side of the housing 266 that may insert into a pair of grooves 273 oriented within the recess 270 of the lower shell 108. Each projection 271 of the pair of projections is received into each groove 273 of the pair of grooves to support to the housing 266 in a vertical direction within the recess 270. The wheel assembly 264 may then be secured in a horizontal direction by a mechanical fastener extending through a mounting hole on the flange 267 and into a thickened portion of the shell 108, which prevents the fastener from piercing into an interior of the shell. As another option, the housing 266 may also include a detent 275, or protrusion, on a forward end of the housing 266. The detent 275 may be received in a slot 277 near the rear end of the recess 270 to provide additional support in a horizontal direction to the wheel assembly 264.

Figure 8:
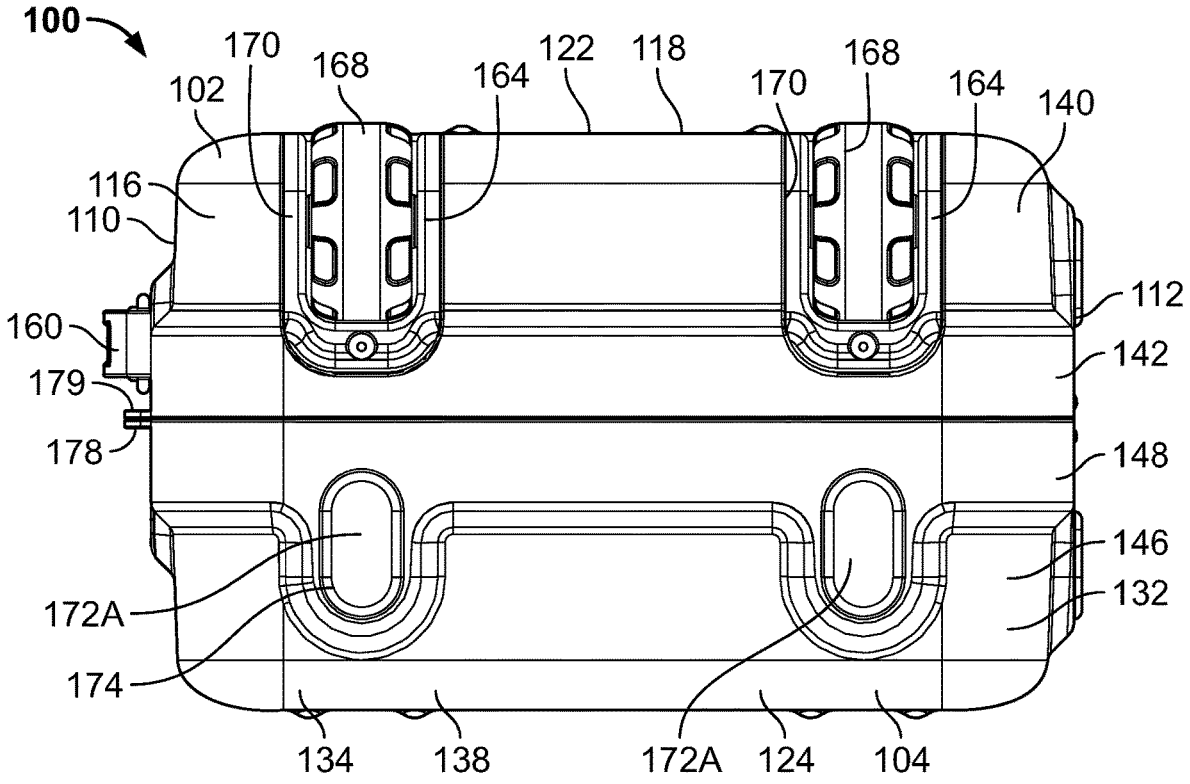
FIG. 8 is a bottom view of the suitcase of FIG. 1 according to one or more aspects described herein.

In some embodiments, the bottom (corresponding to the fourth side 132 of the upper shell 124) of the suitcase 100 may also and/or alternatively include one or more feet 172A which may support the suitcase 100 on a surface such as a table, the ground, or the like. The feet 172 may be attached may be attached to the upper shell 124 and may be located opposite the wheel assemblies 164 to give a proper balance as shown in FIG. 8. The feet 172 may be formed of a non-skid or non-sliding impact absorbing material, such as a rubber, elastomer, or other similar material. For example, the feet 172 may be formed from an EPDM (ethylene propylene diene monomer) rubber (ethylene propylene diene monomer) or similar material. The feet may be attached to the shell using an adhesive, ultrasonic welding technique, or electromagnetic bonding (such as Emabond®). By attaching the feet using a bonding or welding technique the shells 108, 124 may remain free of any intrusions into their interior.

Figure 6:
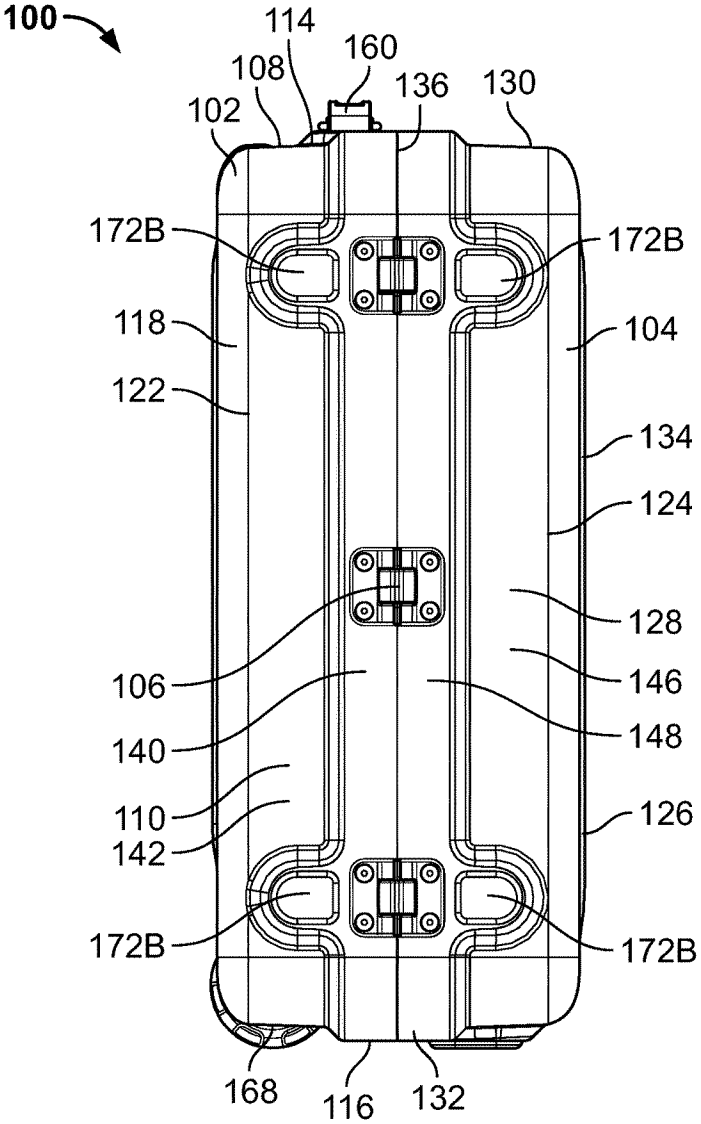
FIG. 6 is a left side view of the suitcase of FIG. 1 according to one or more aspects described herein.
Figure 5:
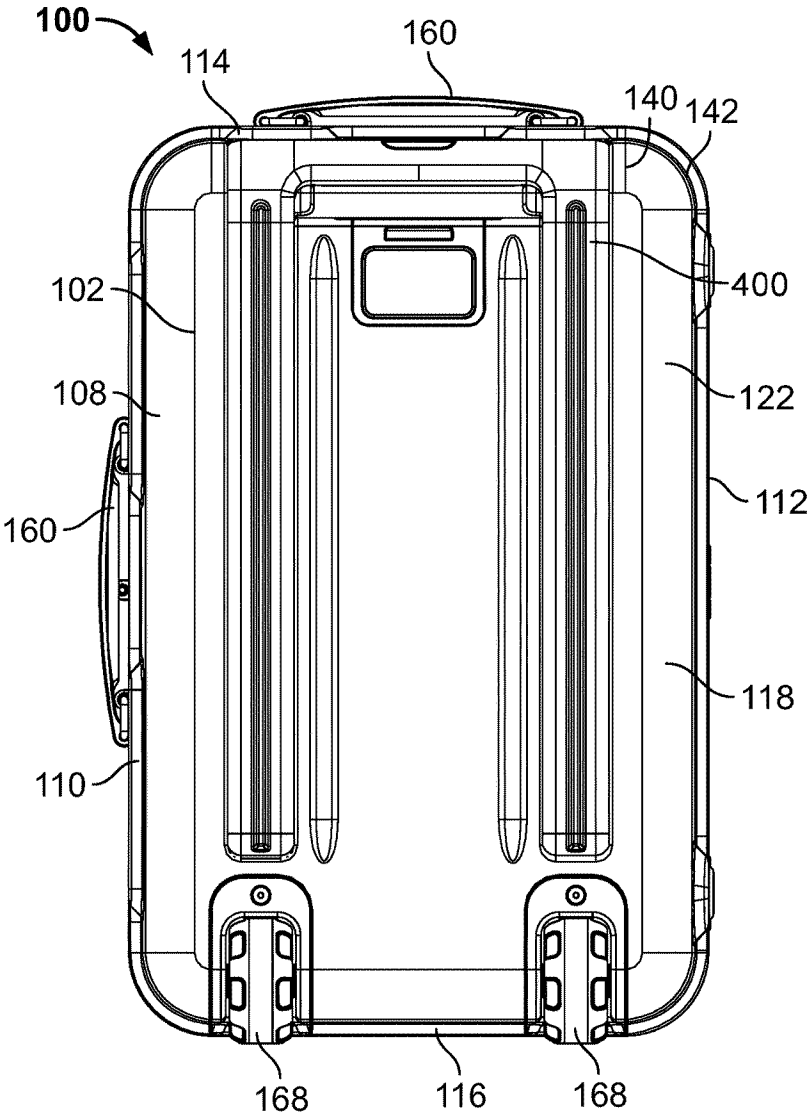
FIG. 5 is a rear view of the suitcase of FIG. 1 according to one or more aspects described herein.
Figure 7:
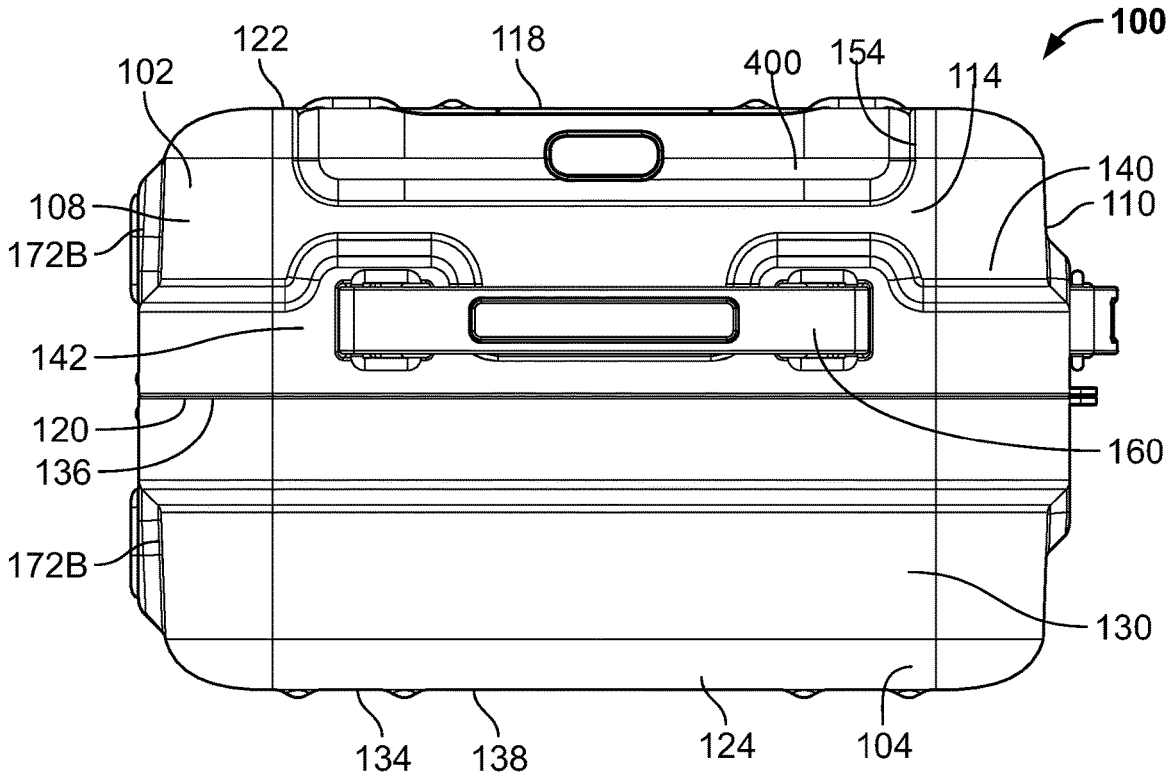
FIG. 7 is a top view of the suitcase of FIG. 1 according to one or more aspects described herein.

Each of the feet 172 may be received in a foot recess 174 that may be formed within the raised surface 148 of the upper shell 124. The foot 172 may have a substantially elliptical shape, a square shape, or any shape. In addition, each foot 172 may extend an amount equal to the distance each wheel 168 extends beyond the suitcase. Thus, the top of the suitcase 100 may be approximately level when sitting on the ground. As another option, one or more feet 172B may also be located along the second side 112, 128 of the shells 108, 124 such that the feet 172B are positioned opposite each other on both the upper shell 124 and the lower shell 108. As shown in FIG. 6, the feet 172B may be positioned along the second side 128 of the upper shell 124 and along the second side 112 of the lower shell 108. The feet 172 B may be formed from a similar material to the feet 172A on the bottom of the suitcase 100. While having the same material, the shape of the feet 172B may be slightly different than the feet 172A in that the feet 172B may have a generally truncated elliptical shape. The feet 172 may be generally aligned with one of the hinges 106 where a flat portion of the feet 172B are spaced from an edge of a hinge 106. In addition, the feet 172B may be arranged to contact one another when the suitcase 100 is fully opened to reduce the impact forces on the hinges and the other components of the suitcase 100 when it is opened.

Figure 12C:
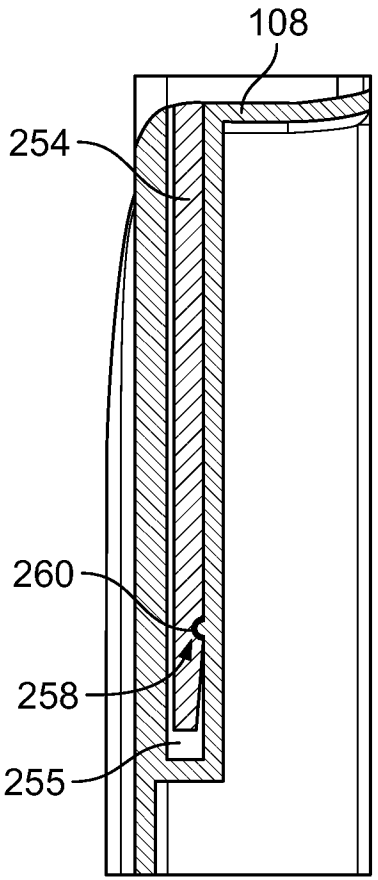
FIG. 12C is a partial cross-sectional view of the identification tag holder installed in the suitcase of FIG. 1 according to one or more aspects described herein.
Figure 12B:
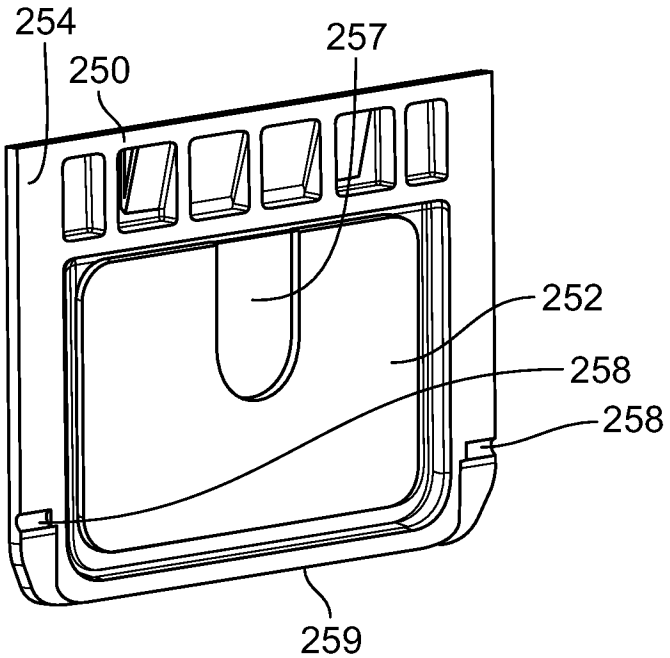
FIG. 12B is a rear perspective view of the identification tag holder according to one or more aspects described herein.
Figure 12A:
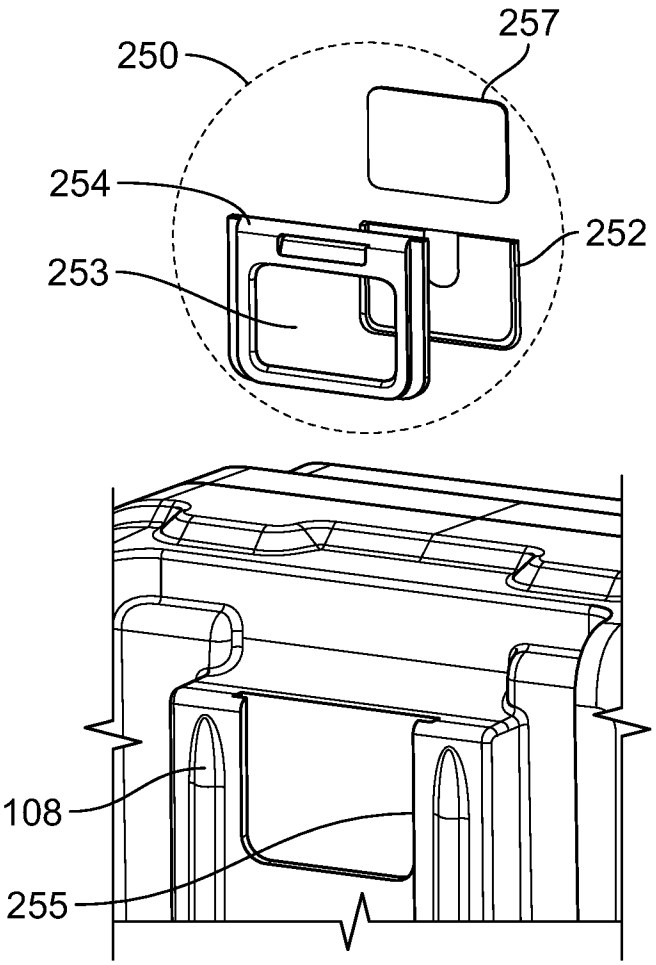
FIG. 12A is a partial exploded view of the identification tag holder being installed onto the suitcase of FIG. 1 according to one or more aspects described herein.

Still another feature of the suitcase 100 is an identification tag holder 250 to help a user easily identify the suitcase 100 as illustrated in FIGS. 12A-12C. The identification tag holder 250 may be located on either the lid 104 or the base 102. For example, the identification holder 250 may be located between the extrusion assemblies 410 of the trolley handle assembly 400. The identification tag holder 250 may include a transparent card sleeve 252, and a slidable card mount 254. The card mount 254 may have a central opening 253 and may be slidably engaged with a slot 255 positioned in the lower shell 108 such that the card mount 254 moves in a vertical direction. The card mount 254 may include a pocket to secure the card sleeve 252. The card sleeve 252 may have an opening to receive an identification tag 257 such as a business card or similar material that may contain a user's identification information. The card mount 254 may slide upward along the slot 255 to an open position exposing the pocket to allow a user to install the card sleeve 252 and then slide the card mount 254 downward into the slot 255. The card mount 254 may include a pair of grooves or depressions 258 arranged on each side of the card mount 254 to receive a detent 260, or protrusion, positioned within the slot 255. As the card mount 254 is slid downward within the slot 255, the detent 260 may be received within the groove 258 of the card mount 254. The card mount 254 may be secured within the slot 255 by the detents 260 engagement with the grooves 258. The slot 255 may have a pair of detents 260 with a detent 260 being located on both sides of the slot 255. The grooves 258 may be positioned near a lower end 259. The identification material may then be easily viewed through the opening 253 of the card mount 254. In some embodiments, the detents 260 may be arranged on the card mount 254 and the grooves 258 arranged within the slot 255.

To help improve the security of the suitcase 100, the suitcase 100 may include a pair of padlock loops 178, 179 to receive a padlock (not shown) to prevent any unauthorized opening of the suitcase 100. A first padlock loop 178 may be connected to the upper shell 124 and a second padlock loop 179 may be connected to the lower shell 108 such that the first padlock loop 178 is aligned with the second padlock loop 179 to allow a padlock to be inserted into the opening of each padlock loop 178, 179. Each padlock loop 178, 179 may be retractable where they can rotate into slots on the respective shells 124, 108 to store and protect the loops 178, 179 when they are not in use.

The suitcase 100 including the upper and lower shells 124, 108 may be formed from various materials, such as one or more metals, alloys, polymers, ceramics, or fiber-reinforced materials. In some examples, the upper and lower shells 124, 108 may be formed of a polymer material, such as a polycarbonate alloy, a thermoplastic olefin (TPO), or other similar material, that is molded to form both the shells 108, 124. In some arrangements, the shells 108, 124 are formed using injection molding or roto-molding/rotational molding processes as would be understood by one of ordinary skill in the art (not shown). However, various other types of molding or other manufacturing processes (e.g., stamping, casting, forging, and the like) may be used to form the suitcase 100 without departing from the invention.

Figure 13:
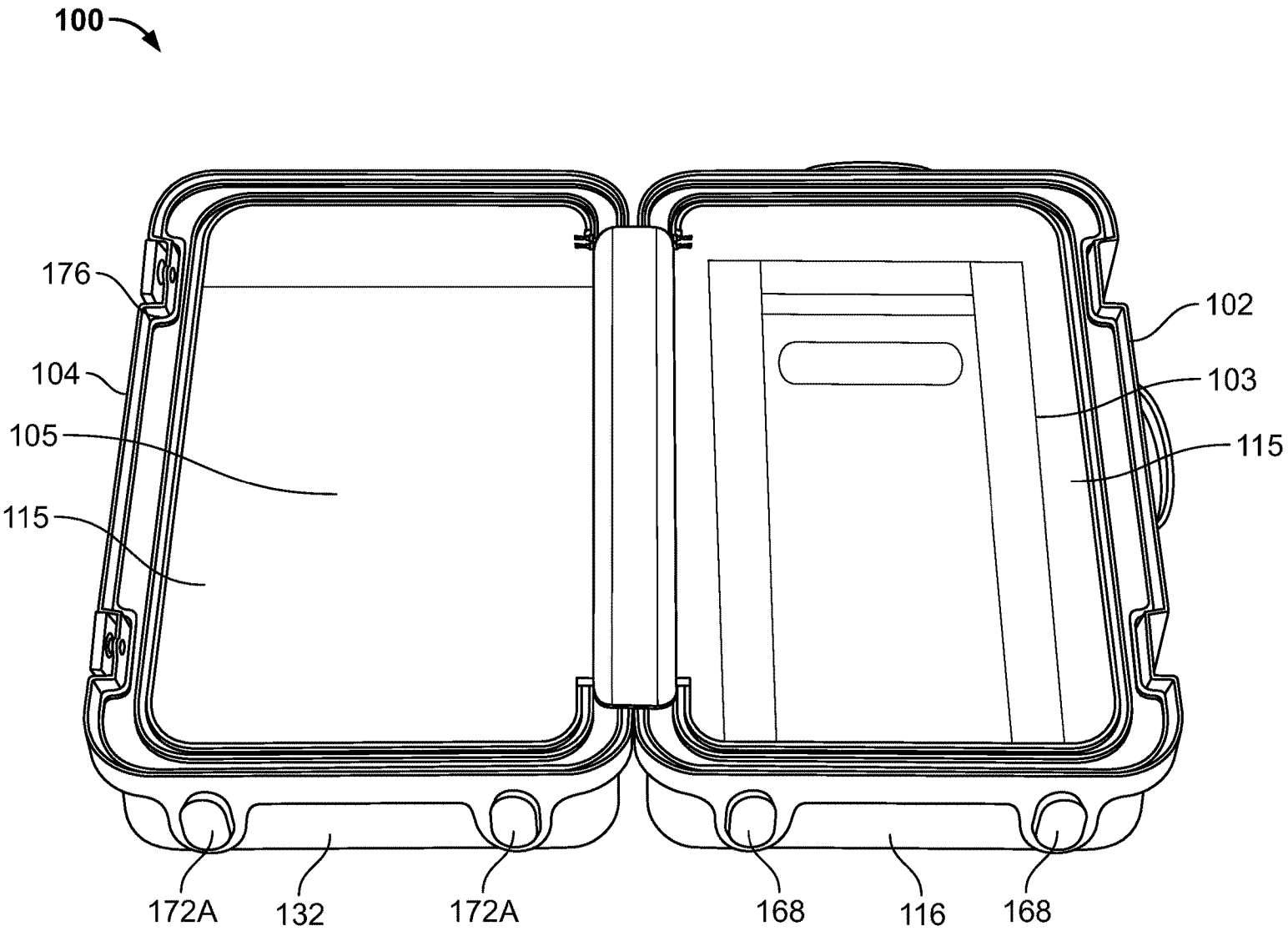
FIG. 13 is a top perspective view of the suitcase of FIG. 1 in an open configuration according to one or more aspects described herein.
Figure 14A:
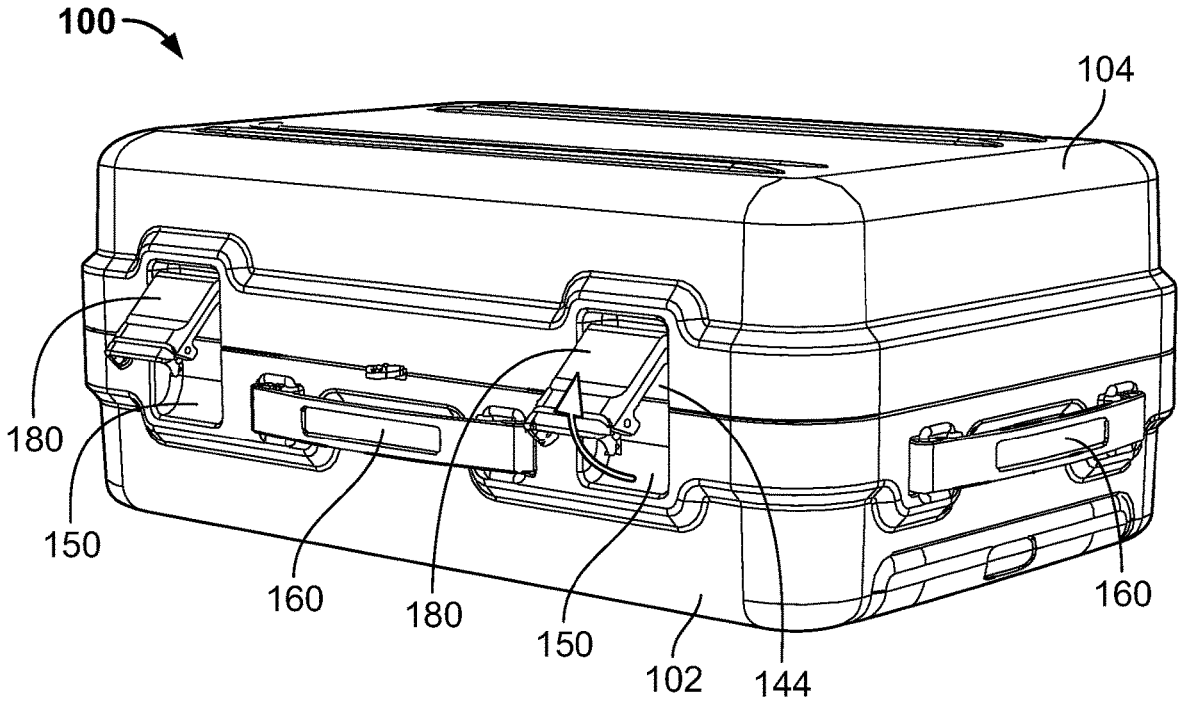
FIG. 14A is a side perspective view of the suitcase of FIG. 1 according to one or more aspects described herein.
Figure 14B:
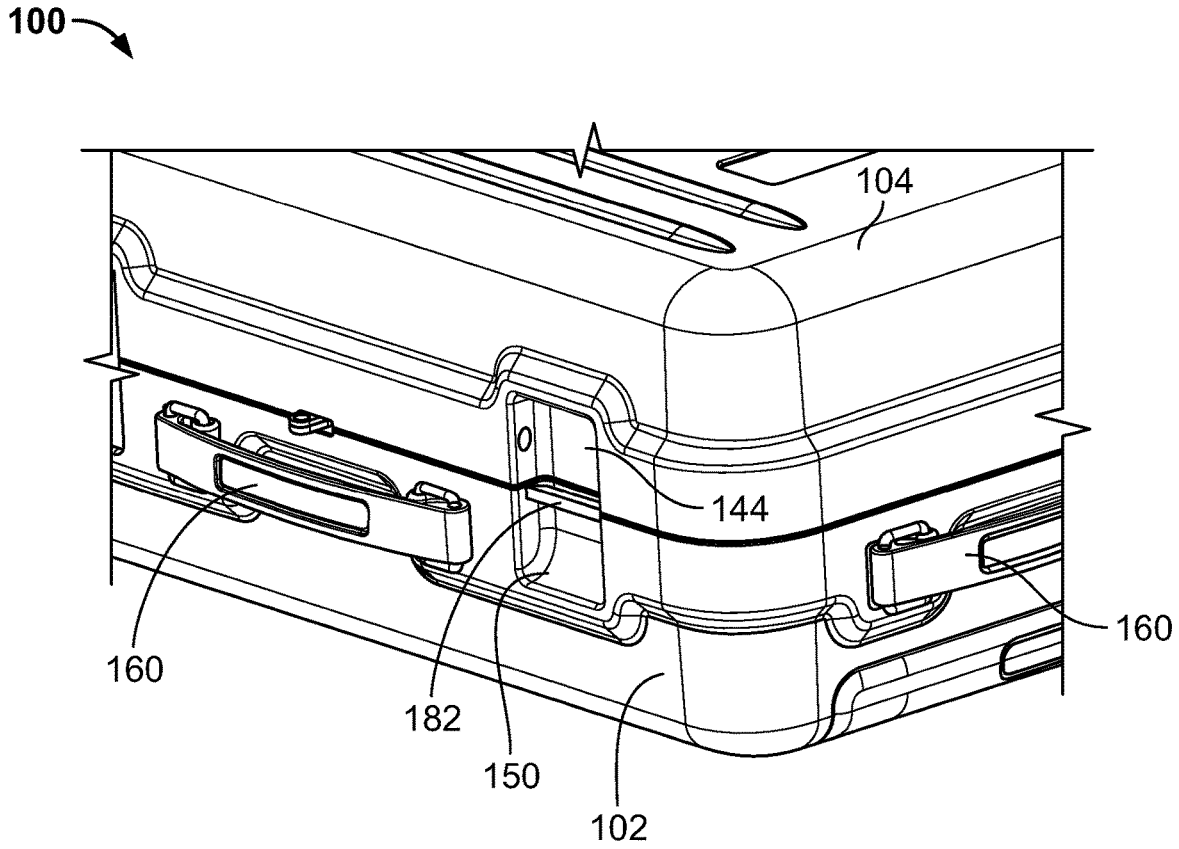
FIG. 14B is an enlarged side perspective view of the suitcase of FIG. 1 with the latch assembly removed according to one or more aspects described herein.

As discussed above, the base 102 and the lid 104 may be rotatably coupled to each other. The hinges 106 may be one of various types of hinges, including a continuous piano hinge, double hinge, ball joint hinge, living hinge, and the like double hinges to allow the base 102 and the lid 104 to rotate away from each other up to at least 180 degrees in a fully opened position as shown in FIG. 13. In some examples, the lid 104 may be removably or permanently connected to the base 102 at the hinge(s) 106. When in the open configuration, the interior voids 103, 105 of both the base 102 and the lid 104 may be accessible to a user. When in the closed configuration, the hinge 106 may facilitate rotation of the lid 104 and the base 102 to secure the contents within the suitcase 100.

Additionally, as shown in FIG. 13, the interiors 105, 103 of both the lid 104 and the base 102 may include a liner 115 to provide a soft interior surface. The liner 115 may include a waterproof fabric material to provide an extra level of moisture protection for the contents of the suitcase 100. As another option, a plurality of magnetic or ferromagnetic elements may be arranged around the inner edges along the second end 120 of the lower shell 108 of the base 102 and also along the inner edges along the second end 136 of the upper shell 124 of the lid 104. These magnetic elements may assist in aligning and closing the lid 104 and the base 102.

In addition, in some arrangements, the suitcase 100 may include a gasket 176 or other sealing device. The gasket 176 may be arranged in either the lid 104 or the base 102 and may aid in sealing the lid 104 and base 102 when the suitcase 100 is in a closed configuration. The gasket 176 may be arranged in a recess or channel in the lid 104. Alternatively, the gasket 176 may be arranged in a recess or channel formed in the base 102. In some examples, the gasket 176 may be a traditional gasket having a substantially circular cross section.

In still other embodiments, the suitcase 100 may be capable of achieving an IP52 rating up to an IP67 rating (as set forth by International Electrotechnical Commission). For example, in one embodiment, the suitcase 100 may be manufactured such that it is protected from limited dust ingress and water resistant to a water spray test corresponding to achieving an IP52 rating. While in other embodiments, the suitcase 100 may be manufactured such that it is dust tight when tested for 8 hours and/or waterproof when tested for 30 minutes under 1 meter of water. In some embodiments, the suitcase 100 may be capable of achieving an IP67 rating which specifies that there is no ingress of dust or complete protection from dust when tested for 8 hours and ingress of water in harmful quantities is not possible when the enclosure is immersed in water under defined conditions of pressure and time (up to 1 m of submersion). The IP67 dust test is 8 hours long and the enclosure is tested in a vacuum. The IP67 water test is 30 minutes long and the enclosure is tested with the lowest point of the enclosure 1000 mm below the surface of the water, or the highest point 150 mm below the surface whichever is deeper. Depending on the IP rating, the suitcase 100 may include a one-way air vent. For example, if the rating is an IP52, a one-way air vent may not be necessary, but if the rating is higher such as an IP67, a one-way air vent may be necessary.

In some arrangements, the suitcase 100 may include one or more handles 160. The handles 160 may be arranged on one or more portions of the base 102 along the lower shell 108. The handles 160 may be arranged on a top side and a right side of the suitcase 100. The handles 160 may be secured to the raised surface 148 of the lower shell 108. The handles 160 may be formed from a polymer and molded with a thermoplastic urethane (TPU) to provide a soft comfortable surface for a user to grip. The handles 160 may be connected to camming rings that attach to brackets 162. The brackets 162 may be engaged/secured to the lower shell 108 using mechanical fasteners, where the mechanical fasteners do not extend into the interior of the lower shell 108.

As discussed above, the suitcase 100 may also include one or more latch assemblies 180.

The latch assemblies 180 may have a locked position and an unlocked position and may be configured to lock the lid 104 to the base 102 when the lid 104 is in a closed configuration. The latch assemblies 180 may include one or more portions integrally formed with or otherwise attached to the suitcase 100. As shown in FIGS. 14A-16B, the suitcase 100 may include a latch keeper 182 located within lower latch recess 150. The latch keeper 182 may extend from a sidewall of the lower latch recess 150 of the lower shell 108. The recess 150 has a shape configured to receive a portion of the locking member 190 as will be discussed in more detail below. The latch keeper 182 may have an upper surface 184, an inner surface 186 and a lower surface 188. As will be discussed in greater detail below, the latch assemblies 180 may engage the latch keeper 182 to lock the lid 104 to the base 102 when the suitcase 100 is in a closed configuration.

Figure 15A:
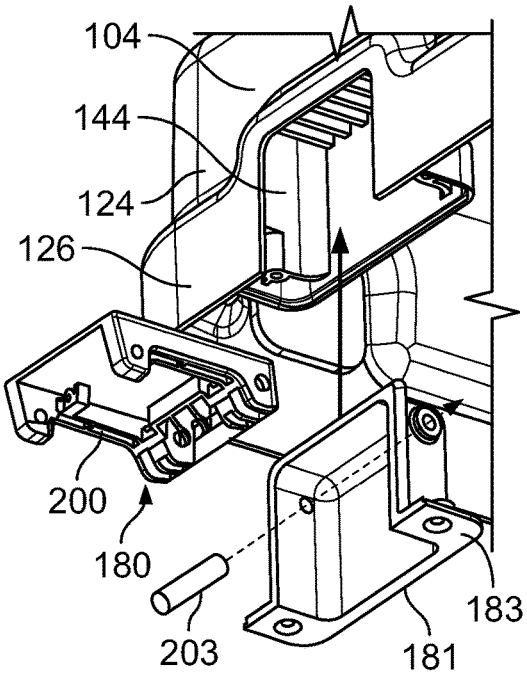
FIG. 15A is a partial exploded perspective view of the latch assembly being assembled to the lid of the suitcase of FIG. 1 according to one or more aspects described herein.
Figure 15B:
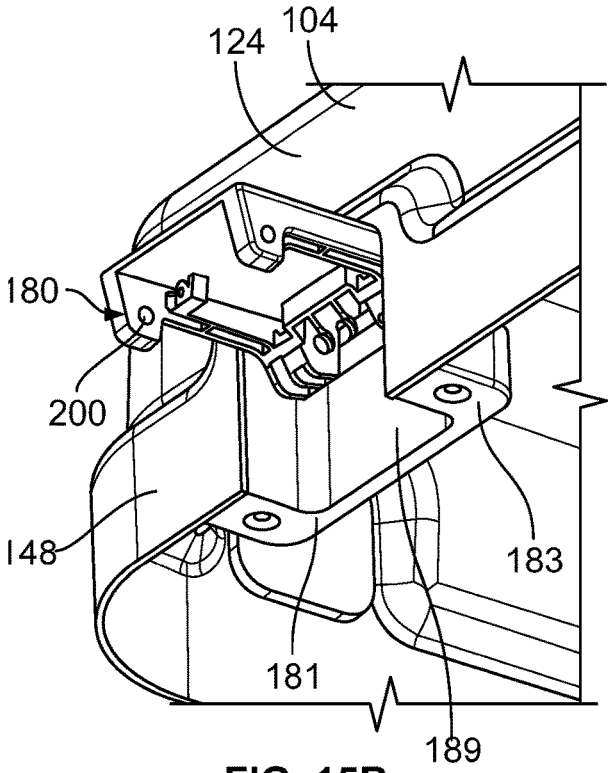
FIG. 15B is a partial perspective view of the latch assembly assembled to the lid of the suitcase of FIG. 1 according to one or more aspects described herein.

In some embodiments, the latch assembly 180 may be rotatably coupled to a lid latch mount 181 prior to being installed to the lid 104. The latch assembly 180 may be coupled to the lid latch mount 181 using a pin 203, or hinge. The pin 203 may be inserted into an opening in the latch body 200 of the latch assembly 180 and into a pair of openings in the sides of the lid latch mount 181 as shown in FIGS. 15A and 15B. The lid latch mount 181 may be received in the upper latch recess 144 of the upper shell 124. The lid latch mount 181 may be installed in recess 144 in a direction generally parallel to the surface of the first side 126 and secured to the shell 124 using at least one mechanical fastener inserted into an opening on flange 183 of lid latch mount 181. The mechanical fastener securing the flange 183 to the upper shell 124 may insert into a threaded hole in a thickened portion of the shell 124, which may prevent the fastener from piercing into the interior of the shell 124. The pin 203 may be a straight pin, or a stepped pin and may have knurled features.

Figure 15C:
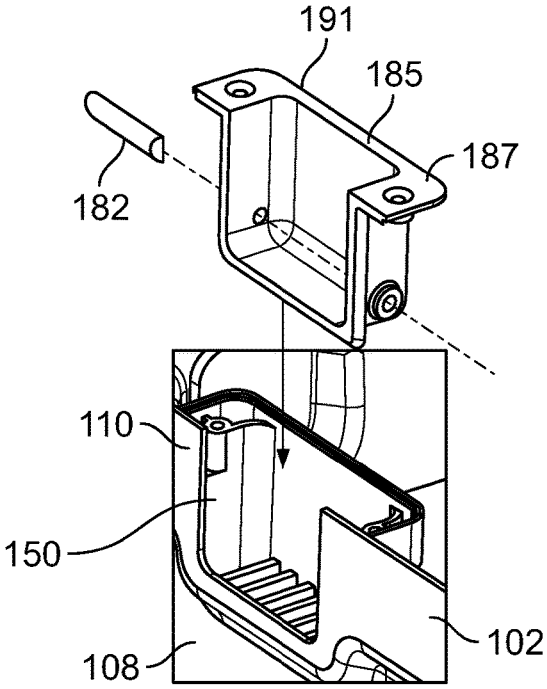
FIG. 15C is a partial exploded perspective view of the latch assembly assembled to the base of the suitcase of FIG. 1 according to one or more aspects described herein.

Similarly, in some examples, a base latch mount 185 may be received in lower latch recess 150 of the lower shell 108 as shown in FIG. 15C. The latch keeper 182 may be installed into the base latch mount 185 prior to being installed to the base 102. The base latch mount 185 may be installed in recess 150 in a direction generally parallel to the surface of the first side 110 and secured to the lower shell 108 using at least one mechanical fastener inserted into an opening on flange 187 of lid latch mount 185. The mechanical fastener securing the flange 187 to the shell 108 may insert into a threaded hole in a thickened portion of the shell 108 to prevent the fastener from piercing into the interior of the shell 108.

Referring now to the latch assembly 180 as shown in FIGS. 15A-18, the latch assembly 180 may include multiple components including a latch body 200, a locking member 190, a biasing member 220, and an activating member 230. As discussed above, the latch assembly 180 may include a locked position and an unlocked position.

Figure 17:
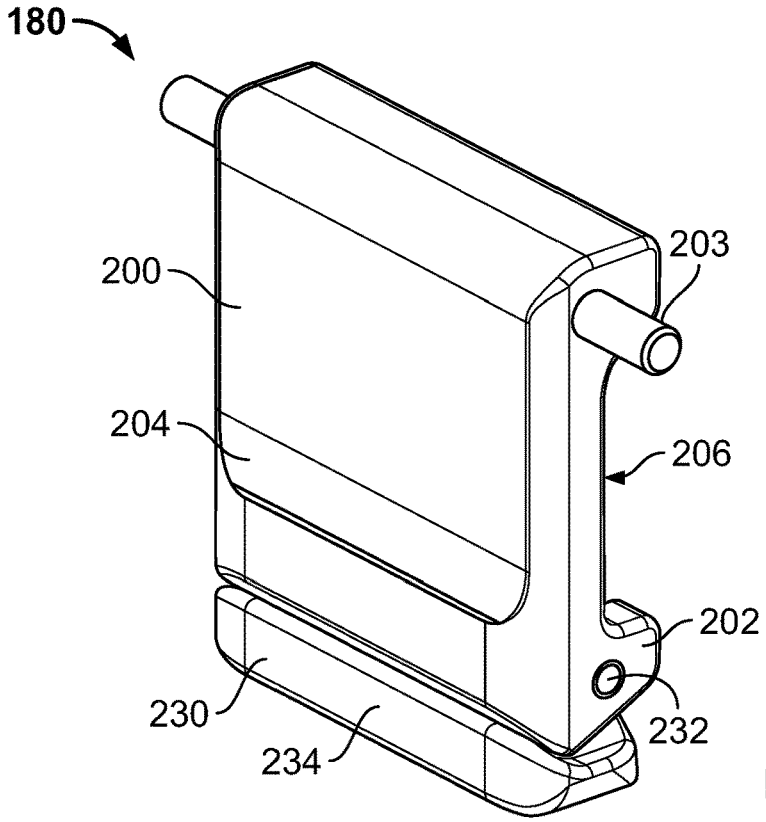
FIG. 17 is a front perspective view of a latch assembly of the suitcase of FIG. 1 according to one or more aspects described herein.

The latch body 200 may be pivotally engaged with the lid 104. As shown in FIG. 17, the latch body 200 may be pivotally engaged with the lid 104 using pin, or hinge 203, however, any suitable pivotal engagement may be used. In some embodiments, the hinge 203 may be removably engaged with the suitcase 100. This hinge 203 may allow a user to easily remove and replace the latch assembly 180 if it becomes damaged. The latch body 200 may include an inner surface 204 and an outer surface 206. The outer surface 206 may be contoured and may not extend outward of the outer edge of the raised surface 148 of the lower shell 108 or raised surface 140 of the upper shell 124. The inner surface 204 may also be curved and may also include a number of different features. One exemplary feature that may be included on the latch body 200 may be one or more engagement lugs 208. As will be discussed in more detail below the engagement lugs 208 may engage the base 102, or latch keeper 182, and may assist in compressing the lid 104 against the base 102 of the suitcase 100.

Figure 16A:
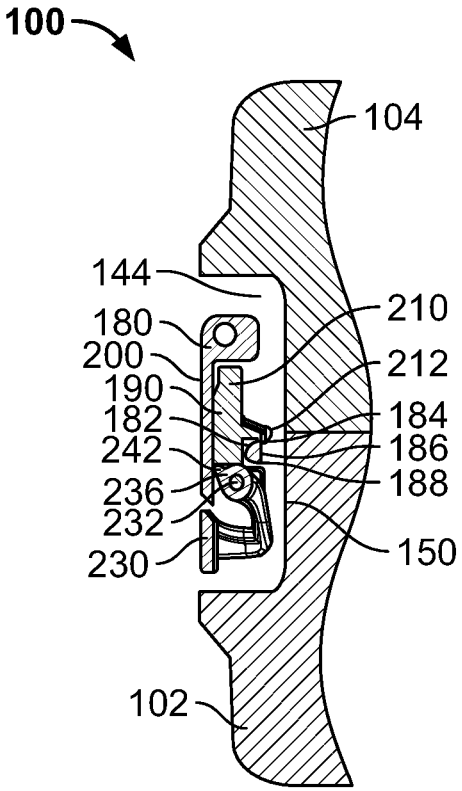
FIG. 16A is a partial cross-sectional side view through the latch assembly of the suitcase of FIG. 1 in a locked position according to one or more aspects described herein.
Figure 16B:
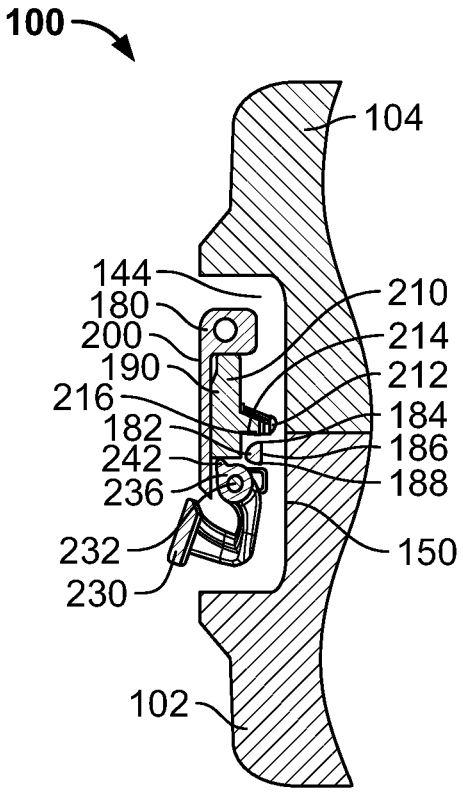
FIG. 16B is a partial cross-sectional side view through the latch assembly of the suitcase of FIG. 1 in an unlocked position according to one or more aspects described herein.

The latch body 200 may also be engaged with the locking member 190. As shown in FIGS. 16A and 16B, the locking member 190 may be slidably engaged with the latch body 200 such that the locking member 190 may move between an upward position and a downward position in a substantially linear path. The locking member 190 may be configured to lock the lid 104 in a closed configuration when the locking member 190 is in the downward position and unlock the lid 104 when the locking member 190 is in the upward position.

Figure 18:
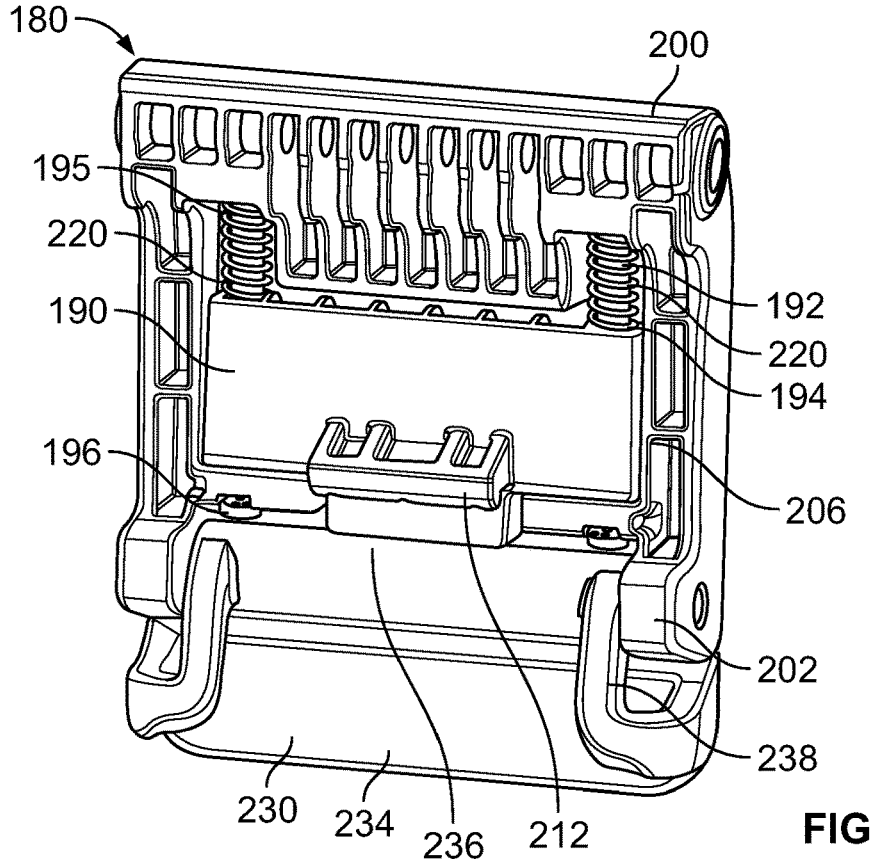
FIG. 18 is a rear perspective view of a latch assembly of the suitcase of FIG. 1 according to one or more aspects described herein.

As shown primarily in FIG. 18, the locking member 190 may be movably engaged with one or more guide members 192 such that the locking member 190 may slide up and down the guide members 192. In one embodiment, the locking member 190 may include apertures 194 passing through the locking member 190 and through which the guide members 192 may also pass. The guide members 192 may be engaged with the latch body 200 at a top end 195 and at a bottom end 196. As shown in FIG. 18 the guide members 192 are cylindrical rods but any suitable shape may be used that permits upward and downward movement of the locking member 190. For example, guide members 192 may be prismoidal or substantially prismoidal (e.g., a pentagonal prism, hexagonal prism, heptagonal prism, or the like) in shape. In still other examples, the latching assembly 180 may include other devices suitable for allowing generally linear movement between the locking member 190 and the latch body 200, including for example, rails.

As also shown in FIG. 18, the latch assembly 180 may also include at least one biasing member 220 engaged with the latch body 200 and the locking member 190. As will be discussed in more detail below, the biasing member 220 is configured to bias the locking member 190 in a downward position. The biasing member 220 may be a compression spring as shown in FIG. 18, but may in alternative embodiments be any suitable device for biasing the locking member 190 in the downward position.

The locking member 190 may include a base portion 210 and a hook portion 212 extending inwards from the base portion 210. The hook portion 212 may include a lower surface 214 and an inward facing surface 216. As shown in FIG. 15, when the latch assembly 180 is in the locked position, the lower surface 214 of hook portion 212 of the locking member 190 may engage the upper surface 184 of the latch keeper 182 and the inward facing surface 216 of the hook portion 212 may engage the inner surface 186 of the latch keeper 182. Additionally, when the latch assembly 180 is in the locked position the upper surface of the engagement lugs 202 may engage the lower surface 188 of the latch keeper 182.

The latch body 200 may also be pivotally engaged with an activating member 230. The activating member 230 may also be engaged with the locking member 190 and may be configured to move the locking member 190 from the downward position to the upward position. As shown in FIGS. 15 and 16, the activating member 230 may be pivotally engaged to the latch body 200 by a hinge 232 extending through the latch body 200 and the activating member 230. The activating member 230 may include a grip portion 234, an activating barrel 236, and one or more arms 238 connecting the grip portion 234 and the activating barrel 236. As shown in FIG. 16B, the grip portion 234 is spaced a distance from the lower surface of the recess 150 of the lower shell 108. This distance may allow a user grip the back surface 240 of the grip portion 234 with their fingers placed between the lower surface of the recess 150 and the grip portion 234. As shown in FIGS. 15 and 16, the activating barrel 236 of the activating member 230 may engage the locking member 190. The activating barrel 236 may include a raised portion 242. As will be discussed in greater detail below, a user may pull the grip portion 234 of the activating member 230 forward causing the raised portion 242 of the activating barrel 236 to rotate and lift up the locking member 190. This movement causes the latch assembly 180 to unlock and allows the lid 104 to be moved from the closed configuration to an open configuration.

Referring now to FIGS. 16A and 16B, a procedure for moving an embodiment of the latch assembly 180 from the locked position to an unlocked position is shown with side cross-sectional views of the latch assembly 180 and portions of the base 102 and lid 104. FIGS. 16A and 16B illustrate simplified versions of the base 102 and the lid 104 to focus the illustrations on the latch assembly 180. FIG. 16A depicts the latch assembly 180 in the locked position, and FIG. 16B depicts the latch assembly 180 in an unlocked position. As shown in FIG. 16A, in the locked position, the lower surface 214 of hook portion 212 is engaged with the upper surface 184 of the latch keeper 182; the inward facing surface 216 of the hook portion 212 is engaged with the inner surface 186 of the latch keeper 182, and the engagement lugs 202 are engaged with the lower surface 188 of the latch keeper 182.

As shown in FIG. 16B, the latching assembly 180 may be moved to the unlocked position by rotating the activating member 230 as shown with arrow. This rotation may be accomplished by a user pulling forward on back surface 240. As the activating barrel 236 rotates, the raised portion 242 engages the locking member 190 and raises the locking member 190.

The latch assembly 180, including the latch body 200, locking member 190, and activating member 230, may each be separately formed and may be formed of materials such as plastic materials or another suitable material which can be formed or molded into the desired shape. The latch assembly 180 may be made of sufficient size, thickness and materials of construction to withstand repeated cycles of stress as the latch is engage/disengaged with the latch keeper 182 over time. The suitcases described herein include various features that ensure easy and efficient manufacture of the suitcases, while providing durability and wear resistance.

Figure 19:
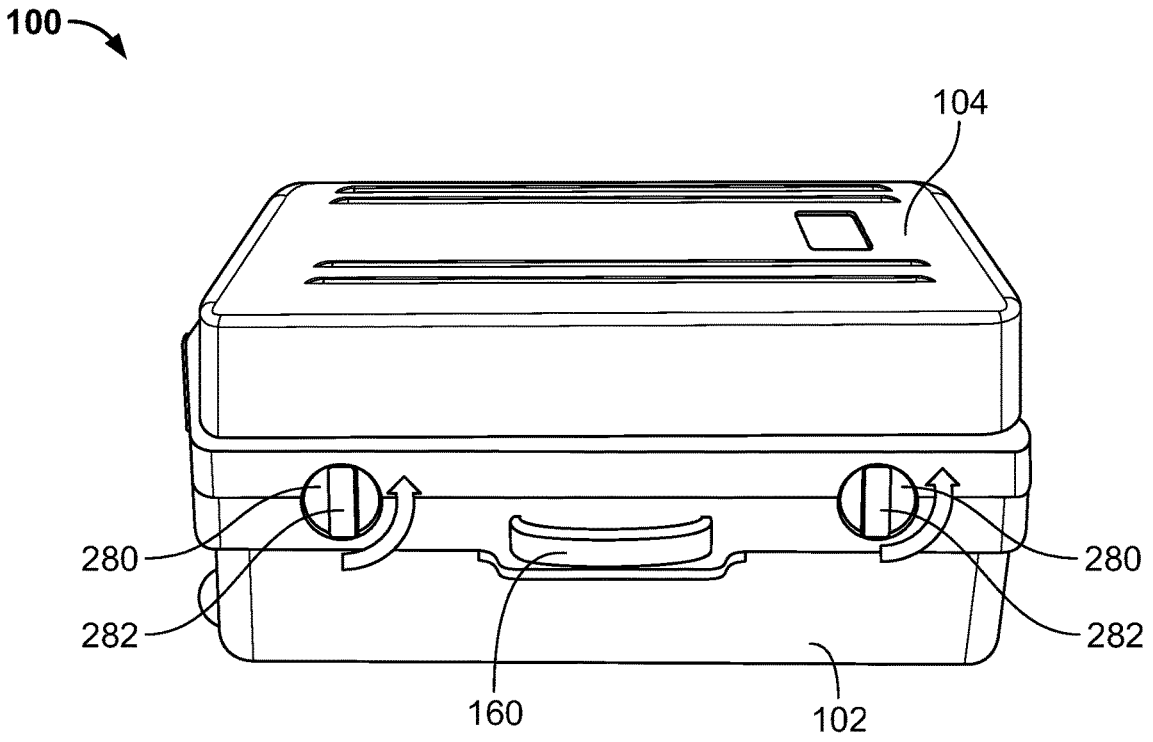
FIG. 19 is a side perspective view of an alternate embodiment of the suitcase of FIG. 1 in a locked orientation according to one or more aspects described herein.
Figure 20:
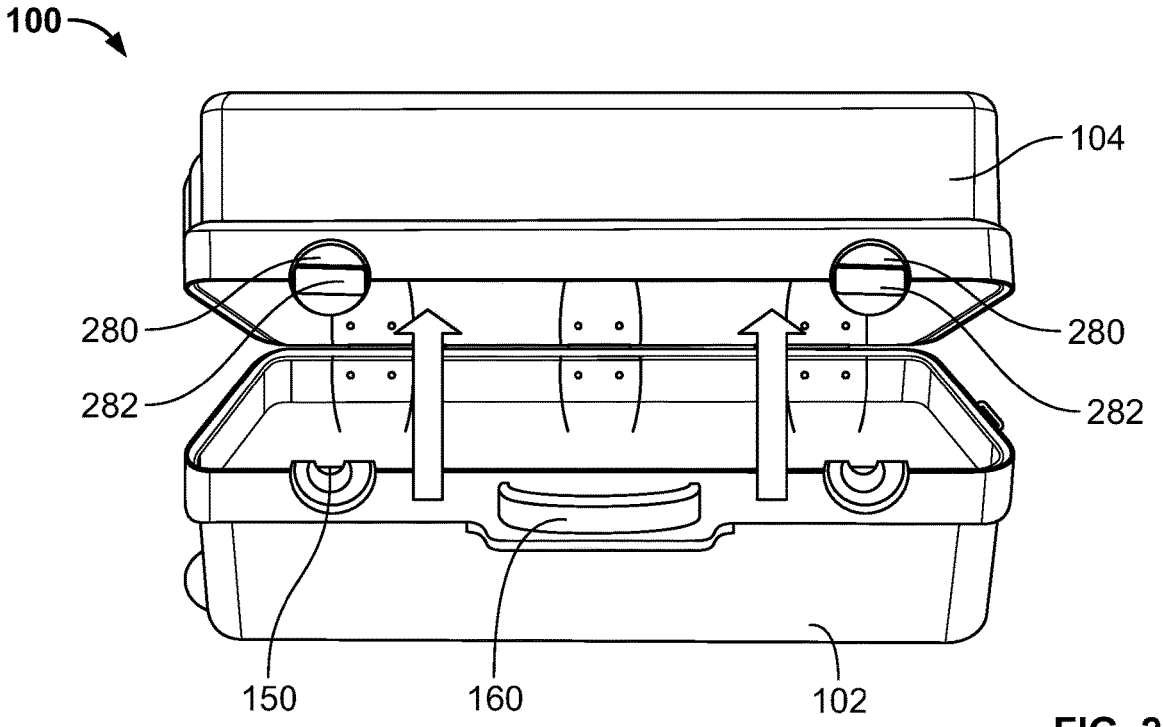
FIG. 20 is a side perspective view of an alternate embodiment of the suitcase of FIG. 1 in an unlocked orientation according to one or more aspects described herein.

FIGS. 19-20 illustrate suitcase 100 with alternate latching assemblies 280 to lock and unlock the lid 104 to the base 102. The latching assemblies 280 may include a handle 282 that can rotate about an axis that is generally oriented generally perpendicularly to the first side 110 of the lower shell 108 and the first side 126 of the upper shell 124. The handle 282 may be permanently attached to the lid 104 and have a latch or hook such that when in a locked orientation, the latch engages to the base 102 to lock the lid 104 to the base 102. To unlock the suitcase 100, the handle 282 may be rotated approximately 90 degrees to disengage the latch from the base 102 allowing the lid 104 to move relative to the base 102.

Figure 21:
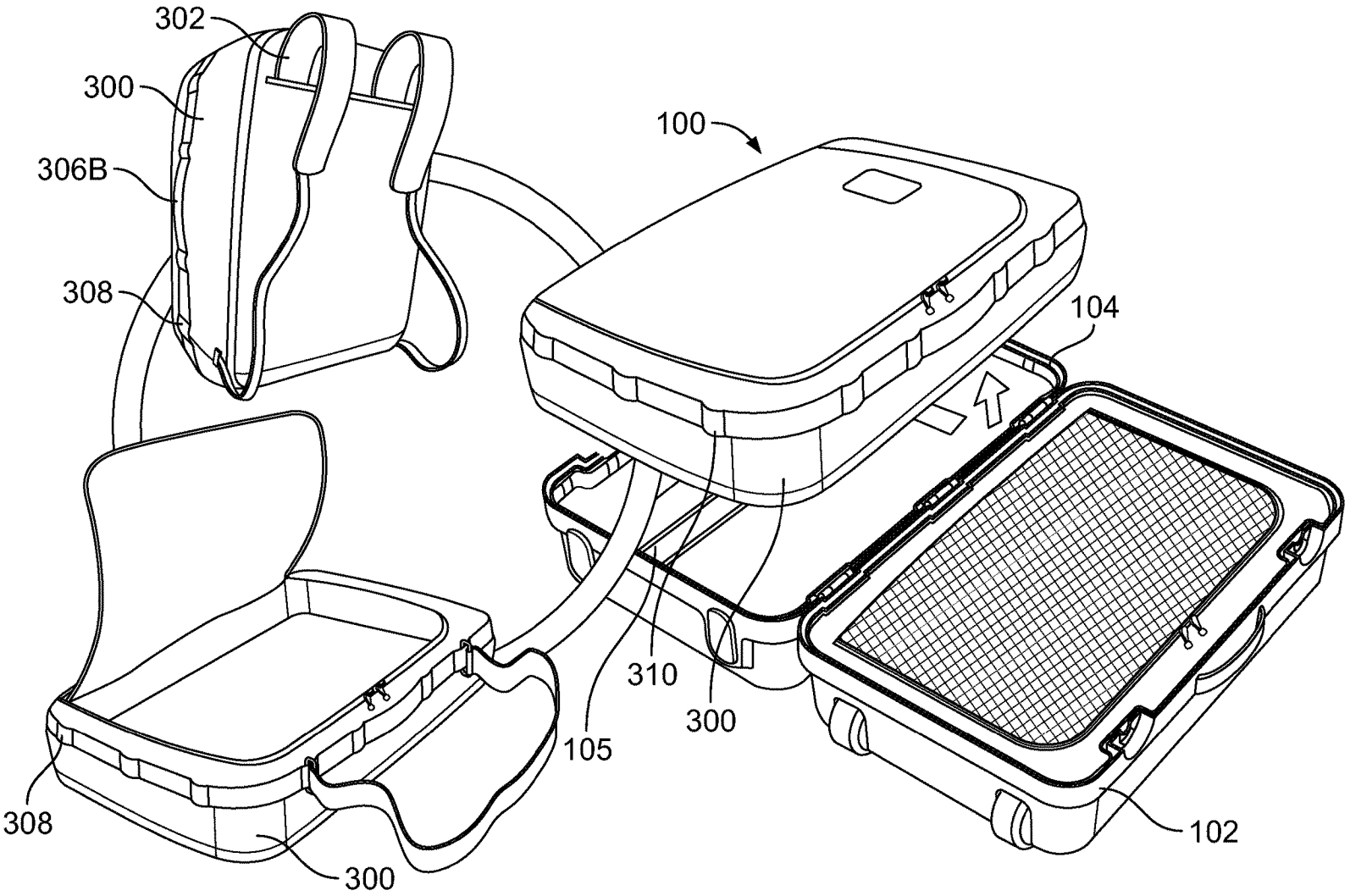
FIG. 21 is a perspective schematic view of an alternate embodiment of the suitcase of FIG. 1 with a deployable bag according to one or more aspects described herein.
Figure 22:
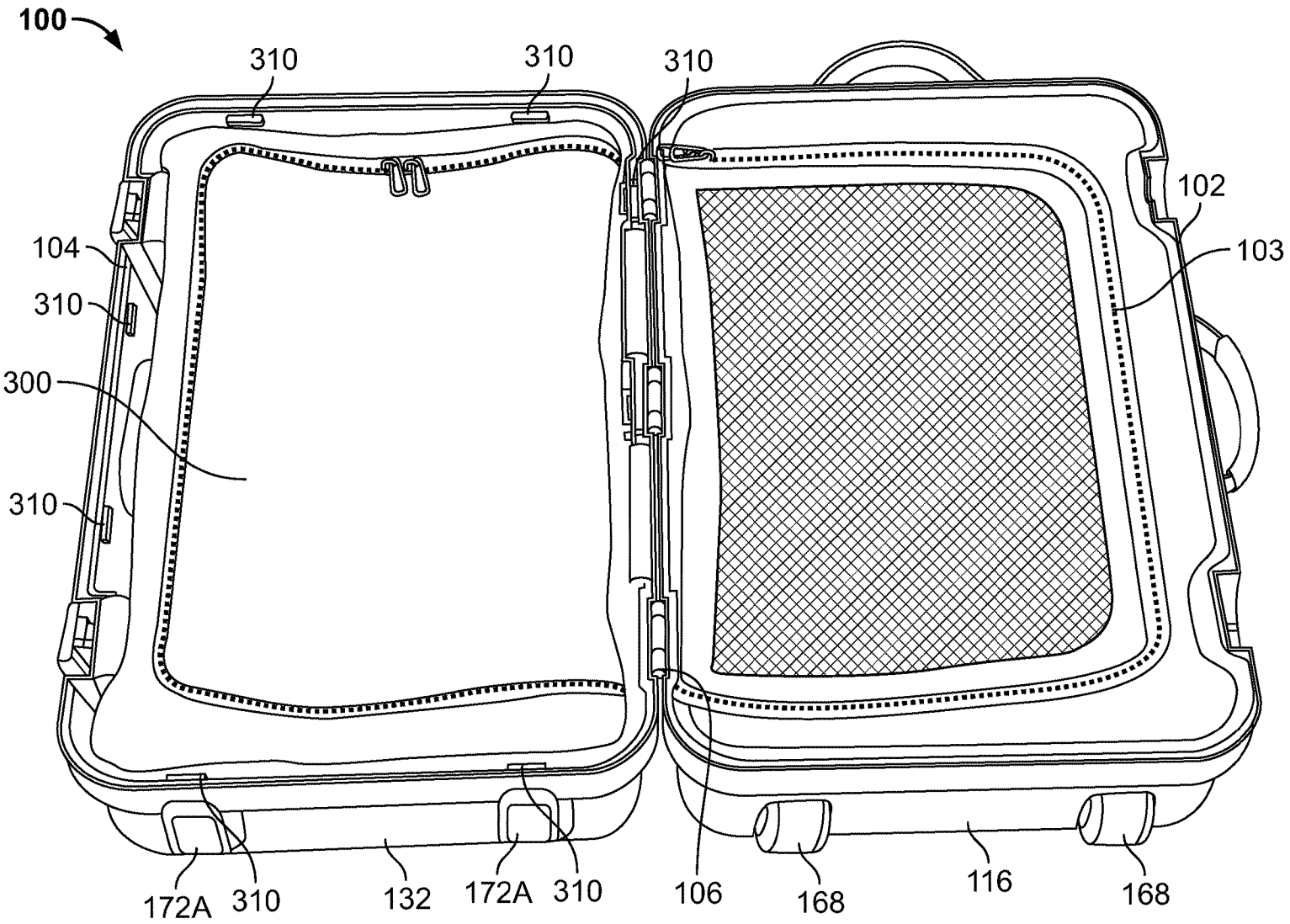
FIG. 22 is a top perspective view of an alternate embodiment of the suitcase with a deployable bag of FIG. 21 according to one or more aspects described herein.
Figure 23:
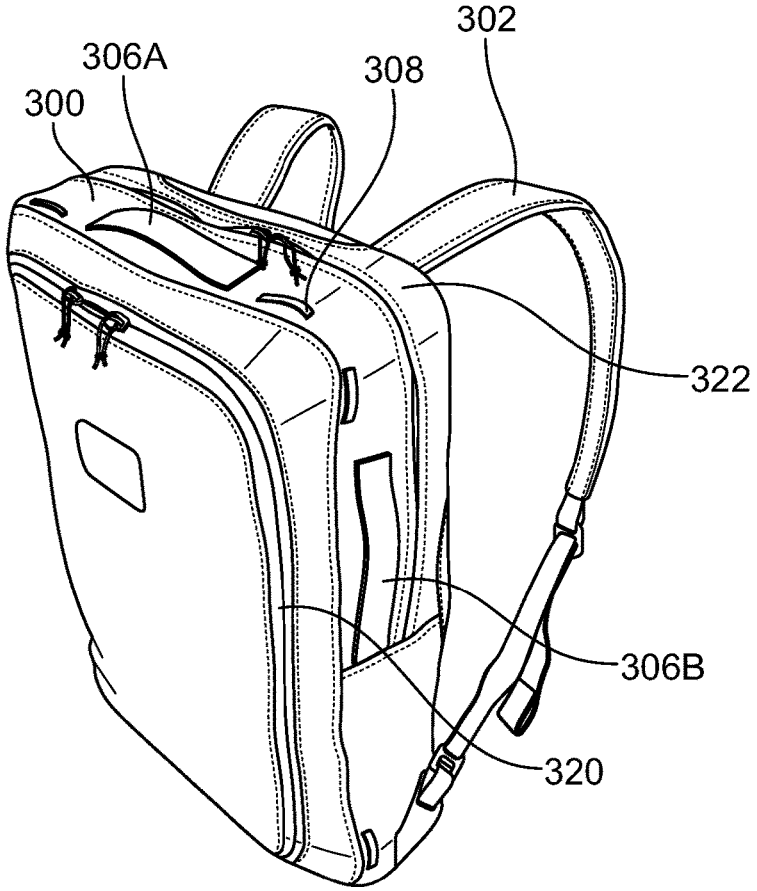
FIG. 23 is a front right perspective view of the deployable bag in a closed configuration of the suitcase of FIG. 21 according to one or more aspects described herein.
Figure 24:
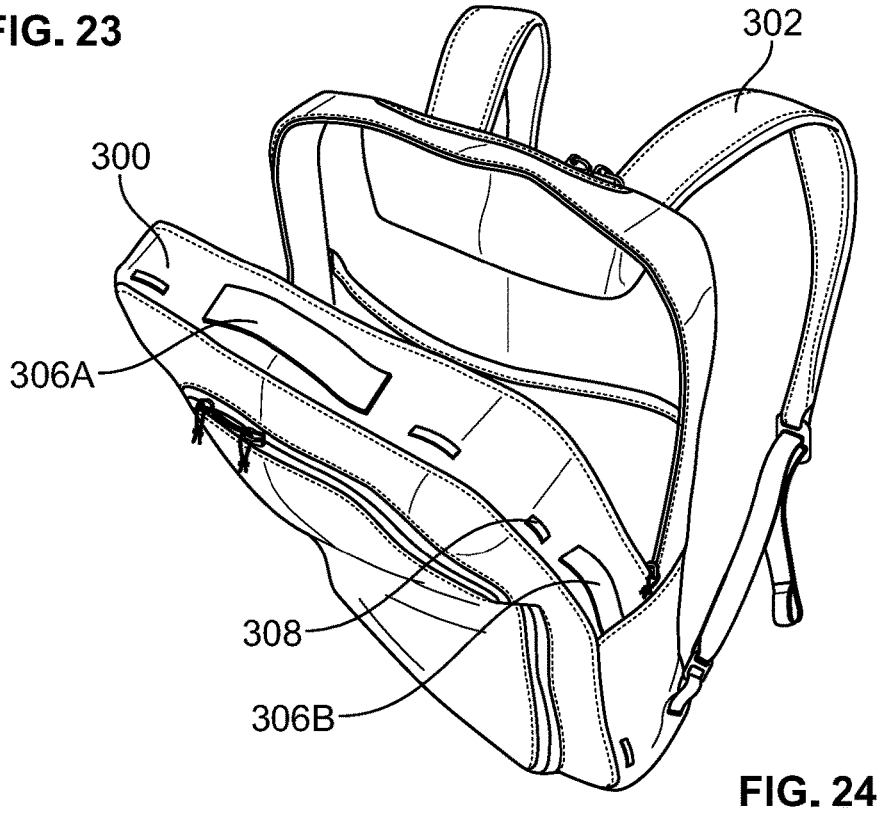
FIG. 24 is a front right perspective view of the deployable bag in an open configuration of the suitcase of FIG. 21 according to one or more aspects described herein.
Figure 25:
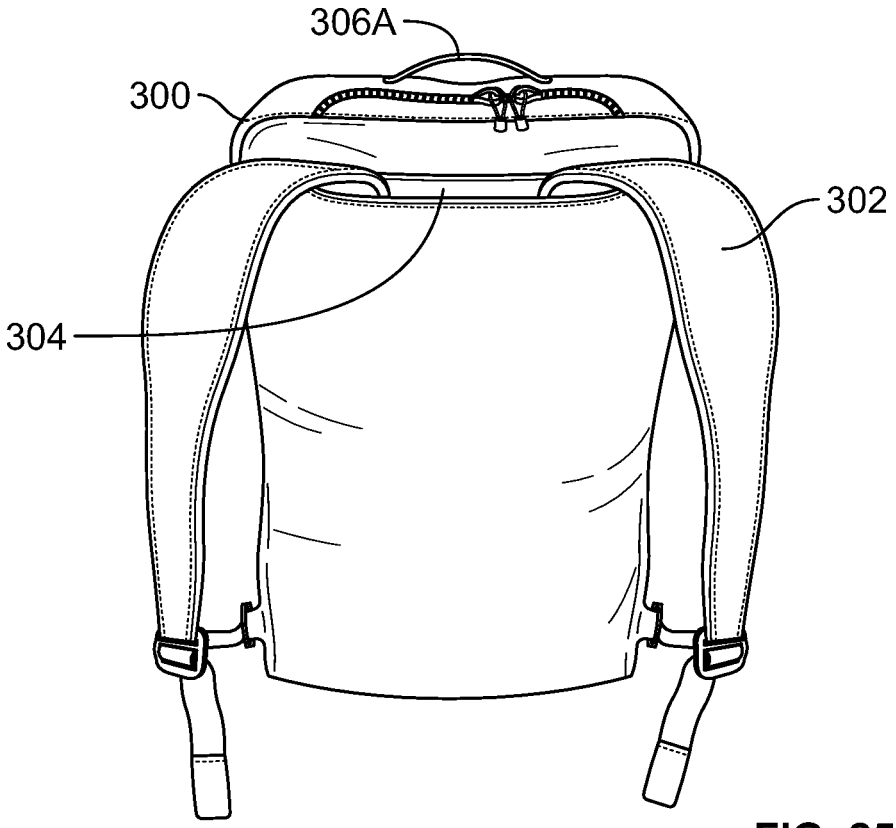
FIG. 25 is a rear perspective view of the deployable bag in a closed configuration of the suitcase of FIG. 21 according to one or more aspects described herein.
Figure 26:
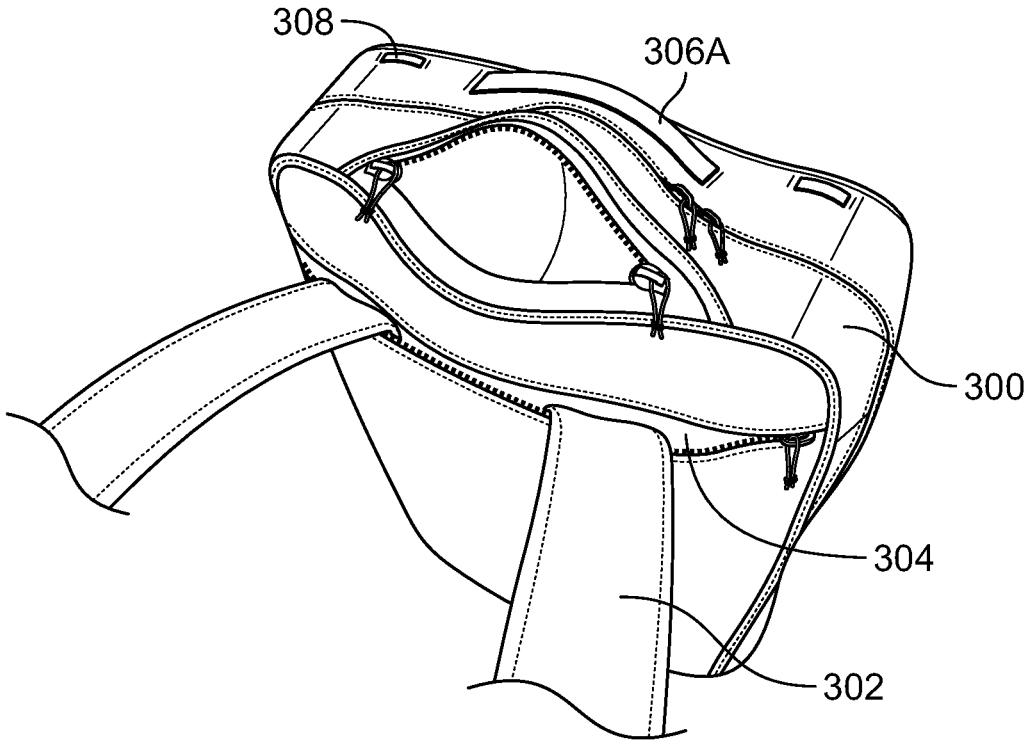
FIG. 26 is a rear perspective view of the deployable bag in an open configuration of the suitcase of FIG. 21 according to one or more aspects described herein.

FIGS. 21-29 illustrate another option for the suitcase 100. In this embodiment, the suitcase 100 may include a deployable bag 300 that attaches to one or both of the interior voids 103, 105. FIG. 21 illustrates the conversion of the bag 300 from being removed from interior void 105 of the lid 104, and then converted to a backpack. FIG. 21 also shows the bag 300 in an open configuration with a front pocket unzipped. While the illustrated embodiment shows the deployable bag 300 releasably attached to the interior void 105 of the lid 104, the deployable bag 300 may be releasably attached to the interior void 103 of the base 102. The deployable bag 300 may be secured within the suitcase 100 and then removed to easily convert to a portable bag that can easily be carried by a user. The deployable bag 300 may have at least one carrying strap or a pair of carrying straps 302 as shown such that the bag 300 may be worn as a backpack by the user.

The deployable bag 300 may have a plurality of pockets including a rear pocket 304 that may secure and store the straps 302 such that the bag 300 may be carried by either the handle 306A located on the top of bag 300 or the handle 306B located on the side of the bag 300. The bag 300 may also have a closure 320 on the front side of the bag along with a closure 322 along the sides that allow access to the interior of the bag 300. The front closure 320 allows a user to access the interior of the bag 300 even when the bag 300 is secured within the lid 104. The bag 300 may include a waterproof exterior material and may have a volume of approximately 20 liters or within a range of 15 to 30 liters. As another way of defining the size, the bag 300 may substantially fill the volume of the interior void 105 of the lid 104. As another option for the deployable bag 300, a one-way air vent may be provided to allow the bag 300 to be compressed to remove the air from the bag 300 to minimize the volume of the bag within the suitcase 100.

Figure 27:
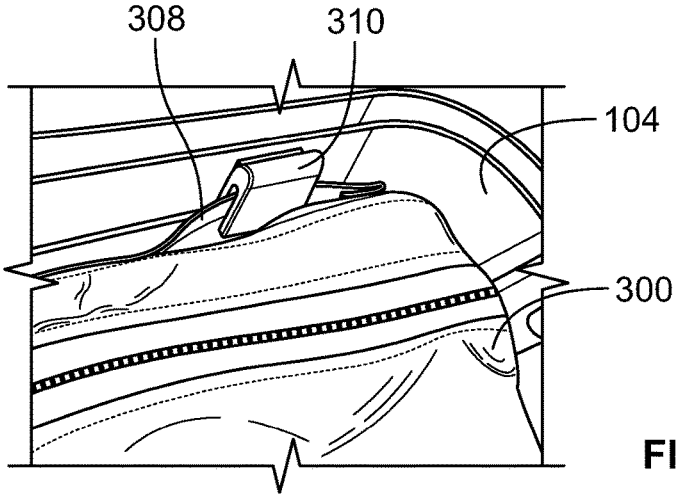
FIG. 27 is an enlarged view of the deployable bag installed in the suitcase of FIG. 21 according to one or more aspects described herein.
Figure 28:
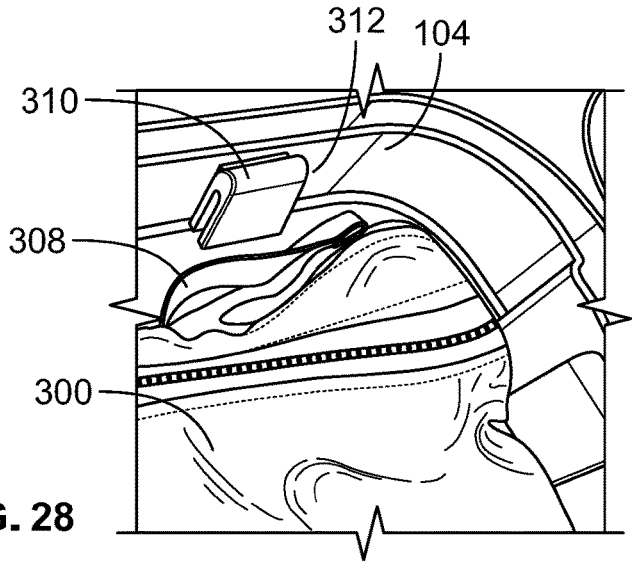
FIG. 28 is an enlarged view of the deployable bag installed in the suitcase of FIG. 21 according to one or more aspects described herein.
Figure 29:
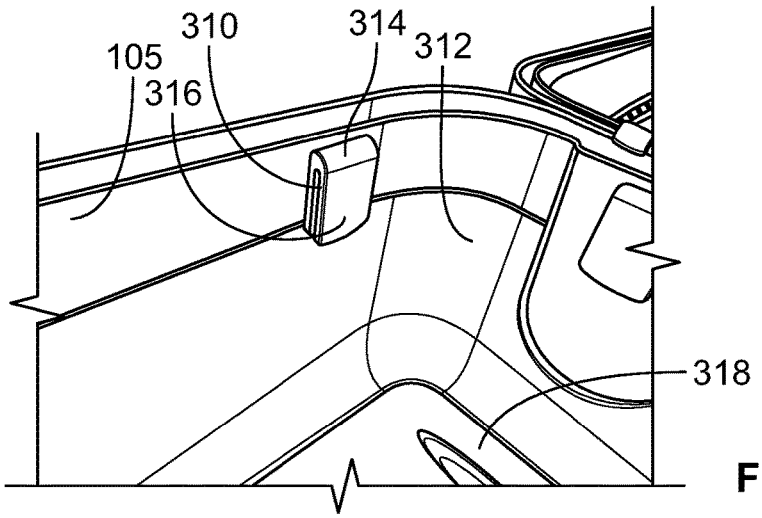
FIG. 29 is an enlarged view of the deployable bag installed in the suitcase of FIG. 21 according to one or more aspects described herein.

In addition, bag 300 may include a plurality of attachment loops 308 arranged along an exterior perimeter of the bag 300. For instance, the attachment loops 308 may be evenly spaced along the top, bottom, left, and right sides of the bag 300. Each side of the bag 300 may include at least two attachment loops 308, or in some embodiments, each side of the bag 300 may have three or more attachment loops 308. Each attachment loop 308 may engage a hook 310 located along the sides of the interior void 105 of the lid 104. As shown in FIGS. 27, the hook 310 may engage and extend through the loop 308 to secure the bag 300 to the suitcase 100. FIG. 28 illustrates the removal of the loop 308 from the hook 310 to disengage the bag 300 from the suitcase 100. The hook 310 may be permanently connected to an interior side surface 312 of the lid 104. The hook 310 may comprise an outward member 314 extending outward from the side surface 312 and then a downward member 316 that extends from the edge of the outward member 314 towards the interior bottom surface 318 of the lid 104.

The attachment loops 308 may be part of an outer band that is attached to the exterior surface of the bag 300, or alternatively, the loops 308 may be individually placed along the exterior surface of the bag. The attachment loops 308 may be formed from a nylon or other suitable fabric material. As an alternative, the attachment loops 308 may be replaced by alternate fastening methods such as hook and loop type fasteners, magnetic elements, or other releasable element that may be positioned around the perimeter of the bag 300.

As another option, the bag 300 may be replaced by a plurality of deployable bags 300 that are removably coupled to the interior of the lid 104. The plurality of deployable bags 300 may be modular bags of different sizes. For example, the plurality of deployable bags 300 may include a first bag that fills approximately one-half of the interior void 105 and a second and third bag that each fills approximately one-quarter of the interior void 105. Additionally, at least one of the plurality of bags may be waterproof or all of the plurality of bags may be waterproof.

The suitcase 100 may also include a trolley handle assembly 400 or tow pull handle. The trolley handle assembly, or tow pull, may be used in conjunction with wheels on a suitcase to easily pull or push the suitcase making it more maneuverable. The trolley handle assembly 400 may comprise a pair of extrusion assemblies 410 that are connected to the base 102 of the suitcase 100 and connected to each other by a handle or grip 402. The components of the trolley handle assembly 400 may be formed by various forming methods. For example, metal components, may be formed by forging, extruding, molding, casting, stamping, machining, and/or other known techniques. The polymer components may be formed or manufactured by polymer processing techniques, such as various molding and casting techniques and/or other known techniques.

Figure 30:
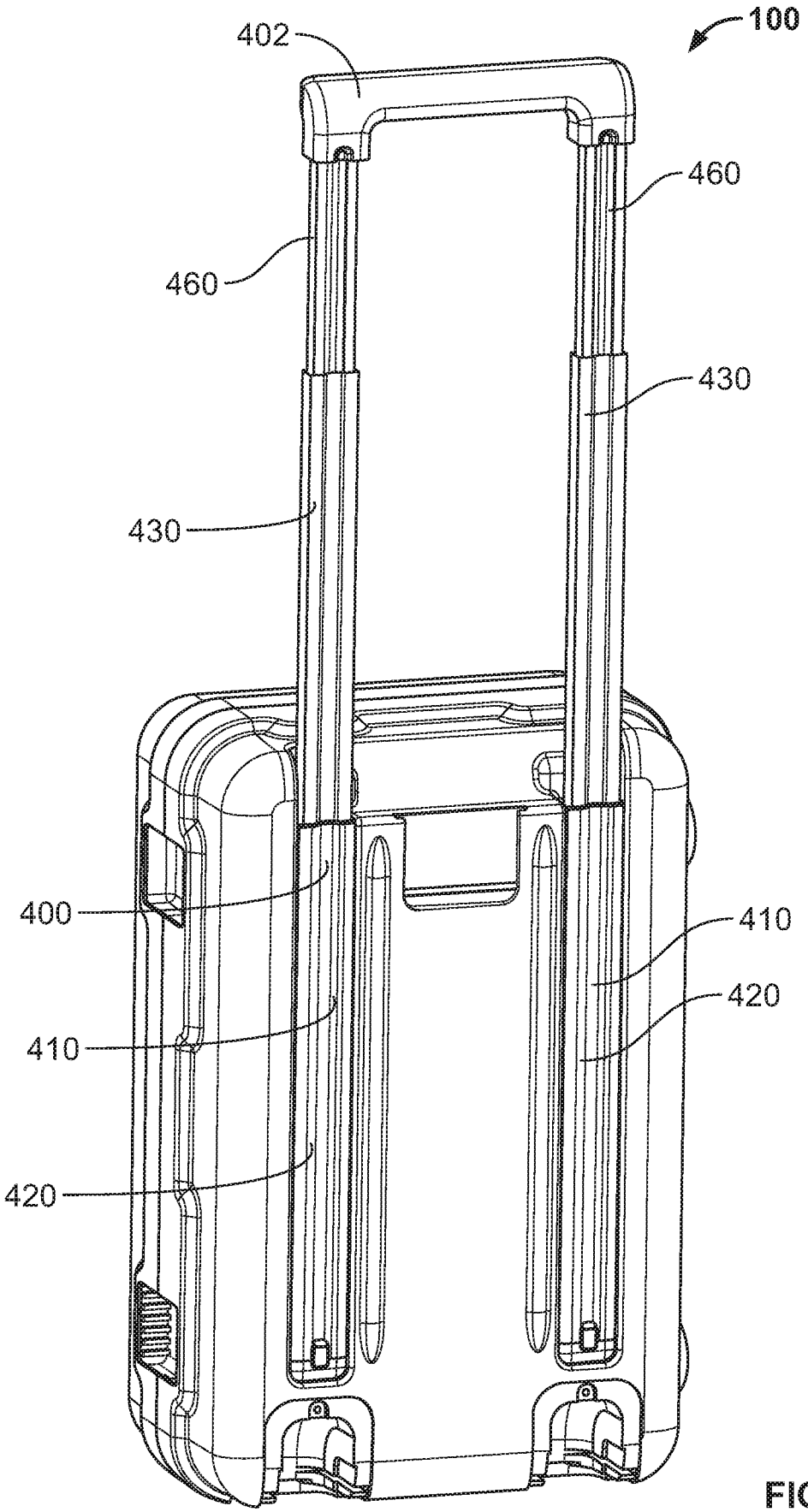
FIG. 30 is a rear perspective view of the suitcase of FIG. 1 with the trolley handle extended and some components removed according to one or more aspects described herein.
Figure 32:
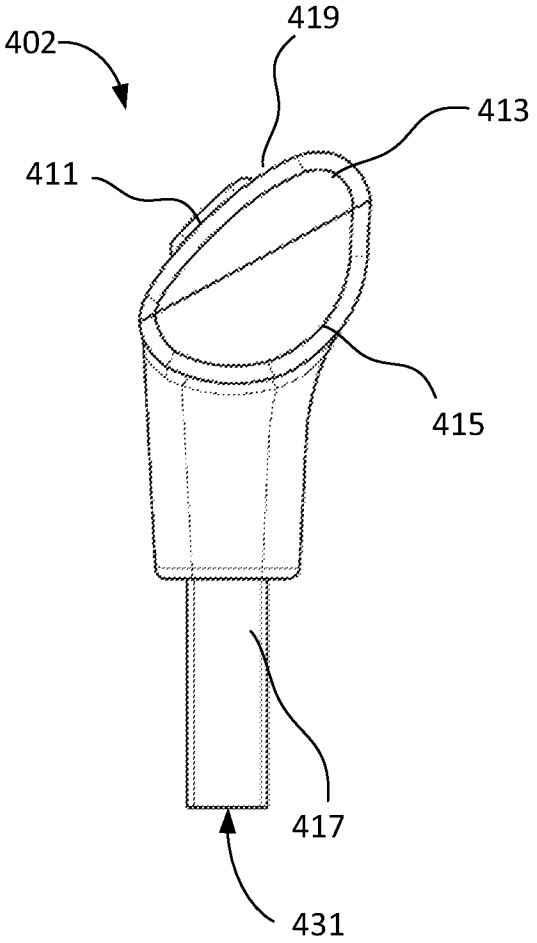
FIG. 32 is a side view of the grip portion of FIG. 31 according to one or more aspects described herein.
Figure 31:
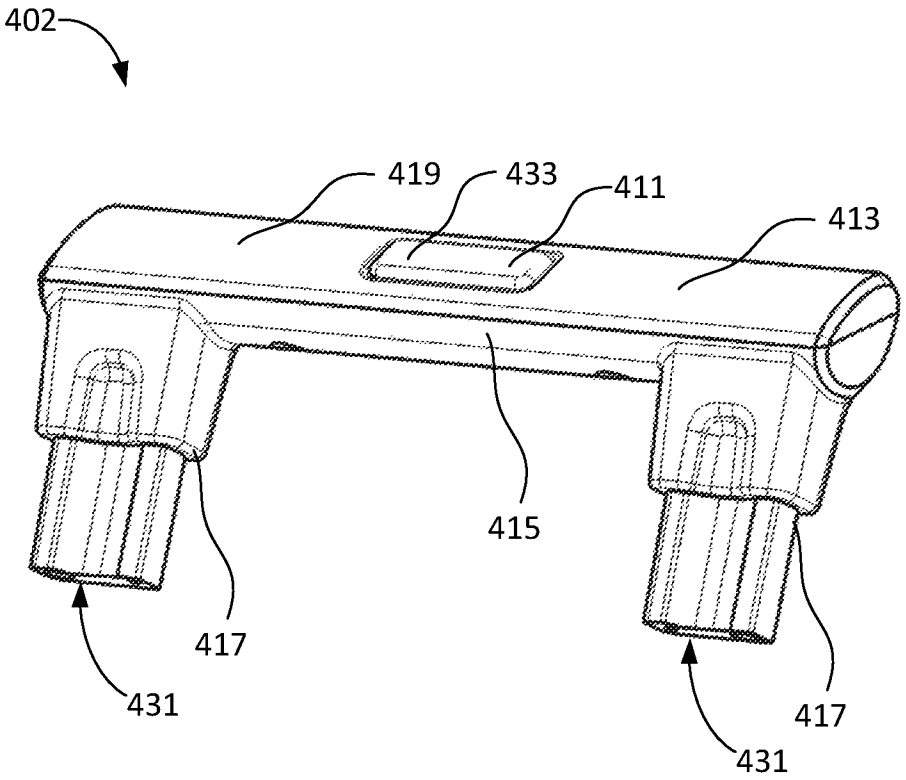
FIG. 31 is a front perspective view of the grip portion of the trolley handle assembly of an exemplary suitcase according to one or more aspects described herein.

As discussed above, the exterior of the suitcase 100 may have a contoured shape that may include a plurality of recesses to accommodate the latch assemblies, trolley handle assembly 400, and wheels 168 to minimize their profile and exposure to possible damage from collisions with other objects during travel. For instance, the lower shell 108 may have a tow pull recess 154 that is offset from the primary surface 146 on the bottom portion 122 of the lower shell 108. The tow pull recess 154 may have a depth that is equal to or greater than the thickness of the extrusion assembly 410 to adequately protect the trolley handle assembly 400 from impacts. The trolley handle assembly 400 may include an a pair of extendable extrusion assemblies 410 that can extend above from the top of the suitcase 100 to provide an elevated grip 402 for a user to easily pull the suitcase 100 as shown in FIG. 30. The extrusion assemblies 410 may include a major extrusion 420 and one or more minor extrusions 430, 460, where the minor extrusions may be nested within a central opening of the major extrusion 420, and slidably engaged with the major extrusion 420.

FIGS. 31-34 illustrate an exemplary grip or handle 402 of the trolley handle assembly 400. As discussed above the grip 402 may extend between the extrusion assemblies 410 and act as the interface for a user to extend and lower the trolley handle 400. The grip 402 may include a release button 411, an upper grip housing 413, and a lower grip housing 415. The lower grip housing 415 may include a pair of extension members 417 that extend away from an upper surface 419 of the upper grip housing 413. These extension members 417 may have an opening 431 with a shape and profile that is slightly larger than the profile of the minor extrusion 430 or of the tertiary or second minor extrusion 460 such that the uppermost extrusion member 430, 460 may be inserted into the opening 431 and secured. The extrusion member 430, 460 may then be secured to the grip 402 by means known to one skilled in the art.

Figure 33:
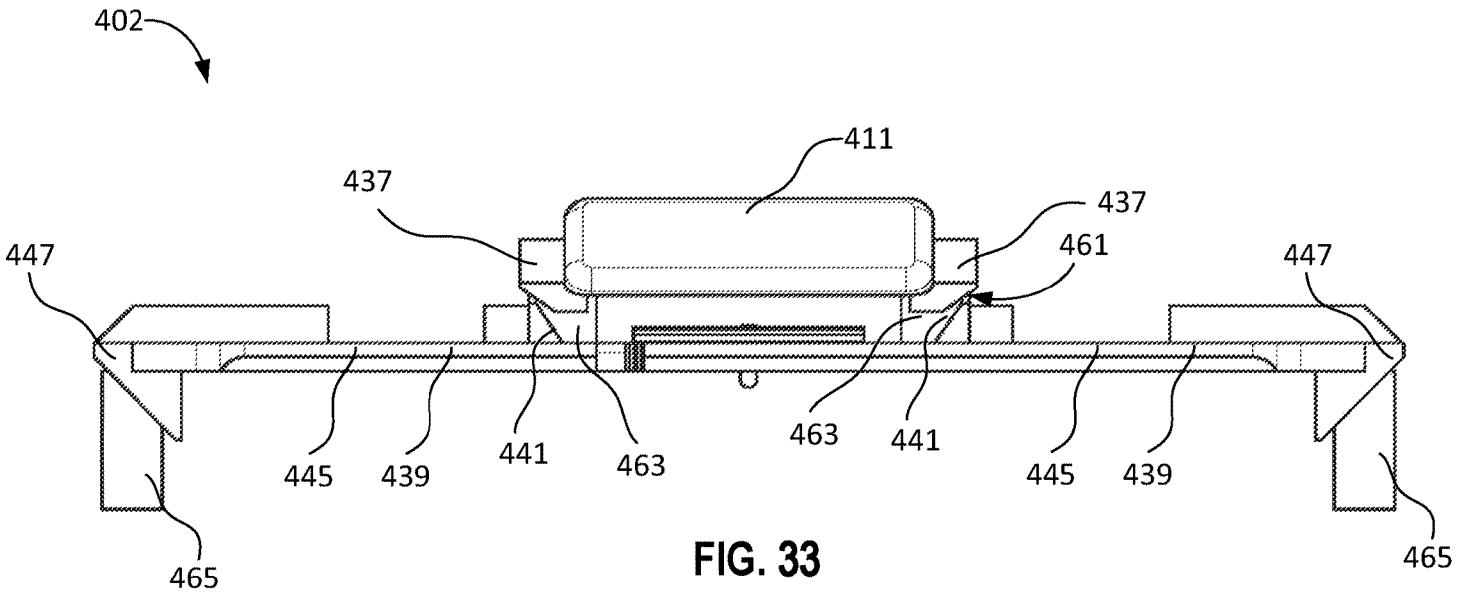
FIG. 33 is a front view of the grip portion of FIG. 31 with the outer housings removed according to one or more aspects described herein.
Figure 34:
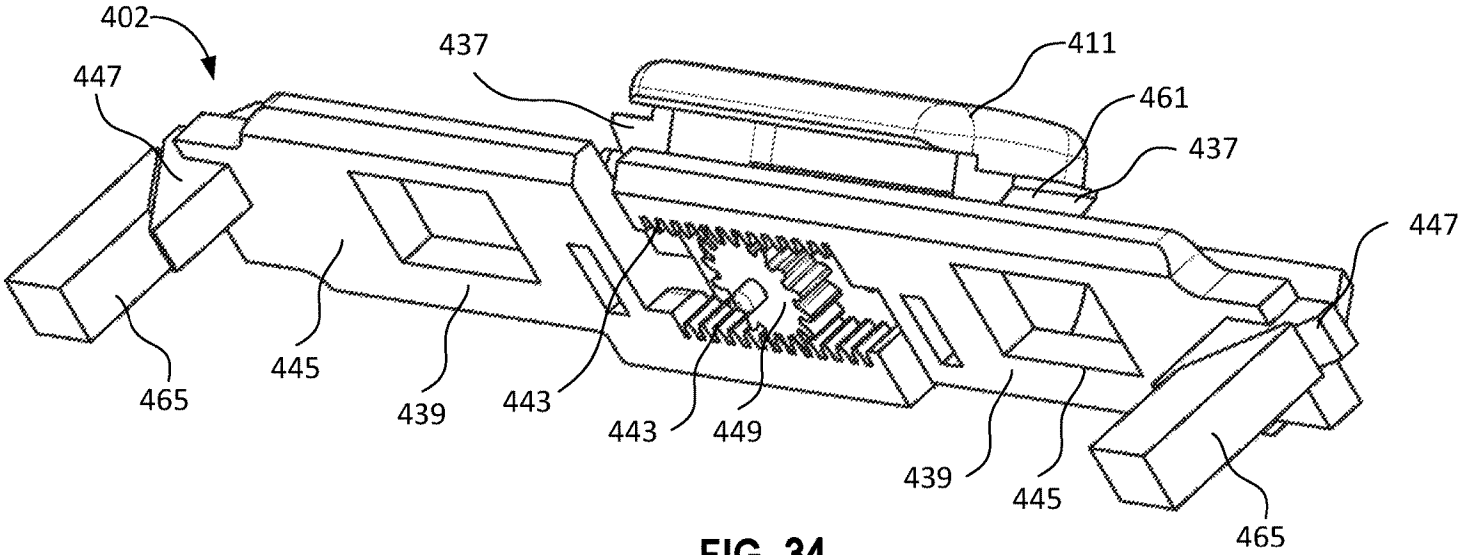
FIG. 34 is a perspective view of the grip portion FIG. 33 according to one or more aspects described herein
Figure 35:
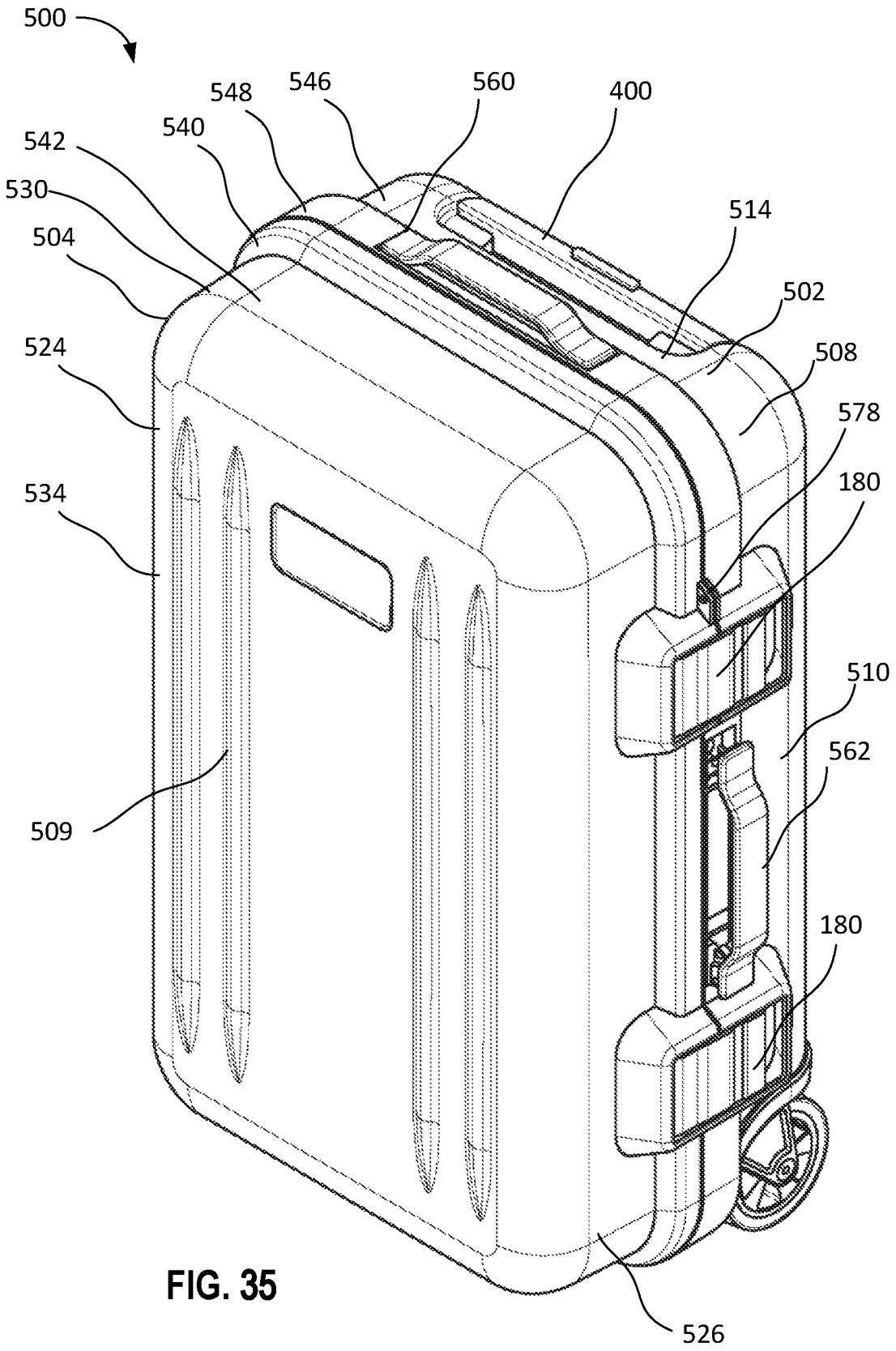
FIG. 35 is a front perspective view of another exemplary suitcase according to one or more aspects described herein.
Figure 36:
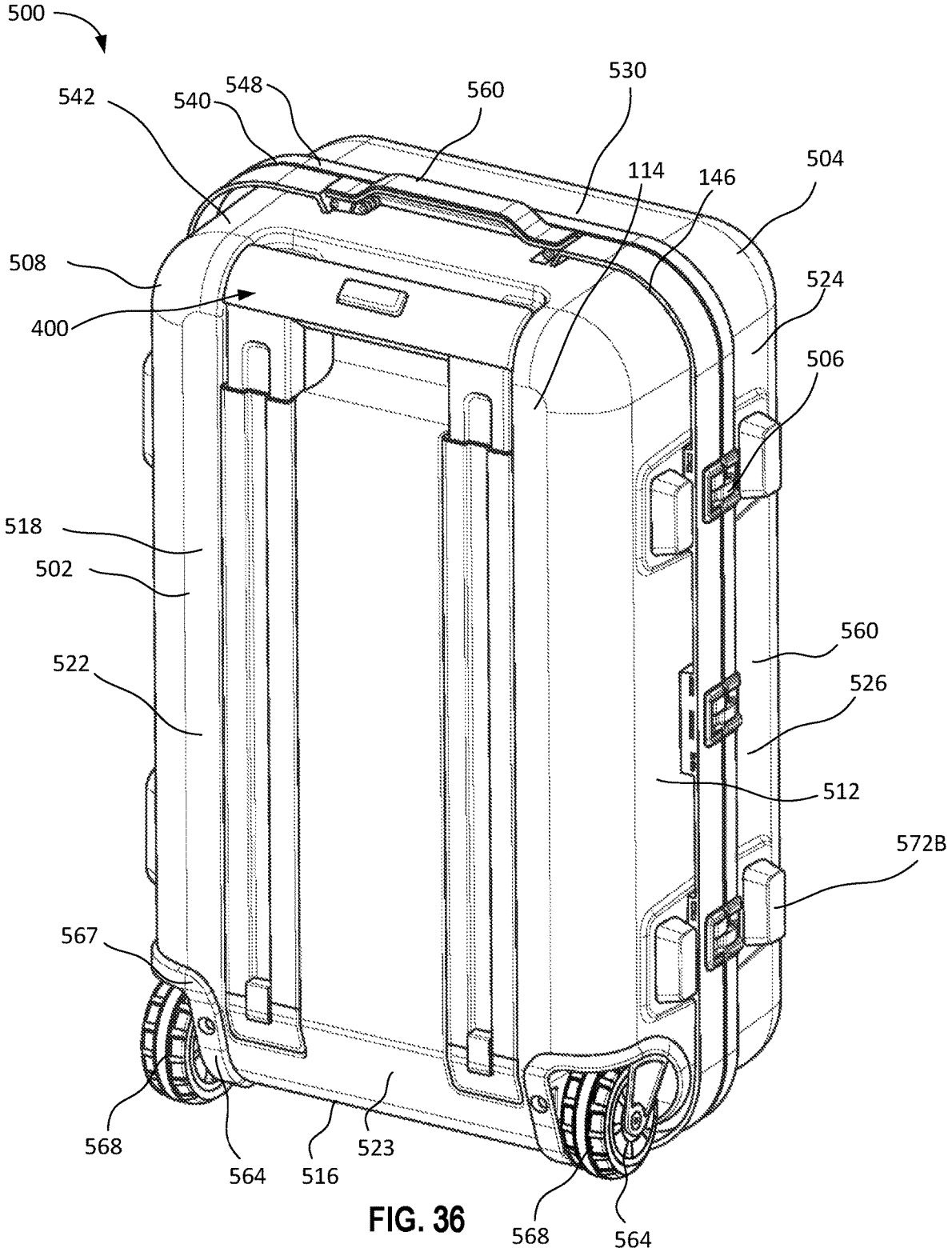
FIG. 36 is a rear perspective view of the suitcase of FIG. 35 according to one or more aspects described herein.
Figure 38:
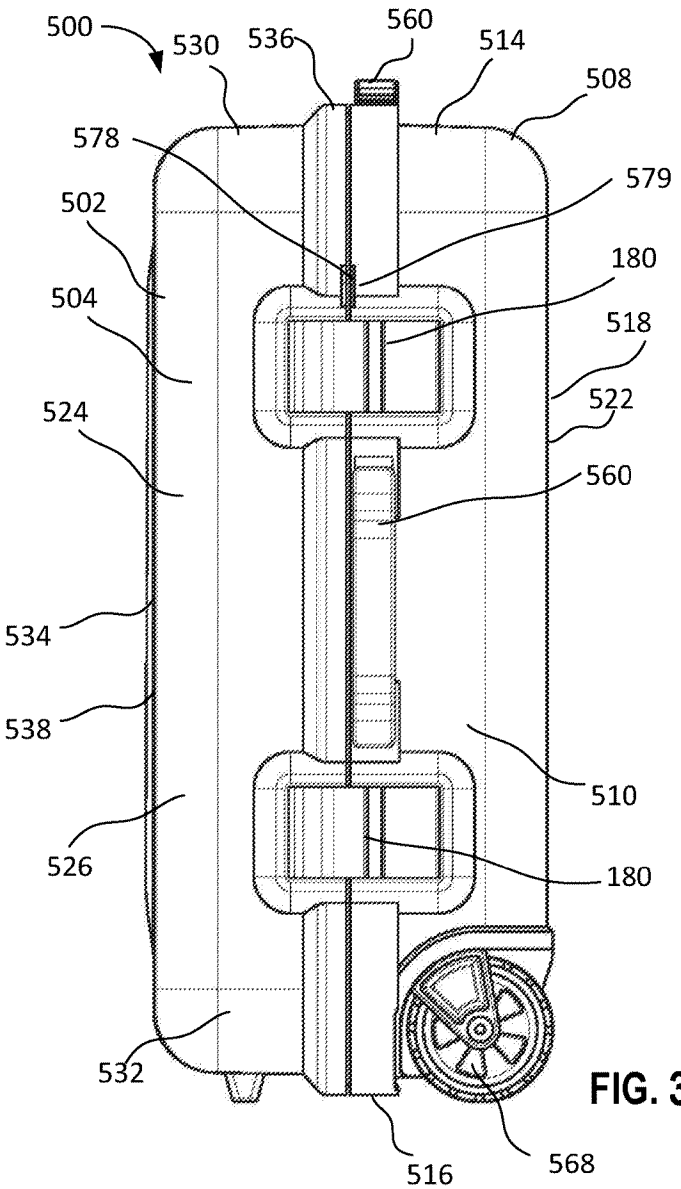
FIG. 38 is a right side view of the suitcase of FIG. 35 according to one or more aspects described herein.
Figure 37:
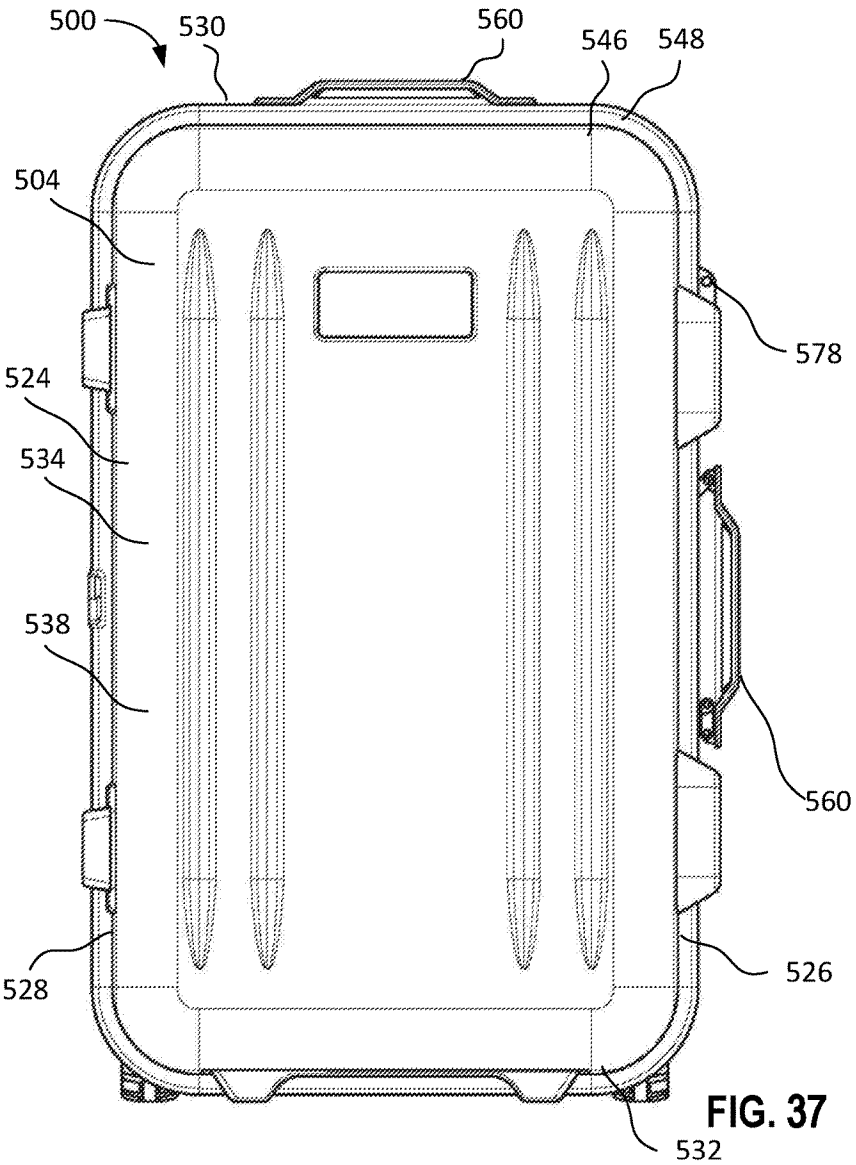
FIG. 37 is a front view of the suitcase of FIG. 35 according to one or more aspects described herein.
Figure 40:
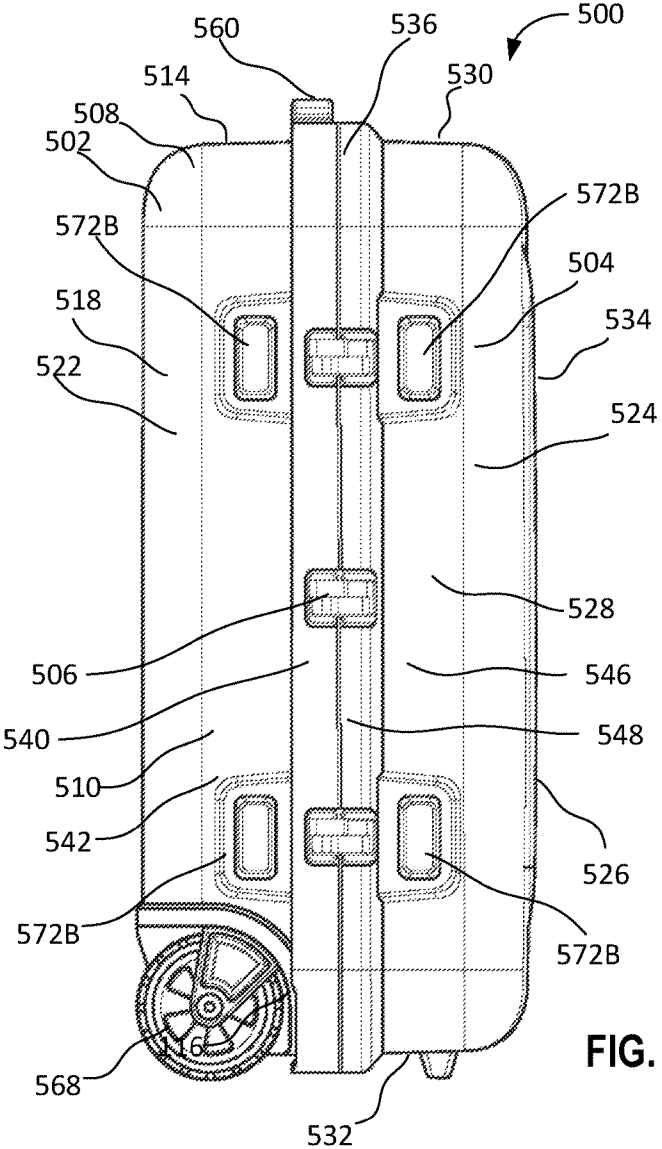
FIG. 40 is a left side view of the suitcase of FIG. 35 according to one or more aspects described herein.
Figure 39:
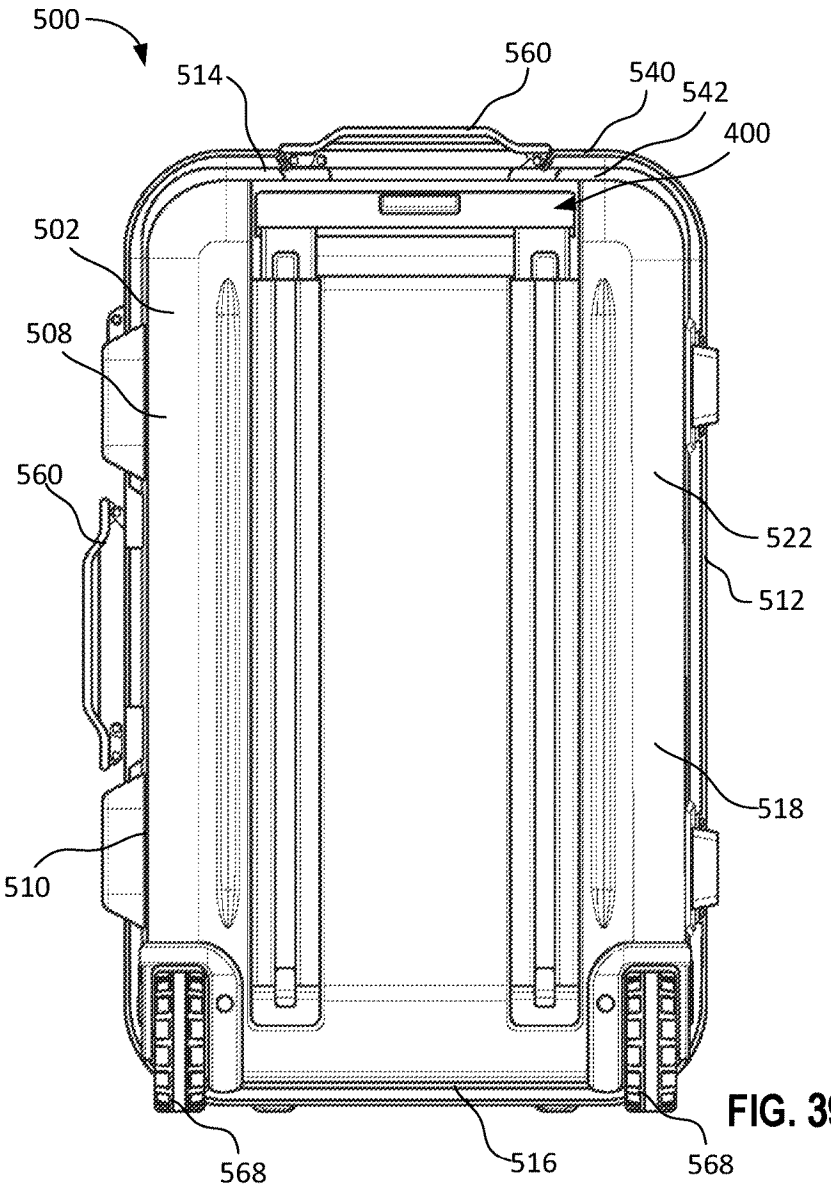
FIG. 39 is a rear view of the suitcase of FIG. 35 according to one or more aspects described herein.
Figure 41:
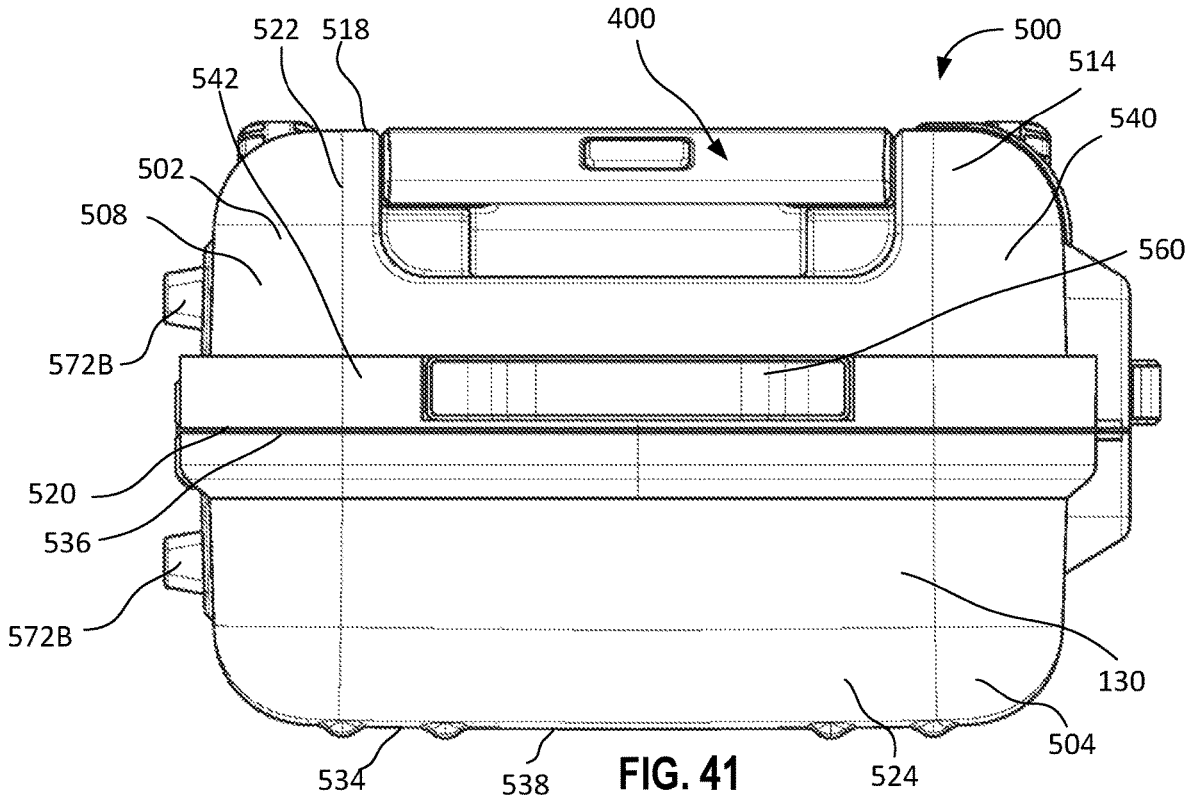
FIG. 41 is a top view of the suitcase of FIG. 35 according to one or more aspects described herein.
Figure 42:
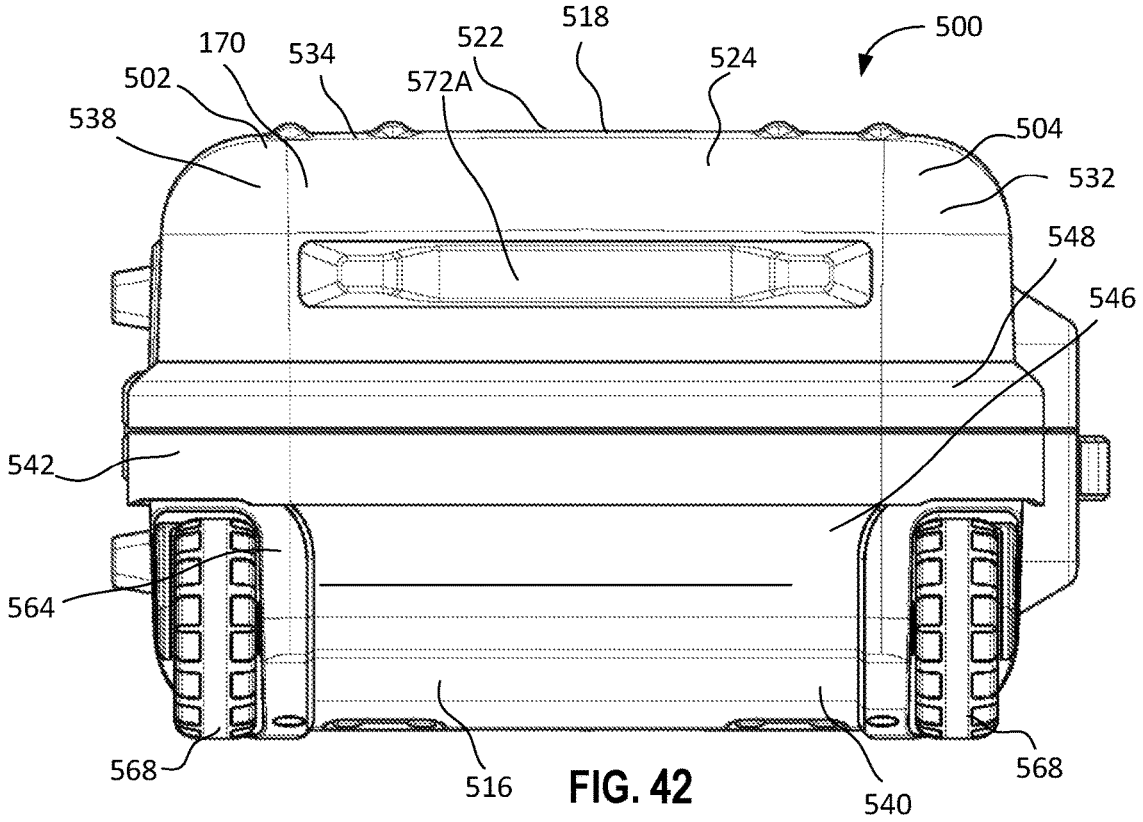
FIG. 42 is a bottom view of the suitcase of FIG. 35 according to one or more aspects described herein.

The release button 411 may be centrally located in both a horizontal and vertical direction along the grip 402. In addition, the upper surface 419 may be contoured to match the adjacent surfaces of the suitcase to provide a clean aesthetic appearance. The release button 411 also may be include a contoured upper surface 433 to correspond with the upper surface 419 of the grip 402. Further, the release button 411 may be coupled to a rack and pinion gear assembly 435 as shown in FIGS. 33 and 34 that are illustrated with the upper grip housing 413 and the lower grip housing 415 removed. The release button 411 may have two lower engaging members 437 on each end of the button 411 that contact an engaging member 441 located on each of a pair of rack gear members 439. Each rack gear member 439 may include an engaging member 441, a rack gear portion 443 at a first end, a base member 445, and a transmitting member 447 at a second end opposite the first end. The rack gear portion 443 of each of the rack gear members 439 may engage with a pinion gear 449. The pinion gear 449 may be centrally located beneath the release button 411, such that when the release button 411 is pushed, the release button 411 may move in a direction generally perpendicular to the upper surface 419 of the grip 402. As the button 411 is pushed, the lower engaging members 437, which may have an angled surface 461, may contact and slide along a corresponding angled surface 463 of the engaging member 441 on the rack gear member 439. Angled surface 463 may have a compound angle relative to an upper surface of the base member 445, where the compound angle is angled to two orthogonal planes that are also orthogonal to the upper surface of the base member 445. The compound angle of surface 463 may form acute angles between 1 degree and 60 degrees to the two orthogonal planes. As the angled surfaces 461, 463 move along one another, both of the rack gear members 439 be urged to move outward. The pinion gear 449 may help to keep the movement between both gear members 439 equal and in a controlled manner. As the gear members 439 move outward, the transmitting member 447 then applies a force to an activating member 465 located in a slot positioned within the lower extension 417. The transmitting member 447 may include an angled surface that contacts an angled surface on activating member 465. Activating member 465 may disengage a locking mechanism for the trolley handle assembly 400 allowing the grip 402 to be pulled upward and extend the extrusion assembly 410.

FIGS. 35-52 illustrate exemplary suitcase 500. The features of suitcase 500 are referred to using similar reference numerals under the "5*xx*" series of reference numerals, rather than "1*xx*" as used in the embodiment of FIGS. 1-30. Accordingly, certain features of suitcase 100 that were already described above as shown in FIGS. 1-30 may be described in lesser detail, or may not be described at all. In addition, suitcase 500 may also include a latch assembly 180 and trolley handle 400 as described above. Exemplary suitcase 500 may include a base 502 and the lid 504 rotatably coupled together by a hinge 506 or a plurality of hinges 506.

The base 502 may include a lower shell structure 508 having a first side 510, a second side 512 opposite the first side 510, a third side 514 extending between an edge of the first side 510 and an edge of the second side 512, and a fourth side 516 opposite the third side 514. The lower shell 508 may also have a first end 518 and a second end 520 near the opening for the interior void 503 of the base 502. The lower shell 508 may also include a bottom portion 522 connected to a first end 518 of the lower shell structure 508 and configured to support the suitcase 500 on a surface such as a table, the ground, or the like. Similarly, the lid 504 may include a upper shell structure 524 having a first side 526, a second side 528 opposite the first side 526, a third side 530 extending between an edge of the first side 526 and an edge of the second side 528, and a fourth side 532 opposite the third side 530. The upper shell structure 524 may also have a first end 534 and a second end 536 near the opening for the interior void 505 of the lid 504. The upper shell structure 524 may also include a bottom portion 538 connected to a first end 534 of the upper shell structure 524 and configured to support the suitcase 100 on a surface such as a table, the ground, or the like.

Similar to the example suitcase 100, both the upper shell 524 and the lower shell 508 may each be formed as a unitary, or single, member such that each shell is seamless. Additionally, the upper shell 524 and the lower shell 508 may be free of any apertures or openings that pierce or extend from an exterior surface into the respective interior voids 503, 505 of the base 502 and lid 504 when the various components of the suitcase 500 are assembled to the shells 524, 508. Shells 508, 524 may generally have a thickness within a range of 2 mm and 4 mm, or within 1.5 mm and 6 mm. The shells 508, 524 may also include varying wall thicknesses. As another feature, the shells 508, 524 may include external ribs (or rubrails) 509, which may be arranged along an outer or inner surface of the lower shell 108 and the upper shell 524 to increase the stiffness and strength of the shells as well as to protect the shells from impacts.

Upper shell 524 and lower shell 508 may form the majority of the exterior of the suitcase 500 and each may have a contoured shape that includes a primary surface, a raised surface, and a plurality of recesses, where the recesses may protect the components from collisions or damage. For example, the upper shell 524 may include a raised outward facing surface 540 that extends near and/or along the second end 520 around the perimeter of the upper shell 524. The raised outward facing surface 540 may be offset a fixed distance from an outward facing primary surface 542 of the upper shell 524. A plurality of upper latch recesses 544 and hinge recesses 545 may be formed within the raised surface 540. Each upper latch recess 544 may have a depth equal to or greater than the thickness of each of the latch assemblies 180 to provide protection for the latch assemblies 180. In some examples, each upper latch recess may have a rear surface 544A, an upper surface 544B, and a pair of opposing side surfaces 544C, and an opening 544D opposite the upper surface 545B. The upper recess depth of latch recess 544 may be defined as the horizontal distance between the outward facing surface 540 to the rear surface 544A. The upper latch recesses 544 may have a substantially rectangular shape, or alternatively a shape that closely matches the shape of the latch assembly 180. Each latch recess 544 may have receiving features to secure a latch assembly 180 within the recess 544. The receiving features may include a pocket on either side of the recess 544 to receive a pin or other mounting hardware for the latch assemblies 180. Similarly, each hinge recess 545 may be formed within the raised surface 540. Each upper hinge recess 545 may have a depth equal to or greater than the thickness of each of each hinge 506 to provide protection for hinge 506 from impacts.

Similar to the upper shell 124, the lower shell 508 may include a primary outward facing surface 546, a raised outward facing surface 548 that extends near and/or along the second end 536 around the perimeter of the lower shell 508. The raised outward facing surface 548 may be offset a fixed distance from a primary outward facing surface 546 of the lower shell 508. A plurality of lower latch recesses 550 and lower hinge recesses 551 may be formed within the raised surface 548. Each lower latch recess 550 may have a depth equal to or greater than the thickness of each of the latch assemblies 180. The lower latch recesses 550 may have a depth that is generally the same as the depth of the upper latch recess 544. In some examples, each lower latch recess 550 may have a rear surface 550A, an upper surface 550B, and a pair of opposing side surfaces 550C, and an opening 550D opposite the upper surface 550B. The lower recess depth of lower latch recess 550 may be defined as the horizontal distance between the outward facing surface 548 to the rear surface 550A. The latch recesses 550 may include a latch keeper 182 that extends across the lower recess 550 and provides an engaging surface for the latch assembly 180 to secure the lower shell 508 to the upper shell 524. Each latch recess 550 may have a substantially rectangular shape, or alternatively a shape that closely matches the shape of the latch assembly 180. The shape and size of the latch recesses 544, 550 may be mirror images of each other to and may be aligned to form a larger recess to receive the entire latch assembly 180 when the suitcase 500 is in a closed configuration. By receiving the entire latch assembly 180 within this larger recess, the exposed surfaces of latch assembly 180 may be below outward facing surfaces 540, 548 and also protected around the sides of the latch assembly 180 such that when the suitcase is in the closed configuration, a perimeter of the latch assembly 180 may be located within a combined perimeter of the upper latch recess 544 and lower latch recess 550.

Figure 44A:
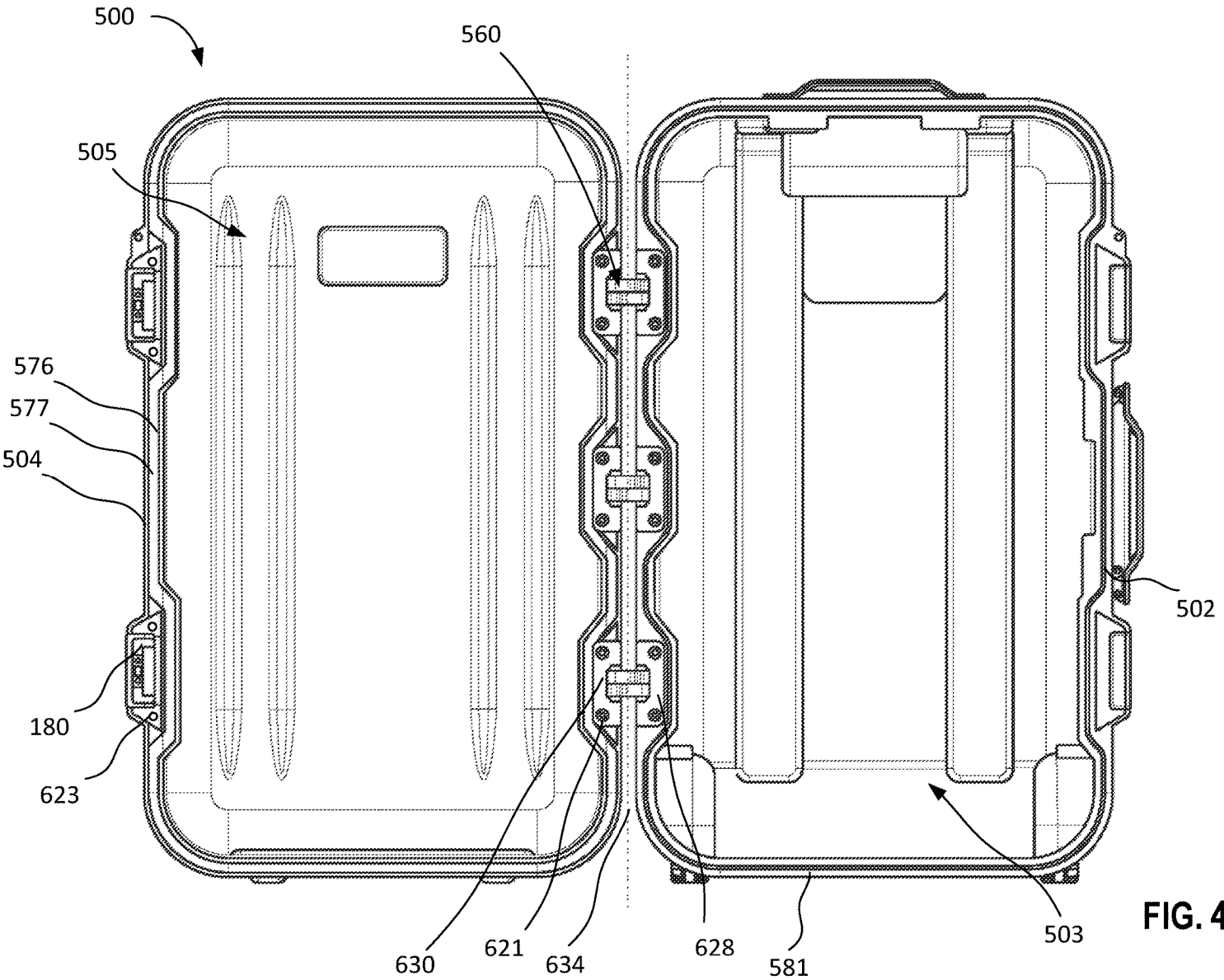
FIG. 44A is a front view of the suitcase of FIG. 35 in an open configuration with some components removed according to one or more aspects described herein.
Figure 44C:
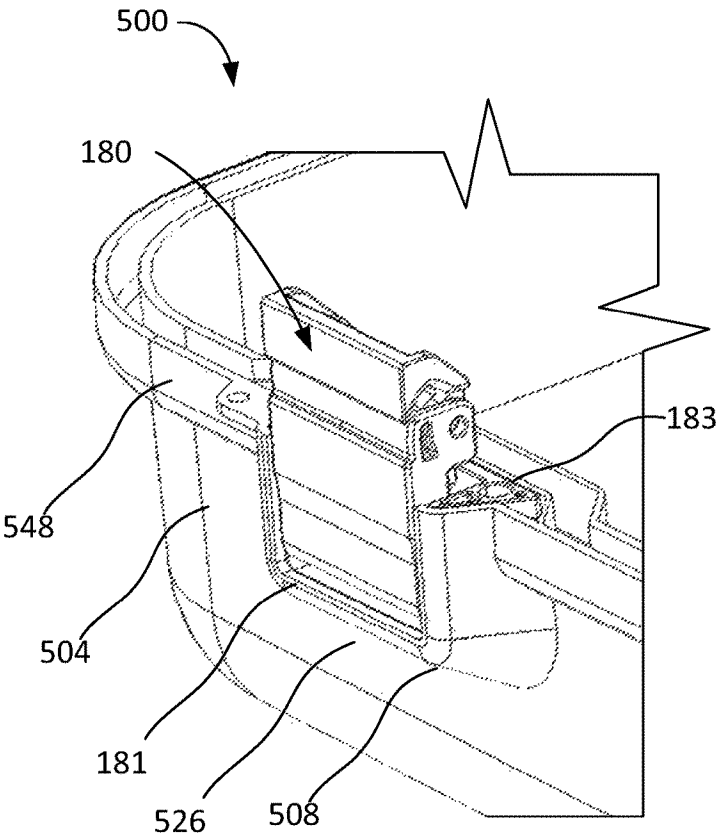
FIG. 44C is a partial front perspective view of the suitcase of FIG. 35 in an open configuration with some components removed according to one or more aspects described herein.
Figure 44B:
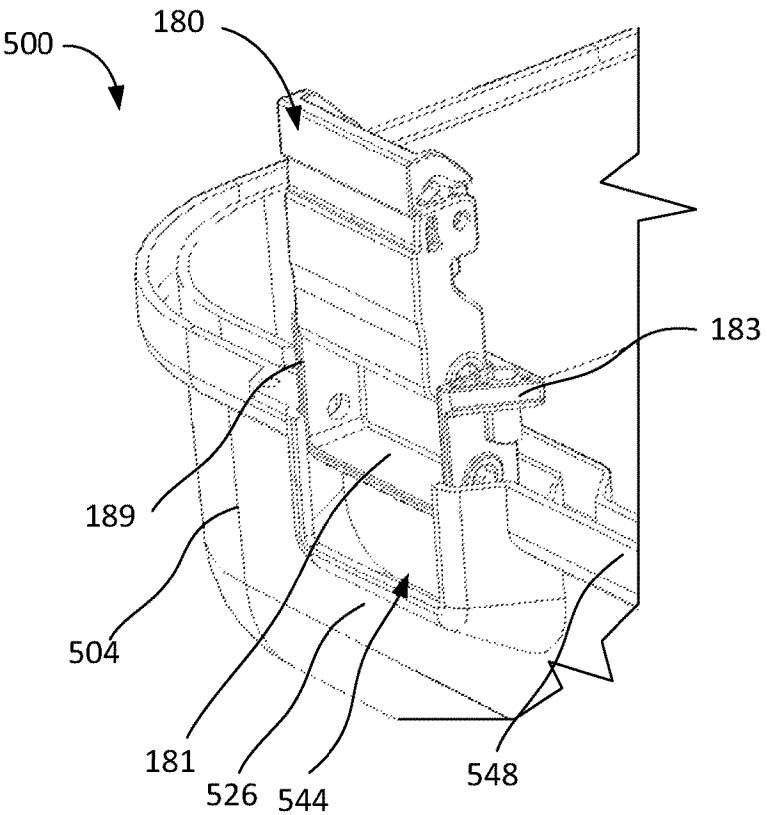
FIG. 44B is a partially exploded front perspective view of the suitcase of FIG. 35 in an open configuration with some components removed according to one or more aspects described herein.

In some examples, as shown in FIGS. 44B and 44C, the latch assembly 180 may be rotatably coupled to a lid latch mount 181 prior to being installed to the lid 504. The lid latch mount 181 may include a body member 189 that may be received within upper latch recess 544 and a flange 183 that may be mounted to a shelf within recess 544 or mount to a surface adjacent the upper latch recess 544. The lid latch mount 181 may be installed in recess 544 in a direction generally parallel to the surface of the first side 526 and secured to the shell 124 using at least one mechanical fastener inserted into an opening on flange 183 of lid latch mount 181. The mechanical fastener securing the flange 183 to the upper shell 524 may insert into a threaded hole in a thickened portion of the shell 524, which may prevent the fastener from piercing into the interior of the shell 524. As described above, in some examples, a base latch mount 185 may be received in lower latch recess 550 of the lower shell 508. The latch keeper 182 may be installed into the base latch mount 185 prior to being installed to the base 102. The base latch mount 185 may include a base member 191 that may be received within lower latch recess 550 and a flange member 187 that may be mounted to a shelf within recess 544 or mount to a surface adjacent the upper latch recess 544. The lower latch mount 185 may be installed in lower latch recess 550 in a direction generally parallel to the surface of the first side 110 and secured to the lower shell 508 using at least one mechanical fastener inserted into an opening on flange 187 of lid latch mount 185. The mechanical fastener securing the flange 187 to the shell 108 may insert into a threaded hole in a thickened portion of the shell 508 to prevent the fastener from piercing into the interior of the shell 508. The mechanical fasteners 623 securing the latch mounts 181, 185 to their respective shells 524, 508 may be oriented generally parallel to each other and may also be parallel to the first side 510 of the shell 508 and also may be parallel to the first side 526 of shell 524.

The lower hinge recesses 551 may be formed within the raised surface 548. Each lower hinge recess 551 may have a depth equal to or greater than the thickness of each of each hinge 506 to provide protection for hinge 506 from impacts. The shape and size of the recesses 545, 551 may be mirror images of each other to and may be aligned to form a larger recess to receive the entire hinge 506. The larger recess formed from recesses 545, 551 may have a shape that surrounds a majority of the perimeter of the hinge assembly 506.

Figure 43A:
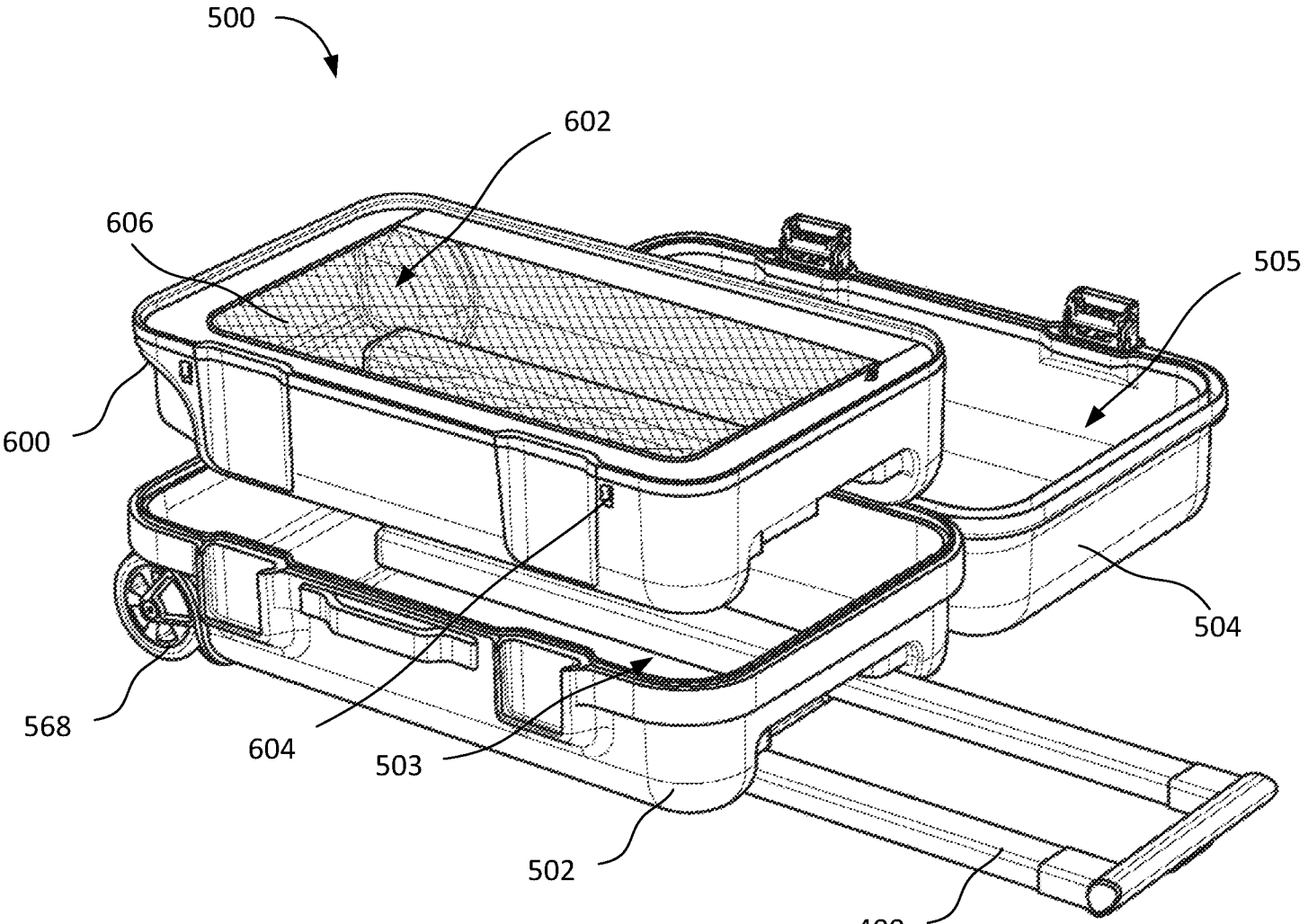
FIG. 43A is a partially exploded top right perspective view of the suitcase of FIG. 35 in an open configuration according to one or more aspects described herein.

As shown in FIG. 43A, suitcase 500 may include an interior liner 600. The interior liner 600 may be molded and may be releasably secured into either the interior void 503 of the base 502 or the interior void 505 of the lid 504. The interior liner 600 may have a formed exterior shape to match the interior profile of either interior void 503, 505. The interior liner 600 may include a storage cavity 602 recessed from an upper surface 608 of the liner 600 to accommodate different cargo. For example, the storage cavity 602 may include a plurality of different shaped cavities to receive and protect different shaped items. The interior liner 600 may be formed via a molding process where the liner 600 is molded from a rubber, polymer, or foam material such as ethylene-vinyl acetate (EVA) or other similar material. The liner 600 may be include mechanical elements 604, such as clips or hooks, that are spaced around the exterior of the liner 600 where the mechanical elements 604 engage corresponding mechanical elements, such as loops, positioned along the interior of the base 502 and the lid 504. Optionally, the interior liner 600 may also be secured using an adhesive, hook and loop type fasteners (Velcro), magnetic elements, or other connection methods. For example, the interior liner 600 may have a plurality of magnetic or ferromagnetic elements positioned along a perimeter and/or bottom surface that may attach to corresponding magnetic or ferromagnetic elements positioned along or within the interior surfaces of the shells 508, 524. In some instances, suitcase 500 may include multiple interior liners 600 where the interior liners 600 may be interchangeably installed into suitcase 500 depending on the contents to be secured. In some examples, the liner 600 may include a releasable netting or layer 606 to further secure items within the liner 600.

As another option to releasably secure the interior liner 600 to within the interior void 503 of the base shell 508 or interior void 505 of the lid shell 524, the liner 600 may include a liner attachment assembly 620 that releasably engages a base attachment member 639. FIGS. 43B-43E illustrate an alternate means to releasably attach the liner 600 to either of the shells 508, 524. The liner attachment assembly 620 may move between a locked position to secure the liner 600 to one of the shells 508, 524 and an unlocked position that allows the liner 600 to be removed from the suitcase 500. The liner attachment member 620 may be permanently attached to the interior liner 600 and the base attachment member 639 may be permanently attached to an interior surface 507, 525 of the base shell 508 or the lid shell 524. The liner attachment assembly 620 may include a tail member 622, a flange member 627, and a grip member 634. The tail member 622 may include a tail body member 624 with a locking projection 625 extending outwardly from the tail body member 624. In some cases, such as the illustrated example in FIG. 43E, the tail member 622 may have a pair of locking projections 625 that are arranged opposite each other. The locking projections 625 may have at least one tapered surface to securely engage the base attachment member 639. In addition or optionally, each locking projection 625 may have a detente or recess to engage a corresponding recess or detent on the base attachment member 639 to provide positive feedback of the attachment assembly 620 reaching the locked position. The body member 624 of the tail member 622 may have a generally cylindrical shape or may have any shape that is symmetrical around a central axis. The flange member 627 may include a flange body 629 that may be permanently secured to the liner 600 (i.e. through stitching, rivets, adhesives, or other means known to one skilled in the art) and a flange opening 631. The flange opening 631 may receive a portion of the tail member 622, and the grip member 634 may attach to the portion of the tail member 622 that extends into the flange opening 631. The grip member 634 may be any shape and provide a surface to allow a user to grab and rotate the grip member 634.

The base attachment member 639 may include a first wall 641 and a second wall 643 where each wall 641, 643 may extend away from the interior surface 507 of the base shell 508 with a first end 645 at the interior surface and a second end 647 opposite the first end 645. The first wall 641 may include a first base locking projection 649 located at the second end 647 that extends toward the second wall 643, where the second wall 643 includes a second base locking projection 649 located at the second end that extends toward the first wall 643. The first wall 641 and second wall 643 may be spaced a fixed distance from each other. Each of the base locking projections 649 may include a contoured edge shape 651 to receive the tail member 622 such that the body member 624, the contoured edge shape 651, and the opening 631 may be coaxial with each other when the attachment assembly 620 is in a locked position.

The liner attachment assembly 620 may be moved to a locked position from an unlocked position by rotating the grip member 634 a predetermined amount in a first direction, and may be moved to an unlocked position from a locked position by rotating the grip member 634 a predetermined amount in a second direction, where the second direction is opposite the first direction. For example, the liner attachment assembly 620 may be moved to a locked position from an unlocked position by rotating the grip member 634 approximately 90 degrees in a first direction, and may be moved to an unlocked position from a locked position by rotating the grip member 634 approximately 90 degrees in a second direction, where the second direction is opposite the first direction. In some examples, the grip member 634 may be moved to a predetermined amount in the same direction to move the attachment assembly 620 from a locked position to an unlocked position. When in the locked position, the locking projection of the liner attachment assembly is at least partially positioned underneath the first base locking projection or the second base locking projection.

The liner may include a plurality of liner attachment assemblies 620 that may be attached to the base attachment members 639. For examples, the liner attachment assemblies 620 may be located within the storage cavities 602 or within anywhere on the liner 600 such as the sidewalls or bottom surface. Similarly, the shells 508, 524 may include a plurality of base attachment members 639 that may be arranged anywhere along the interior surfaces of the corresponding shell. For examples, base attachment members 639 may be placed along the interior side surfaces and/or bottom surfaces of the shells 508, 524. As another option, backpack 300 may also include the liner attachment assemblies 620 and may be releasably secured to the shells 508, 524 as described above.

Figure 43F:
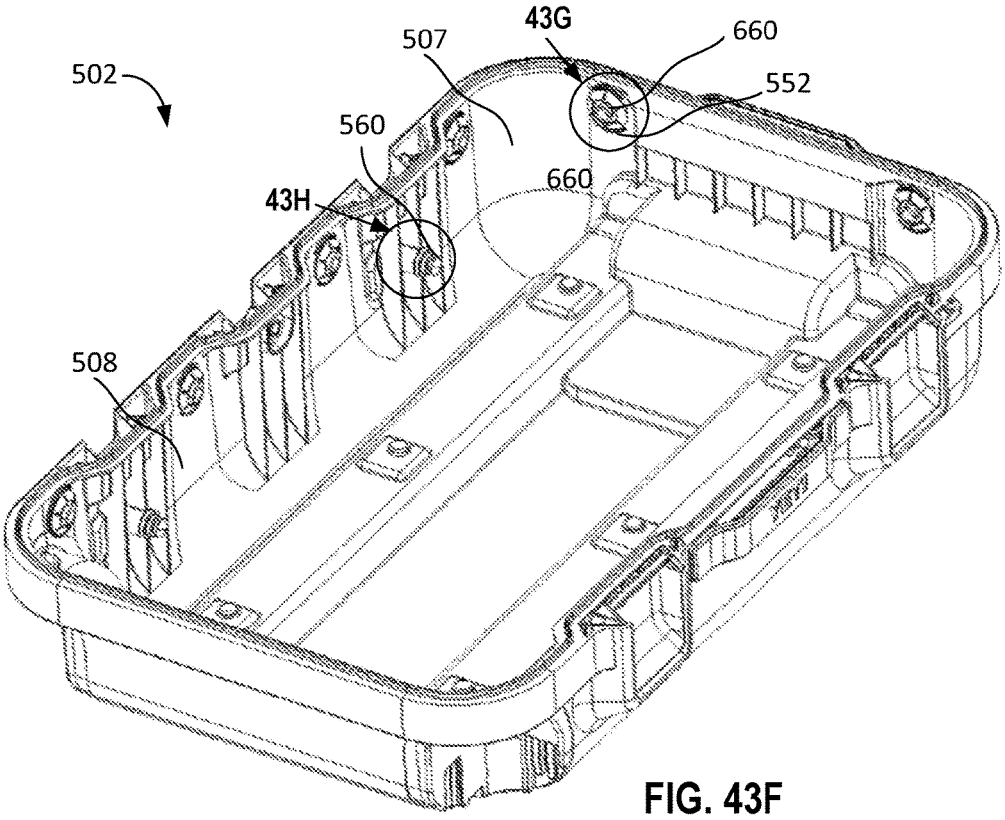
FIG. 43F is a perspective view of the lid of the suitcase of FIG. 35 with some components removed according to one or more aspects described herein.
Figure 43G:
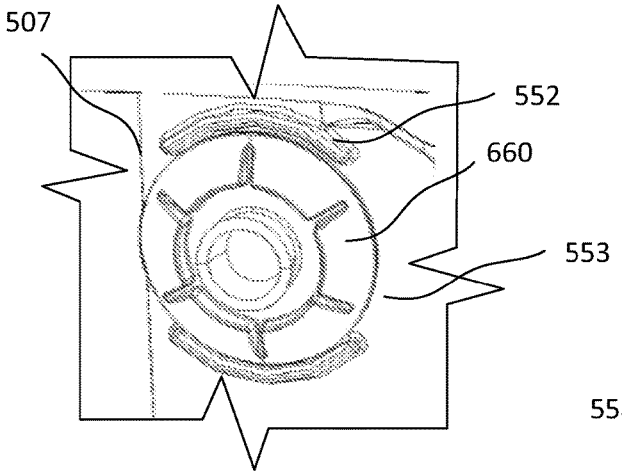
FIG. 43G is an enlarged perspective view of the mechanical connector arranged on the interior of the lid of FIG. 43F according to one or more aspects described herein.

FIGS. 43F and 43G illustrate another example of an attachment configuration to releasably secure liner 600 to the base 502 and lid 504. FIG. 43F illustrates an example of base 502 with a plurality of mechanical connectors 660 positioned along the interior surface 507. While not shown, lid 504 may have a plurality of mechanical connectors 660 arranged in a similar manner. In this example, liner 600 may have a plurality of mechanical connectors 660 that releasably engage a plurality of corresponding mechanical connectors 660 that are arranged along the interior of the lower and upper shells 508, 524. The mechanical connectors 660 may be attached to an interior surface 507, 525 of the base 502 or the lid 504. The mechanical connectors 660 may be evenly or irregularly spaced along each of the interior surfaces 507, 525 of the respective base 502 and lid 504. The mechanical connectors 660 may be attached to an interior surface 507, 525 using an adhesive, tape, or other means known to one skilled in the art. In some examples, the interior surface 507, 525 may have a rib 552 positioned offset a predetermined distance along a portion of a perimeter of the mechanical connector 660 as shown in FIG. 43G. In some examples, the rib 552 may be located less than 2 mm from an edge of the connector 660, or located less than 4 mm from the edge, or less than 8 mm from the edge. The rib 552 may act to protect the mechanical connector 660 from impacts and prevent any shear forces from acting on the mechanical connector 660 to prevent any mechanical connectors 660 from coming loose. The rib 552 may be continuous around an entire perimeter of the mechanical connector 660 or be discontinuous as shown in the illustrated example. For example, rib 552 may have an opening or plurality of openings or breaks 553 within the length of the rib 552. This discontinuity or opening 553 may allow a user to use a tool to slide through the opening 553 in the rib 552 to engage the mechanical connector 660 and pry the connector 660 off in order to repair or replace a damaged connector 660. Each rib 552 may be formed as a part of shells 508, 524. While the illustrated examples show a circular mechanical connector 660 and rib 552, the mechanical connector 660 and rib 552 may have any shape, such as rectangular shape, triangular shape, or other geometric shape. Alternatively, the connector 660 may have a magnetic or ferromagnetic element that releasably engages a complementary connector on the liner 600.

Figure 43H:
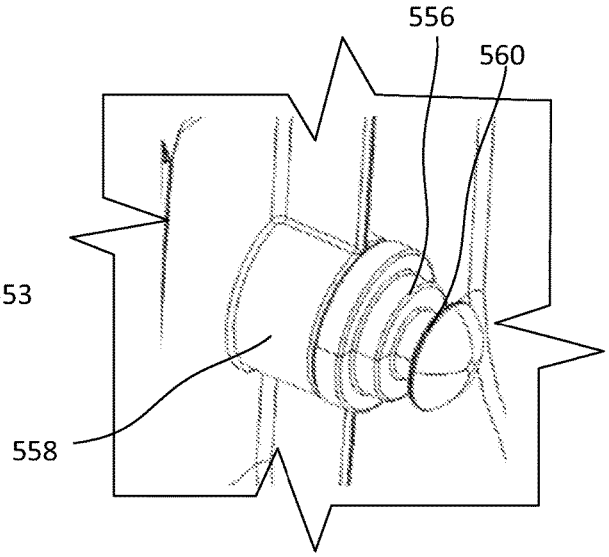
FIG. 43H is an enlarged perspective view of the mechanical connector arranged on the interior of the lid of FIG. 43F according to one or more aspects described herein.

In addition, both the base 502 and lid 504 may include a plurality of mounts or plugs 556 that attach to the interior surfaces 507, 525 respectively. FIGS. 43F and 43H illustrate the mounts 556. The mounts 556 may be plugs that attach to a boss 558 that is formed with the base shell 508 and lid shell 524. The mounts 556 may have a groove 560 that connects The mounts 556 may allow a strap (not shown) to releasably connect to mounts 556 on a first side of the suitcase 500 and stretch across to the second side of the suitcase 500 to secure any contents stored within the suitcase 500. In some examples, the mounts 556 may extend through openings that are located in the liner 600 to allow a user to access the mounts 556 to attach the releasable straps when a liner is secured in either the base 502 and/or lid 504.

FIG. 44A illustrates a front view of the suitcase in an open configuration with some components removed. The plurality of hinges 506 that join the base 502 and lid 504 together may be secured to the base 502 and lid 504 such that the lid portion and base portion of the hinge 506 may be slid into the respective hinge recess 545, 551 and then secured the using a mechanical element 621, such as a mechanical fastener. The mechanical element 621 may be oriented generally perpendicular to the bottom portion 522 of the base 502. Similarly, the latch assembly 180 may be installed into the lid 504 by sliding the latch assembly 180 into the lid latch recess 544 and securing it to the lid 504 using a mechanical element 623, such as a mechanical fastener, where the mechanical element 623 may also be oriented generally perpendicular to the bottom surface 522 of the base 502.

As discussed above, the suitcase 500 may include a gasket 576 or other sealing device. As shown, the gasket 576 may be arranged in a recess 577 arranged on the lower surface 537 at the second end 536 of the lid 504. The base 502 may have a sealing rib 581 arranged along the upper surface 521 at the second end 520 of the base 502 that engages the gasket 576 when the suitcase 500 is in the closed configuration. In addition, when the suitcase 500 is in the closed configuration, the engagement of the gasket 576 and the sealing rib 581 may prevent the upper surface 521 of the base 502 from contacting the lower surface of the lid 504, where the upper surface and the lower surface and the fourth end surface are spaced apart from each other where the lid 504 is spaced apart a fixed distance from the base 502 creating a gap between them. The gasket 576 may be formed from a rubber or polymeric material and in some examples, have a substantially circular cross-section. Alternatively, the gasket 576 may be arranged in a recess or channel formed in the base 502.

Figure 44D:
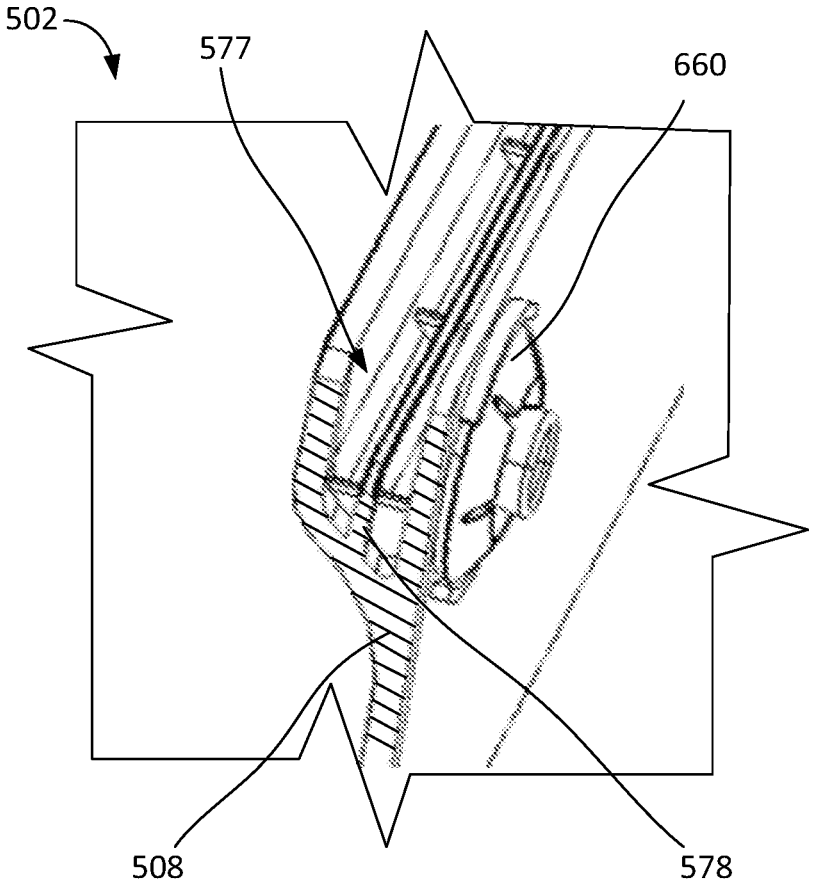
FIG. 44D is an enlarged partial cross-sectional perspective view of the lid of the suitcase of FIG. 35 with some components removed according to one or more aspects described herein.

As shown in FIG. 44D, the recess 577 may include a rib 578 that extends upward to engage the gasket 576 opposite the engagement of the sealing rib 581. This rib 578 within the recess may help create a symmetrical load on the gasket 576 to enable the gasket 576 to have a circular cross-section while still providing an adequate seal.

In addition, the base 502 of suitcase 500 may include a tapered region 523 between the bottom portion 522 and the fourth surface 516. The tapered region 523 may be located between the pair of wheel assemblies 564 and form an acute angle with the central region of the bottom portion 522. This tapered portion may extend at an angle within a range of 1 degree and 30 degrees when measured from the central portion of the bottom portion 522 to a lower surface of the tapered region 523 (or tangent plane to a lower surface of the tapered region 523). Tapered portion 523 allows suitcase 500 to be pulled using the trolley handle 400 in a larger variety of positions to accommodate users having different heights.

Figure 64:
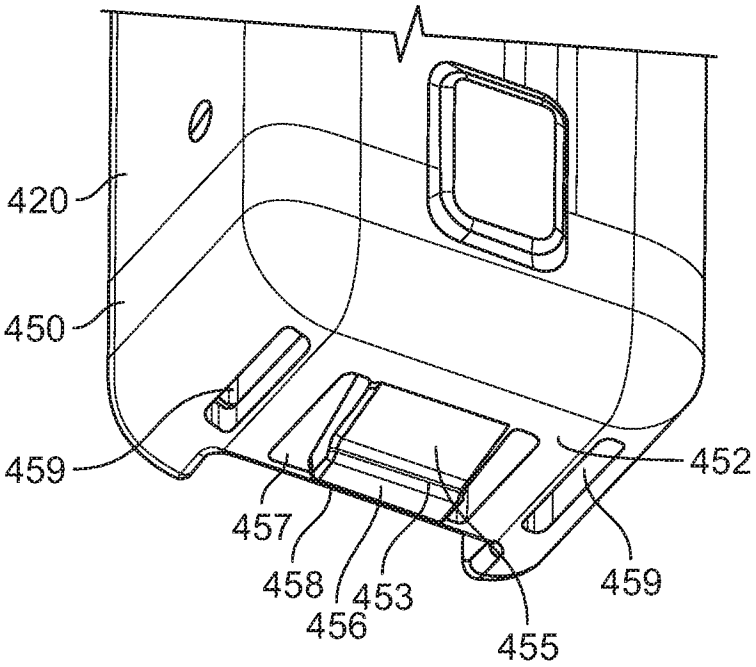
FIG. 64 is an enlarged rear bottom perspective view of the trolley handle assembly of FIG. 54 according to one or more aspects described herein.
Figure 63:
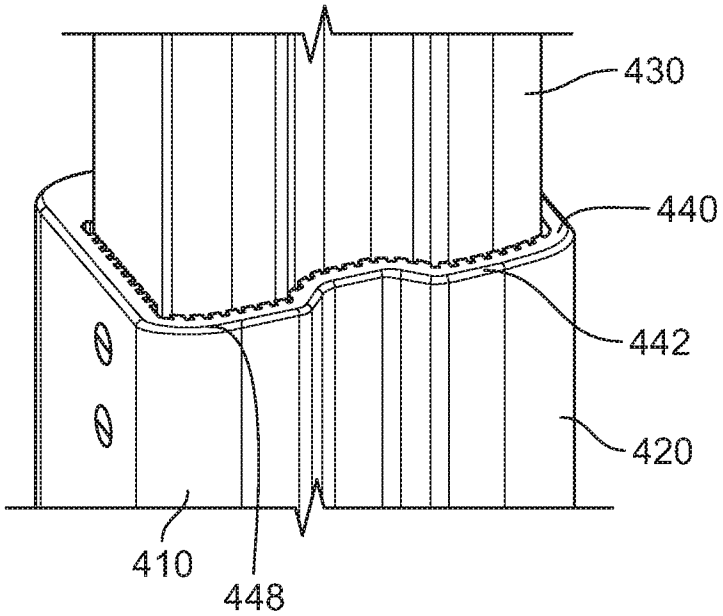
FIG. 63 is an enlarged rear perspective view of the juncture of the minor extrusion and major extrusion of the view of the trolley handle assembly of FIG. 62 according to one or more aspects described herein.
Figure 65:
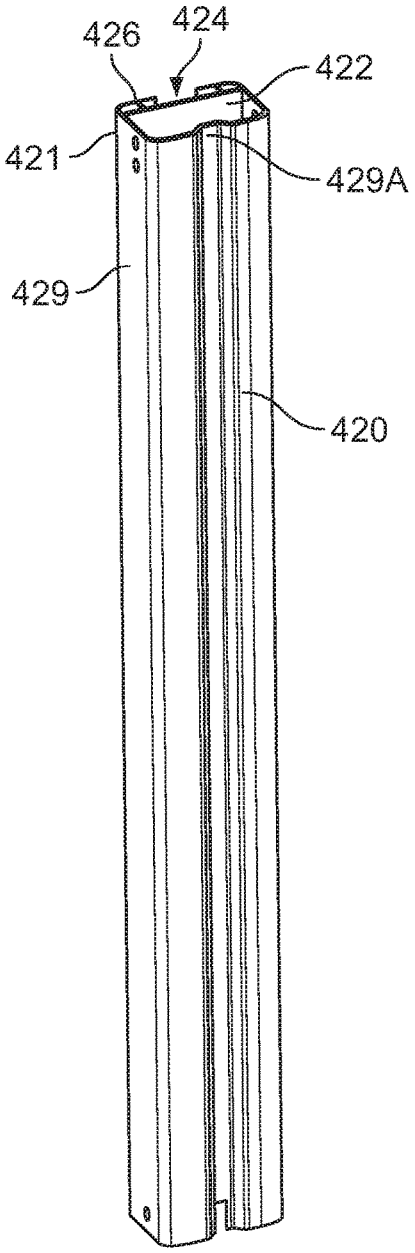
FIG. 65 is a rear perspective view of the major extrusion of the trolley handle extrusion assembly according to one or more aspects described herein.
Figure 66:
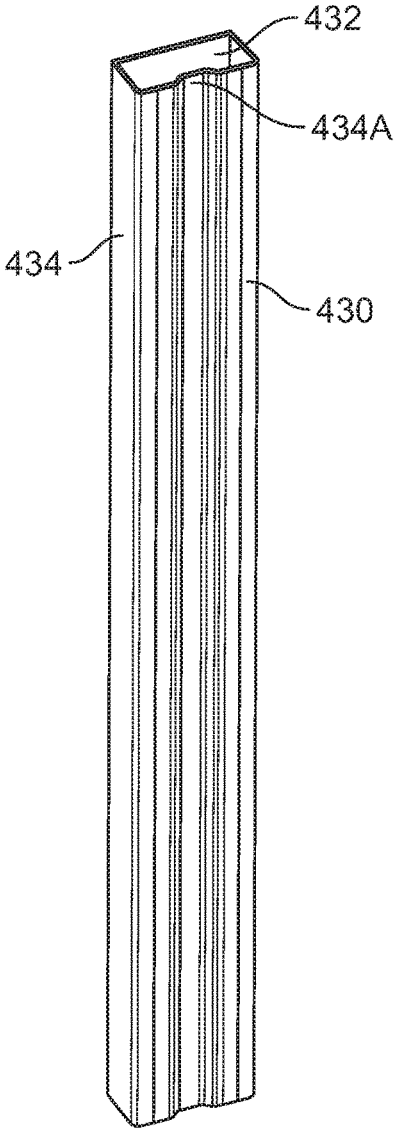
FIG. 66 is a rear perspective view of the minor extrusion of the trolley handle extrusion assembly according to one or more aspects described herein.
Figure 67:
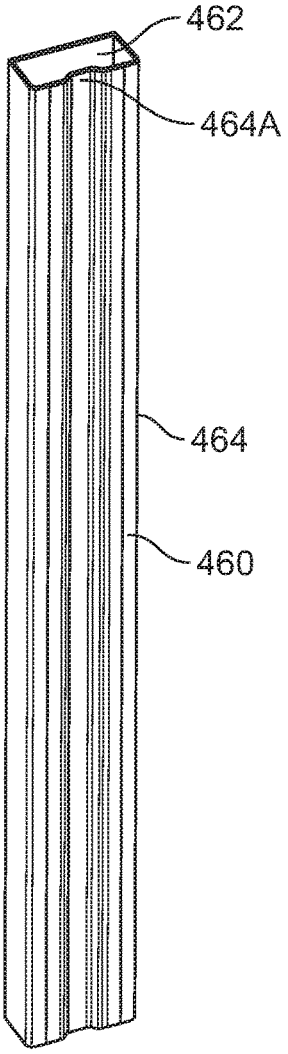
FIG. 67 is a rear perspective view of the tertiary extrusion of the trolley handle extrusion assembly according to one or more aspects described herein.

FIGS. 63 and 64 illustrate the hinge 506. The hinge assembly 506 may include at least two linkages 626, a base hinge insert 628, a lid hinge insert 630, and a plurality of linkage pins 632. A portion of each linkage 626 may be connected via a linkage pin 632 to the lid 504 and a portion of each linkage 626 may be connected via a linkage pin 632 to the base 502. The hinge assembly 506 may define a hinge axis 633 for the rotation of the lid 504 relative to the base 502. Hinge axis 633 may be located outside of a rear edge of the base 502 and also outside of a rear edge of the lid 504. Additionally, the hinge axis 633 may be outside of the physical geometry of the hinge assembly 506. The base hinge insert 628 and the lid hinge insert 630 may each have a recess 636, 638 respectively. The hinge recesses 636, 638 may receive the plurality of linkages 626. Each recess 636, 638 may have a depth measured from a respective top surface and bottom surface 640, 642 of the hinge insert 628, 630 to a bottom surface of the recess that is greater than a thickness of each of the linkages 626. This arrangement allows the hinge inserts 628, 630 to protect the linkages 626 from any damage.

Figure 45:
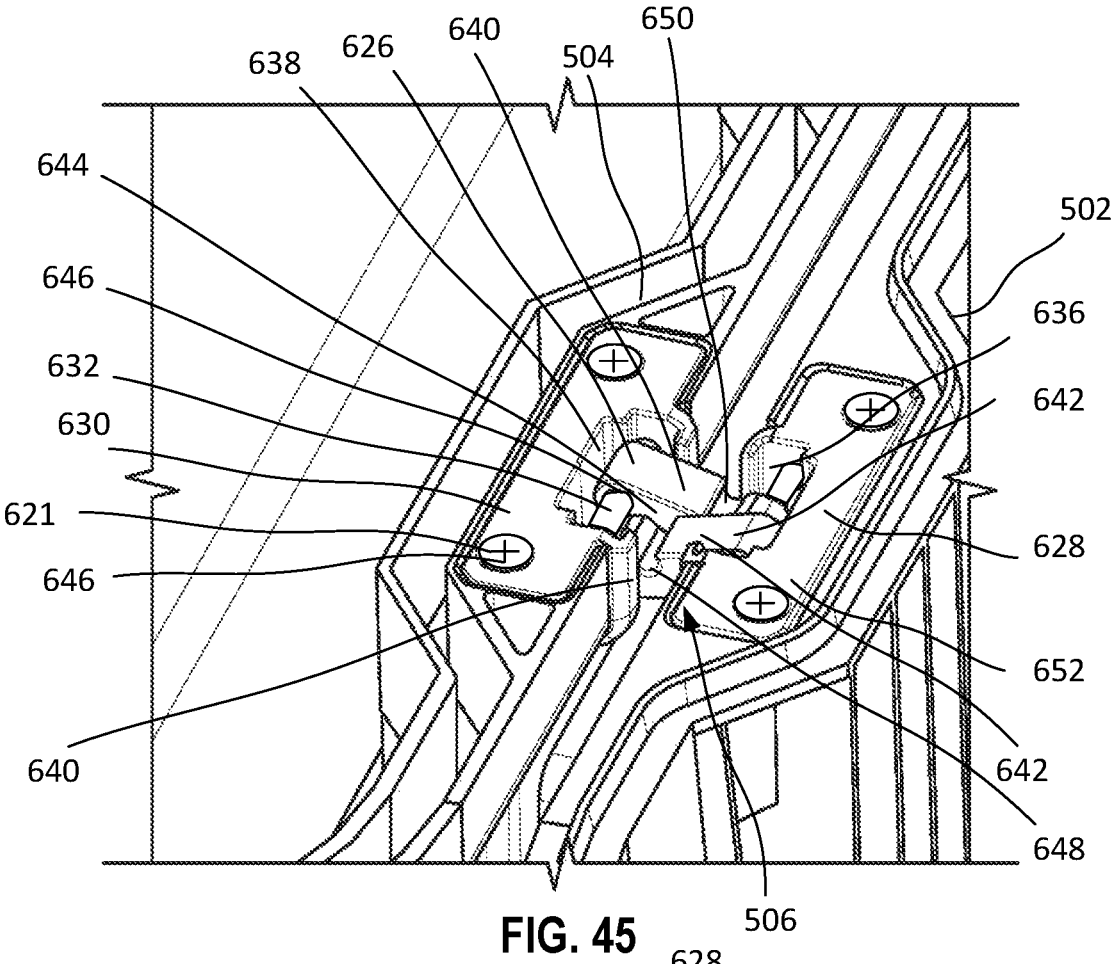
FIG. 45 is a partial front perspective view of the suitcase of FIG. 35 in an open configuration with some components removed according to one or more aspects described herein.

Each linkage 626 may have a top surface 640 and a bottom surface 642 opposite the top surface 640 as well as side surfaces 644 extending between the top and bottom surfaces 640, 642. A pair of holes 646 may extend through the side surfaces 644 where the holes 646 receive the linkage pins 632. For example, linkage 626 may include a first linkage opening 646 that receives a first linkage pin 632 that extends through the opening 646 into an opening in the base hinge insert 628 and a second linkage opening 646 that receives a second linkage pin 632 that extends through the opening 646 into an opening in the lid hinge insert 630. Thus, each linkage 626 is connected to both the base 502 and the lid 504. In addition, the bottom surface 642 may include a slot 648 that receives one of the linkage pins 632 when the suitcase is in the closed configuration and a slot 650 on the top surface 640 that receives one of the linkage pins 632 when the suitcase is in the open configuration. The linkages 626 may be arranged adjacent each other where the first linkage may be oriented with the top surface 640 facing toward the top perimeter of both the lid 504 and the base 502 when the suitcase 500 is in the open configuration and the second linkage may be oriented with the bottom surface 642 facing toward the top perimeter of both the lid 504 and the base 502 when the suitcase 500 is in the open configuration as shown in FIG. 45.

Each of the base hinge insert 628 and lid hinge insert 630 may have a generally rectangular shape when viewed from the left side view of the suitcase 500. As discussed above, each hinge insert 628, 630 has a hinge recess 636, 638, where each hinge recess is open on one end and surrounded by a hinge insert wall on the remaining sides. When installed, the open end of each recess 636, 638 may align with each other to form an overall hinge recess to receive the linkages 626 and allow them to move. Each hinge insert 628, 630 may have a hinge flange 652 extending from the hinge insert wall at the end of the hinge insert 628, 630 that has the open end of the recess 636, 638. The hinge flange 652 may have at least one opening to receive the mechanical element 621 that secures the hinges 506 within the respective hinge recesses 550, 551 of the base 502 and lid 504.

Figure 46:
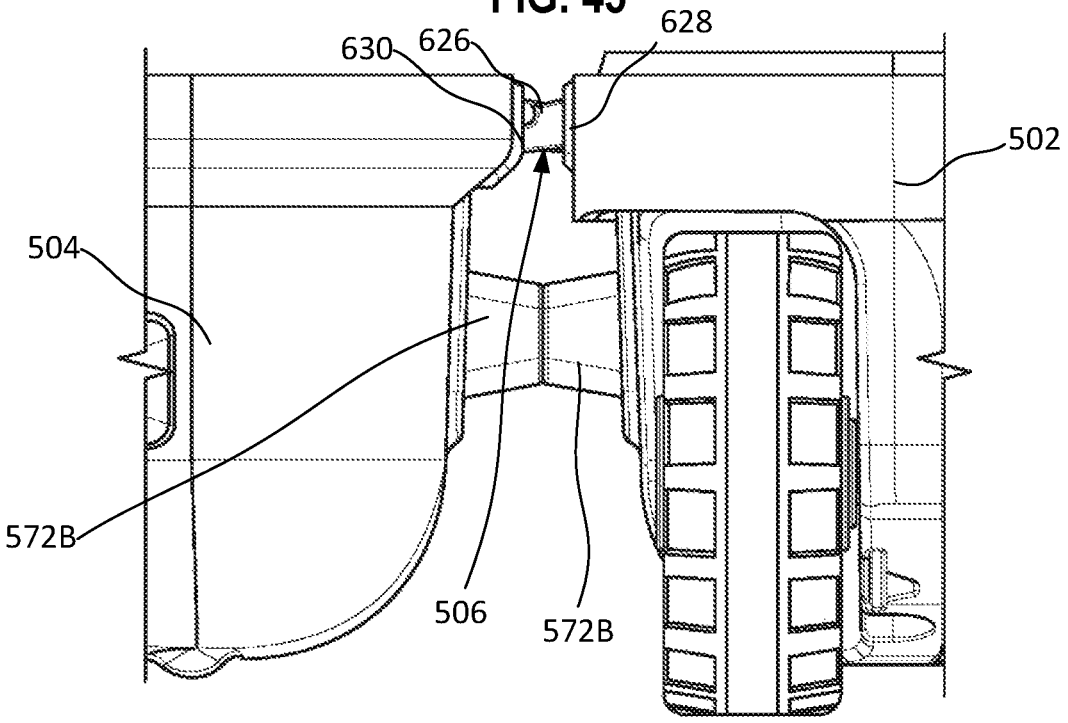
FIG. 46 is a partial top view of the suitcase of FIG. 35 in an open configuration with some components removed according to one or more aspects described herein.

Similar to the configuration of suitcase 100, the feet 572 may be generally aligned with one or more of the hinges 506 where a flat portion of the feet 572B are spaced from an edge of a hinge 506. In addition, the feet 572B may be arranged to contact one another when the suitcase 500 is fully opened to reduce the impact forces on the hinges and the other components of the suitcase 500 when it is opened as shown in FIG. 46. While the illustrated example suitcase 500 has three hinge assemblies 506, the suitcase 500 may only have two hinges 506 or may have more than three hinges.

The components of the hinge assembly 506 such as the linkages 626, hinge inserts 628, 630, linkage pins 632, may be formed of metallic materials such as steel or aluminum to provide adequate strength and stiffness. Alternatively, these components may be formed from a polymeric material or composite material such as a fiber-filled polymer. The components may be manufactured using known methods such as casting, machining, and molding.

Figure 47:
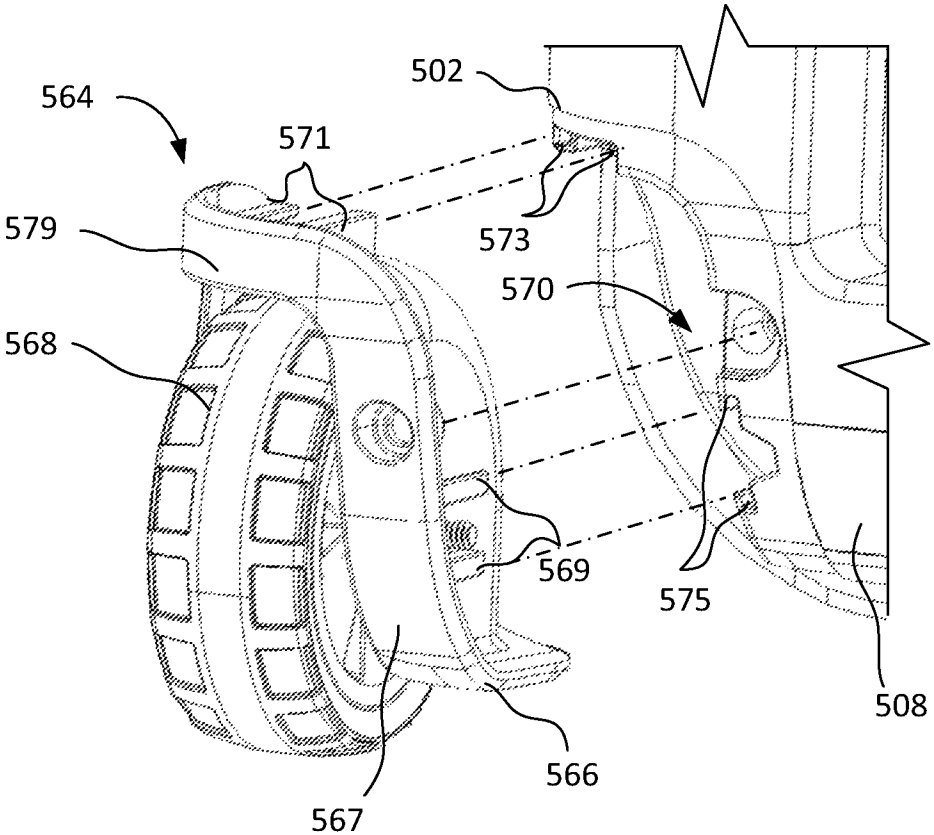
FIG. 47 is a rear perspective view of the wheel assembly of the suitcase of FIG. 35 according to one or more aspects described herein.

Similar to suitcase 100, suitcase 500 may include a plurality of wheel assemblies 564 positioned near the rear and bottom corners of suitcase 500. As shown in FIG. 47, wheel assembly 564 may be installed into wheel recess 570 of the lower shell 508. Wheel assembly 564 may include a wheel housing 566 that has a rounded shape and a mounting flange 567. The wheel assembly 564 may further include a wheel 568 mounted on an axle and bearings (not shown). The housing 566 may further include a plurality of guide rails 569 oriented along a side surface of wheel housing 566 and a plurality of guide rails 571 positioned along the top surface of the wheel housing 566. The guide rails 569, 571 will slide into corresponding guide slots 573, 575 arranged within the wheel recess 570 of the lower shell 508. The guide slots 573, 575 and guide rails 569, 571 may include at least one tapered surface to provide a tighter fit as the wheel assembly 564 is slid into its final position. Furthermore, the guide rails 573, 575 and guide slots 569, 571 may secure the wheel assembly 564 in both a lateral and vertical direction (when looking at the rear view of the suitcase 500). The wheel assembly 564 may be secured to the wheel recess 570 using at least one mechanical element, such as mechanical fastener, extending through the mounting hole positioned in the mounting flange 567, wherein the mechanical element is oriented parallel to the mechanical elements 621 and 624 that secure the hinges 506 and latch assemblies 180 respectively. As shown in the illustrated example, each wheel assembly may be secured with a single mechanical fastener.

Figure 48:
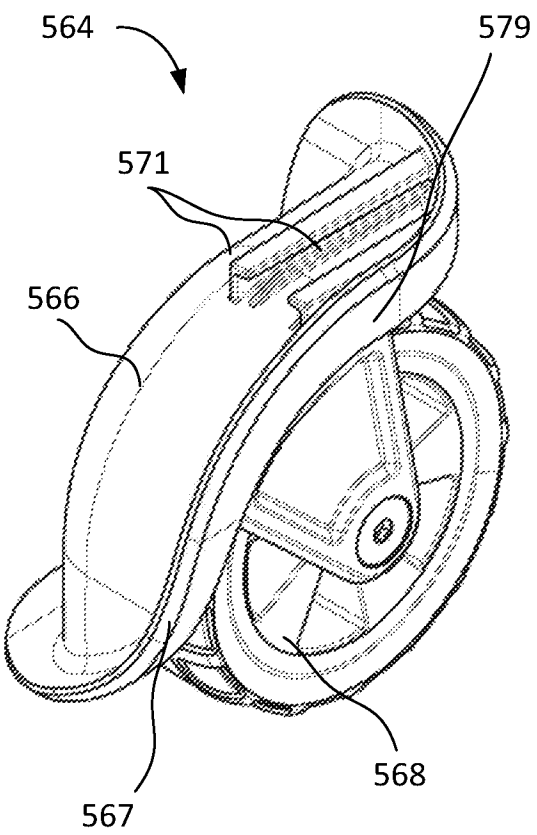
FIG. 48 is a front perspective view of the wheel assembly of the suitcase of FIG. 35 according to one or more aspects described herein.

Each wheel assembly 564 may be formed as a separate member, as shown in FIGS. 47 and 48. Each wheel assembly 564 may include a wheel housing 566 having a rounded shape and at least one mounting flange 567 located on at least one end, and a wheel 568 mounted on an axle and bearings (not shown) such that the axle is aligned with a center of the rounded shape. In addition, each wheel housing 566 may have a contoured surface that generally follows the contour of the bottom surface 522 of the suitcase and includes the tapered portion 523. The outward facing surface 583 of wheel housing 566, when installed, may be spaced outward of the bottom surface 522 and tapered portion 523 of the base 502. By spacing the outward facing surface 583 away from the base 502 may help to protect the base 502 from any impacts.

As shown in the illustrated examples, the suitcase 500 may comprise a pair of wheel assemblies 564, however, in other embodiments the suitcase may include additional wheel assemblies 564. The wheel assemblies 564 may be evenly spaced apart and may be located on the outer edges of the suitcase 500 such that the wheel housing 566 is exposed on at least three sides of the base 502. The housing 566 may be formed from a polymer material, such as a polyamide (nylon) or similar material, w646*le* the wheels 568 may be formed from a polymer material, such as a polyurethane, or similar material. In some examples, the wheels 568 may include a rubber coating or rubber exterior for better traction and wear.

Figures 49, 50:
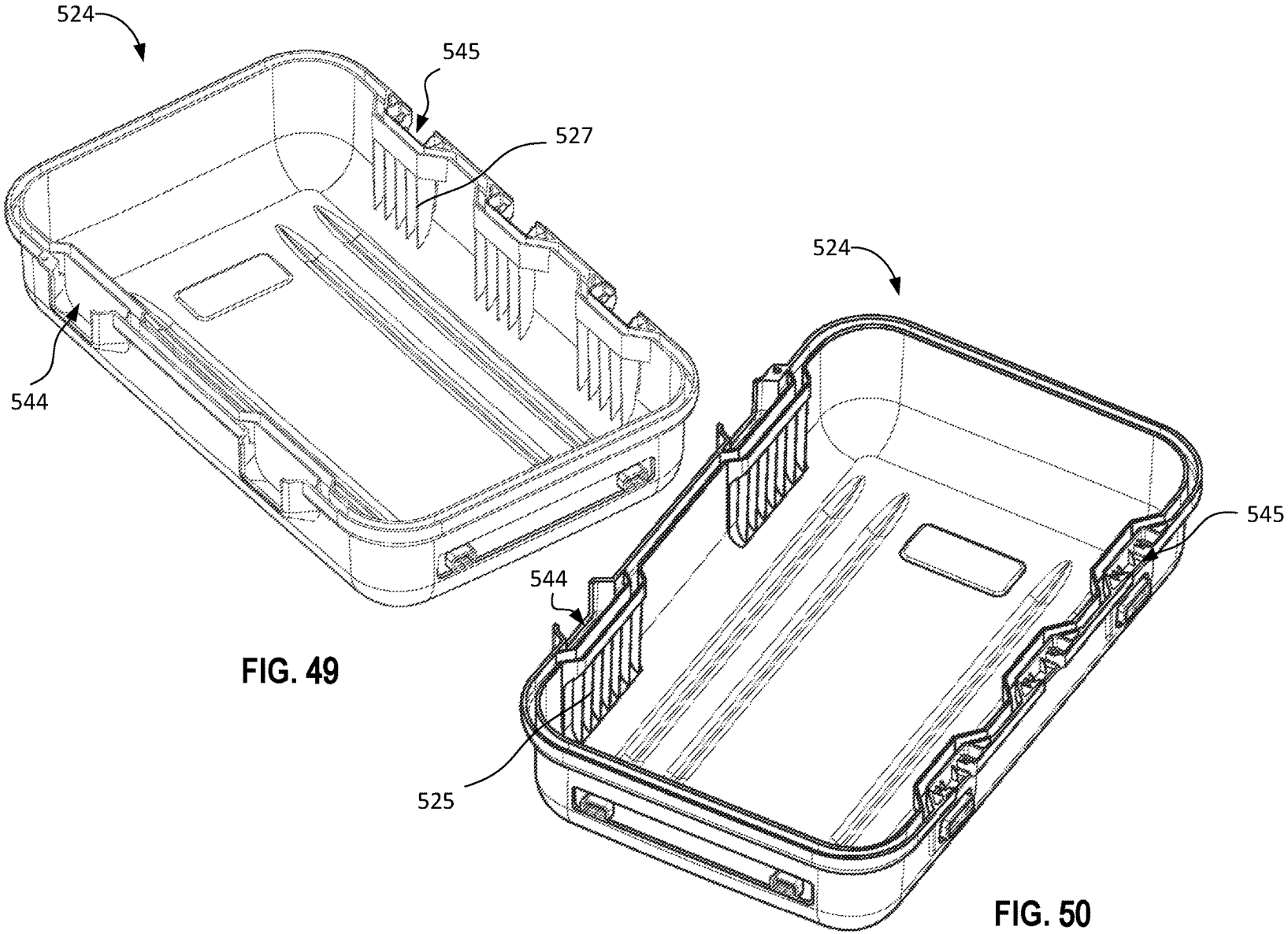
FIG. 49 is a right front perspective view of the lid shell of the suitcase of FIG. 35 according to one or more aspects described herein.
FIG. 50 is a left front perspective view of the lid shell of the suitcase of FIG. 35 according to one or more aspects described herein.
Figure 52:
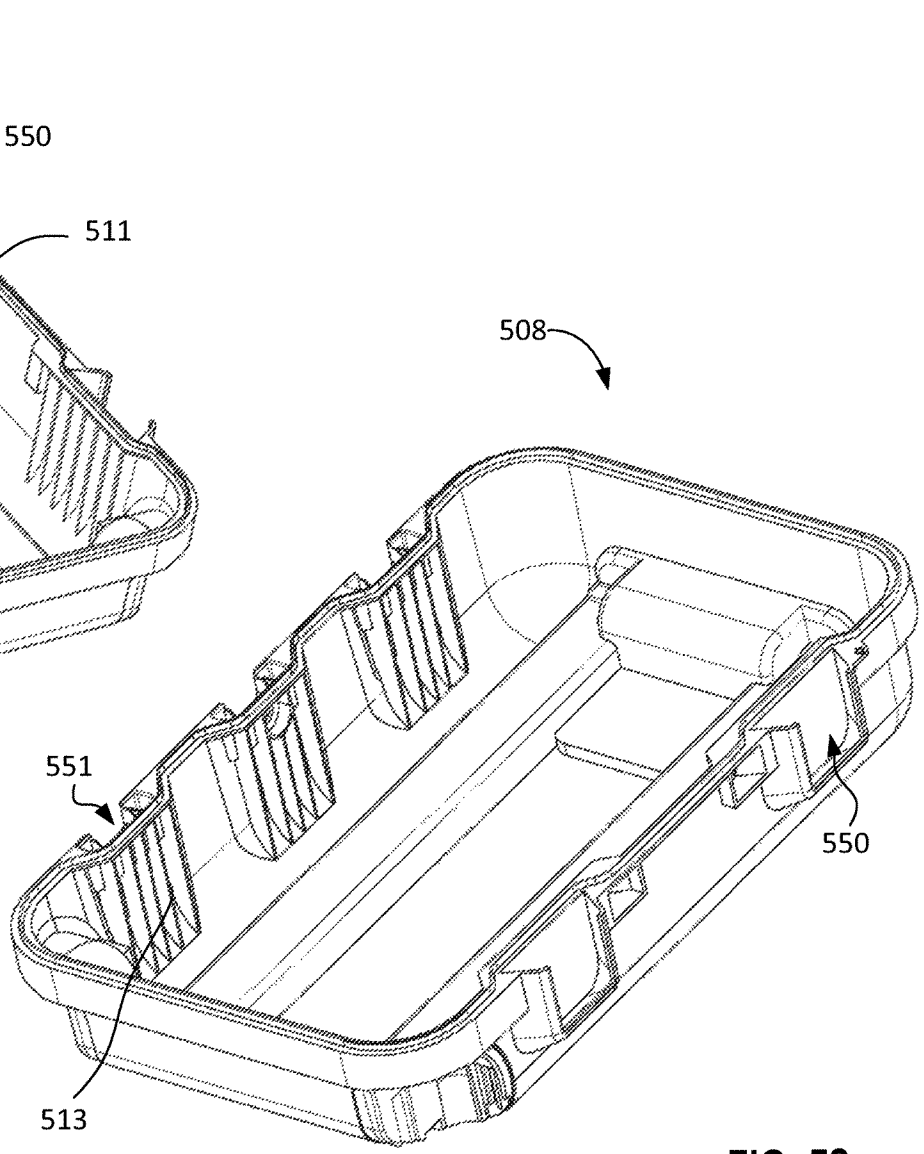
FIG. 52 is a right front perspective view of the base shell of the suitcase of FIG. 35 according to one or more aspects described herein.
Figure 51:
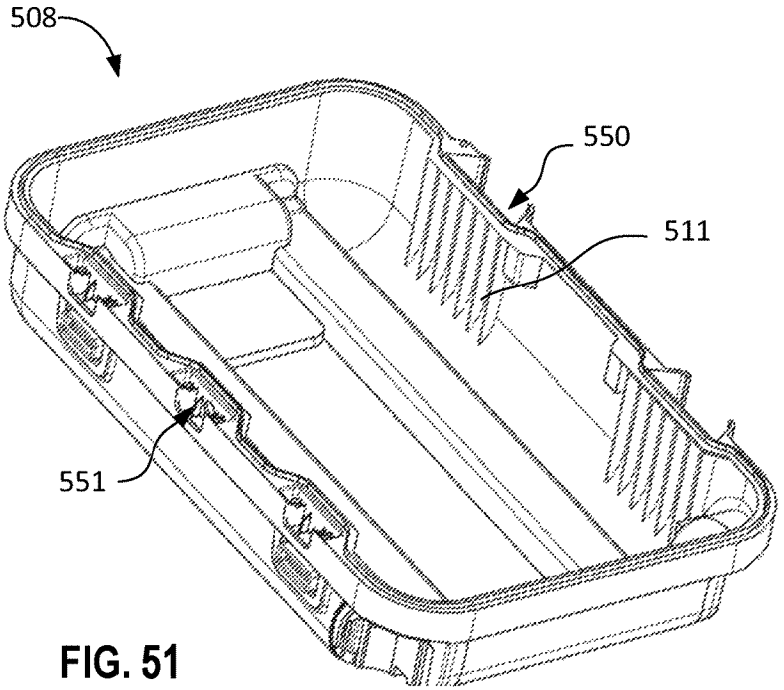
FIG. 51 is a left front perspective view of the base shell of the suitcase of FIG. 35 according to one or more aspects described herein.
Figure 54:
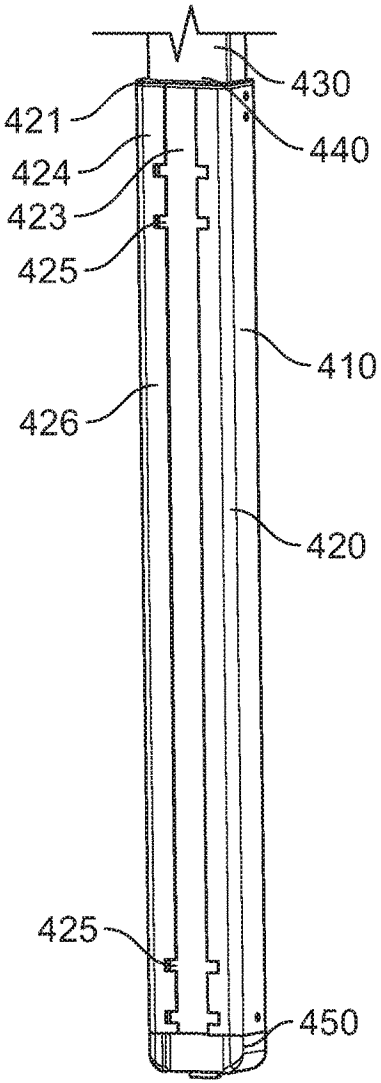
FIG. 54 is a partial front perspective view of view of the trolley handle extrusion assembly of one side of the trolley handle assembly of the suitcase of FIG. 1 with the suitcase shell removed for clarity according to one or more aspects described herein.

As discussed above, the base 502 may include a lower shell 508 and the lid 504 may include an upper shell 524 to provide a rigid structure that may form a barrier to protect the stored contents. The lower and upper shells 508, 524 may be formed from various materials, such as one or more metals, alloys, polymers, ceramics, or fiber-reinforced materials. In some examples, the upper and lower shells 124, 108 may be formed of a polymer material, such as a polycarbonate alloy, a thermoplastic olefin (TPO), or other similar material, that is molded to form both the shells 508, 524. In some arrangements, the shells 508, 524 are formed using injection molding or roto-molding/rotational molding processes as would be understood by one of ordinary skill in the art (not shown). In order to further enhance the structure, the shells 508, 524 may include elongated rib structures to further stiffen the structure in areas around the latch assemblies 180 and hinges 506. For instance, as shown in FIGS. 49 and 50, upper shell 524 may have a set of elongated ribs 527 extending from a surface underneath each of the upper latch recesses 544 to the interior surface on the top portion 538 of upper shell 524. Similarly, a set of elongated ribs 527 may extend from a surface underneath each of the upper hinge recesses 545 to the interior surface of the top portion 538 of upper shell 524. Each rib 527, 529 within each set may be evenly spaced apart from the next adjacent rib, where each rib may be spaced apart from each other a distance of approximately 9.5 times the thickness of each rib 527, 529, or spaced apart from each other within a range of 8 time to 10 times the thickness of each rib 527, 529, or spaced apart from each other within a range of 6 to 12 times the thickness of each rib 527, 529. Each rib 527, 529 may have a thickness of approximately 1.6 mm or within a range of 1.0 mm and 2.2 mm. Similarly, as shown in FIGS. 51 and 52, the lower shell 508 may have a set of elongated ribs 511 extending from a surface underneath each of the lower latch recesses 550 to the interior surface bottom portion 522 of lower shell 508. Similarly, a set of elongated ribs 513 may extend from a surface underneath each of the lower hinge recesses 551 to the interior surface of the bottom portion 522 of lower shell 508. Each rib 511, 513 within its set of ribs may be evenly spaced apart from the next adjacent rib, where each rib 511, 513 may be spaced apart from each other a distance of approximately 9.5 times the thickness of each rib 511, 513, or spaced apart from each other within a range of 8 to 10 times the thickness of each rib 511, 513, or spaced apart from each other within a range of 6 to 12 times the thickness of each rib 511, 513. Each rib 511, 513 may have a thickness of approximately 1.6 mm or within a range of 1.0 mm and 2.2 mm. The rib structures 511, 513, 527, 529 may also be connected to the adjacent interior surface of the shell structure of the respective lid and base shells 524, 508. The rib structures 511, 513, 527, 529 help to stiffen and strengthen shells 508, 524. As another option, the lower shell 508 may have an opening 515 arranged within the ribs 513 under one of the hinge recesses 551 to receive a one-way pressure release valve.

FIGS. 53-70 illustrate a trolley handle assembly 400 along with its attachment to the suitcase 100. Trolley handle assembly 400 may be attached to the lower shell 108 along the exterior of the bottom portion 122 of the shell 108. The trolley handle 400 may be formed as a separate member or assembly and attached to the lower shell 108. The trolley handle 400 may comprise a pair of extrusion assemblies 410, and a grip 402 for a user to grasp that extends between the pair of extrusion assemblies 410. In some embodiments, the trolley handle 400 may comprise a single extrusion assembly 410. Each extrusion assembly 410 may have a major extrusion 420, a minor extrusion 430, a top cap or major bushing 440 positioned between the major extrusion 420 and the minor extrusion, and a bottom cap 450 attached to a bottom end of the major extrusion 420. Alternatively, each extrusion assembly 410 may have a major extrusion 420, a minor extrusion 430, a tertiary or second minor extrusion 460, a top cap 440 positioned between the major extrusion 420 and the minor extrusion 430, an upper cap or minor bushing 404 positioned between the tertiary extrusion 460 and the minor extrusion 430, and a bottom cap 450 attached to a bottom end of the major extrusion 420. Still in other embodiments, the number of extrusions in each extrusion assembly 410 may comprise a single extrusion or more than three extrusions.

As shown in FIGS. 61 and 65-67, the extrusions 420, 430, 460 of the extrusion assembly 410 may be configured in a nested arrangement. The major extrusion 420 may have a central opening 422 surrounded by an outer wall 429, where the central opening 422 has a generally rectangular shape with an alignment member 429A arranged on the rear side of the outer wall 429. The alignment member 429A may be a centrally located indention along the outer wall 429 extending into the opening 422 to help align the other extrusions 430, 460 within the openings 422, 432 as they move relative to each other. While the exemplary alignment member 429A has a trapezoidal shape, the alignment member 429A may be curved, triangular, or other geometric shape. The minor extrusion 430 may have an exterior surface 434 with a shape or profile that generally corresponds to the shape of the opening 422 of the major extrusion 420 such that the minor extrusion 430 may be inserted into an opening 422 of the major extrusion 420. The exterior shape of the minor extrusion 430 may be offset a predetermined distance from the interior surface of the opening 422 and include alignment member 434A to permit the minor extrusion 430 to slide freely upward and downward within the opening 422 of the major extrusion 420 to allow the trolley handle 400 to extend to a usage position or withdraw to a storage position. Similarly, the tertiary extrusion 460 may have an exterior surface 464 with a shape or profile that generally corresponds to the shape of the central opening 432 of the minor extrusion 430 such that the tertiary extrusion 460 may be inserted into an opening 432 of the minor extrusion 430. The exterior shape of the tertiary extrusion 460 may be offset a predetermined distance from the interior surface of the opening 432 and include alignment member 464A to permit the tertiary extrusion 460 to slide freely upward and downward within the opening 432 of the minor extrusion 430. The grip 402 may be secured to the tertiary extrusion 460 of each of the extrusion assemblies 410. In some instances, the minor extrusion 430 may be the uppermost extrusion of the extrusion assembly 410 where the grip 402 secured between pair of minor extrusions 430.

Figure 61:
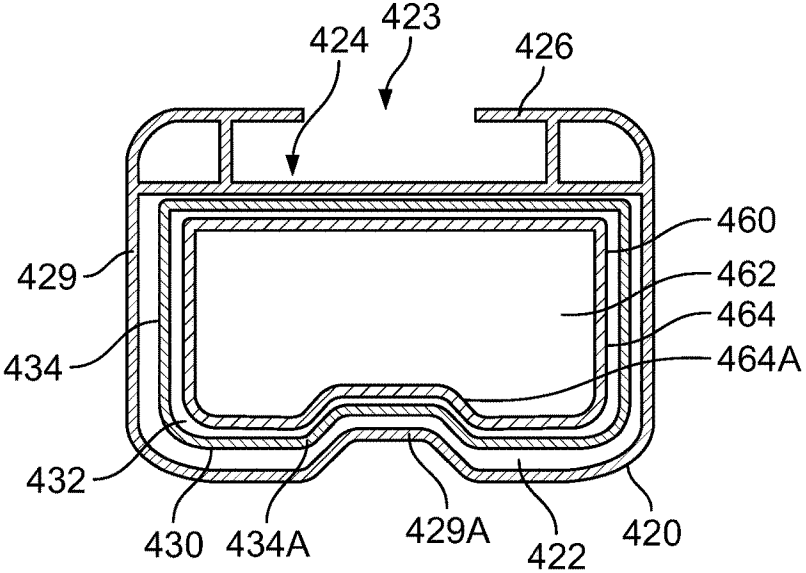
FIG. 61 is a top cross-sectional view of the extrusions of the trolley handle extrusion assembly of FIG. 54 according to one or more aspects described herein.

The major extrusion 420, minor extrusion 430, and tertiary extrusion 460 may each be formed as a single unitary piece, where each extrusion 420, 430, 460 may have a substantially constant cross-sectional profile. FIG. 61 further illustrates the nested arrangement and the cross-sectional profile of the major extrusion 420 may have a central opening 422 with a channel 424 positioned adjacent the central opening 422 on the front side of the major extrusion 420 with a central slot 423 extending into the channel 424. The outer channel wall 426 extends from either side of the slot 423 and wrap around until connecting to the outer wall 429 that surrounds the central opening 422.

Figure 53:
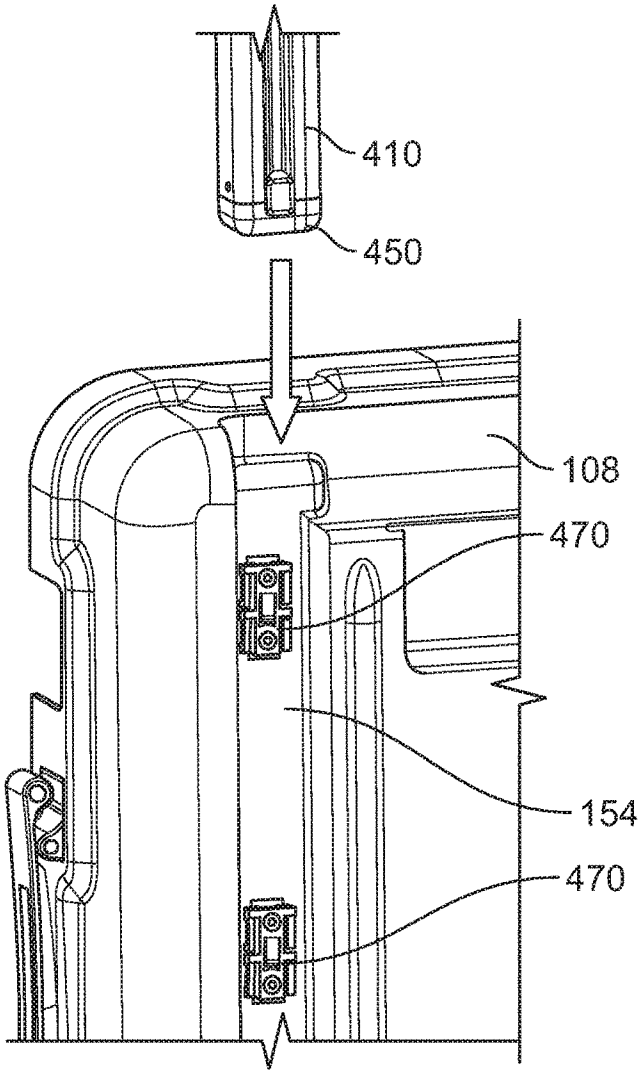
FIG. 53 is a partial rear perspective view of the partially assembled suitcase of FIG. 1 according to one or more aspects described herein.

As illustrated in FIGS. 53-70, the trolley handle assembly 400 may be secured externally to the base 102 of the suitcase 100, where the base 102, or lower shell 108, is free of any apertures that extends through the shell 108. The trolley handle assembly 400 each extrusion assembly 410 may be secured to the lower shell 108 using a plurality of mounting clips 470. As shown in FIG. 53, a plurality of mounting clips 470 may be secured within the tow pull recess 154 of the lower shell 108. The plurality of mounting clips 470 may include three mounting clips 470 evenly spaced apart a first clip 470 secured in an upper region of the recess 154, a second clip secured in a central region of the recess 154, and a third clip secured in a lower region of the recess 154, while other embodiments may comprise two mounting clips 470 or may comprise four mounting clips 470. To install the trolley handle 400 onto the suitcase 100, each extrusion assembly 410 may be slid downward into the tow pull recess 154 such that a central slot 423 in an outer channel 424 of the major extrusion 420 slides over each of the mounting clips 470 until each of the outer spring arms 482 of the mounting clips 470 engages a receiver 425 located adjacent an outer channel wall 426 of the major extrusion 420. As shown in FIGS. 54, 55A-B, 60 and 61, the outer channel 424 may be adjacent the central opening 422 and arranged on a front side of the major extrusion 420 such that the outer channel wall 426 faces the tow pull recess 154 of the lower shell 108. The receiver 425 of the major extrusion 420 may comprise a slot that extends outward from the central slot 423. Each major extrusion 420 may include a plurality of receivers 425. The plurality of receivers 425 may be arranged as a set, where the number of receivers 425 in each set is equal to the number of spring arms 482 on the mounting clips 470. For example, in the exemplary embodiments shown in the figures, four receivers 425 are arranged in a set to correspond to the four outer spring arms 482 on each mounting clip 470.

Figures 55A, 55B:
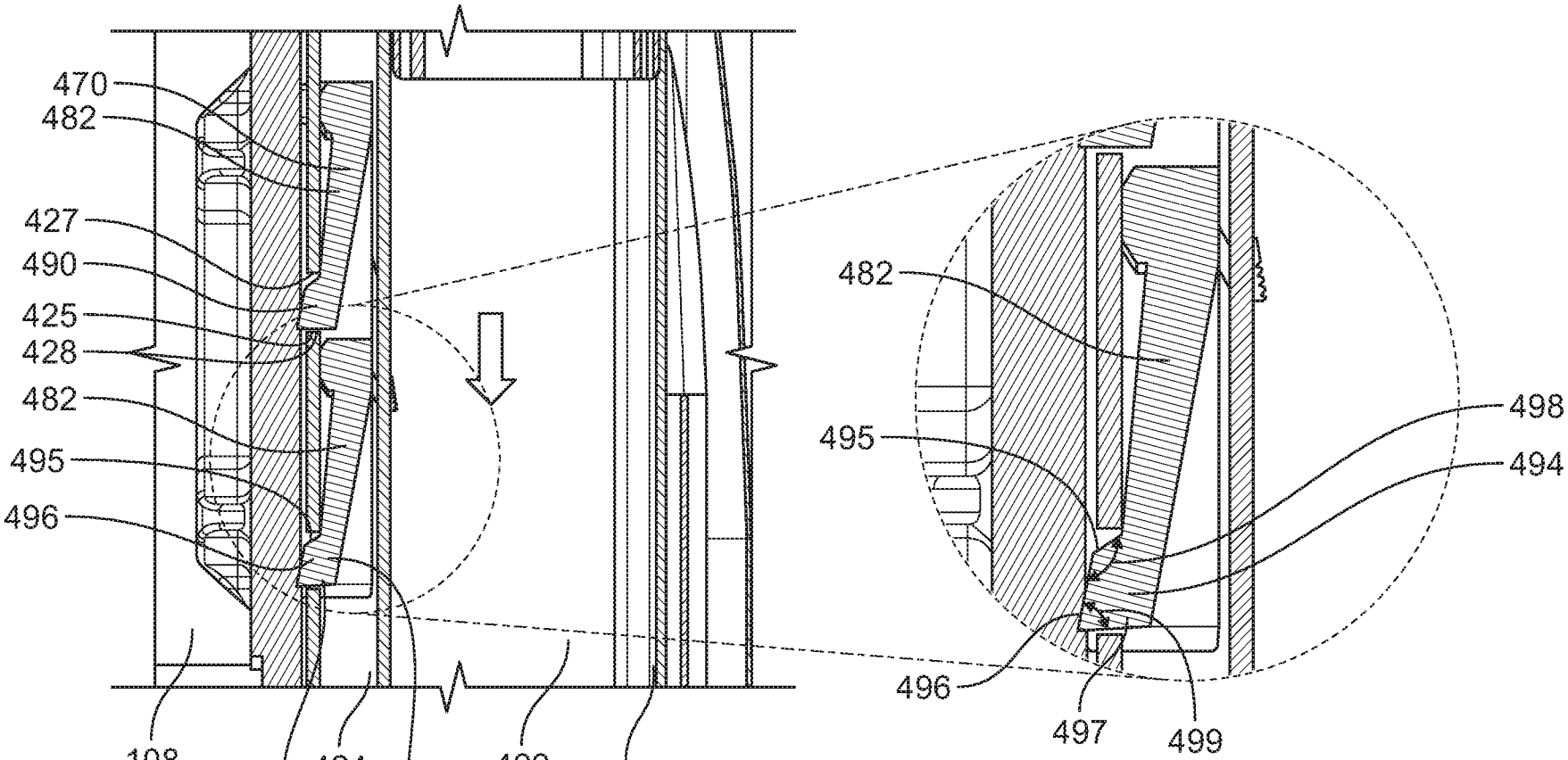
FIG. 55A is a partial cross-sectional side view of the suitcase of FIG. 1 according to one or more aspects described herein.
FIG. 55B is an enlarged cross-sectional side view of FIG. 55A according to one or more aspects described herein.
Figure 70:
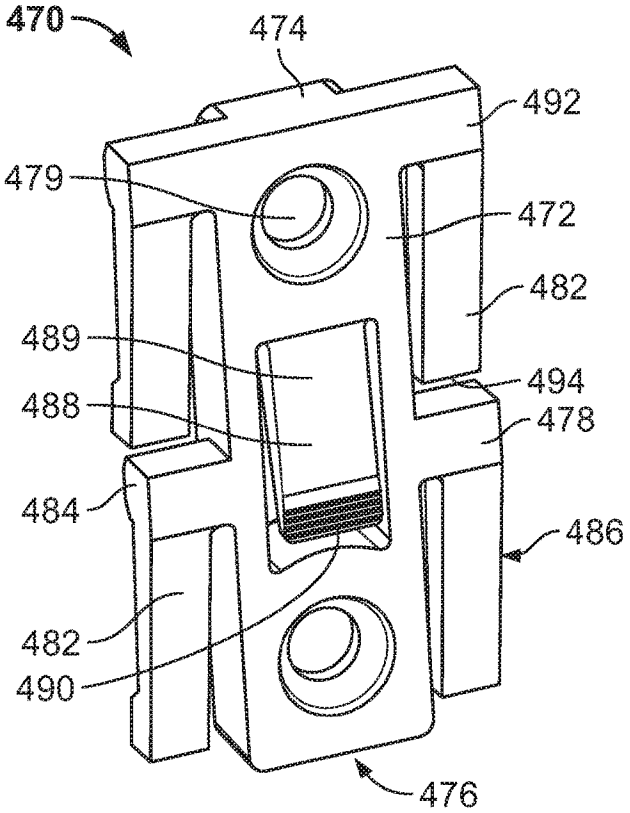
FIG. 70 is a rear perspective view of the mounting clip of the suitcase of FIG. 1 according to one or more aspects described herein.

As best illustrated in FIG. 70, the mounting clips 470 may have a central body 472 with a top end 474, a bottom end 476, a front side 478, a rear side 480, a plurality of outer spring arms 482 arranged on both the left side 484 and the right side 486, a central spring arm 488 extending from the front side 478 of the central body 472, and a plurality of mounting holes 479 extending through the central body 472. Each outer spring arm 482 may have fixed end 492 attached to the central body 472 and a free end 494, such that the outer spring arm 482 is cantilevered from the fixed end. Additionally each free end 494 may have an upper surface 495, a rear surface 496, and a lower surface 497. The angle 498 formed by the upper surface 495 and the rear surface 496 may be an obtuse angle. For example, angle 498 may be approximately 115 degrees, or may be in a range of 91 degrees and 135 degrees. By arranging angle 498 in this manner, the major extrusion 420 may be able to push the outer spring arms 482 inward to allow the extrusion 420 to slide downward over the mounting clips 470 until it reaches the bottom without the upper mounting clip 470 causing it to become locked midway down. As best seen in FIGS. 55A and 55B, as the major extrusion 420 moves downward, the upper edge 427 of the receiver 425 may contact the upper surface 495 and push the outer spring arm 482 inwards towards the front side 478 to allow the major extrusion to continue to move downward until arriving at its final assembly position. In addition, the rear surface 496 and lower surface 497 of the free end 494 form angle 499, which is an acute angle. For example, angle 499 may be approximately 85 degrees, or within a range of 45 degrees and 89 degrees. By arranging the lower surface 497 and the rear surface at acute angle 499, the major extrusion 420 may be unable to be removed by being pulled upward after a spring arm 482 has engaged with its corresponding receiver 425. Once the spring arm 482 is engaged, if the major extrusion 420 is pulled upward, lower edge 428 of receiver 425 may contact lower surface 497 where the angled lower surface 497 will cause the outer spring arm 482 to resist moving inward thereby keeping the major extrusion 420 from moving upward.

Figure 56:
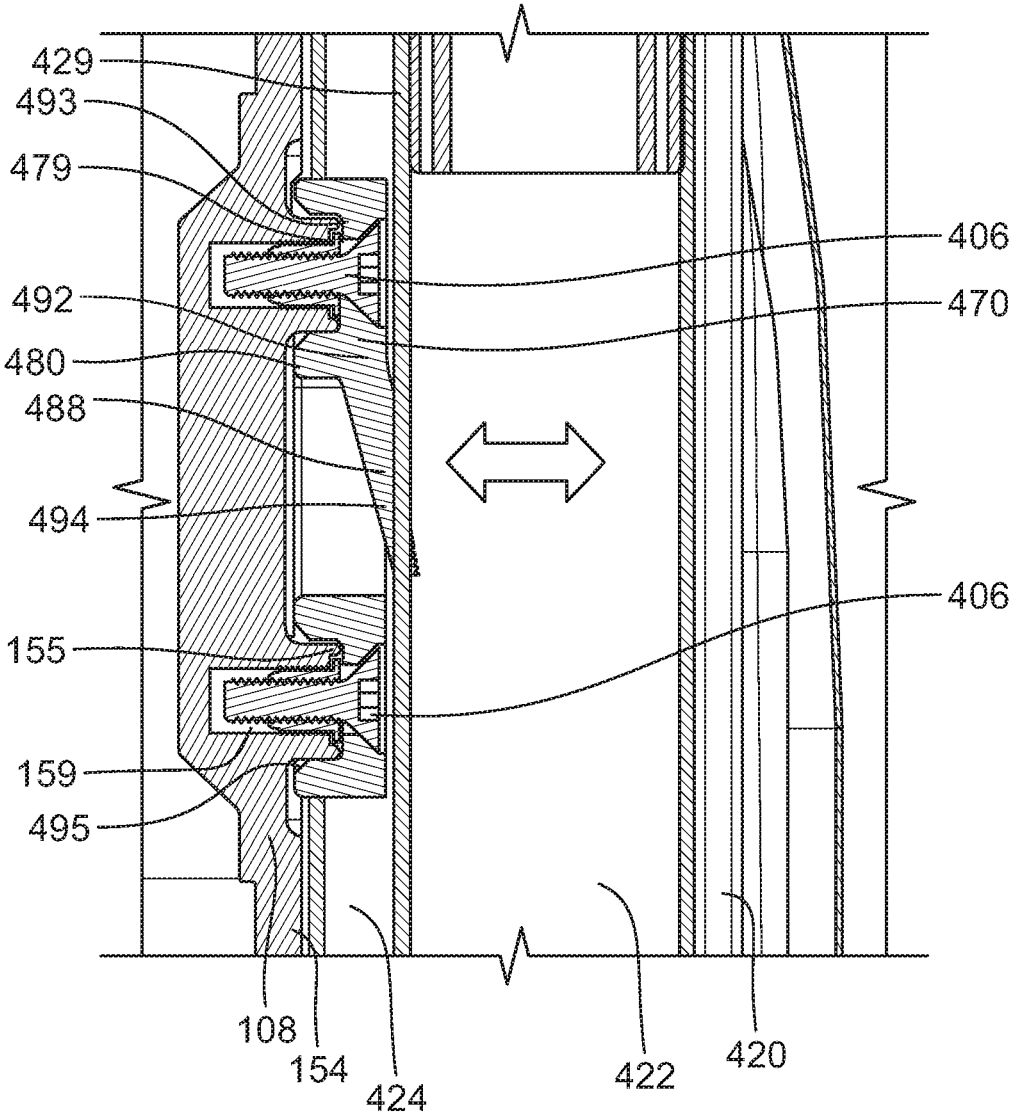
FIG. 56 is a partial cross-sectional side view of suitcase of FIG. 1 according to one or more aspects described herein.

As shown in FIG. 56, each mounting clip 470 may be secured to the lower shell using a mechanical fastener 406 inserted through each the mounting hole 479 of the mounting clip 470. The fasteners 406 may be inserted into blind holes 159 formed in the lower shell 108 such that the holes 159 do not extend into the interior void of the suitcase 100, which keeps the lower shell 108 free of any openings extending through its body. The lower shell 108 may have a wall thickness that is greater than the wall thickness of the majority of the lower shell 108 in the regions that secure the mounting clips 470.

Since each mounting clip 470 is arranged to allow the movement of the major extrusion 420 in only one direction, the mounting clip 470 may be mounted on the suitcase in a manner to ensure its proper operation. Each mounting clip 470 may have a pocket 493 on the rear side 480 that may engage a boss 155 arranged in the tow pull recess 154. Each boss 155 may have an asymmetrical shape along at least one plane that intersects the axis of the blind holes 159 that engages pocket 493 having a corresponding asymmetrical shape. The bosses 155 may be arranged in pairs to engage the pockets 493 arranged on the each mounting clip 470. For example, as shown in FIGS. 57A and 57B, the bosses 155 may be arranged as three pairs of bosses 155 in each recess 154 to connect to three mounting clips 470 within each recess 154. Such the number of pairs of bosses 155 may equal the number of mounting clips 470 attached to the shell 108. Each boss 155 may be D-shaped where an upper region is rounded and a lower region is straight. The asymmetry of boss 155 and pocket 493 may help to prevent the mounting clip 470 from being assembled to the lower shell 108 incorrectly. Alternatively, only one boss 155 of each pair of bosses 155 may be asymmetrically shaped.

In addition, as a means of creating a secure installation of the trolley handle 400 to the suitcase, the central spring arm 488 of the mounting clip 470 may provide a horizontally oriented force to help further secure the extrusion assembly 410 to the shell 108 and reduce any vibration within the trolley handle 400 relative to the suitcase 100. As discussed above, the central spring arm 488 may extend outward from the front side 478 of the central body 472 toward the bottom end 476. The spring arm 488 may have a fixed end 489 on the front side 478 of the mounting clip 470 and a free end 490 spaced away from the front side 478. The free end 490 may contact the portion of the outer wall 429 of the major extrusion 420 that is positioned between the central opening 422 and the channel 424. As the free end 490 contacts the outer wall 429, the central spring arm 488 is compressed and as it is compressed it exerts a force against the major extrusion 420 to reduce any vibration and keep the trolley handle 400 secured to lower shell 108.

Figure 68:
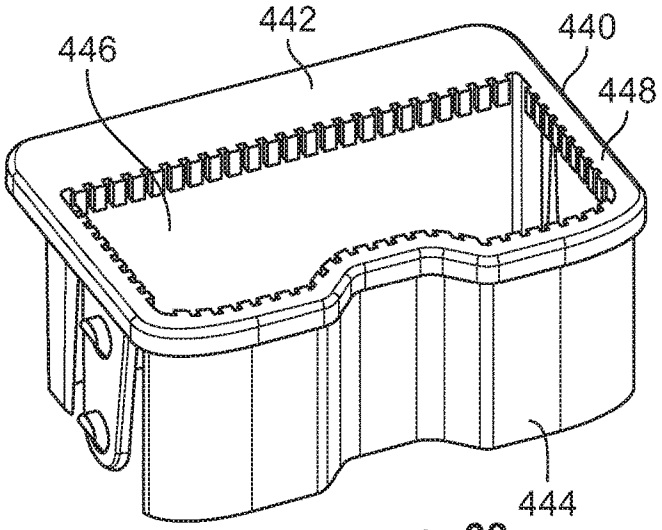
FIG. 68 is a rear perspective view of the top cap of the trolley handle extrusion assembly according to one or more aspects described herein.
Figure 69:
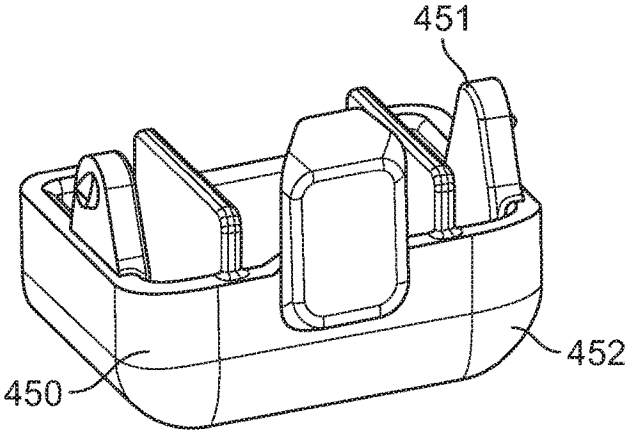
FIG. 69 is a rear perspective view of the bottom cap of the trolley handle extrusion assembly according to one or more aspects described herein.
Figure 71:
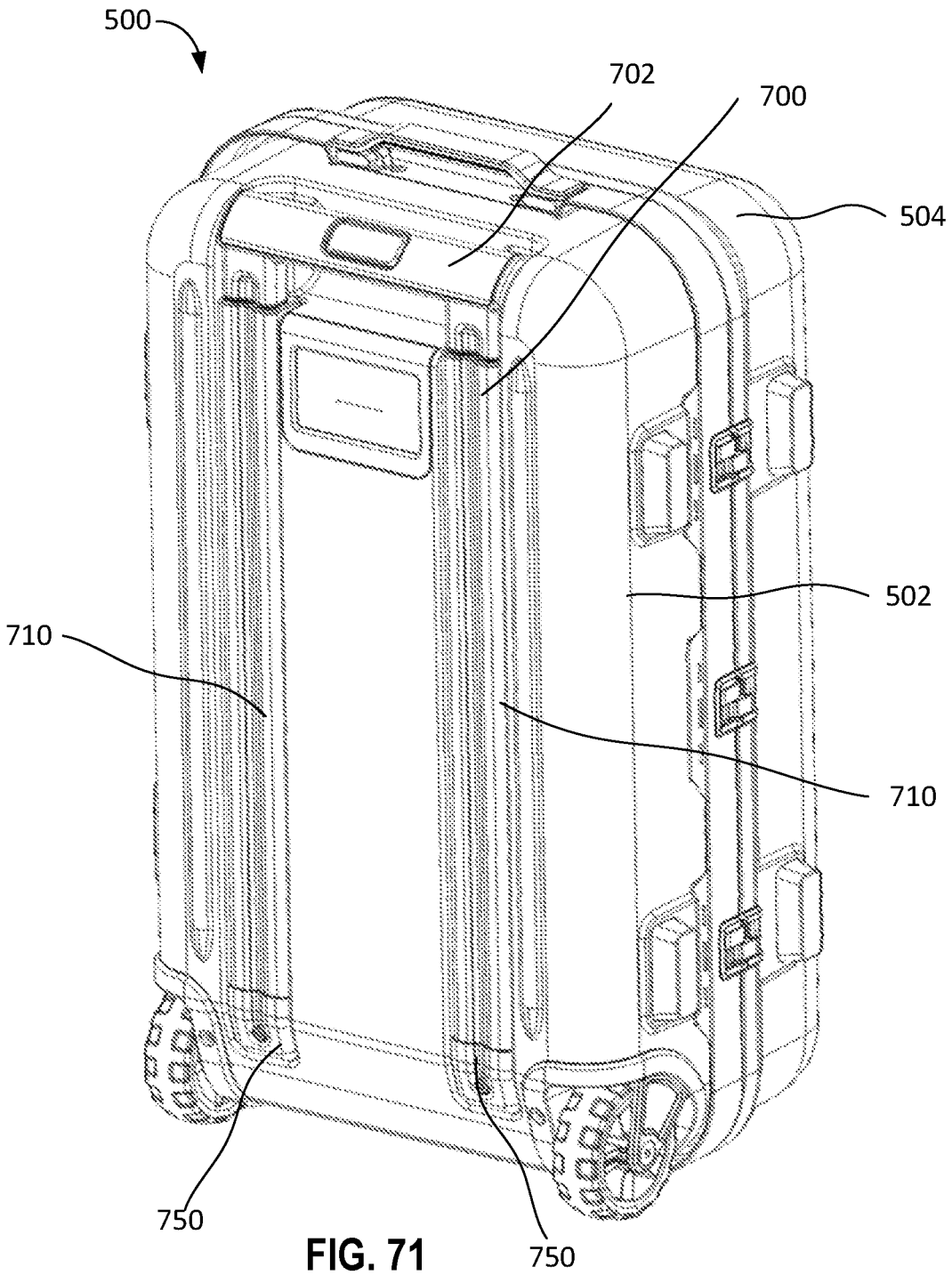
FIG. 71 is a rear perspective view of an exemplary suitcase according to one or more aspects described herein.
Figure 72A:
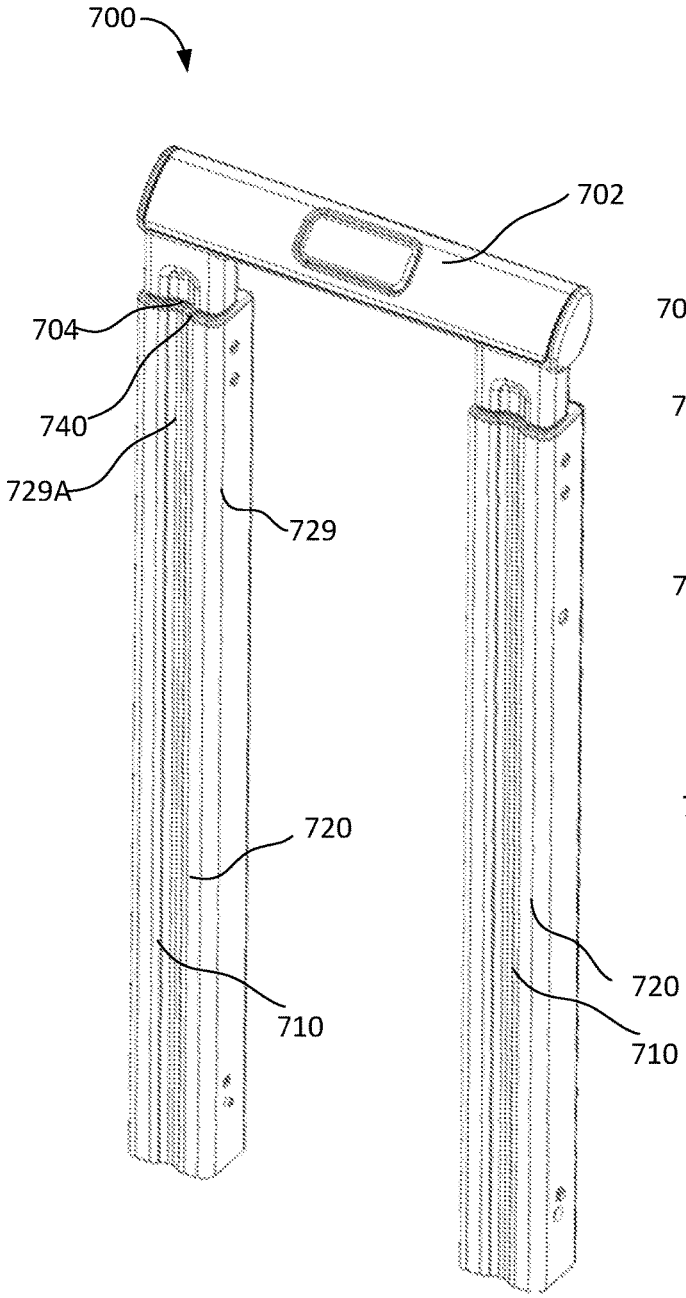
FIG. 72A is a front perspective view of a trolley handle assembly of the suitcase of FIG. 71 according to one or more aspects described herein.
Figure 73:
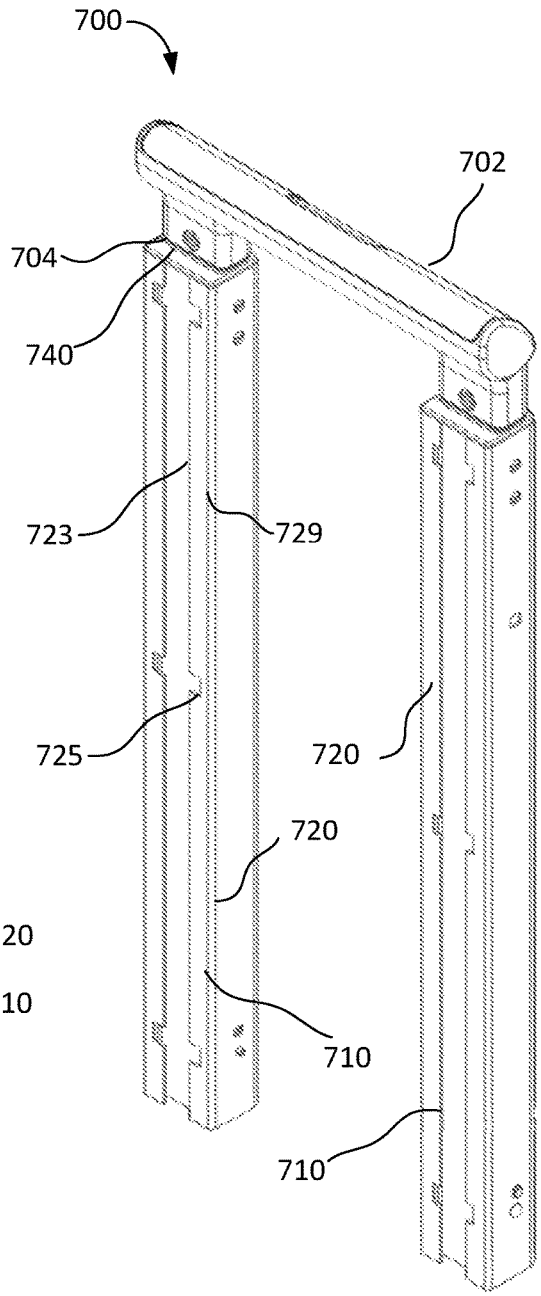
FIG. 73 is a rear perspective view of the trolley handle assembly of FIG. 72A according to one of more aspects described herein.

The extrusion assembly 410 may have a means to keep dirt and debris from causing the extrusions 420, 430, 460 from binding as they move relative to each other. Each extrusion 420, 430, 460 includes a central opening 422, 432, 462 respectively to allow any dirt or debris that enters the assembly 410 to pass easily through the center. Additionally, as shown in FIGS. 63 and 68, the extrusion assembly 410 may include the top cap 440 inserted into the central opening 422 at the top of the major extrusion 420. The top cap 440 may have upper lip 442 that rests on a top surface 421 of the major extrusion 420 and a lower portion 444 that inserts into the central opening 422. The top cap 440 may have a central opening 446 that extends through the top cap 440 with a shape that corresponds with the exterior surface 434 of minor extrusion 430. The upper lip 442 may have a plurality of inward facing grooves 448. These grooves 448 provide small openings to allow dust and debris to pass through, such that the dust may travel along the inside of the extrusion assembly 410 without affecting the sliding movement of the minor extrusion 430 and allowing the minor extrusion 430 to move freely relative to the major extrusion 420. Similarly, the upper cap 404 may be inserted into the opening 432 of the minor extrusion 430 and have a central opening to receive the tertiary extrusion 460. The upper cap 404 may have all of the features discussed above of the top cap 440 such the plurality of inward facing grooves to allow dust and debris to pass through, such that the dust may travel along the inside of the extrusion assembly 410 without affecting the sliding movement of the tertiary extrusion 460 and allowing the tertiary extrusion 460 to move freely relative to the minor extrusion 430.

Figure 58:
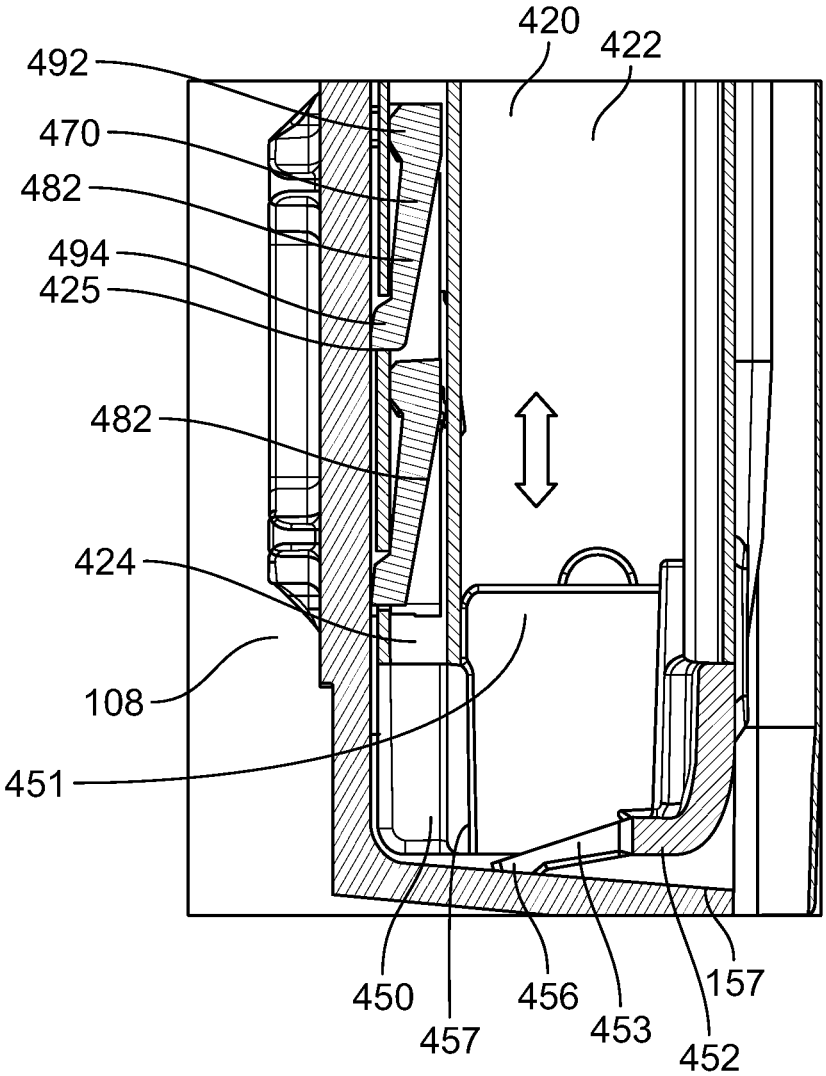
FIG. 58 is a partial cross-sectional side view of suitcase of FIG. 1 according to one or more aspects described herein.
Figure 60:
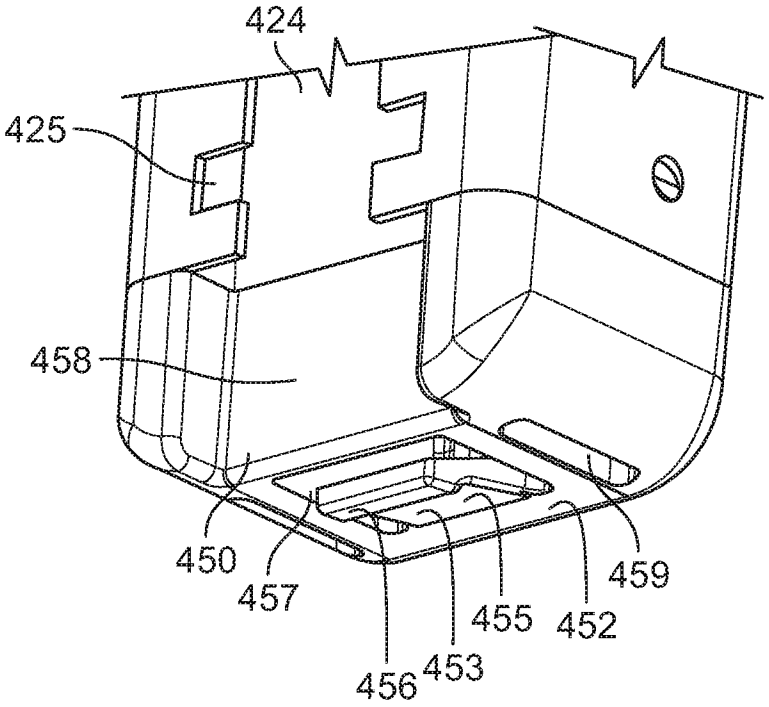
FIG. 60 is an enlarged front perspective view of the trolley handle assembly of FIG. 54 according to one or more aspects described herein.
Figure 59:
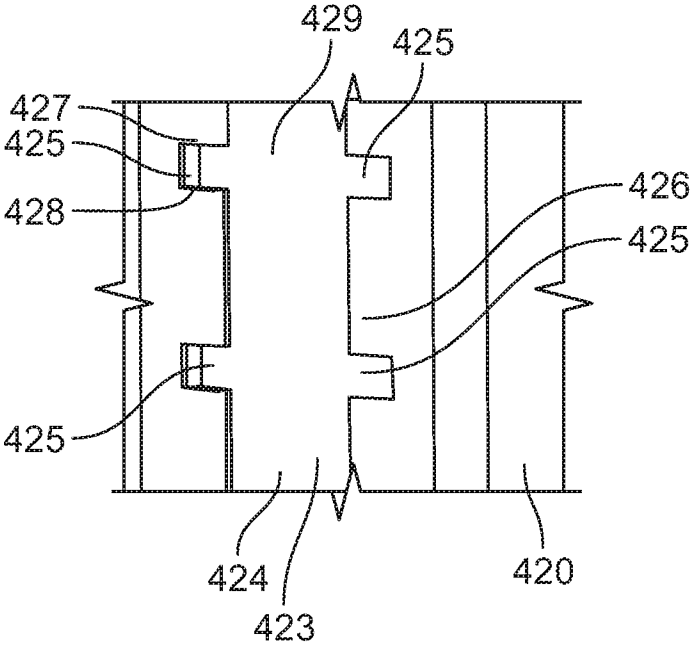
FIG. 59 is an enlarged front perspective view of the trolley handle assembly of FIG. 54 according to one or more aspects described herein.
Figure 62:
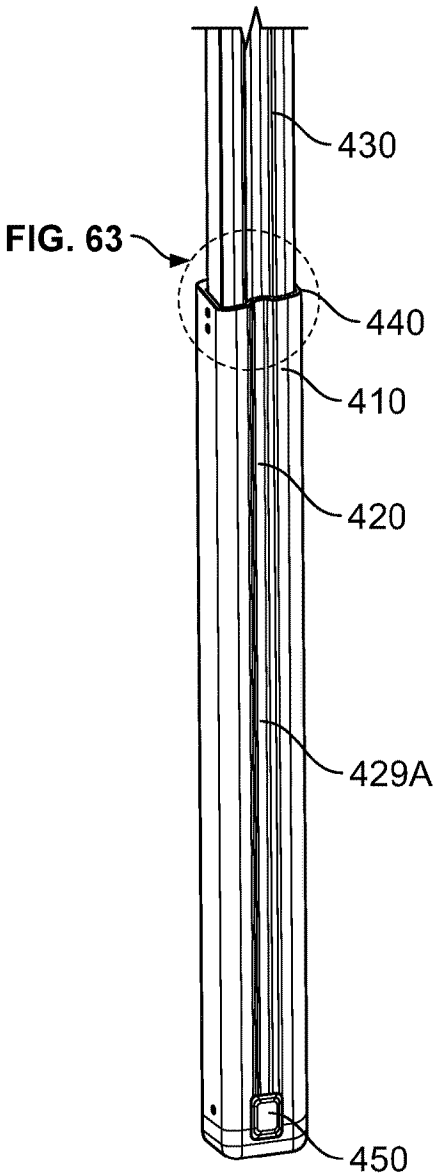
FIG. 62 is a partial rear perspective view of the trolley handle extrusion assembly of FIG. 54 according to one or more aspects described herein.

Additionally, the bottom cap 450 of each extrusion assembly 410 may provide a means to further secure the trolley handle 400 to the suitcase 100 and also provide a means to allow dirt and debris to exit each extrusion assembly 410. The bottom cap 450 may be inserted into central opening 422 at the bottom of major extrusion 420. As shown in FIGS. 56, 58, 42, and 20, the bottom cap 450 may comprise an upper portion 451 that extends into the central opening 422 of the major extrusion 420 and a lower portion 452 that remains outside of the major extrusion 420 and forms a bottom portion of the extrusion assembly 410. The lower portion 452 may comprise a lower spring arm 453 that extends downward away from a bottom surface 454 of the bottom cap 450. The lower spring arm 453 may have a fixed end 455 and a free end 456, where the free end 456 may contact a side surface 157 of the recess 154 as shown in FIG. 56. The lower spring arm 453 may exert a force upward onto the major extrusion to limit vibration and further secure the extrusion assembly 410 to the shell 108. The bottom cap 450 may also include a channel 458 along the lower portion 452 of the cap 450. In addition, the bottom cap 450 may include a central opening 457 through the bottom surface 454, which may be formed where the lower spring arm 453 extends from bottom surface 454 as shown in FIG. 58. The central opening 457 may allow dirt and debris to exit the extrusion assembly 410. As best illustrated in FIG. 64, the bottom cap 450 may also have a plurality of side openings 459 arranged on either side of the central opening 457 that extend through the bottom surface 454 to allow dirt and debris to exit the extrusion assembly 410. The side openings 459 may be any geometric shape, such as substantially rectangular as shown in the exemplary embodiment, or circular, elliptical, or other shape. In addition, side surface 157 of the tow pull recess 154 may be angled downward to help move the dirt and debris away from and out of the extrusion assembly 410.

FIGS. 71-86 illustrate an alternate trolley handle 700, which may be attached to the base 502 of suitcase 500. The features of trolley handle assembly 700 are referred to using similar reference numerals under the "7*xx*" series of reference numerals, rather than "4*xx*" as used in the embodiments of FIGS. 1-70. Accordingly, certain features of trolley handle assembly 700 that were already described above as shown in FIGS. 1-70 may be described in lesser detail, or may not be described at all. The trolley handle assembly 700 may be attached to the lower shell 508 along the exterior of the bottom portion 522 of the lower shell 508. Similar to trolley handle assembly 400, trolley handle assembly 700 may be formed as a separate member or assembly and attached to the lower shell 508. The trolley handle assembly 700 may comprise a pair of extrusion assemblies 710, and a grip 702 for a user to grasp that extends between the pair of extrusion assemblies 710. In some embodiments, the trolley handle assembly 700 may comprise a single extrusion assembly 710. Each extrusion assembly 710 may have a major extrusion 720, a minor extrusion 730, a tertiary or second minor extrusion 760, a top cap or major bushing 740 positioned between the major extrusion 720 and the minor extrusion 730, an upper cap or minor bushing 704 positioned between the tertiary extrusion 760 and the minor extrusion 730. In other examples, the number of extrusions may comprise a single extrusion, two extrusions, or more than three extrusions.

Similar to extrusion assembly 410, extrusion assembly 710 may have a nested arrangement. The major extrusion 720 may have a central opening 722 surrounded by an outer wall 729, where the central opening 722 has a generally rectangular shape with an alignment member 729A arranged on the rear side of the outer wall 729. The alignment member 729A may be a centrally located indention along the outer wall 729 extending into the opening 722 to help align the other extrusions 730, 760 within the openings 722, 732 as they move relative to each other. While the exemplary alignment member 729A has a trapezoidal shape, the alignment member 729A may be curved, triangular, or other geometric shape. The minor extrusion 730 may have an exterior surface 734 with a shape or profile that generally corresponds to the shape of the opening 722 of the major extrusion 720 such that the minor extrusion 730 may be slidably engage with opening 722. Similarly, the exterior surface 764 may have a shape or profile that generally corresponds to the shape of the central opening 732 of the minor extrusion 730 such that the tertiary extrusion 760 may slidably engage opening 732 of the minor extrusion 730. The grip portion 702 may be secured to the tertiary extrusion 760 of each of the extrusion assemblies 710. In some instances, the minor extrusion 730 may comprise the uppermost extrusion of the trolley handle assembly 700 and have the grip 702 secured between pair of minor extrusions 730.

Figure 76:
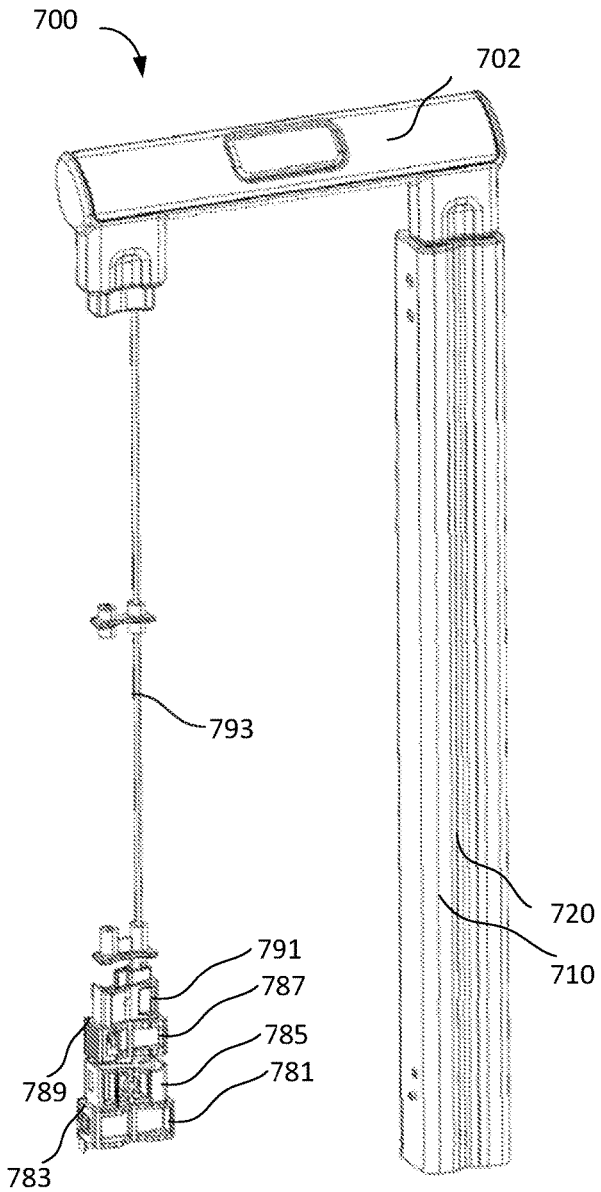
FIG. 76 is a front perspective view of the trolley handle assembly of FIG. 72A with some components removed according to one or more aspects described herein.
Figure 74:
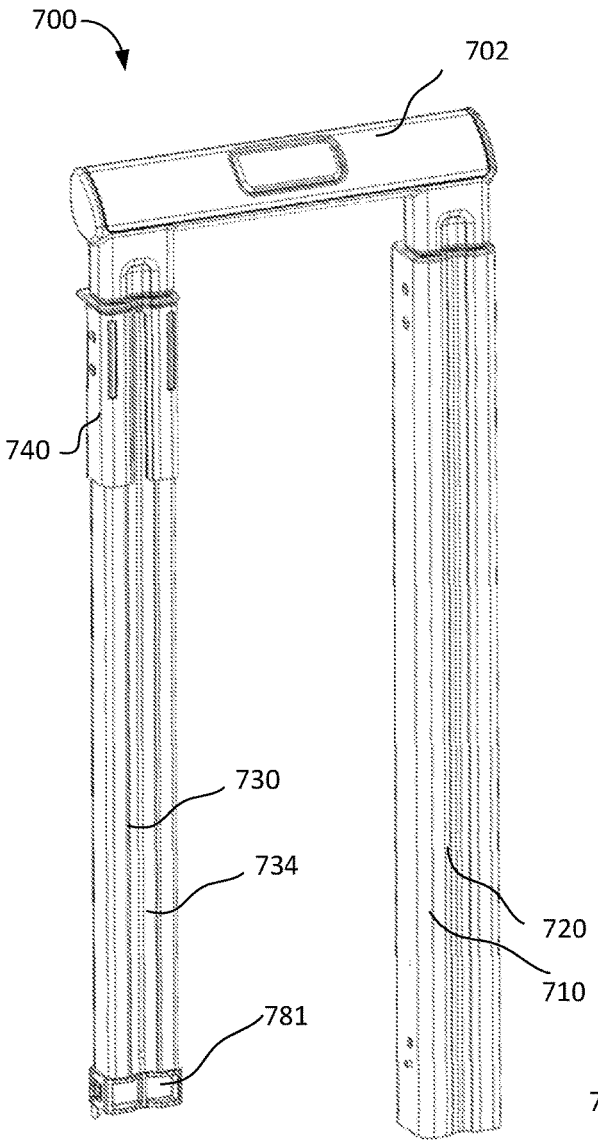
FIG. 74 is a front perspective view of the trolley handle assembly of FIG. 72A with some components removed according to one or more aspects described herein.
Figure 75:
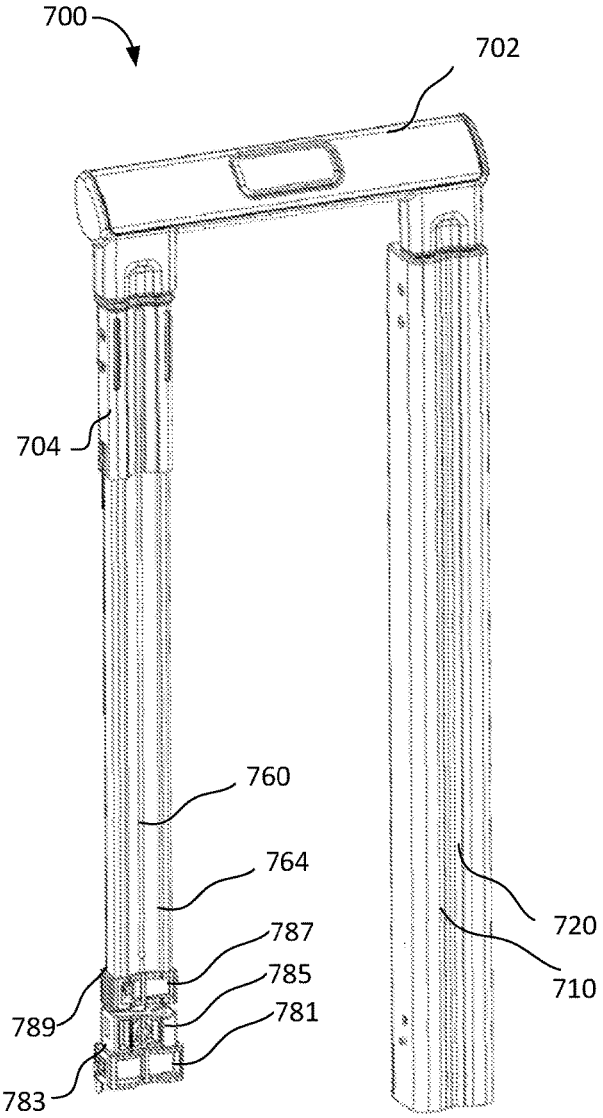
FIG. 75 is a front perspective view of the trolley handle assembly of FIG. 72A with some components removed according to one or more aspects described herein.

FIGS. 74-76 illustrate the trolley handle assembly 700 with various components removed to illustrate the nested arrangement. For example, FIG. 74 illustrates the trolley handle assembly 700 with the major extrusion 720 removed from one of the extrusion assemblies 710. FIG. 74 shows the minor extrusion 730 underneath the major extrusion 720. In addition, the major bushing 740 may be positioned between the major extrusion 720 and minor extrusion 730 at the top the extrusion assembly 710. A major stop 781 may be positioned at a bottom of the minor extrusion 730 that contacts has a shelf 783 that contacts the bottom end of the minor extrusion 730. The major stop 781 may have a plug portion 785 that extends into opening 732 of the minor extrusion 730 to help secure the major stop 781 to the extrusion assembly 710 as shown in FIG. 75, which illustrates an extrusion assembly 710 with both the major extrusion 720, minor extrusion 730, and major bushing 740 removed. FIG. 75 also shows the minor bushing 704 that is attached to the top of the tertiary extrusion 760. FIG. 76 further illustrates the tertiary extrusion 760 removed along with the middle stop 787 positioned at the bottom end of the tertiary extrusion 760. Similar to the major stop 781, the middle stop 787 may have shelf 789 to contact the tertiary extrusion 760 and a plug portion 791 that extends into the opening 762 of the tertiary extrusion 760 to help secure the middle stop 787 to the extrusion assembly 710 as shown in FIG. 76. The push rod 793 connects from the activation member 765 to the locking mechanism to allow the grip portion 702 to be pulled upward extending the extrusion assembly 710.

Figure 72B:
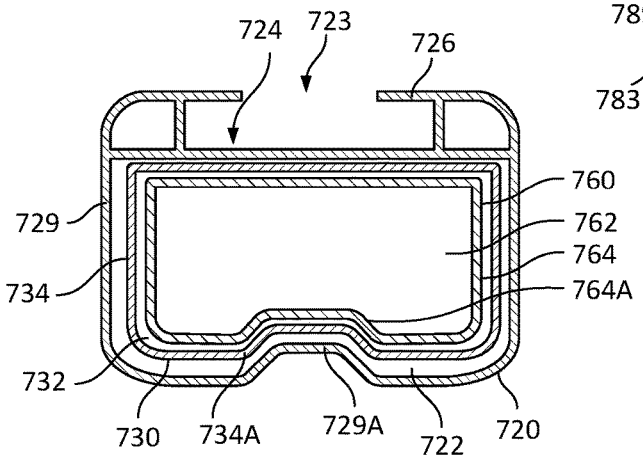
FIG. 72B is a top cross-sectional view of the extrusions of the trolley handle extrusion assembly of FIG. 72A according to one or more aspects described herein.

Like the extrusions of trolley handle assembly 400, the major extrusion 720, minor extrusion 730, and tertiary extrusion 760 may each be formed as a single unitary piece, where each extrusion 720, 730, 760 may have a substantially constant cross-sectional profile as shown in FIG. 72B.

Figure 77:
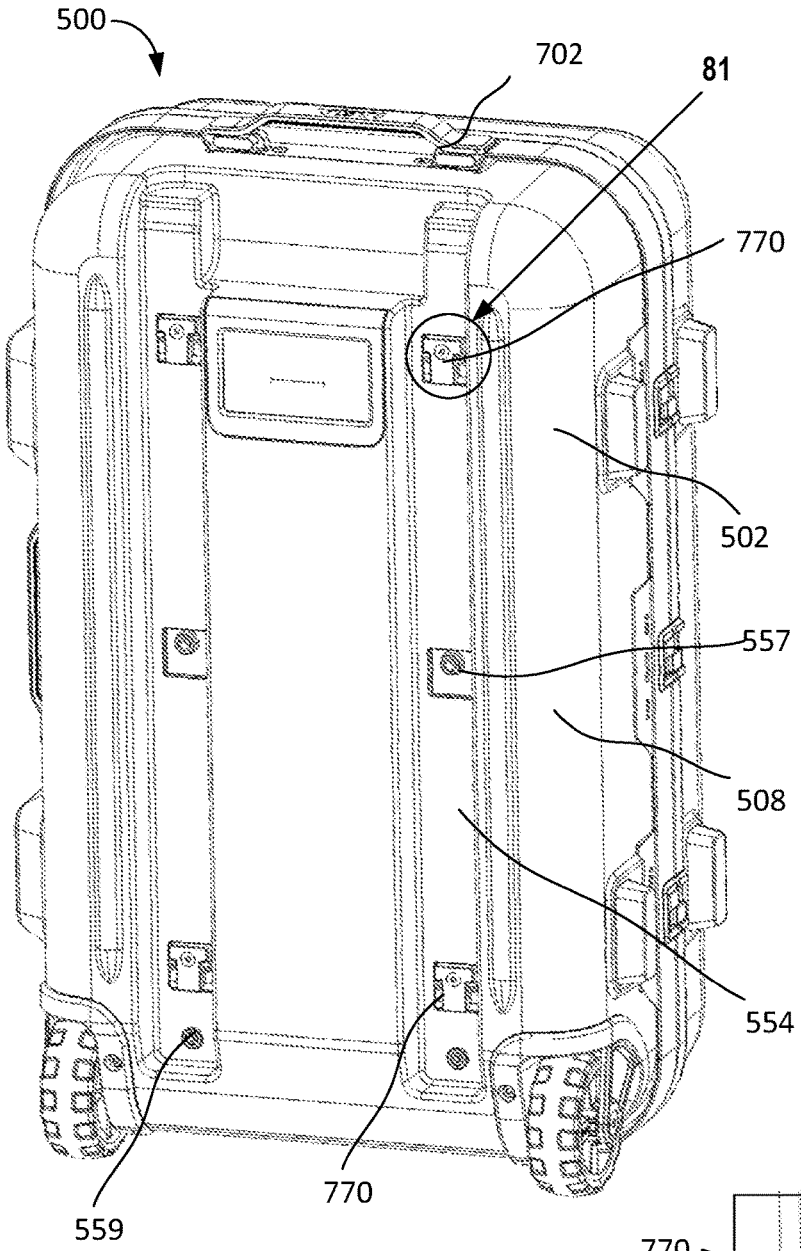
FIG. 77 is a rear perspective view of the suitcase of FIG. 71 with the some components removed according to one or more aspects described herein.
Figure 78:
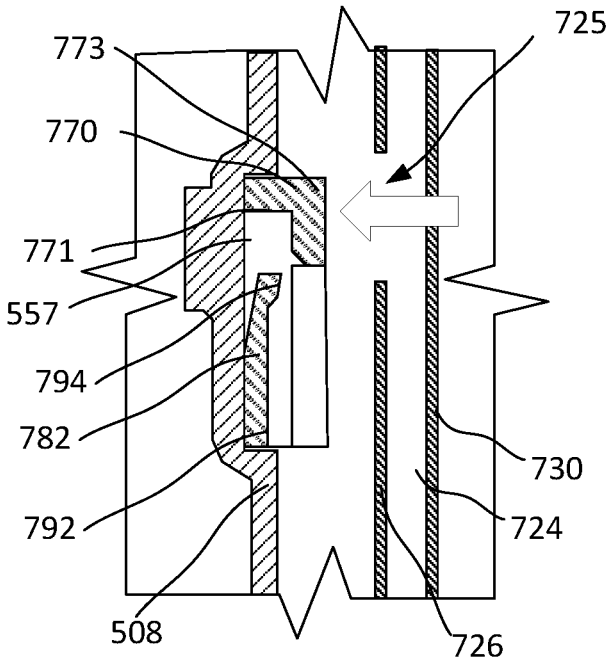
FIG. 78 is a partially exploded cross-sectional side view of the suitcase of FIG. 71 according to one or more aspects described herein.
Figure 79:
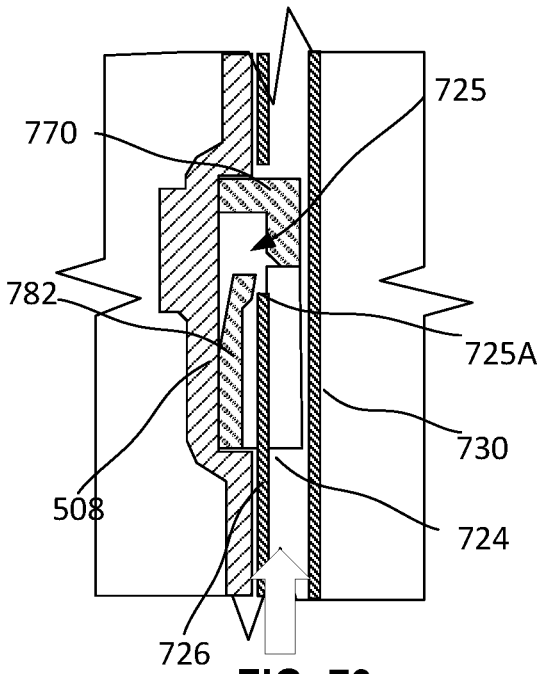
FIG. 79 is a partially exploded cross-sectional side view of the suitcase of FIG. 71 according to one or more aspects described herein.
Figure 80:
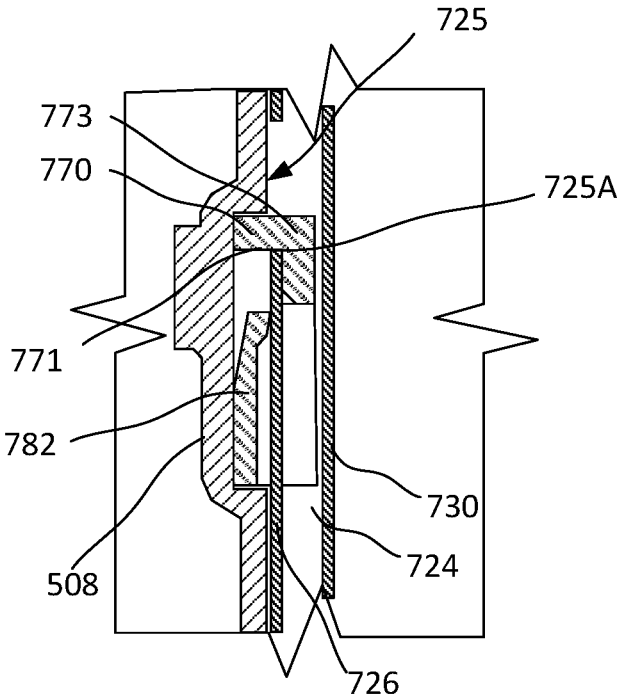
FIG. 80 is a partial cross-sectional side view of the suitcase of FIG. 71 according to one or more aspects described herein.
Figure 82:
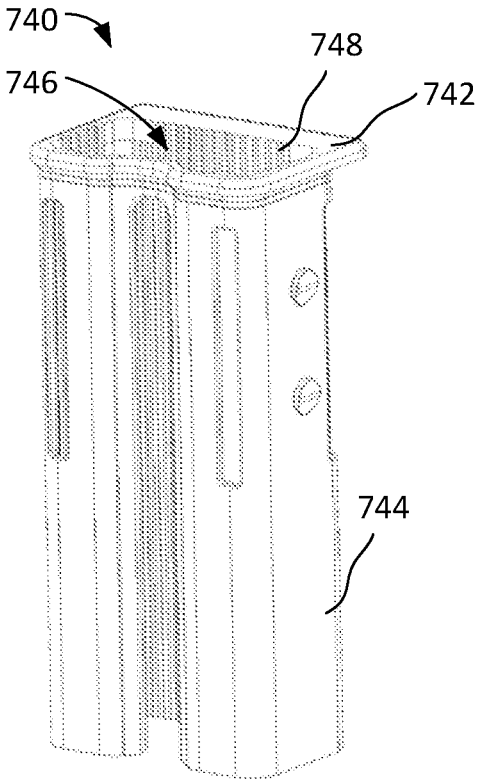
FIG. 82 is a perspective view of the major bushing of the trolley handle assembly of FIG. 72A according to one or more aspects described herein.
Figure 83:
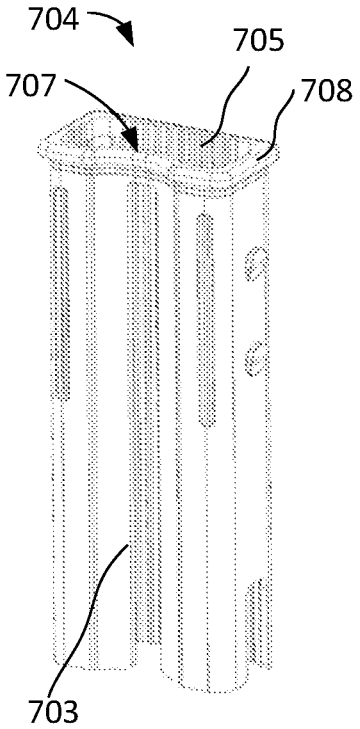
FIG. 83 is a perspective view of the minor bushing of the trolley handle assembly of FIG. 72A according to one or more aspects described herein.

As illustrated in FIGS. 77-82, the trolley handle assembly 700 may be secured externally to the base 502 or lower shell 508. Each extrusion assembly 710 may be secured to the lower shell 508 using a plurality of mounting clips 770. As shown in FIG. 78, a plurality of mounting clips 770 may be secured within the tow pull recess 554 of the lower shell 508. The plurality of mounting clips 770 may include two mounting clips 770 with a first clip 770 in an upper region of the recess 554 and a second clip secured in a lower region of the recess 554, while other embodiments may comprise three mounting clips 770 or may comprise four mounting clips 770. To install the trolley handle assembly 700 onto the suitcase 500, each extrusion assembly 710 may be lowered into the tow pull recess 554 in a direction toward the front of the suitcase 500 such that a central slot 723 and receiver 725 in an outer channel 724 of the major extrusion 720 slides over each of the mounting clips 770. The extrusion assemblies 710 may then slide upward toward the top surface 514 (away from the wheel assemblies 564). The extrusion assemblies 710 may stop when the lower edge 725A of the receiver 425 engages a lower surface 771 of an upper shelf 773 of mounting clip 770. The spring arms 782 may engage the outer channel wall 726 to keep the channel wall 426 in contact with the a rear side 780 of the mounting clip 770. The receiver 725 of the major extrusion 720 may comprise a slot that extends outward from the central slot 723. Each major extrusion 760 may include a plurality of receivers 725. The plurality of receivers 725 may be arranged as a set, where the number of receivers 725 in each set is equal to the number of spring arms 782 on the mounting clips 770. For example, in the exemplary embodiments shown in the figures, two receivers 725 are arranged in a set to correspond to the two outer spring arms 782 on each mounting clip 770. Once the extrusion assemblies 710 are engaged with the mounting clips 770, a bottom cap 750 may be positioned within each recess 554 and secured to the shell 508 to prevent each extrusion assembly 710 from moving downward. Once the bottom cap 750 is secured, the trolley handle assembly 700 is secured to the suitcase 500. The bottom cap 750 may prevent the extrusion assemblies 710 and accordingly the trolley handle assembly 700 from downward moving towards the bottom of the suitcase (in a direction toward a plane created by axes of a plurality of wheels 564).

Figure 81:
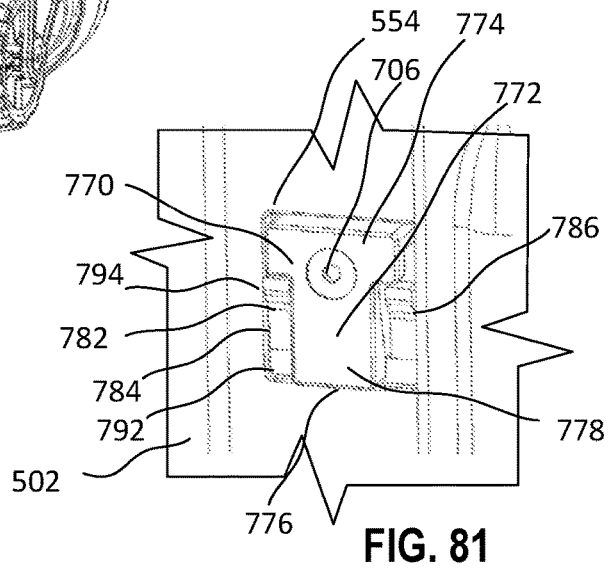
FIG. 81 is an enlarged partial perspective view of the suitcase of FIG. 71 according to one or more aspects described herein.

As best illustrated in FIG. 81, the mounting clips 770 may have a central body 772 with a top end 774, a bottom end 776, a front side 778, a rear side 780, a plurality of outer spring arms 782 arranged on both the left side 784 and the right side 786, and a mounting hole extending through the central body 772. Each outer spring arm 782 may have fixed end 792 attached to the central body 772 and a free end 794, such that the outer spring arm 782 is cantilevered from the fixed end 792. Each spring arm 782 of the mounting clip 770 may provide a horizontally oriented force to help further secure the extrusion assembly 710 to the shell 508 and reduce any vibration within the trolley handle assembly 700 relative to the suitcase 500. As the free end 794 contacts the outer channel wall 726, the spring arm 782 is compressed and as it is compressed it exerts a force against the major extrusion 720 to reduce any vibration and keep the trolley handle assembly 700 secured to lower shell 508.

As shown in FIG. 77, each mounting clip 770 may be secured to the lower shell 508 using a mechanical fastener 706 inserted through each the mounting hole 779 of the mounting clip 770. The fastener 706 is inserted into a blind threaded hole 559 formed in the lower shell 508 such that the holes 559 do not extend into the interior void of the suitcase 500. Each mounting clip 770 may be arranged to allow the movement of the major extrusion 720 in only one direction, the mounting clip 770 may be mounted on the suitcase in a manner to ensure its proper operation. Each mounting clip 770 may be positioned within a pocket 557 located within the recess 554. The pocket 557 may include the mounting hole 559 that is located away from a center of the pocket such that the mounting clip 770 may only be attached one way to the shell 508.

Similar to extrusion assembly 410, extrusion assembly 710 may have a means to keep dirt and debris from causing the extrusions 720, 730, 760 from binding as they move relative to each other. Each extrusion 720, 730, 760 may include a central opening 722, 732, 762 respectively to allow any dirt or debris that enters the assembly 710 to pass easily through the center. Additionally, as shown in FIGS. 72A-76 and 82-83, each extrusion assembly 710 may include a top cap 740 inserted into the central opening 722 at the top of the major extrusion 720. The major bushing740 may have a lower portion 744 that inserts into the major extrusion 720 and a central opening 746 that extends through the top cap 740 with a shape that corresponds with the exterior surface 734 of minor extrusion 730. The upper shelf 742 may have a plurality of inward facing grooves 748. These grooves 748 may provide small openings to allow dust and debris to pass through, such that the dust may travel along the inside of the extrusion assembly 710 without affecting the sliding movement of the minor extrusion 730 and allowing the minor extrusion 730 to move freely relative to the major extrusion 720. Similarly, the minor bushing 704 may have a lower portion 703 that is inserted into the opening 732 of the minor extrusion 730, an upper shelf 708 that rests on top of the minor extrusion 730, and a central opening 707 to receive the tertiary extrusion 760. The upper cap 704 may have all of the features discussed above of the top cap 740 such the plurality of inward facing grooves 705 to allow dust and debris to pass through, such that the dust may travel along the inside of the extrusion assembly 710 without affecting the sliding movement of the tertiary extrusion 760 and allowing the tertiary extrusion 760 to move freely relative to the minor extrusion 730.

Figure 84:
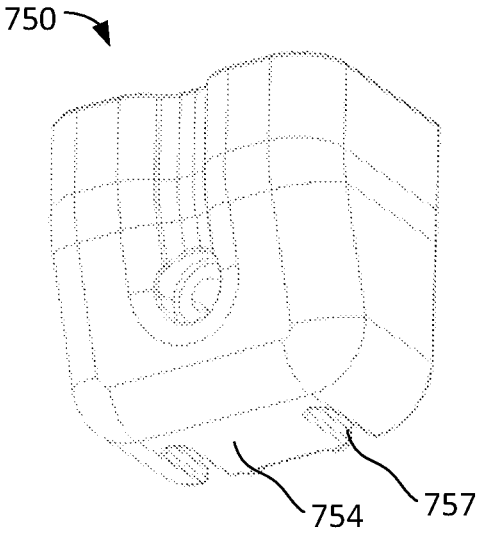
FIG. 84 is a perspective view of the bottom cap of the trolley handle assembly of FIG. 72A according to one or more aspects described herein.

Additionally, as shown in FIG. 84, each bottom cap 750 of the trolley assembly 700 may provide a means to allow dirt and debris to exit each extrusion assembly 710. In addition, the bottom cap 750 may include at least one opening 757 through the bottom surface 754 to allow dirt and debris to exit the extrusion assembly 710.

Figure 85:
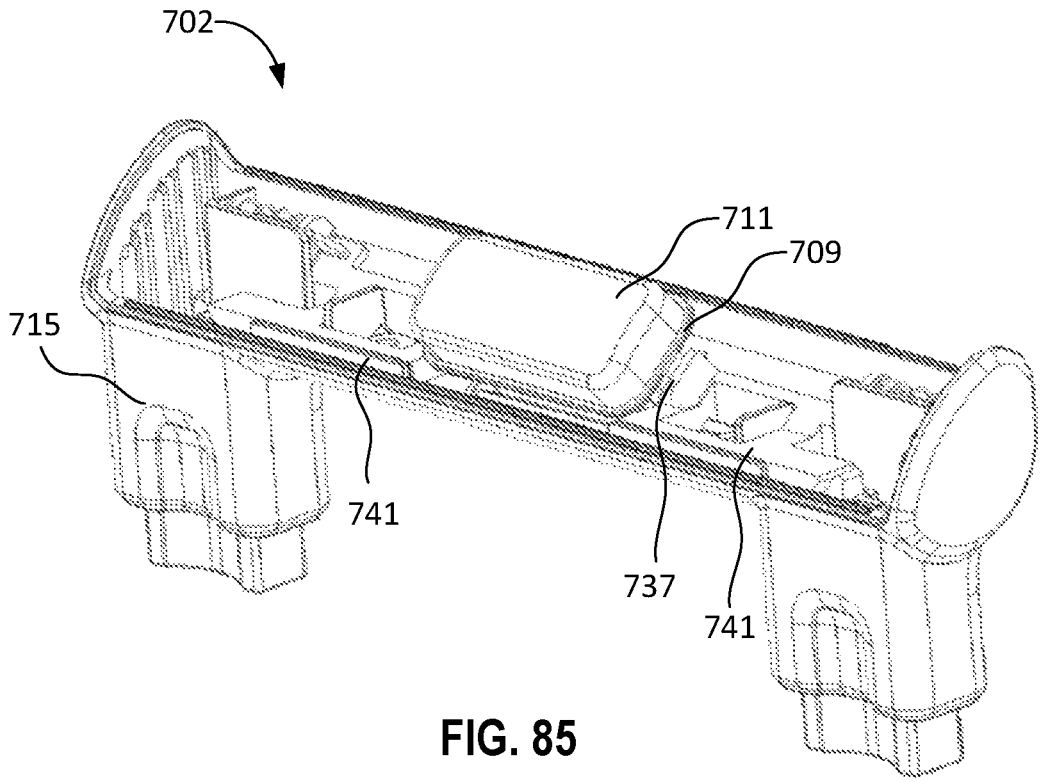
FIG. 85 is a front perspective view of the grip portion of the trolley handle assembly of FIG. 72A with some components removed according to one or more aspects described herein.
Figure 86:
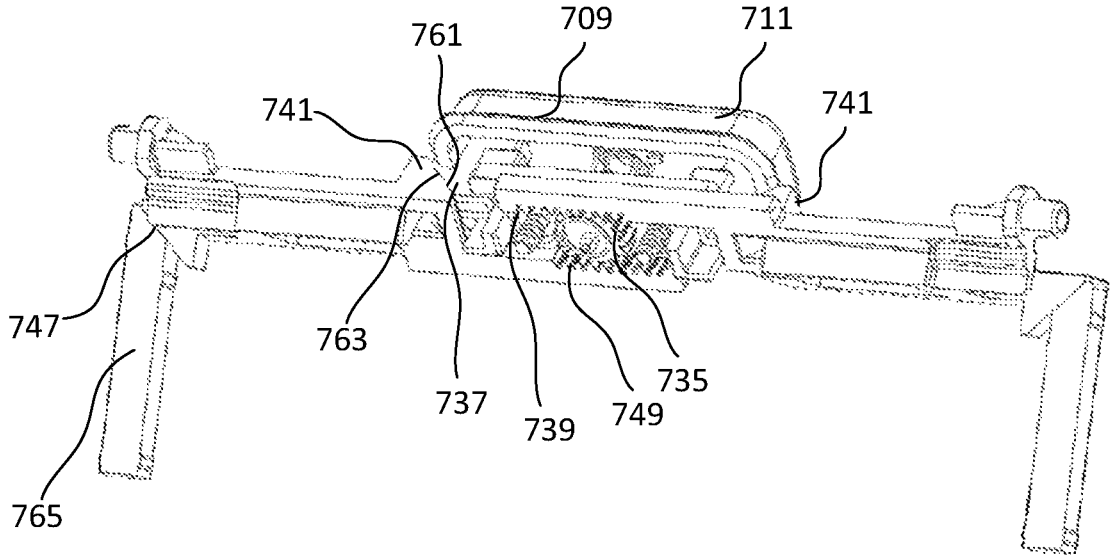
FIG. 86 is a rear perspective view of the grip portion of the trolley handle assembly of FIG. 72A with some components removed according to one or more aspects described herein.

FIGS. 85-86 illustrate an exemplary grip or handle 702 of the trolley handle assembly 700. The features of grip 702 are referred to using similar reference numerals under the "7*xx*" series of reference numerals, rather than "4*xx*" as used in the embodiments of FIGS. 1-70. Accordingly, certain features of grip portion 702 that were already described above as shown in FIGS. 1-70 may be described in lesser detail, or may not be described at all. As discussed above the grip portion 702 may extend between the extrusion assemblies 710 and act as the interface for a user to extend and lower the trolley handle assembly 700. The grip 702 may include a release button 711, an upper grip housing (not shown), and a lower grip housing 715. The release button 711 may be centrally located in both a horizontal and vertical direction along the grip 702. A seal 709 may be arranged around the release button 711 to prevent any dirt or moisture from entering into the grip portion 702. For example, the release button 711 may be over-molded with a rubber or soft polymer material. In addition to or optionally, the seal 709 may also include a wiper gasket around the perimeter of the base of the release button 711.

Similar to grip portion 402, the release button 711 may be coupled to a rack and pinion gear assembly 735 as shown in FIG. 86 that has with the upper grip housing and the lower grip housing 715 removed. The release button 711 may have two lower engaging members 737 on each end of the button 711 that contact an engaging member 741 located on each of a pair of rack gear members 739. As the button 711 is pushed, the lower engaging members 737, which may have an angled surface 761, may contact and slide along a corresponding angled surface 763 of the engaging member 741 on the rack gear member 739. As the angled surfaces 761, 763 move along one another, both of the rack gear members 739 be urged to move outward. The pinion gear 749 may help to keep the movement between both gear members 739 equal and in a controlled manner. As the gear members 739 move outward, the transmitting members 747 may then apply a force to the activating members 765 located in a slot positioned within the lower extension 717. The transmitting member 747 may include an angled surface that contacts an angled surface on activating member 765. Activating member 765 may connect to the push rod 793 to disengage a locking mechanism allowing the grip 702 to be pulled upward e the extrusion assemblies 710.

In some embodiments, this disclosure relates to a suitcase comprising a lid rotatably connected to a base, where the lid may include an upper shell formed as a unitary member and where the base includes a lower shell formed as a unitary member. The suitcase may be configured in an open orientation or a closed configuration, where in the closed configuration, a plurality of latch assemblies secure the lid to the base. In addition, the upper shell and the lower shell may be free of apertures or openings extending from an exterior surface through an interior surface. As another option, the latch assemblies may be located within an upper latch recess and a lower latch recess located on the lid and base respectively. Additionally, a wheel assembly comprising a housing, a wheel, and an axle may be formed as a separate member and received in a recess formed on the lower shell.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

What is claimed is:

1. A suitcase comprising:

a base, the base including:

a first shell structure having a first side and a second side opposite the first side, wherein the first shell structure has a first end and a second end and wherein the first shell structure has a first outward facing surface and a second outward facing surface, wherein the second outward facing surface is offset a first fixed distance from the first outward facing surface;

a bottom portion connected to a first end of the first shell structure;

a first interior void defined by the first shell structure and the bottom portion;

a lid rotatably connected to the base, the lid including:

a second shell structure having a third side and a fourth side opposite the third side, the second shell structure having a third end and a fourth end; wherein the second shell structure has a third outward facing surface and a fourth outward facing surface, wherein the fourth outward facing surface is offset a second fixed distance from the third outward facing surface;

a top portion connected to the third end of the second shell structure; and an extendable trolley handle assembly, the trolley handle assembly including:

a pair of extrusion assemblies, wherein a first extrusion assembly of the pair of extrusion assemblies includes a first major extrusion and a first minor extrusion, wherein the first minor extrusion is nested within a central opening of the first major extrusion, and slidably engaged with the first major extrusion, wherein the central opening of the first major extrusion is surrounded by an outer wall, and the first major extrusion includes a channel adjacent to one side of the central opening and extending parallel to the central opening, and wherein the central opening and the channel extend along a length of the first major extrusion;

wherein a portion of the outer wall of the first major extrusion is located between the channel and the central opening of the first major extrusion separating the central opening from the channel, and an outer channel wall is connected to the outer wall;

a grip portion connected to the first minor extrusion, wherein the first extrusion assembly is at least partially secured to the base by a plurality of mounting clips, wherein the plurality of mounting clips is secured within a trolley handle recess that is positioned along the bottom portion of the base, wherein the trolley handle recess is offset below an exterior surface of the bottom portion; and wherein a first mounting clip of the plurality of mounting clips engages a first receiver located in the outer channel wall of the first major extrusion and a portion of the first mounting clip is located within the channel of the first major extrusion, wherein the first receiver comprises a slot.

2. The suitcase of claim 1, wherein the plurality of mounting clips are evenly spaced apart within the trolley handle recess.

3. The suitcase of claim 2, wherein each mounting clip is secured within a pocket located within the trolley handle recess.

4. The suitcase of claim 1, wherein each mounting clip of the plurality of mounting clips includes a central body with a top end, a bottom end, a front side, a rear side, and an outer spring arm.

5. The suitcase of claim 1, wherein the first major extrusion includes a second receiver that engages a second mounting clip of the plurality of mounting clips, and wherein an outer spring arm of the first mounting clip engages the outer channel wall to keep the outer channel wall in contact with a rear side of the first mounting clip to secure the first major extrusion to the base.

6. The suitcase of claim 5, wherein a number of receivers on the first major extrusion is equal to a number of outer spring arms on the plurality of mounting clips.

7. The suitcase of claim 1, wherein a bottom cap is attached to the trolley handle recess and contacts the first major extrusion to prevent the first major extrusion from moving in a direction toward a plane created by axes of a plurality of wheels.

8. The suitcase of claim 1, wherein the trolley handle assembly further comprises a major bushing positioned between the first major extrusion and the first minor extrusion, wherein the major bushing includes an upper lip that contacts an end surface of the first major extrusion and the central opening that receives the first minor extrusion, and wherein the upper lip has a plurality of inward facing grooves.

9. The suitcase of claim 1, wherein the trolley handle recess has a depth that is greater than a thickness of the first major extrusion.

10. The suitcase of claim 1, wherein the slot forming the first receiver extends outwardly from a central slot in the outer channel wall of the first major extrusion.

11. The suitcase of claim 1, wherein a lower edge of the first receiver engages a lower surface of an upper shelf of the first mounting clip.

12. A suitcase comprising:

a base, the base including:

a first shell structure having a first side and a second side opposite the first side, wherein the first shell structure has a first end and a second end and a bottom portion connected to a first end of the first shell structure;

a first interior void defined by the first shell structure and the bottom portion;

a lid rotatably connected to the base, the lid including:

a second shell structure having a third side and a fourth side opposite the third side, the second shell structure having a third end and a fourth end;

a top portion connected to the third end of the second shell structure; and an extendable trolley handle assembly, the trolley handle assembly including:

a pair of extrusion assemblies, wherein a first extrusion assembly of the pair of extrusion assemblies includes a first major extrusion and a first minor extrusion, wherein the first minor extrusion is nested within a central opening of the first major extrusion, and slidably engaged with the first major extrusion, wherein the central opening of the first major extrusion is surrounded by an outer wall, and the first major extrusion includes a channel adjacent to one side of the central opening and extending parallel to the central opening, and wherein the central opening and the channel extend along a length of the first major extrusion;

wherein a portion of the outer wall of the first major extrusion is located between the channel and the central opening of the first major extrusion separating the central opening from the channel, and an outer channel wall is connected to the outer wall;

a grip portion connected to the first minor extrusion, wherein the grip portion includes a release button for the trolley handle assembly, wherein the release button actuates a rack and pinion gear assembly located within the grip portion to allow the trolley handle assembly to extend or contract, wherein one of the pair of extrusion assemblies is at least partially secured to the base by a plurality of mounting clips that are mounted within a trolley handle recess that is positioned along the bottom portion of the base, wherein the trolley handle recess is offset below an exterior surface of the bottom portion; and wherein a first mounting clip of the plurality of mounting clips engages a first receiver located in the outer channel wall of the first major extrusion and a portion of the first mounting clip is located within the channel of the first major extrusion, wherein the first receiver comprises a slot.

13. The suitcase of claim 12, wherein the rack and pinion gear assembly includes a pair of rack gear members, wherein each rack gear member includes an engaging member that contacts a portion of the release button, a rack gear portion, wherein each rack gear portion engages a pinion gear to equalize movement of the rack gear members.

14. The suitcase of claim 12, wherein a gasket is positioned around a perimeter of the release button.

15. The suitcase of claim 12, wherein the trolley handle recess has a depth that is greater than a thickness of the first major extrusion.

16. A suitcase comprising:

a base, the base including:

a first shell structure having a first side and a second side opposite the first side, wherein the first shell structure has a first end and a second end and wherein the first shell structure has a first outward facing surface and a second outward facing surface;

a bottom portion connected to a first end of the first shell structure;

a first interior void defined by the first shell structure and the bottom portion;

a lid rotatably connected to the base, the lid including:

a second shell structure having a third side and a fourth side opposite the third side, the second shell structure having a third end and a fourth end;

a top portion connected to the third end of the second shell structure; and an extendable trolley handle assembly, the trolley handle assembly including:

a pair of extrusion assemblies, wherein a first extrusion assembly of the pair of extrusion assemblies includes a first major extrusion and a first minor extrusion, wherein the first minor extrusion is nested within a central opening of the first major extrusion, and slidably engaged with the first major extrusion, and a second extrusion assembly of the pair of extrusion assemblies includes a second major extrusion and a second minor extrusion, wherein the second minor extrusion is nested within a central opening of the second major extrusion, and slidably engaged with the second major extrusion;

wherein the central opening of the first major extrusion is surrounded by an outer wall, and the first major extrusion includes a channel adjacent to one side of the central opening and extending parallel to the central opening, and wherein the central opening and the channel extend along a length of the first major extrusion;

wherein a portion of the outer wall of the first major extrusion is located between the channel and the central opening of the first major extrusion separating the central opening from the channel, and an outer channel wall is connected to the outer wall;

a grip portion extending between the pair of extrusion assemblies connecting the pair of extrusion assemblies, wherein the first extrusion assembly is at least partially secured to the base by a first plurality of mounting clips that are mounted to the base and the second extrusion assembly is at least partially secured to the base by a second plurality of mounting clips that are mounted to the base; and wherein each mounting clip of the first plurality of mounting clips and the second plurality of mounting clips includes a central body with a top end, a bottom end, a front side, a rear side, and a spring arm, wherein the first plurality of mounting clips are attached to the base within a first trolley handle recess that is positioned along a third outward facing surface of the bottom portion of the base and the second plurality of mounting clips are attached to the base within a second trolley handle recess that is positioned along the third outward facing surface of the bottom portion of the base, wherein the first trolley handle recess and the second trolley handle recess are offset below the third outward facing surface of the bottom portion; and wherein a first mounting clip of the first plurality of mounting clips engages a first receiver located in the outer channel wall of the first major extrusion and a portion of the first mounting clip is located within the channel of the first major extrusion, wherein the first receiver comprises a slot.

17. The suitcase of claim 16, wherein the first extrusion assembly further includes a tertiary extrusion that is nested within a central opening of the first minor extrusion, and slidably engaged with the first minor extrusion.

18. The suitcase of claim 16, wherein the first trolley handle recess is substantially parallel to the second trolley handle recess.

19. The suitcase of claim 16, wherein a first bottom cap is positioned in the first trolley handle recess and contacts the first major extrusion of the first extrusion assembly to prevent the first major extrusion from moving within the first trolley handle recess in a direction toward a plane created by axes of a plurality of wheels, and wherein the first bottom cap includes an opening in a bottom surface.

20. The suitcase of claim 16, wherein the first extrusion assembly further includes a major bushing positioned between the first major extrusion and the first minor extrusion, wherein the major bushing includes an upper lip that contacts an end surface of the first major extrusion and the central opening that receives the first minor extrusion, and wherein the upper lip has a plurality of inward facing grooves.

21. The suitcase of claim 16, wherein the first trolley handle recess has a depth that is greater than a thickness of the first major extrusion of the first extrusion assembly.

* * * * *